US012522464B2

(12) United States Patent
Vegliante et al.

(10) Patent No.: US 12,522,464 B2
(45) Date of Patent: Jan. 13, 2026

(54) CONTAINER WITH CUTTER

(71) Applicant: Cutting Edge Packaging Solutions, LLC, Sarasota, FL (US)

(72) Inventors: Paul Vegliante, Sarasota, FL (US); Patrick Boyle, Stamford, CT (US)

(73) Assignee: Cutting Edge Packaging Solutions, LLC, Sarasota, FL (US)

( * ) Notice: Subject to any disclaimer, the term of this patent is extended or adjusted under 35 U.S.C. 154(b) by 0 days.

(21) Appl. No.: 18/652,091

(22) Filed: May 1, 2024

(65) Prior Publication Data

US 2024/0279019 A1 Aug. 22, 2024

Related U.S. Application Data

(63) Continuation of application No. 17/691,278, filed on Mar. 10, 2022, now abandoned, which is a (Continued)

(51) Int. Cl.
*B65H 35/00* (2006.01)
*B65H 35/06* (2006.01)

(52) U.S. Cl.
CPC ..... *B65H 35/0086* (2013.01); *B65H 35/06* (2013.01); *B65H 2301/51512* (2013.01); (Continued)

(58) Field of Classification Search
CPC ..... Y10T 83/8822; B65H 35/0086; B65H 2701/1752; B65H 2301/5154; (Continued)

(56) References Cited

U.S. PATENT DOCUMENTS 1,827,029 A 10/1931 Marcalus
2,115,891 A 5/1938 Tishler
(Continued)

FOREIGN PATENT DOCUMENTS

CA 2156643 A1 2/1997
EP 1475027 A2 11/2004
(Continued)

OTHER PUBLICATIONS

Office Action mailed Nov. 12, 2021, issued in connection with U.S. Appl. No. 16/825,783 (12 pages).
(Continued)

*Primary Examiner* — Laura M Lee
(74) *Attorney, Agent, or Firm* — McCarter & English, LLP

(57) ABSTRACT

Roll-dispensed stock containers are provided. The roll-dispensed stock containers can include a first slot extending along a support wall of the container and a second slot in as lid extending over the support wall. A slidable cutter is movable along the first and second slots in the support wall and the lid. The slidable cutter includes a top portion, a base portion, and a blade portion disposed therebetween, the top portion of the slidable cutter positioned above the lid, the base portion positioned below the support wall, and the blade portion extending through the first and second slots, such that the lid is positioned against the support wall and the roll-dispensed stock is positioned therebetween during cutting.

8 Claims, 87 Drawing Sheets

Related U.S. Application Data continuation-in-part of application No. 16/825,783, filed on Mar. 20, 2020, now Pat. No. 11,639,281, which is a continuation-in-part of application No. 16/689,059, filed on Nov. 19, 2019, now Pat. No. 12,404,138, and a continuation-in-part of application No. 15/832,953, filed on Dec. 6, 2017, now Pat. No. 10,894,688, and a continuation-in-part of application No. 15/399,863, filed on Jan. 6, 2017, now Pat. No. 10,836,558, and a continuation-in-part of application No. 15/358,816, filed on Nov. 22, 2016, now abandoned, application No. 18/652,091, filed on May 1, 2024 is a continuation-in-part of application No. 17/981,199, filed on Nov. 4, 2022, now abandoned, which is a continuation of application No. 16/825,783, filed on Mar. 20, 2020, now Pat. No. 11,639,281, application No. 18/652,091, filed on May 1, 2024 is a continuation-in-part of application No. 18/138,430, filed on Apr. 24, 2023, now abandoned, which is a continuation of application No. 17/152,590, filed on Jan. 19, 2021, now Pat. No. 11,634,295, which is a continuation of application No. 15/832,953, filed on Dec. 6, 2017, now Pat. No. 10,894,688.

(52) U.S. Cl.
CPC ..... *B65H 2301/51532* (2013.01); *B65H 2301/5154* (2013.01)

(58) Field of Classification Search
CPC ..... B26D 1/045; B26D 1/065; B26D 7/015; B26D 7/14; B65D 43/16
See application file for complete search history.

(56) References Cited

U.S. PATENT DOCUMENTS 2,118,380 A 5/1938 Gresenz
2,713,939 A 7/1955 Lear
2,743,009 A 4/1956 Williamson et al.
3,071,034 A 1/1963 Castelli
3,079,827 A 3/1963 Catelli
3,153,853 A 10/1964 Lipton
3,165,283 A 1/1965 Kaiser et al.
3,301,117 A 1/1967 Spaulding
3,477,624 A 11/1969 Branyon et al.
3,549,066 A 12/1970 Wankow
3,561,312 A 2/1971 Jones
3,974,947 A 8/1976 Budny
4,104,108 A * 8/1978 Kishida ..... B31B 70/00 156/583.9
4,156,382 A 5/1979 Baker
4,197,774 A 4/1980 Singh et al.
D255,779 S 7/1980 Clatterbuck
4,210,043 A 7/1980 Urion et al.
4,238,065 A 12/1980 Ragsdale
4,340,162 A 7/1982 Heiman et al.
4,346,829 A 8/1982 Myers
4,417,495 A 11/1983 Gordon et al.
4,586,639 A 5/1986 Ruff et al.
4,699,031 A 10/1987 D'Angelo et al.
D293,211 S 12/1987 DePaul et al.
4,960,022 A 10/1990 Chuang
5,292,046 A 3/1994 Kaiser et al.
D347,345 S 5/1994 Kaiser et al.
5,322,001 A 6/1994 Boda
5,440,961 A 8/1995 Lucas, Jr. et al.
5,658,179 A 8/1997 Glydon et al.
5,772,094 A 6/1998 Kaiser et al.
D396,978 S 8/1998 Kaiser et al.
5,802,942 A 9/1998 Cornell et al.
5,936,652 A 8/1999 Narayan et al.
5,941,476 A 8/1999 Copass
6,223,639 B1 5/2001 Chen
6,269,970 B1 8/2001 Huang et al.
D447,685 S 9/2001 Chagnon et al.
D504,314 S 4/2005 Kim
6,931,974 B2 8/2005 Tseng
D540,187 S 4/2007 Duffy
7,299,731 B2 11/2007 Schulz
7,406,904 B2 8/2008 Antal et al.
7,603,937 B2 10/2009 Pavlik et al.
7,694,617 B2 * 4/2010 Habra ..... B26D 1/065 83/578
7,845,261 B2 12/2010 Chiang
7,918,151 B2 4/2011 Vegliante et al.
7,921,756 B2 4/2011 Vegliante et al.
D643,747 S 8/2011 Rye et al.
7,987,758 B2 8/2011 Chabansky
D700,837 S 3/2014 Antal, Sr.
8,684,228 B2 4/2014 Parker
D727,170 S 4/2015 Lokey et al.
D728,258 S 5/2015 Cohen
D778,149 S 2/2017 Frick
9,604,382 B2 3/2017 Vegliante et al.
D787,324 S 5/2017 Sotka
D787,931 S 5/2017 Beck et al.
D815,522 S 4/2018 Vegliante
D873,659 S 1/2020 Vegliante
10,836,558 B2 11/2020 Vegliante
10,894,688 B2 1/2021 Vegliante
10,959,580 B2 3/2021 Vegliante
11,407,580 B2 8/2022 Vegliante
11,634,295 B2 4/2023 Vegliante
2002/0023526 A1 2/2002 Vegliante et al.
2002/0056785 A1 5/2002 Newman et al.
2002/0096031 A1 7/2002 Yang
2002/0117038 A1 8/2002 Vegliante et al.
2003/0127352 A1 7/2003 Buschkiel et al.
2003/0140760 A1 * 7/2003 Bory ..... B65H 35/002 83/175
2004/0040429 A1 3/2004 Nichols et al.
2004/0237746 A1 * 12/2004 Schultz ..... B65H 35/0086 83/614
2005/0005755 A1 1/2005 Turvey et al.
2005/0034585 A1 2/2005 Antal
2005/0035133 A1 * 2/2005 Gerulski ..... B26D 1/065 83/614
2005/0166738 A1 8/2005 Hsu
2005/0223863 A1 10/2005 Volfson et al.
2006/0156885 A1 7/2006 Wu
2006/0202079 A1 9/2006 Pavlik
2006/0237579 A1 10/2006 Doubleday et al.
2007/0000935 A1 1/2007 Pavlik et al.
2007/0004598 A1 1/2007 Maeda
2007/0044617 A1 3/2007 Pavlik
2007/0125214 A1 6/2007 Dong et al.
2007/0173394 A1 7/2007 Lee
2008/0005882 A1 1/2008 Kaiser et al.
2008/0073371 A1 3/2008 Neiberger et al.
2008/0142379 A1 6/2008 Gnatenko
2009/0188366 A1 7/2009 Habra et al.
2010/0032445 A1 2/2010 Bunoz
2010/0168685 A1 7/2010 Drown
2011/0209594 A1 9/2011 Withers
2011/0214544 A1 9/2011 Vegliante et al.
2012/0267387 A1 10/2012 Omdoll et al.
2014/0096659 A1 4/2014 Choi
2015/0203313 A1 7/2015 Kaiser
2015/0239615 A1 8/2015 O'Donnell et al.
2015/0344256 A1 12/2015 Kaiser et al.
2016/0051330 A1 2/2016 Cosentino, II
2017/0151687 A1 6/2017 Vegliante et al.
2018/0141742 A1 5/2018 Vegliante
2018/0141743 A1 5/2018 Vegliante
2019/0167047 A1 6/2019 Vegliante
2019/0168985 A1 6/2019 Vegliante
2020/0011114 A1 1/2020 Gerstein
2020/0087099 A1 3/2020 Vegliante et al.
2020/0208073 A1 7/2020 Nowak et al.
2020/0283254 A1 9/2020 Vegliante et al.

(56) References Cited

U.S. PATENT DOCUMENTS

| | | | |
|---|---|---|---|
| 2021/0139266 | A1 | 5/2021 | Vegliante |
| 2021/0214150 | A1 | 7/2021 | Vegliante |
| 2022/0073263 | A1 | 3/2022 | Vegliante |
| 2022/0194734 | A1 | 6/2022 | Vegliante et al. |
| 2023/0056530 | A1 | 2/2023 | Vegliante et al. |
| 2023/0257226 | A1 | 8/2023 | Vegliante |
| 2024/0199311 | A1 | 6/2024 | Vegliante |

FOREIGN PATENT DOCUMENTS

| | | | |
|---|---|---|---|
| FR | 2895985 | A1 | 7/2007 |
| JP | 1086937 | | 4/1998 |
| JP | 200131077 | A | 2/2001 |
| KR | 19980068958 | U | 12/1998 |
| KR | 200153428 | Y1 | 8/1999 |
| KR | 200169841 | Y1 | 2/2000 |
| KR | 20100010691 | U | 11/2010 |
| KR | 200458830 | Y1 | 2/2012 |
| KR | 20130010454 | A | 1/2013 |
| KR | 20130135058 | A | 12/2013 |
| KR | 200473478 | Y1 | 7/2014 |
| KR | 20140089688 | A | 7/2014 |
| KR | 20160033516 | A | 3/2016 |
| KR | 101907354 | B1 | 10/2018 |

OTHER PUBLICATIONS

Plastic Wrap Dipenser Saran Wrap Cutter [online] Published on Oct. 14, 2014 from URL: https://wowbeli.com/plastic-wrap-dispenser-saran-wrap-cutter-poly-bags-cling-film-food-storage-containers-kitchen-accessories-supplies-products/ (8 pages).
Plastic Wrap Dispenser by ChicWrap [online] Retrieved Oct. 16, 2017 from URL: https://www.everythingkitchens.com/chicwrap-plastic-wrap-dispenser-modern-silver-dots-9914.html?utm_source=google&utm_medium=cse&utem_term=9914&gclid=EAlalQobChMI0_O9wZf11glVil6GCh1OXQCdEAQYCCABEgK_zPD-BwE (5 pages).
Office Action mailed Oct. 30, 2017, issued in connection with U.S. Appl. No. 29/585,274 (6 pages).
Notice of Allowance mailed Dec. 19, 2017, issued in connection with U.S. Appl. No. 29/585,274 (5 pages).
International Search Report of the International Searching Authority mailed on Jan. 30, 2018, issued in connection with International Application No. PCT/US2017/062770 (3 pages).
Written Opinion of the International Searching Authority mailed on Jan. 30, 2018, issued in connection with International Application No. PCT/US2017/062770 (8 pages).
Office Action mailed Mar. 4, 2019, issued in connection with U.S. Appl. No. 15/832,953 (16 pages).
Written Opinion of the International Searching Authority mailed on Feb. 26, 2019, issued in connection with International Application No. PCT/US2018/64234 (4 pages).
Search Report of the International Searching Authority mailed on Feb. 26, 2019, issued in connection with International Application No. PCT/US2018/64234 (3 pages).
International Search Report of the International Searching Authority mailed on Feb. 27, 2019, issued in connection with International Application No. PCT/US2018/64241 (3 pages).
Written Opinion of the International Searching Authority mailed on Feb. 27, 2019, issued in connection with International Application No. PCT/US2018/64241 (9 pages).
Office Action mailed May 28, 2019, issued in connection with U.S. Appl. No. 15/832,989 (16 pages).
Office Action mailed Jun. 5, 2019, issued in connection with U.S. Appl. No. 15/399,863 (9 pages).
Office Action mailed Jun. 5, 2019, issued in connection with U.S. Appl. No. 15/358,816 (7 pages).
Applicant-Initiated Interview Summary mailed Jun. 12, 2019, issued in connection with U.S. Appl. No. 15/832,953 (9 pages).
Notice of Allowance mailed Sep. 20, 2019, issued in connection with U.S. Appl. No. 29/656,548 (11 pages).
Office Action mailed Oct. 24, 2019, issued in connection with U.S. Appl. No. 15/358,816 (8 pages).
Office Action mailed Nov. 21, 2019, issued in connection with U.S. Appl. No. 15/832,953 (20 pages).
Applicant-Initiated Interview Summary mailed Nov. 12, 2019, issued in connection with U.S. Appl. No. 15/358,816 (2 pages).
Office Action mailed Dec. 6, 2019, issued in connection with U.S. Appl. No. 15/832,989 (16 pages).
Office Action mailed Dec. 19, 2019, issued in connection with U.S. Appl. No. 15/358,816 (7 pages).
Office Action mailed Dec. 20, 2019, issued in connection with U.S. Appl. No. 15/399,863 (9 pages).
Examiner-Initiated Interview Summary mailed Dec. 19, 2019, issued in connection with U.S. Appl. No. 15/399,863 (3 pages).
Office Action mailed Jul. 10, 2020, issued in connection with U.S. Appl. No. 15/832,989 (17 pages).
Office Action mailed Jul. 10, 2020, issued in connection with U.S. Appl. No. 15/358,816 (10 pages).
Notice of Allowance mailed Aug. 25, 2020, issued in connection with U.S. Appl. No. 15/399,863 (7 pages).
Examiner-Initiated Interview Summary mailed Sep. 25, 2020, issued in connection with U.S. Appl. No. 15/832,953 (1 page).
Notice of Allowance mailed Sep. 25, 2020, issued in connection with U.S. Appl. No. 15/832,953 (10 pages).
Office Action mailed Jan. 7, 2021, issued in connection with U.S. Appl. No. 15/358,816 (9 pages).
Notice of Allowance mailed Dec. 22, 2020, issued in connection with U.S. Appl. No. 15/832,989 (11 pages).
Office Action mailed Sep. 23, 2021, issued in connection with U.S. Appl. No. 17/152,590 (11 pages).
Office Action mailed Dec. 17, 2021, issued in connection with U.S. Appl. No. 16/689,059 (15 pages).
Office Action mailed Oct. 8, 2021, issued in connection with U.S. Appl. No. 17/218,055 (7 pages).
Notice of Allowance mailed Mar. 28, 2022, issued in connection with U.S. Appl. No. 17/218,055 (8 pages).
Office Action mailed Jun. 1, 2022, issued in connection with U.S. Appl. No. 16/825,783 (14 pages).
Applicant-Initiated Interview Summary mailed Jun. 30, 2022, issued in connection with U.S. Appl. No. 16/825,783 (2 pages).
Office Action mailed Jul. 1, 2022, issued in connection with U.S. Appl. No. 17/152,590 (8 pages).
Office Action mailed Sep. 20, 2022, issued in connection with U.S. Appl. No. 17/530,876 (6 pages).
Office Action mailed Oct. 5, 2022, issued in connection with U.S. Appl. No. 16/689,059 (16 pages).
Notice of Allowance mailed Nov. 18, 2022, issued in connection with U.S. Appl. No. 17/152,590 (7 pages).
Notice of Allowance mailed Nov. 21, 2022, issued in connection with U.S. Appl. No. 16/825,783 (7 pages).
Copy of Applicant-Initiated Interview Summary mailed Dec. 19, 2022, issued in connection with U.S. Appl. No. 17/530,876 (2 pages).
Notice of Allowance mailed Feb. 13, 2023, issued in connection with U.S. Appl. No. 17/152,590 (7 pages).
Office Action mailed Feb. 17, 2023, issued in connection with U.S. Appl. No. 17/530,876 (8 pages).
Notice of Allowance mailed Feb. 27, 2023, issued in connection with U.S. Appl. No. 16/825,783 (7 pages).
Office Action mailed Mar. 16, 2023, issued in connection with U.S. Appl. No. 16/689,059 (20 pages).
Office Action mailed May 16, 2023, issued in connection with U.S. Appl. No. 17/981,199 (15 pages).
International Search Report of the International Searching Authority mailed on Jul. 21, 2023, issued in connection with International Application No. PCT/US2023/15018 (6 pages).
Written Opinion of the International Searching Authority mailed on Jul. 21, 2023, issued in connection with International Application No. PCT/US2023/15018 (9 pages).
Decision on Appeal mailed May 3, 2022, issued in connection with U.S. Appl. No. 15/358,816 (9 pages).

(56) References Cited

OTHER PUBLICATIONS

Office Action mailed Sep. 18, 2023, issued in connection with U.S. Appl. No. 17/530,876 (11 pages).
Office Action mailed Oct. 10, 2023, issued in connection with U.S. Appl. No. 16/689,059 (14 pages).
Office Action mailed Nov. 15, 2023, issued in connection with U.S. Appl. No. 18/138,430 (9 pages).
Office Action mailed Apr. 19, 2024, issued in connection with U.S. Appl. No. 16/689,059 (12 pages).
Office Action mailed Sep. 30, 2024, issued in connection with U.S. Appl. No. 18/416,705 (11 pages).
Office Action mailed Dec. 17, 2024, issued in connection with U.S. Appl. No. 16/689,059 (11 pages).
Applicant-Initiated Interview Summary mailed Feb. 3, 2025, issued in connection with U.S. Appl. No. 16/689,059 (3 pages).
Notice of Allowance mailed Apr. 30, 2025, issued in connection with U.S. Appl. No. 18/416,705 (8 pages).
Notice of Allowance mailed May 1, 2025, issued in connection with U.S. Appl. No. 16/689,059 (9 pages).

* cited by examiner

CONTAINER WITH CUTTER

CROSS-REFERENCE TO RELATED APPLICATION

This application is a continuation application of, and claims priority to, U.S. patent application Ser. No. 17/691,278, filed on Mar. 10, 2022, which is a continuation-in-part application of, and claims priority to, U.S. patent application Ser. No. 16/825,783, filed on Mar. 20, 2020, now U.S. Pat. No. 11,639,281 issued on May 2, 2023, which is a continuation-in-part application of, and claims priority to, U.S. patent application Ser. No. 16/689,059, filed on Nov. 19, 2019, U.S. patent application Ser. No. 15/832,953, filed on Dec. 6, 2017, now U.S. Pat. No. 10,894,688 issued on Jan. 19, 2021, U.S. patent application Ser. No. 15/399,863, filed on Jan. 6, 2017, now U.S. Pat. No. 10,836,558 issued on Nov. 17, 2020, and U.S. patent application Ser. No. 15/358,816, filed on Nov. 22, 2016; this application is also a continuation-in-part application of, and claims priority to, U.S. patent application Ser. No. 17/981,199, filed on Nov. 4, 2022, which is a continuation application of, and claims priority to, U.S. patent application Ser. No. 16/825,783, filed on Mar. 20, 2020, now U.S. Pat. No. 11,639,281 issued on May 2, 2023, which is a continuation-in-part application of, and claims priority to, U.S. patent application Ser. No. 16/689,059, filed on Nov. 19, 2019, U.S. patent application Ser. No. 15/832,953, filed on Dec. 6, 2017, now U.S. Pat. No. 10,894,688 issued on Jan. 19, 2021, U.S. patent application Ser. No. 15/399,863, filed on Jan. 6, 2017, now U.S. Pat. No. 10,836,558 issued on Nov. 17, 2020, and U.S. patent application Ser. No. 15/358,816, filed on Nov. 22, 2016; this application is also a continuation-in-part application of, and claims priority to, U.S. patent application Ser. No. 18/138,430, filed on Apr. 24, 2023, which is a continuation application of, and claims priority to U.S. patent application Ser. No. 17/152,590, filed on Jan. 19, 2021, now U.S. Pat. No. 11,634,295 issued on Apr. 25, 2023, which is a continuation application of, and claims priority to U.S. patent application Ser. No. 18/532,953, filed on Dec. 6, 2017, now U.S. Pat. No. 10,894,688 issued on Jan. 19, 2021, the entire contents of which are all expressly incorporated herein by reference.

FIELD

The present disclosure relates to a cutter and roll-dispensed stock container, and in particular, to roll-dispensed stock containers and cutter assemblies.

BACKGROUND

Various forms of roll-dispensed stock, of different materials, are dispensed from containers, and cut, in various ways. For example, paper (e.g., wrapping or decorative paper) can be pulled from a continuous roll of the same and cut to length with scissors, a straight-edge blade, a serrated edge, a cutting board, or another cutting device. Roll-dispensed stock, such as gift wrapping, wax paper, parchment, and aluminum foil, can be thin and flexible which makes tearing and bunching common problems encountered while trying to cut roll-dispensed stock. Current products that are directed to solving these problem can be large, bulky, and costly and can be unsafe due to exposed cutting implements.

Accordingly, what is needed, but has not yet been developed, are methods and devices for shipping, dispensing and safely cutting roll-dispensed stock materials. These and other needs are addressed by the cutter and roll-dispensed stock containers of the present disclosure.

SUMMARY

In accordance with some aspects of the present disclosure, a roll-dispensed stock container is provided. The container includes a body having a front wall, a rear wall, a bottom wall, side walls, a support wall, and a lid. The front wall, rear wall, bottom wall, support wall, lid, and side walls could form an enclosure configured and dimensioned to receive a roll of roll-dispensed stock. A cutter assembly could be positioned on the lid. The cutter assembly includes an elongated track and a slidable cutter with a blade. The slidable cutter travels along the track to cut the roll-dispensed stock positioned between the lid and the support wall. In accordance with some aspects of the present disclosure, the track can comprise an elongated aperture in the lid, or a plastic rail integrated into the body of the container and positioned on an end thereof. In accordance with aspects of the present disclosure, the container can be configured to dispense, and the cutter assembly can be configured to cut, plastic wrap, foil (e.g., aluminum or tin foil), wax paper, parchment paper, tape, duct tape, wrapping paper, non-woven fabric, and other roll-dispensed stock. One or more fixation strips can be disposed on the support wall and/or on the lid to hold a sheet of roll-dispensed stock in place while the sheet is being cut from the roll. According to some aspects of the present disclosure, the fixation strips can be a coating applied to the support wall and/or on the lid that adheres to the roll-dispensed stock and holds the stock in place during cutting. An opening for dispensing the roll-dispensed stock is exposed when the container is in the open configuration and covered when the container is in the closed configuration.

In accordance with some aspects of the present disclosure, a method for dispensing roll-dispensed stock from the container is provided. The method includes dispensing the roll-dispensed stock from the container, drawing the roll-dispensed stock over the one or more fixation strips, closing the lid on top of the roll-dispensed stock, thereby securely holding the roll-dispensed stock in place, and using the cutter assembly to separate a single sheet of roll-dispensed stock. The roll-dispensed stock is securely held in place by the fixation strips and tension is maintained on the roll-dispensed stock to allow the slidable cutter to easily and cleanly cut therethrough.

According to some aspects of the present disclosure, the cutter assembly includes a base and biased button that, when depressed, causes the blade to move from a retracted position within the base to a deployed position where the blade extends through the base to cut the roll-dispensed stock.

According to some aspects of the present disclosure, the cutter assembly includes a base and a button that slides therealong that, when actuated, causes a blade to move from a retracted position within the base, to a deployed position where the blade extends through the base to cut the roll-dispended stock. The cutter assembly can include a biasing means to maintain the blade in the retracted position until actuated by a user. According to some aspects of the present disclosure, the base of the cutter assembly includes body and a retaining plate that can be attached to the body after insertion through an elongated slot of a container, to secure the cutter assembly within the elongated slot.

According to some aspects of the present disclosure, the base of the cutter assembly can include a retaining means for securing the cutter assembly within the elongated slot. The retaining means can include one or more outwardly biased flanges that are hingedly attached to a bottom of the base.

According to some aspects of the present disclosure, the elongated slot of the container can include an aperture sized to accommodate the base of the cutter assembly, in an orientation other than the direction of travel during operation, to facilitate insertion of the cutter assembly into the elongated slot during assembly of the container.

In accordance with some aspects of the present disclosure, a method for dispensing roll-dispensed stock from a container can include the steps of opening a container lid to access an opening in the body of the container, drawing the roll-dispensed stock out of the body through the opening and over a surface of the container, closing the lid against the surface of the container, applying pressure to a cutter assembly to move a cutting blade from a first retracted position to a second deployed position, sliding the cutter assembly along a length of the lid from a first position to a second position to cut through the roll-dispensed stock, while continuously applying pressure to the cutting assembly to maintain the blade in a deployed position, to separate a portion of the roll-dispensed stock from the roll, and releasing pressure from the cutter assembly to allow the blade to automatically move from the second deployed position back to the first retracted position.

According to certain aspects of the present disclosure, any of the slidable cutter designs can be utilized in connection with other applications, such as a paper cutting board having a sliding cutter assembly positioned on a track that is attached to a cutting surface. According to some aspects of the present disclosure, the cutter assembly can be substantially similar in design and operation to the cutter assemblies disclosed in connection with the roll-dispensed stock containers.

According to some embodiments the present disclosure, a roll-dispensed stock container having a coating disposed on one or more surfaces thereof is provided. The container can include a front wall, a rear wall, a bottom wall, side walls, a support wall, a lid with an elongated slot therein, a slidable cutter disposed within and movable along the slot. One or more fixation strips can be disposed on the support wall to secure the roll-dispensed stock during a cutting operation. The coating can be a film, laminate, or other layer of material and can be provided on one or more surfaces of the container and can be formed from a material selected to reduce surface friction, increase rigidity, disperse forces associated with a cutter, and/or otherwise enhance characteristics of the container. The coating can be provided as a sheet of material, applied in a liquid or gaseous form, or otherwise bonded to the one or more surfaces of the container. According to some embodiments, the coating is formed from a transparent or translucent material such that underlying graphics or other indicia provided on the surfaces of the container can be viewed therethrough.

According to further embodiments of the present disclosure, a roll-dispensed stock container having a support wall configured to accept and retain a slidable cutter is provided. The support wall can include an elongated slot extending along a length thereof and one or more apertures positioned on one or more ends of the elongated slot and in communication therewith. The slidable cutter can include a top portion, a base portion, and a blade extending therebetween, the blade of the slidable cutter travelling within and along an elongated slot in a lid of the container. The one or more apertures are configured to accept the base of the slidable cutter and the elongated slot of the support wall is configured to allow the blade to move therealong, while retaining the base of the slidable cutter thereunder. During a cutting operation, the top portion of the slidable cutter is positioned on a top side of the lid, the base is positioned below the support wall, and the blade extends through the elongated slots of the lid and the support wall, thereby retaining the lid in a closed position against the support wall and/or compressing the roll-dispensed stock between the lid and the support wall. After a cutting operation, the base of the slidable cutter can be moved within an aperture of the support wall, thereby releasing the lid. According to some embodiments, a recessed track is positioned within an elongated aperture of the support wall, the recessed track having flanges configured to support the recessed track within the elongated aperture, allow the blade of the slidable cutter to move therebetween, and retain the base of the slidable cutter thereunder during a cutting operation.

According to still further embodiments of the present disclosure, a roll-dispensed stock container having a slidable cutter assembly positioned in a recessed area is provided. The container can include a body having a front wall, a rear wall, a bottom wall, side walls, a support wall extending from the front wall, and a lid having a front flap and side flaps. The recessed area can be defined by the space between one or more of the support wall, the side walls, and the lid and protects the cutter assembly during shipping or storage of the container. The cutter assembly can include a recessed track positioned within an elongated aperture of the support wall and a slidable cutter movable therealong. According to some embodiments, the cutter assembly could include the slidable cutter positioned within an elongated slot of the support wall and movable therealong. According to other embodiments, the cutter assembly could include a track affixed to a surface of the support wall and a slidable cutter movable therealong.

BRIEF DESCRIPTION OF THE DRAWINGS

To assist those of skill in the art in making and using the disclosed roll-dispensed stock container, reference is made to the accompanying figures, wherein.

DETAILED DESCRIPTION

It should be understood that the relative terminology used herein, such as "front", "rear," "left," "top," "bottom," "vertical," and "horizontal" is solely for the purposes of clarity and designation and is not intended to limit the invention to embodiments having a particular position and/or orientation. Accordingly, such relative terminology should not be construed to limit the scope of the present invention. In addition, it should be understood that the invention is not limited to embodiments having specific dimensions.

Figure 1:
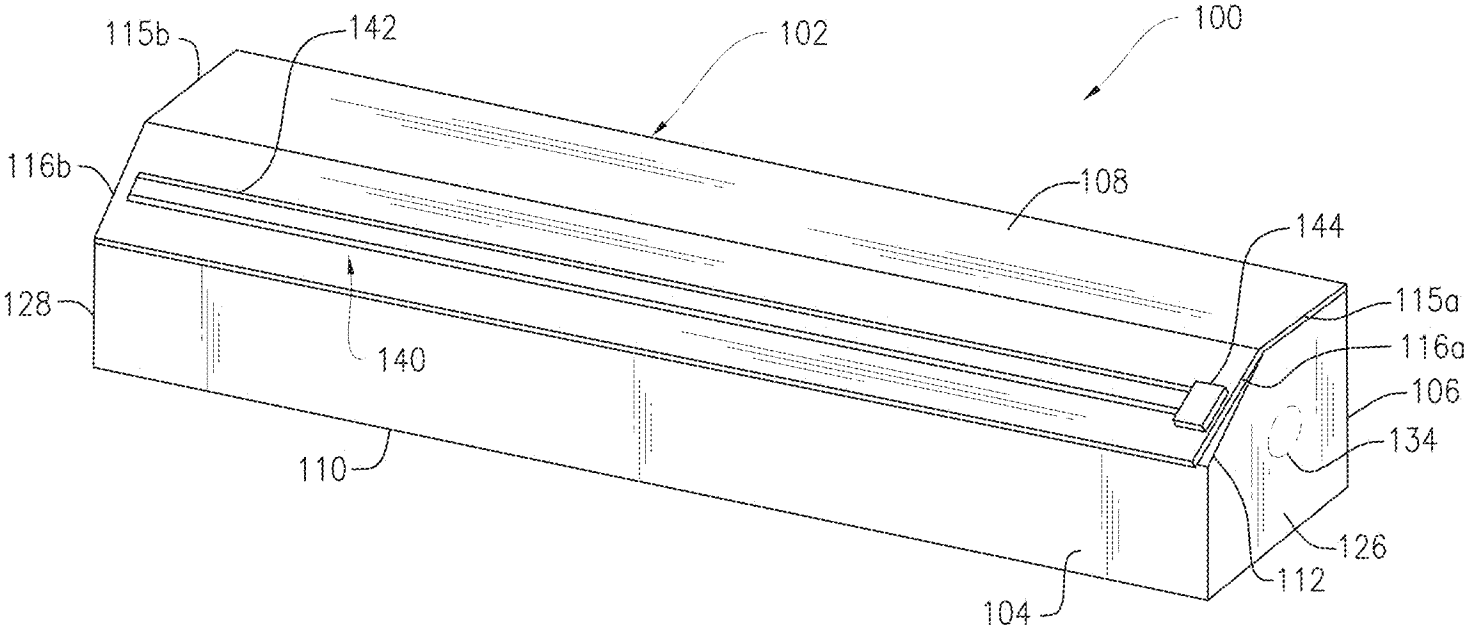
FIG. 1 is a perspective view of a roll-dispensed stock container according to the present disclosure.
Figure 2:
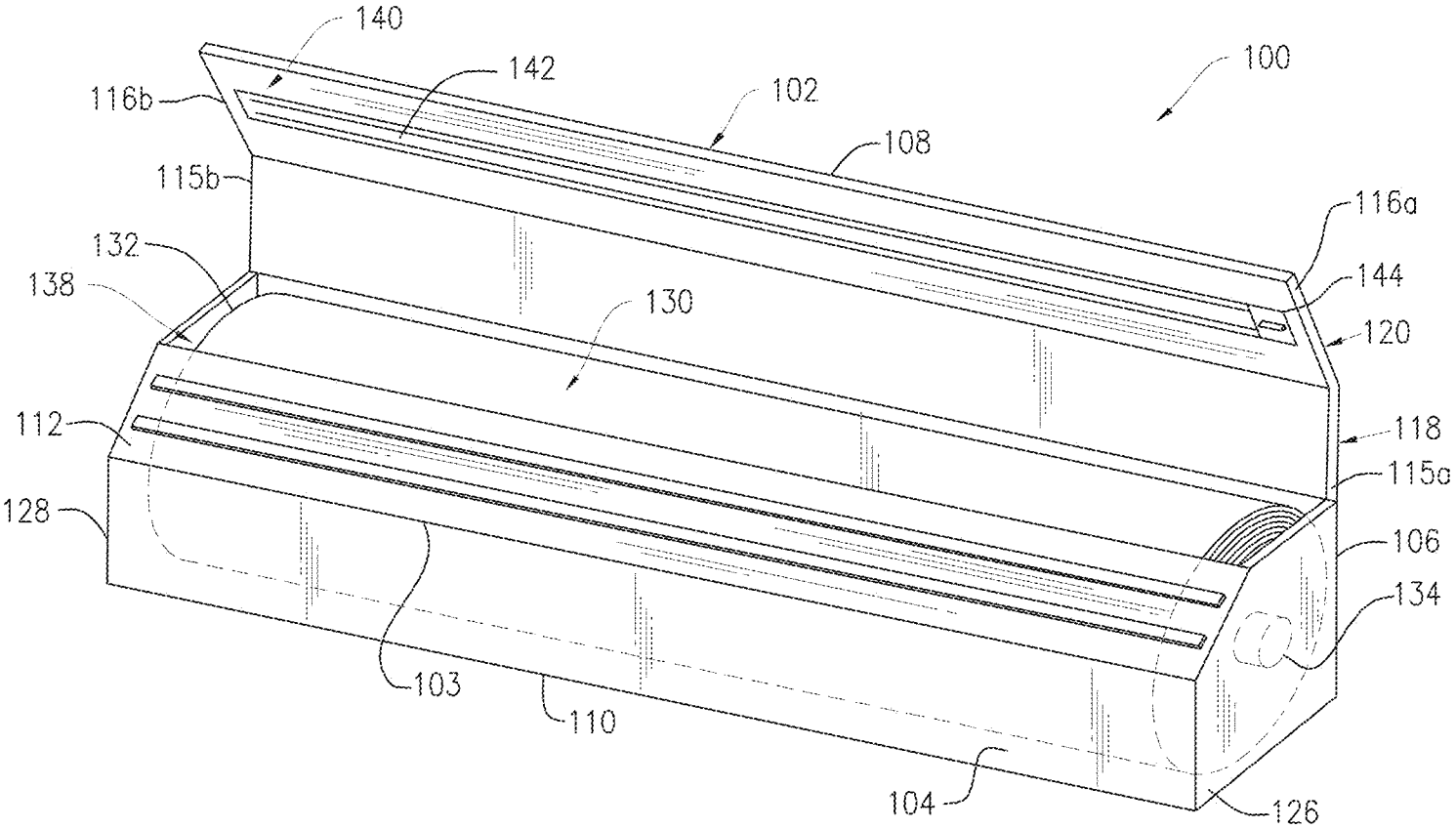
FIG. 2 is a perspective view of the roll-dispensed stock container of FIG. 1 in an open configuration.

FIGS. 1 and 2 show a roll-dispensed stock container (hereinafter "container 100") according to the present disclosure. More specifically, FIG. 1 is a perspective view of the container 100 in a closed configuration and FIG. 2 is a perspective view of the container 100 in an open configuration. The container 100 includes a body 102 including a front wall 104, a rear wall 106, a bottom wall 110, side walls 126,128, a support wall 112, and a lid 108. The body 102 could be formed from a blank (e.g., a continuous piece of material having a substantially planar configuration prior to folding) having multiple perforated lines or fold lines for folding the blank into the configuration of the body 102 of container 100 as shown. The container 100 could be formed from cardboard, plastic, wood, or any other material known to those of ordinary skill in the art that is suitably rigid and durable for receiving and dispensing roll-dispensed stock 132.

The first and second side walls 126, 128 are each connected to edges of the front, rear, and bottom walls 104, 106, and 110 to form a receptacle for holding roll-dispensed stock. The orientation of the first and second side walls 126, 128 and the front, rear, and bottom walls 104, 106, and 110 could be at substantially right angles with respect to adjoining walls. Further, the height of the front wall 104 could be less than the height of the rear wall 106, and the support wall 112 could be joined to a top edge 103 of the front wall 104 and disposed at an angle relative thereto. The support wall 112 could be fixed in position or movable with respect to the top edge 103 of the front wall 104 to allow for roll-dispensed stock 132 to be refilled into the body 102 for re-use.

As shown in FIG. 1, the lid 108 could be hingedly joined to and extend from a top edge of the rear wall 106, over support wall 112, and to the top edge 103 front wall 104. The lid 108 could have a first portion 118 having edges 115*a* and 115*b*, and a second portion 120 having edges 116*a* and 116*b*. The front wall 104, rear wall 106, bottom wall 110, lid 108, support wall 112, and side walls 126, 128 form an enclosure 130 within the body 102 configured and dimensioned to receive a roll of roll-dispensed stock 132 with an opening 138 for dispensing the roll-dispensed stock that is exposed when the container 100 is in the open configuration and obstructed when the container 100 is in the closed configuration.

As shown in FIG. 2, the lid 108 extends over the support wall 112, the underside of the lid 108 extending over the upper side of the support wall 112. The lid 108 could extend entirely or partially over the support wall 112. The first portion 118 and the second portion 120 could be hingedly connected so that the second portion 120 extends to cover the support wall 112 and is positionable so that the second portion 120 is parallel to the plane of the support wall 112. Either or both of the support wall 112 and the lid 108 could have one or more grippers, such as fixation strips 114, for maintaining the position of the roll-dispensed stock 132 prior to cutting. A retainer feature 134 could be in the form of one or more cylinders provided on side walls 126 and 128, or perforated or partially perforated sections configured to be pushed into the enclosure 130, to maintain the position of the roll of roll-dispensed stock 132 within the enclosure 130 of the body 102. The location of the feature 134, if included, defines the approximate axis of rotation for the roll-dispensed stock 132. In another aspect of the present disclosure, the feature 134 can be in the form of an extension mounted to the inner surface of the first and second side walls 126, 128 configured to engage and maintain the position of the roll of roll-dispensed stock 132 within the enclosure 130 (see, e.g., FIG. 2).

The container 100 includes a cutter assembly 140 attached to the body 102. As shown in FIG. 1, the cutter assembly 140 is attached to the lid 108 and includes an elongated track 142 and a slidable cutter 144 with a blade or serrated edge. The slidable cutter 144 could also include an engagement face 164 shaped to receive a finger of a user and pressure therefrom, discussed hereinbelow. The track 142 can be attached to the lid 108 with adhesive or by welding, and the slidable cutter 144 travels along the track 142 to cut the roll-dispensed stock 132 positioned between the lid 108 and support wall 112. The cutter assembly 140 can be provided in any desirable shape. As shown, the cutter assembly 112 extends through the lid 108 and includes a button on the outside of the lid 108, a retainer under the lid 108, and a blade that extends through the lid 108.

In accordance with some aspects of the present disclosure, the container 100 can be configured to dispense, and the cutter assembly 140 can be configured to cut, plastic wrap, foil (e.g., aluminum or tin foil), wax paper, parchment paper, tape, duct tape, wrapping paper, and other materials capable of being delivered as roll-dispensed stock. Further, it is contemplated that any of the containers of the present disclosure (e.g., containers 100, 200, 300, 400, 500, 600, 700, and 800 described herein) could be configured to dispense and cut any of the roll-dispensed stock described herein.

As shown in FIG. 1, the cutter assembly 140 could fit within an area defined by the space under the right angle formed by the intersection of the planes extending from the front wall and the first portion 118 of the lid 108 when the lid 108 is in a closed position, and thus the cutter assembly 140 would not extend beyond the bounds of the container 100 so configured. The cutter assembly 140 is thereby protected from damage during shipping or storage of the container 100. Due to the recessed positioning of the cutter assembly 140, multiple containers 100 can be stacked relative to each other without imparting pressure or force on the cutter assembly 140, thereby preventing potential damage to the cutter assembly 140.

Figure 3:
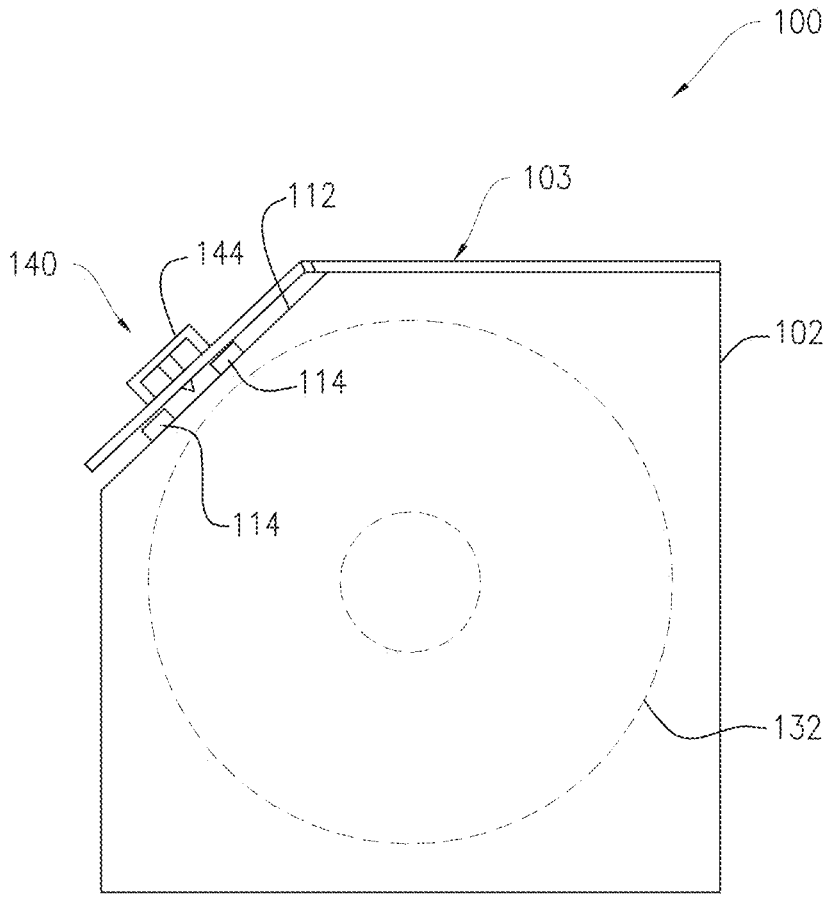
FIG. 3 is a side view of the roll-dispensed stock container of FIG. 1.

FIG. 3 is a side view of the roll-dispensed stock container 100 showing an exemplary arrangement of fixation strips 114 in relation to the cutter assembly 140 and more particularly to the slidable cutter 144. As shown in FIG. 3, one or more fixation strips 114 can be affixed to the support wall 112 of the container 100. When the roll-dispensed stock 132 is dispensed from container 100, described hereinbelow in connection with FIGS. 4-6, the roll-dispensed stock 132 is drawn over the one or more fixation strips 114 (see FIG. 4) and the lid 108 is closed on top of the roll-dispensed stock 132 (see FIG. 5), the fixation strips 114 thereby securely holding the roll-dispensed stock in place while the slidable cutter 144 is used to cut a single sheet of roll-dispensed stock (see FIG. 6). Pressure is applied against the lid 108 and fixation strips 114 when a user presses a finger into the engagement face 164 of the slidable cutter 144 to cut the roll-dispensed stock. The pressure a user applies to the cutter 144 further pushes the lid 108 against the support wall 112 to engage the fixation strips 114 with the adjacent roll-dispensed stock 132. Importantly, because the roll-dispensed stock 132 is securely held in place by the fixation strips 114, tension is maintained on the roll-dispensed stock 132, allowing the slidable cutter to easily and cleanly cut therethrough. For example, as shown in FIGS. 3-6, tension in the roll-dispensed stock 132 material is maintained between the fixation strips 114, regardless of movement on either side of the roll-dispensed stock 132 (e.g., the dispensed end or the roll within container 100). The fixation strips disclosed herein can be positioned so as to not contact, or otherwise interfere with, the cutter assembly 140. Additionally the roll-dispensed stock is not pulled by the cutter. The fixation strips 114 could be made out of any material suitable for securely and removably holding the roll-dispensed stock 132 while it is being cut. Those of ordinary skill in the art will appreciate that the material used for the fixation strips 114 is preferably selected based on the properties of the roll-dispensed stock material. In one example, if the roll-dispensed stock 132 is plastic wrap, foil, wax paper, parchment paper, tape, duct tape, or wrapping paper, the fixation strips 114 could be made of a silicone material, flexible polymer, or another material that provides light tack or clings to the roll-dispensed stock 132. The fixation strips 114 could also be made of a low-tack adhesive (e.g., fugitive, "booger," or "credit card" glue), an ultraviolet (UV) light curing adhesive, a wax, a tacky material, or any other material suitable for securely and removably holding or gripping the roll-dispensed stock 132.

In addition to being provided as continuous strips, the fixation strips 114 could be provided as a plurality of discreet segments or beads disposed along a linear path, or could cover an entire surface. According to some aspects of the present disclosure, the fixation strips 114 could be formed from a low-tack adhesive material that is resiliently deformable upon application of force to the cutter assembly 140 and/or lid 108. Pressure applied to the fixation strips 114 during the cutting process causes the fixation strips to deform and tension the roll-dispensed stock therebetween, eliminating bunching and tearing of the roll-dispensed stock, and providing for repeatable and consistent cutting.

According to some aspects of the present disclosure, one or more of the fixation strips can be formed from synthetic rubber, natural rubber, latex, elastomers, and other resiliently deformable materials that grip the roll-dispensed stock through friction force. With paper, foil, and other roll-dispensed stock materials that do not exhibit "cling" properties (e.g., attraction through electrostatic charge or similar mechanisms), rubber fixation strips, or the like, can be provided. For example, when the foil roll-dispensed stock and rubber fixation strips are pressed together (e.g., during the cutting process, or when the lid is otherwise pressed towards the container body), the rubber fixation strips have tack and grip and tension the roll-dispensed stock with friction generated therebetween. Rubber fixation strips can also be used with roll-dispensed stock (e.g., plastic wrap) made of polyethylene ("PE"), which exhibits less cling than roll-dispensed stock made of polyvinyl chloride ("PVC").

Further, it is contemplated that any of the containers of the present disclosure (e.g., containers 100, 200, 300, 400, 500, 600, 700, and 800 described herein) could be provided with one or more fixation strips 114 of any material and configuration as described herein.

Figure 4:
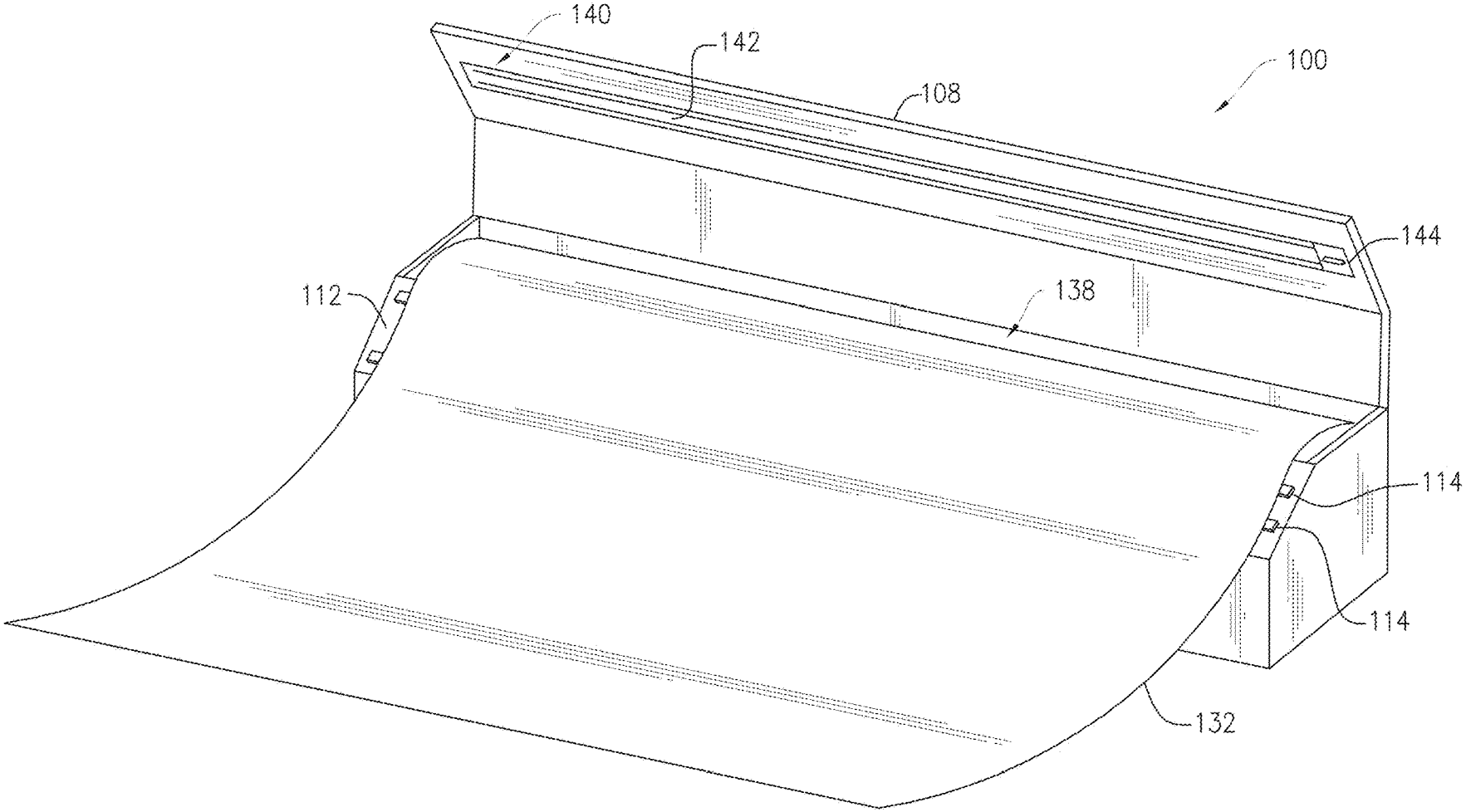
FIG. 4 is a perspective view of the roll-dispensed stock container of FIG. 1 in an open configuration with stock extending from the roll.
Figure 5:
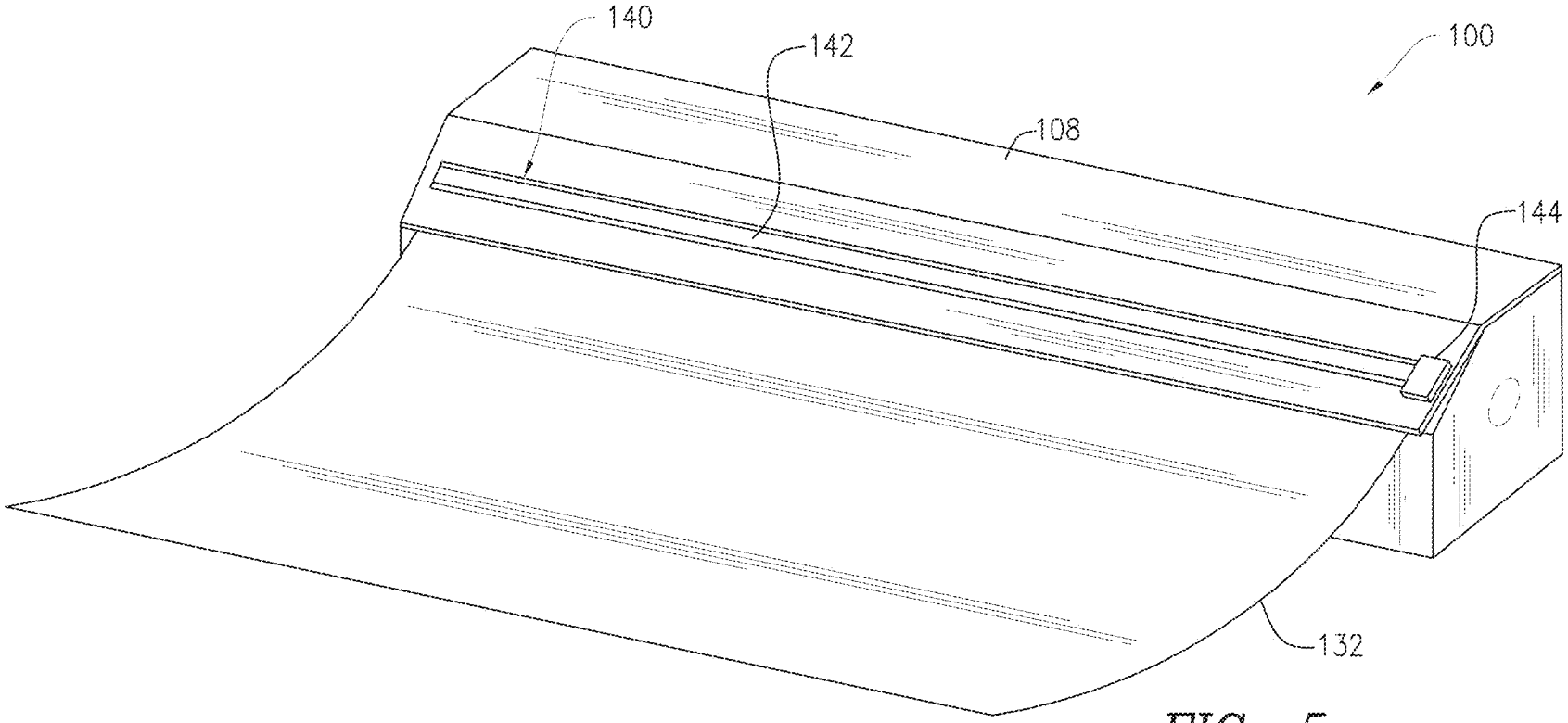
FIG. 5 is a perspective view of the roll-dispensed stock container of FIG. 4 in a closed configuration with stock extending from the roll.
Figure 6:
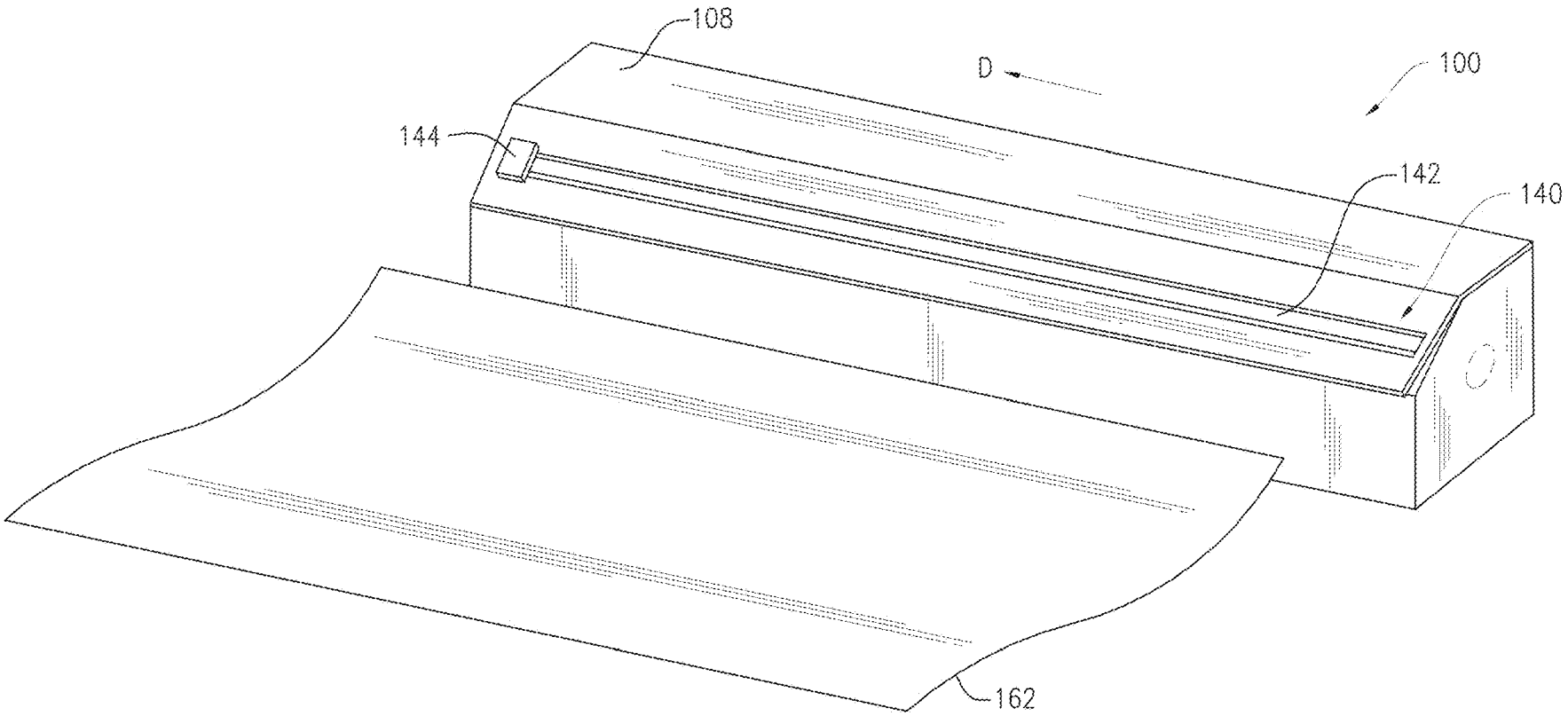
FIG. 6 is a perspective view of the roll-dispensed stock container of FIG. 5 after the cutter has been actuated to cut a section of the roll-dispensed stock.

FIGS. 4-6 show operation of the roll-dispensed stock container 100 according to the present disclosure. More specifically, FIG. 4 is a perspective view of the roll-dispensed stock container of FIG. 1 in an open configuration, thereby allowing for extension of the roll-dispensed stock 132 through the opening 138. FIG. 5 is a perspective view of the roll-dispensed stock container of FIG. 1 in a closed configuration including roll-dispensed stock dispensed from an opening. An end of the roll-dispensed stock 132 can be dispensed through the opening 138 until the desired length of the roll-dispensed stock 132 is achieved. The roll-dispensed stock 132 is positioned against the one or more fixation strips 114 disposed on the support wall 112. The lid 108 can then be closed, thereby positioning the slidable cutter 144 of the cutter assembly 140 adjacent to, or into contact with, the roll-dispensed stock 132. The cutter 144 can then be slid along the track 142 in the direction of arrow D to sever a sheet 162 from the remaining roll-dispensed stock 132. FIG. 6 is a perspective view of the roll-dispensed stock container of FIG. 1 in a closed configuration after the stock was cut by the cutter assembly.

Figure 7A:
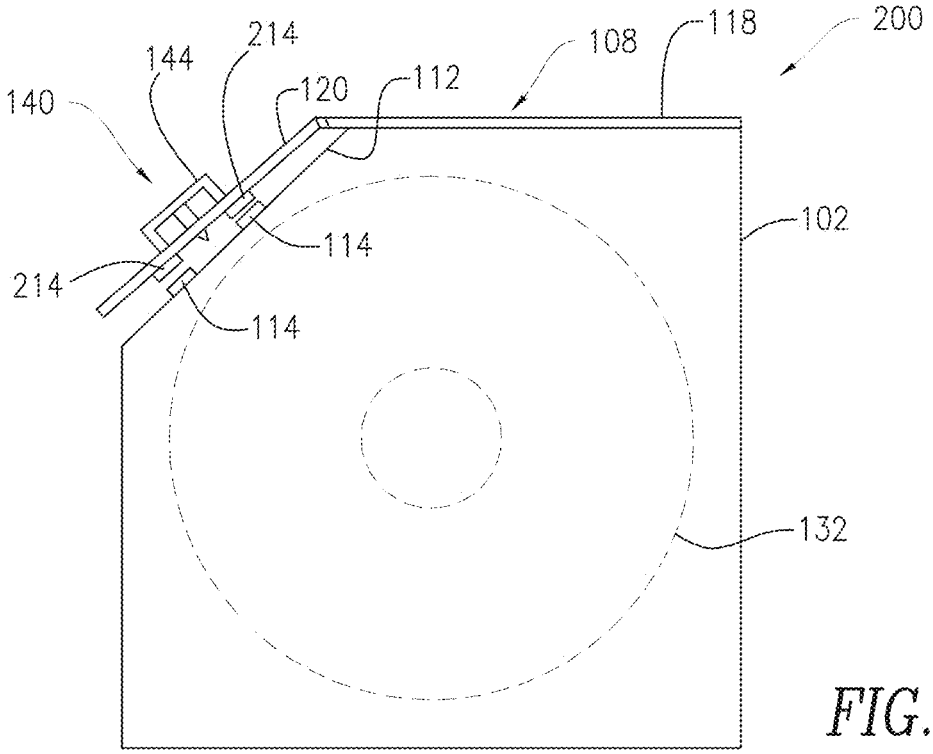
FIG. 7A is a side view of a roll-dispensed stock container according to the present disclosure including fixation strips on both a lid and a support wall of the roll-dispensed stock container.

FIGS. 7A-E are side views of roll-dispensed stock containers according to some aspects of the present disclosure showing additional exemplary configurations of fixation strips. The containers can be substantially similar in structure and function to the container 100, except for the distinctions noted herein. FIG. 7A shows a roll-dispensed stock container 200 including a body 102, a lid 108 having a first portion 118 and a second portion 120, a cutter assembly 140 having a slidable cutter 144, and fixation strips 114 disposed on a support wall 112 on either side of the slidable cutter 144. As shown in FIG. 7A, the container 200 could also include fixation strips 214 disposed on an underside (e.g., the side adjacent to support wall 112 and fixation strips 114) of the second portion of the lid 108 on either side of the slidable cutter 144. Accordingly, container 200 provides fixation strips on either side of the roll-dispensed stock 132 (not shown) as it is being cut in accordance with the steps described in connection with FIGS. 4-6.

Figure 7B:
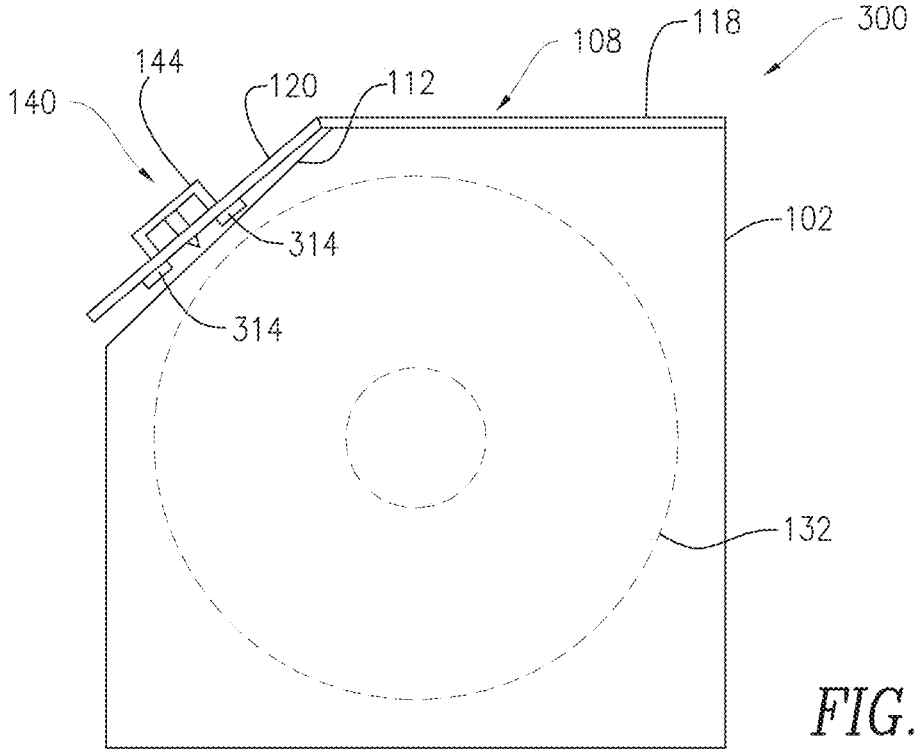
FIG. 7B is a side view of a roll-dispensed stock container according to the present disclosure including fixation strips on only the lid of the roll-dispensed stock container.

FIG. 7B shows a roll-dispensed stock container 300 according to another aspect of the present disclosure and includes a body 102, a lid 108 having a first portion 118 and a second portion 120, a cutter assembly 140 having a slidable cutter 144, and a support wall 112. As shown in FIG. 7B, the container 300 includes fixation strips 314 disposed on an underside (e.g., the side adjacent to support wall 112 and fixation strips 114) of the second portion of the lid 108 on either side of the slidable cutter 144.

Figure 7C:
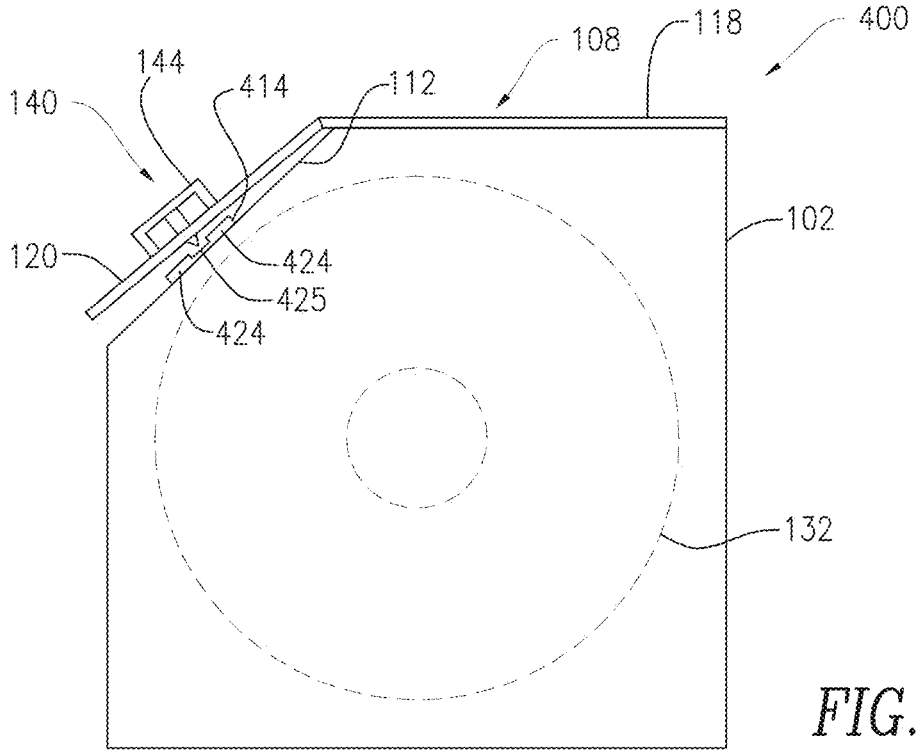
FIG. 7C is a side view of a roll-dispensed stock container according to the present disclosure including a single fixation strip having a recessed center portion positioned on the support wall of the roll-dispensed stock container.

FIG. 7C shows a roll-dispensed stock container 400 according to another aspect of the present disclosure and includes a body 102, a lid 108 having a first portion 118 and a second portion 120, a cutter assembly 140 having a slidable cutter 144, and a support wall 112. As shown in FIG. 7C, in place of one or more fixation strips 114, the container 400 could include a single fixation strip 414 disposed on the support wall 112 having a central recessed portion 425 between two raised portions 424 extending on either side of the slidable cutter 144. Further, the fixation strip 414, and more specifically the raised portions 424, could be configured and dimensioned such that the blade of the slidable cutter 144 passes between the raised ridges 424 when cutting the roll-dispensed stock 132, but does not contact or cut into recessed portion 425 or the support wall 112 thereunder.

Figure 7D:
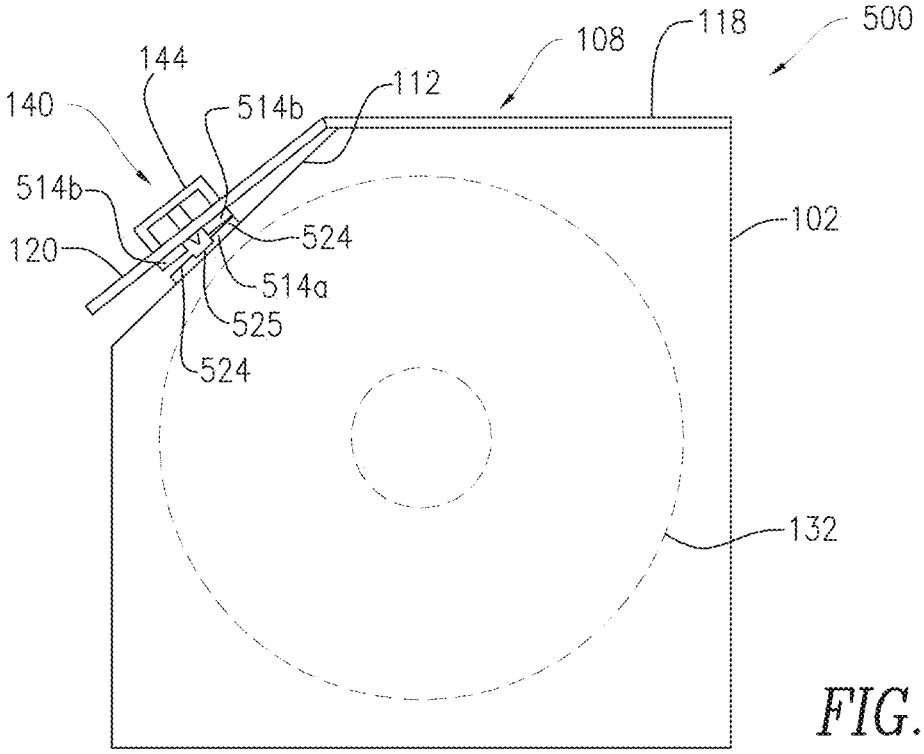
FIG. 7D is a side view of a roll-dispensed stock container according to the present disclosure including fixation strips positioned on the lid of the roll-dispensed stock container and a single fixation strip having a recessed center portion positioned on the support wall of the roll-dispensed stock container.

FIG. 7D shows a roll-dispensed stock container 500 including a body 102, a lid 108 having a first portion 118 and a second portion 120, a cutter assembly 140 having a slidable cutter 144, and a support wall 112. As shown in FIG. 7D, the container 500 could include a single fixation strip 514*a* disposed on the support wall 112 and having a recessed central portion 525 between raised portions 524 extending on either side of the slidable cutter 144. The container 500 could also include one or more fixation strips 514*b* disposed on an underside (e.g., the side adjacent to the support wall 112 aligned with fixation strip 514*a*) of the second portion of the lid 108. Accordingly, container 500 provides fixation strips on either side of the roll-dispensed stock 132 (not shown) to retain and tension the stock as it is being cut.

Figure 7E:
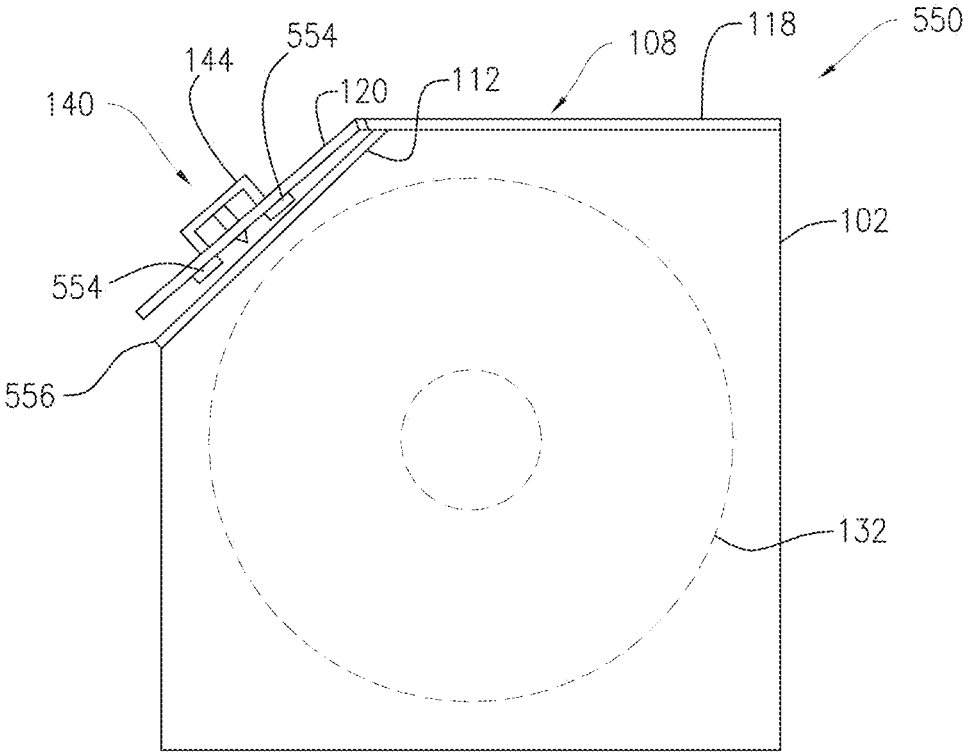
FIG. 7E is a side view of a roll-dispensed stock container according to the present disclosure including a laminate on the support wall of the roll-dispensed stock container.

FIG. 7E shows a roll-dispensed stock container 550 including a body 102, a lid 108 having a first portion 118 and a second portion 120, a cutter assembly 140 having a slidable cutter 144, and a support wall 112. As shown in FIG. 7E, the support wall 112 can be provided with a low-tack coating 556 for maintaining the position of the roll-dispensed stock 132 during cutting. The coating 556 can be made out of any material suitable for securely and removably holding the roll-dispensed stock 132 while it is being cut. The material used for the coating 556 can be selected based on the properties of the roll-dispensed stock material. In one example, if the roll-dispensed stock 132 is plastic wrap, foil, wax paper, parchment paper, or wrapping paper, the coating 556 could be made of a silicone material, flexible polymer, or another material that provides light tack or clings to the roll-dispensed stock 132. The coating 556 could also be made of a low-tack adhesive (e.g., fugitive, "booger," or "credit card" glue), an ultraviolet (UV) light curing adhesive, a wax, a tacky material, or any other material suitable for securely and removably holding or gripping the roll-dispensed stock 132. The coating 556 could cover a portion of support wall 112 or could cover its entire surface. According to some aspects of the present disclosure, the coating 556 could be formed from a material that is resiliently deformable upon application of force to the cutter assembly 140 and/or lid 108.

As shown in FIG. 7E, the container 550 can also include a second coating (not shown) and/or one or more fixation strips 554 disposed on an underside (e.g., the side adjacent to the support wall 112 having coating 556) of the second portion of the lid 108. Accordingly, container 550 can grip one or both sides of the roll-dispensed stock 132 (not shown) with coating(s) 556 and/or the fixations strips 554, to retain and tension the stock as it is being cut. For example, according to some aspects of the present disclosure, a wax or UV material coating can be applied to the entire surface of support wall 112, or a portion thereof, or could be applied to a bottom surface of lid portion 120, opposite the support wall 112. The wax or UV material coating can be used in place of, or in combination with the fixation strips 114. For example, the wax or UV material coating can be applied to the bottom surface of lit portion 120 and the fixation strips 554 can be applied to the support wall 112, or vice versa. The wax or UV material coating can also be used in in combination with any of the configurations of fixation strips disclosed herein.

Figure 8:
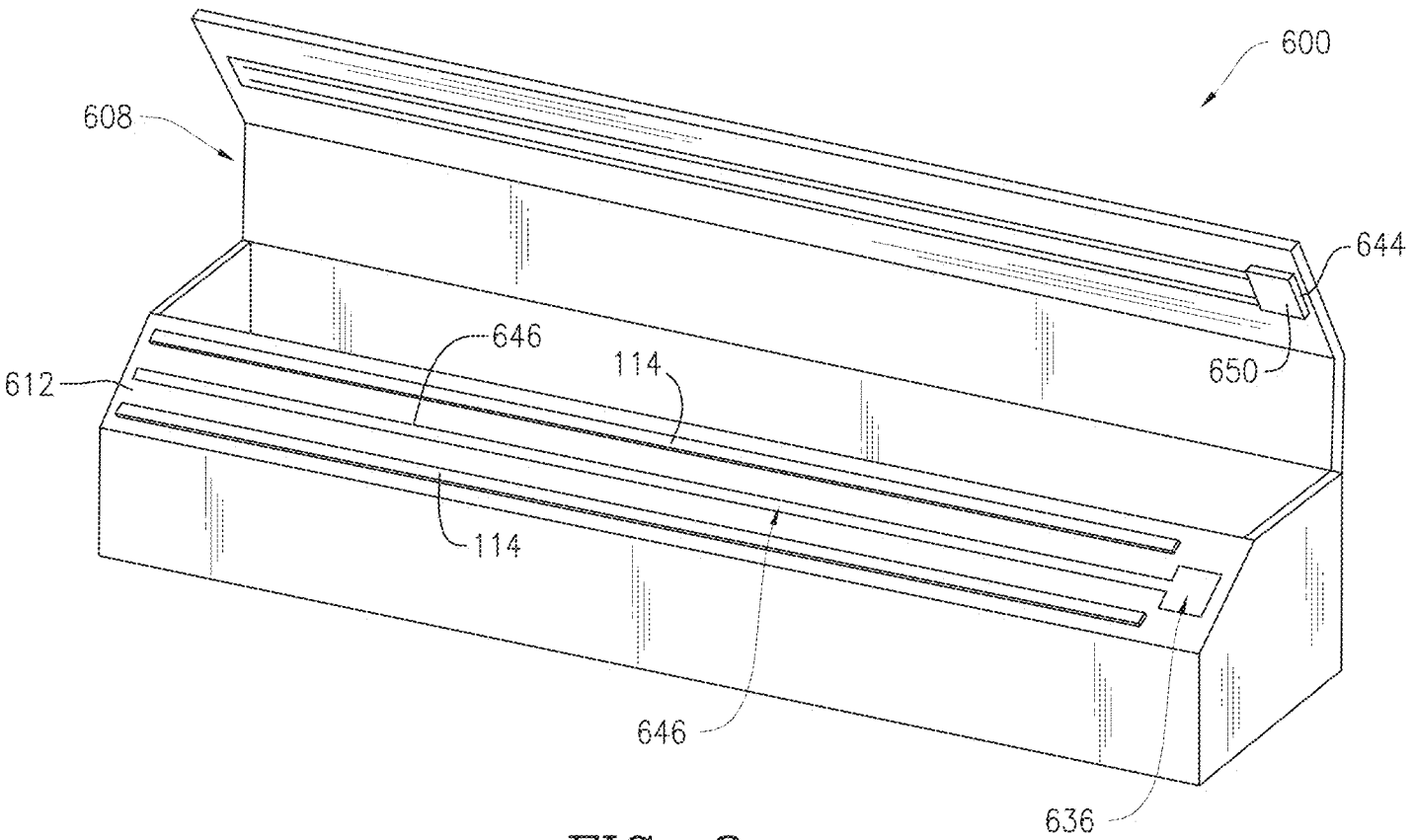
FIG. 8 is a perspective view of another aspect of a roll-dispensed stock container in an open configuration having a slot in the support wall for receiving a lower portion of a slidable cutter.
Figure 9:
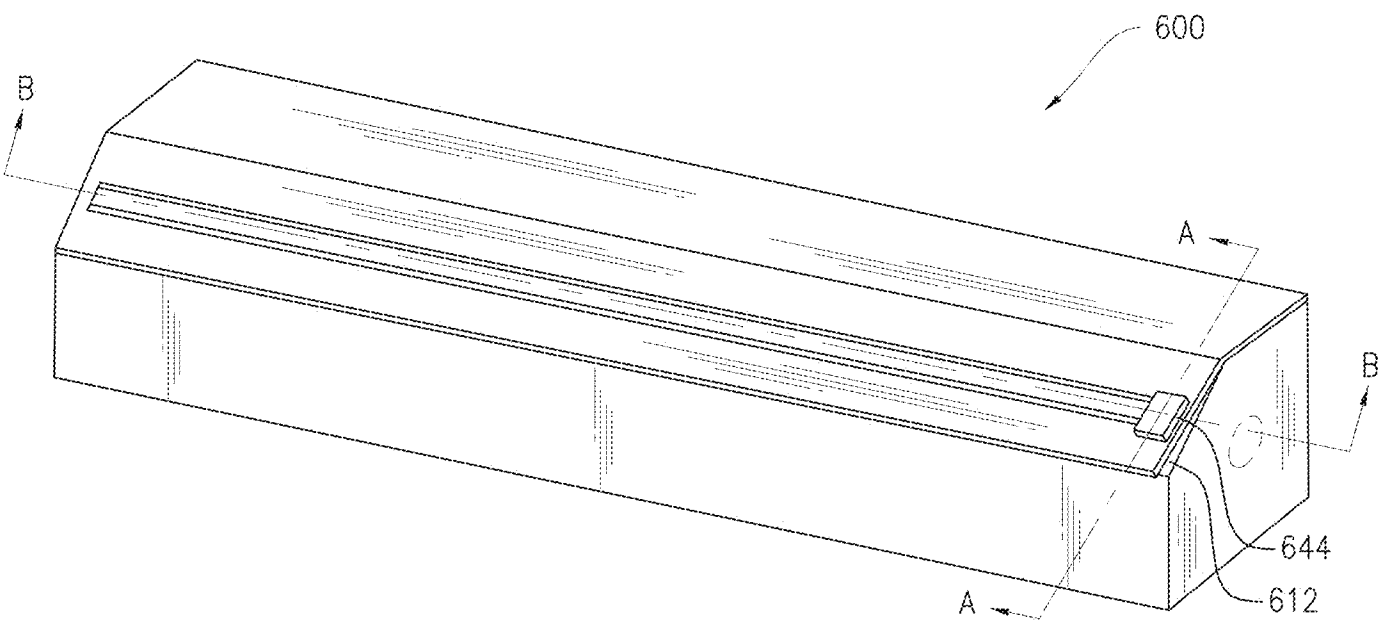
FIG. 9 is a perspective view the roll-dispensed stock container of FIG. 8 in a closed configuration.

FIGS. 8-11B show an exemplary roll-dispensed stock container 600 (hereinafter "container 600") in accordance with some aspects of the present disclosure. Container 600 can be substantially similar in structure and function to the container 100, except for the distinctions noted herein. FIG. 8 is a perspective view of the container 600 in an open configuration and FIG. 9 is a perspective view of the container 600 in a closed configuration. Container 600 includes an aperture 636 for receiving and retaining a base portion 650 of the slidable cutter 644 (see FIGS. 10A-11B), to allow the base portion 650 to move through and extend under a support wall 612. As shown in FIG. 8, the aperture 636 has a slot 646 extending from the aperture 636 and along the support wall 612. This results in an internal blade on the cutter assembly, as the blade is positioned between to the lid 608 and the base portion 650. This configuration also allows for the application of constant and consistent pressure during the cutting process.

Figure 10A:
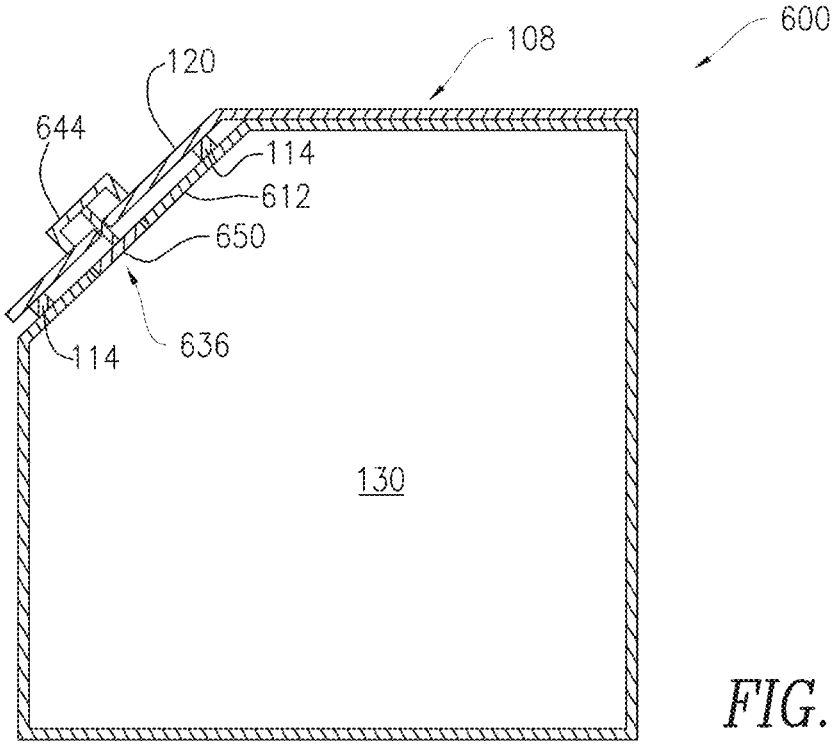
FIG. 10A is a cross-sectional view (taken along line A-A of FIG. 9) of the roll-dispensed stock container of FIG. 9 showing the lid in a first position.
Figure 10B:
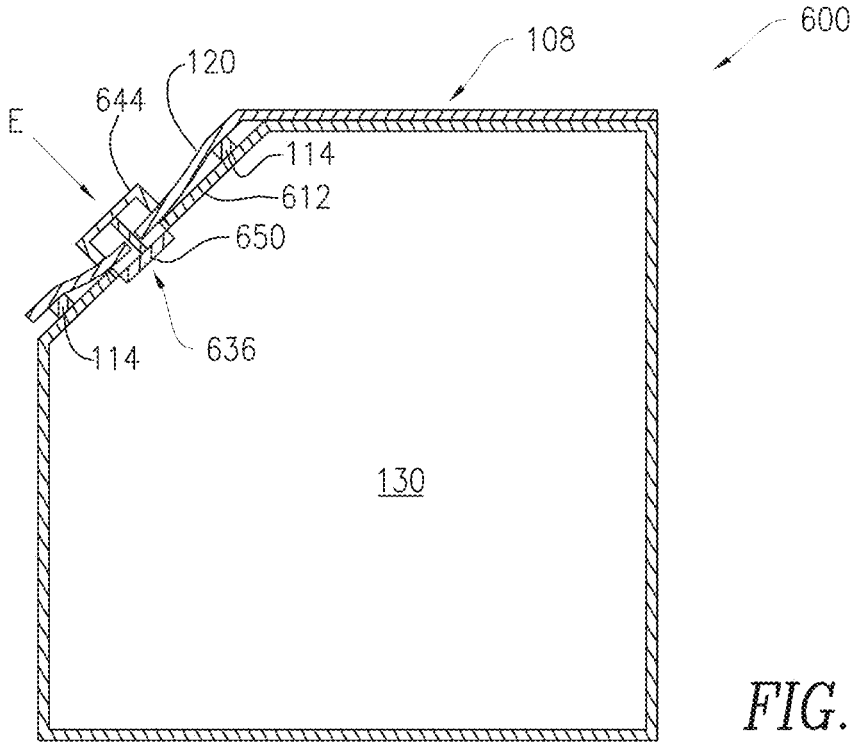
FIG. 10B is a cross-sectional view (taken along line A-A of FIG. 9) of the roll-dispensed stock container of FIG. 9 showing the lid in a second deformed position upon application of force thereto.
Figure 11A:
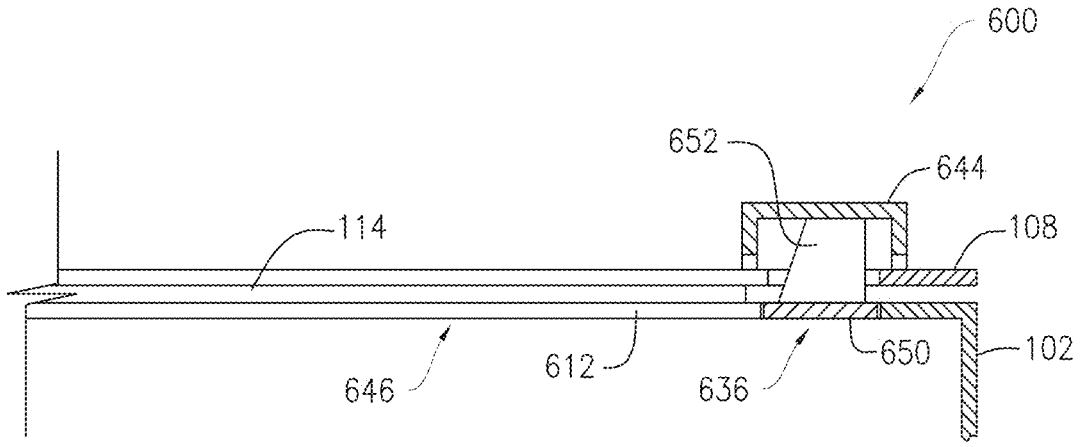
FIG. 11A is a partial cross-sectional view (taken along line B-B of FIG. 9) of the roll-dispensed stock container of FIG. 9 in a first position.
Figure 11B:
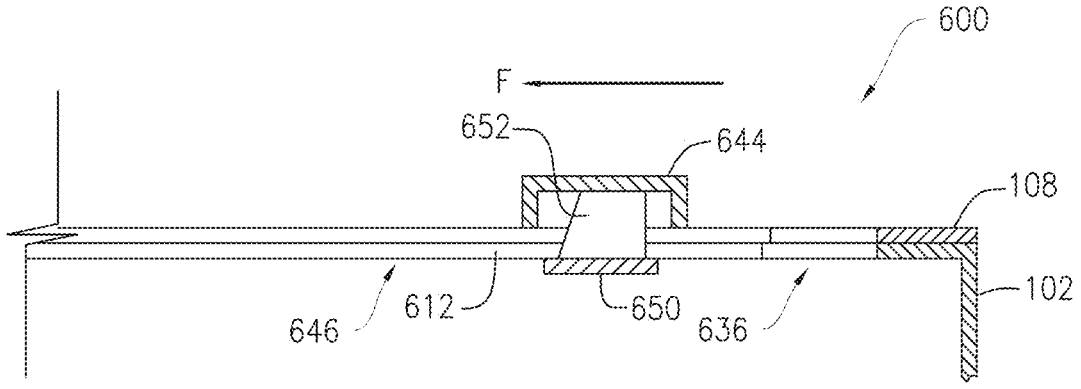
FIG. 11B is a partial cross-sectional view (taken along line B-B of FIG. 9) of the roll-dispensed stock container of FIG. 9 in a second position showing operation of the cutter assembly.

FIGS. 10A and 10B are cross-sectional views (taken along line A-A of FIG. 9) of container 600 and FIGS. 11A and 11B are partial cross-sectional views (taken along line B-B of FIG. 9) of container 600. As shown in FIGS. 10A and 11A, the base 650 of the slidable cutter 644 protrudes below the second portion 120 of the lid 108, but does not fully extend through the aperture 636 (e.g., into enclosure 130) in normal operation (e.g., during storage or transportation). However, as shown in FIG. 10B, upon application of force to engagement face 664 in the direction of arrow E, the second portion 120 of lid 108 is elastically deformed so that the base 650 of the slidable cutter 644 fully extends through the aperture 636. As shown in FIG. 11B, once force has been applied to engagement face 664 in the direction of arrow E and the base 650 of the slidable cutter 644 is fully extended through the aperture 636, the slidable cutter 644 can be moved along elongated track 642 in the direction of arrow F. Notably, the slot 646 extending from aperture 636 can be dimensioned to accommodate a blade 652 of the slidable cutter 644 passing therethrough, but also to retain the base 650 of the slidable cutter 644, thereby preventing the second portion 120 of the lid 108 from returning to its original position. Accordingly, once force is applied in the direction on arrow E and the slidable cutter is moved in the direction of arrow F, pressure is maintained between the one or more fixation strips 114 and the second portion 120 of the lid 108, with the roll-dispensed stock 132 disposed therebetween (not shown). As such, pressing the engagement face 664, and thereby cutter base 650, into the position shown in FIG. 10B maintains the pressure of the roll-dispensed stock against the fixation strips as well as tensioning the roll-dispensed stock. This allows the slidable cutter to more easily and cleanly cut therethrough without a user being required to maintain pressure on the lid 108.

Figure 12:
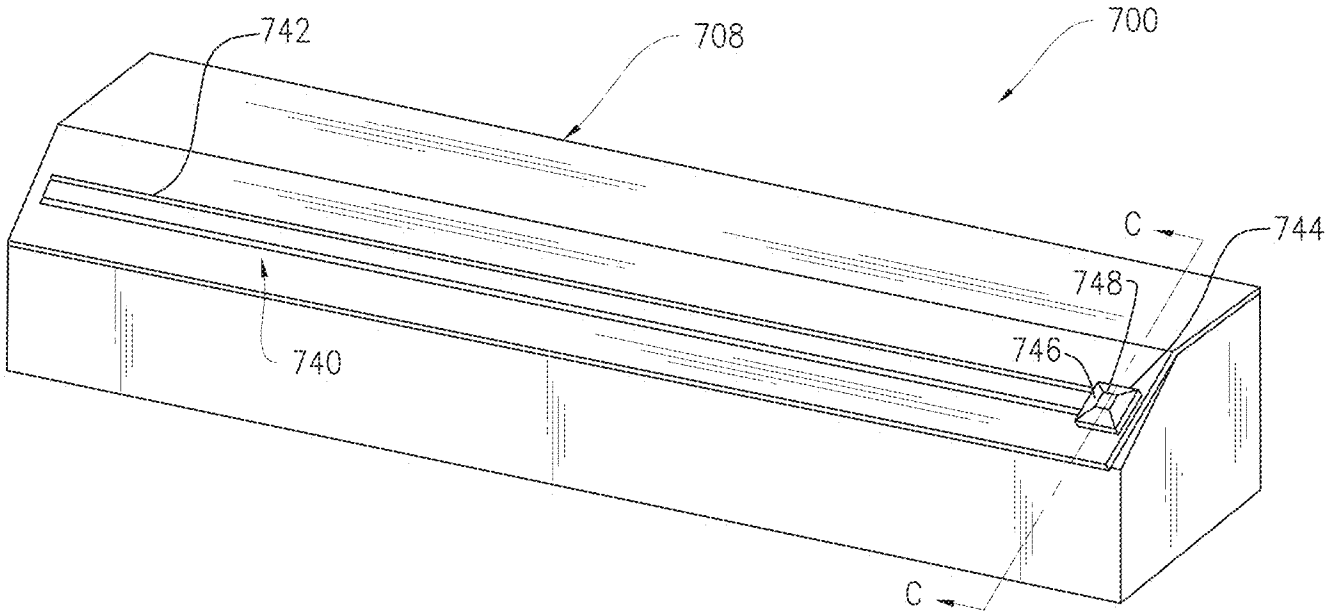
FIG. 12 is a perspective view of another aspect of a roll-dispensed stock container in a closed configuration having a slidable cutter with a recessed blade.
Figure 13A:
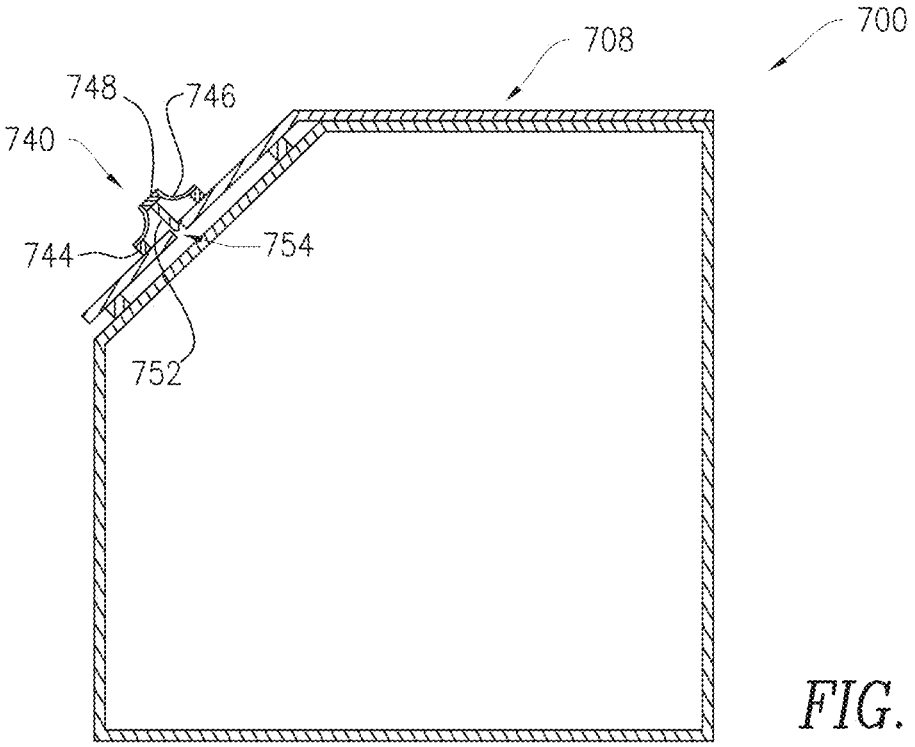
FIG. 13A is a cross-sectional view (taken along line C-C of FIG. 12) of the roll-dispensed stock container of FIG. 12 showing the slidable cutter in a first position.
Figure 13B:
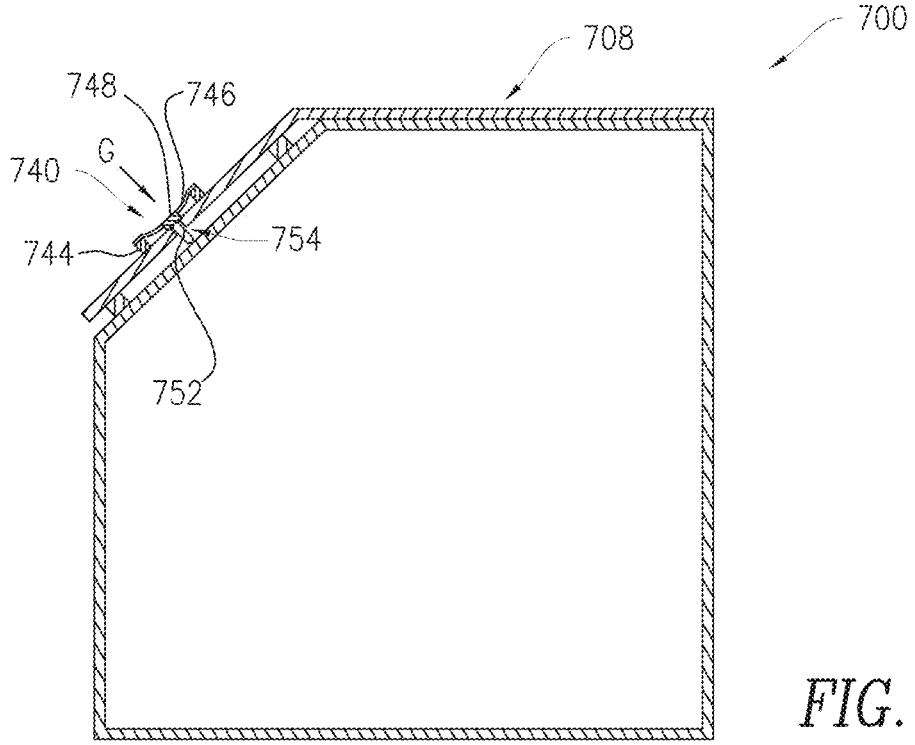
FIG. 13B is a cross-sectional view (taken along line C-C of FIG. 12) of the roll-dispensed stock container of FIG. 12 showing the slidable cutter in a second extended position by application of force thereto.

FIGS. 12-13B show an exemplary roll-dispensed stock container 700 (hereinafter "container 700") in accordance with some aspects of the present disclosure. Container 700 can be substantially similar in structure and function to the container 100, except for the distinctions noted herein. FIG. 12 is a perspective view of the container 700 in a closed configuration. Container 700 could include a lid 708 having a cutter assembly 740 disposed thereon, the cutter assembly 740 having an elongated track 742, a slidable base 744, a resiliently deformable skirt 746, a button 748, and a blade 752. The slidable base 744 can be engaged with the track 742 so as to slide thereon. The resiliently deformable skirt could be coupled to, and provided between, the slidable base 744 and the button 748 and is configured to bias the button 748 in a direction extending away from an exterior side of the lid 708 and slidable base 744. Skirt 746 can be formed from any material, for example, rubber or plastic, that is elastically deformable and capable of providing a bias force between the button 748 and slidable base 744. A blade 752 can be coupled to an underside of the button 748 and can extend into, but not beyond, an elongated slot 754 in the lid 708 (see FIGS. 13A and 13B).

FIGS. 13A and 13B are cross-sectional views (taken along line C-C of FIG. 12) of container 700 showing operation of the cutter assembly 740. As shown in FIG. 13A, the blade 752 of the cutter assembly 740 does not fully extend through the elongated slot 754 of the lid 708 in normal operation (e.g., during storage or transportation). The recessed blade is a safety feature, as it renders the blade unable to contact or cut anything, or anyone, until the container is closed and the cutter is actuated by pressure on the button. As shown in FIG. 13B, upon application of force to button 748 in the direction of arrow G, the skirt 746 is elastically deformed so that the button travels towards the lid 708 and the blade 752 fully extends through the elongated slot 754. Once force has been applied in the direction of arrow G and the blade is fully extended through the elongated slot 754, the slidable base 744 can be moved along elongated track 742, thereby separating a portion of the roll-dispensed stock from the roll. Upon removal of the force from button 748, the button 748 and blade 752 return to their positions as shown in FIG. 13A.

Figure 14:
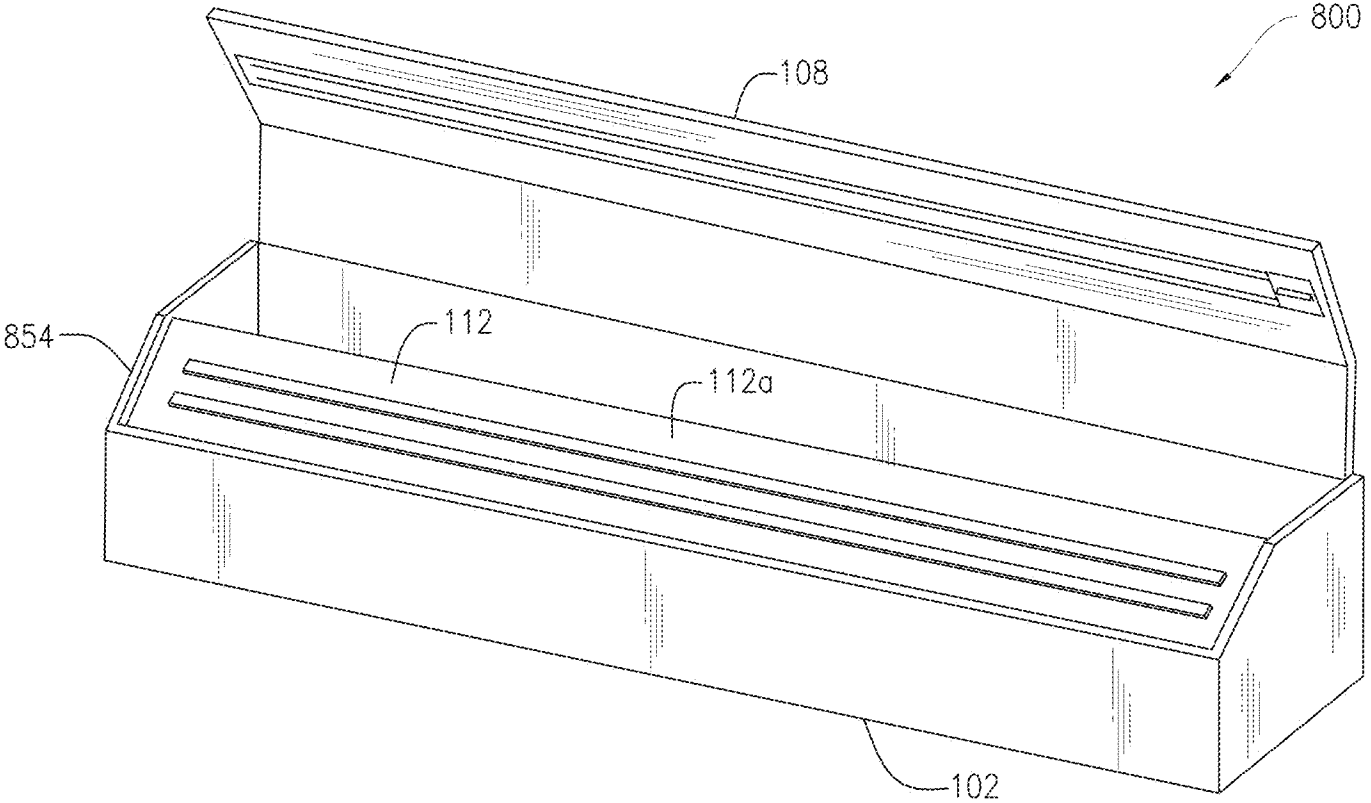
FIG. 14 is a perspective view of a roll-dispensed stock container in an open configuration according to the present disclosure including a snap-fit lid.
Figure 15:
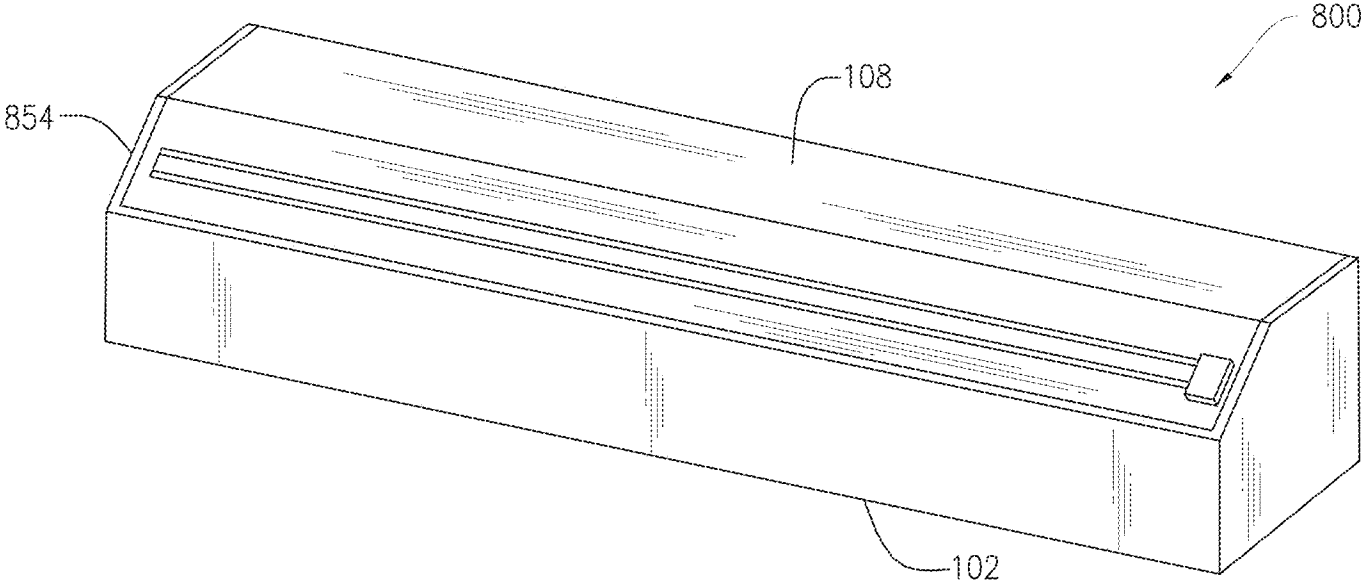
FIG. 15 is a perspective view the roll-dispensed stock container of FIG. 8 in a closed configuration.

FIGS. 14 and 15 show an exemplary roll-dispensed stock container 800 (hereinafter "container 800") in accordance with some aspects of the present disclosure. Container 800 can be substantially similar in structure and function to the container 100, except for the distinctions noted herein. Therefore, like reference numbers represent like structures. FIG. 14 is a perspective view of container 800 in an open configuration according to the present disclosure including a snap-fit lid and FIG. 15 is a perspective view container 800 in a closed configuration. As shown in FIG. 14, the body 102 of container 800 includes a lip 854 protruding therefrom for receiving lid 108 in snap-fit engagement, or the like. As shown in FIG. 15, the lip 854 could completely surround the lid 108. The container 800 could be formed from plastic or any other material known to those of ordinary skill in the art that is suitably rigid and durable for receiving and dispensing roll-dispensed stock and that is capable of being configured with a body and lid being in snap-fit engagement. According to further aspects of the present disclosure, the container of the present disclosure can vary in shape and can include a face that is overlaid by a lid with a cutter. The face can be on the support surface, described hereinabove, or on a vertical front wall, an angled wall, or a horizontal upper wall. The lid can have one or more portions and the cutter overlies the face. The roll-dispensed stock is positioned between the lid and the face and is retained and/or tensioned by one or more fixation strips for cutting.

Figure 16:
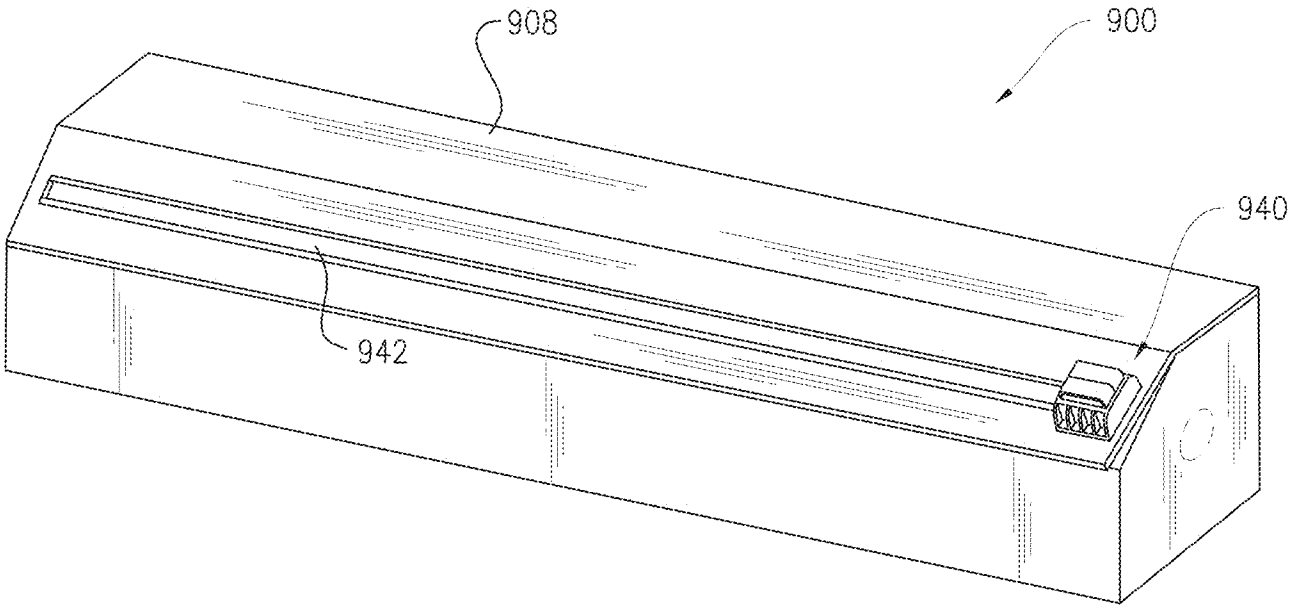
FIG. 16 is a perspective view of a roll-dispensed stock container in a closed configuration having a slidable cutter assembly with a retractable blade.
Figure 17A:
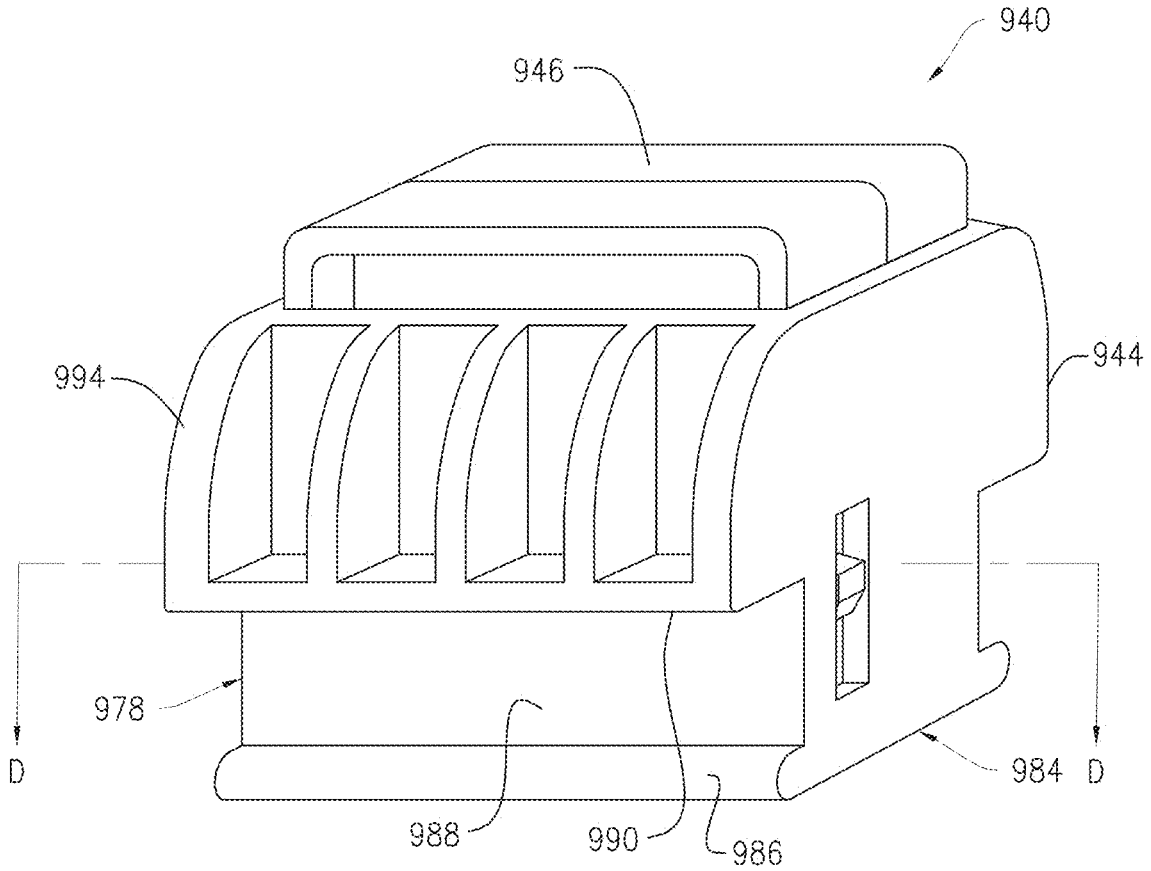
FIG. 17A is a perspective view of the cutter assembly of FIG. 16.

FIG. 16 is a perspective view of a roll-dispensed stock container 900 in accordance with aspects of the present disclosure. Container 900 can be substantially similar in structure and function to container 700 or other containers discussed herein or otherwise known or developed. Container 900 includes a lid 908 having an elongated slot 942 with a slidable cutter assembly 940 disposed therein. FIG. 17A is a perspective view of the slidable cutter assembly 940, which includes a slidable base 944 and an actuating button 946. The base 944 includes a bottom surface 984, having edges 986, recessed sidewalls 988, and shoulders 990 forming base channels 978. The edges 986 and shoulders 990 are positioned above and below the container lid 908 when the cutter assembly 940 is positioned in the slot 942, the recessed side walls 988 bearing against the slot edges to keep the cutter assembly 940 slidably engaged in the slot 942. Slot 974 in end wall 992 accommodates stop tab 976 from actuating button 946 as will be described. Shoulder 990 can overhang the recessed sidewalls 988 and can be supported with buttresses 994.

Figure 17B:
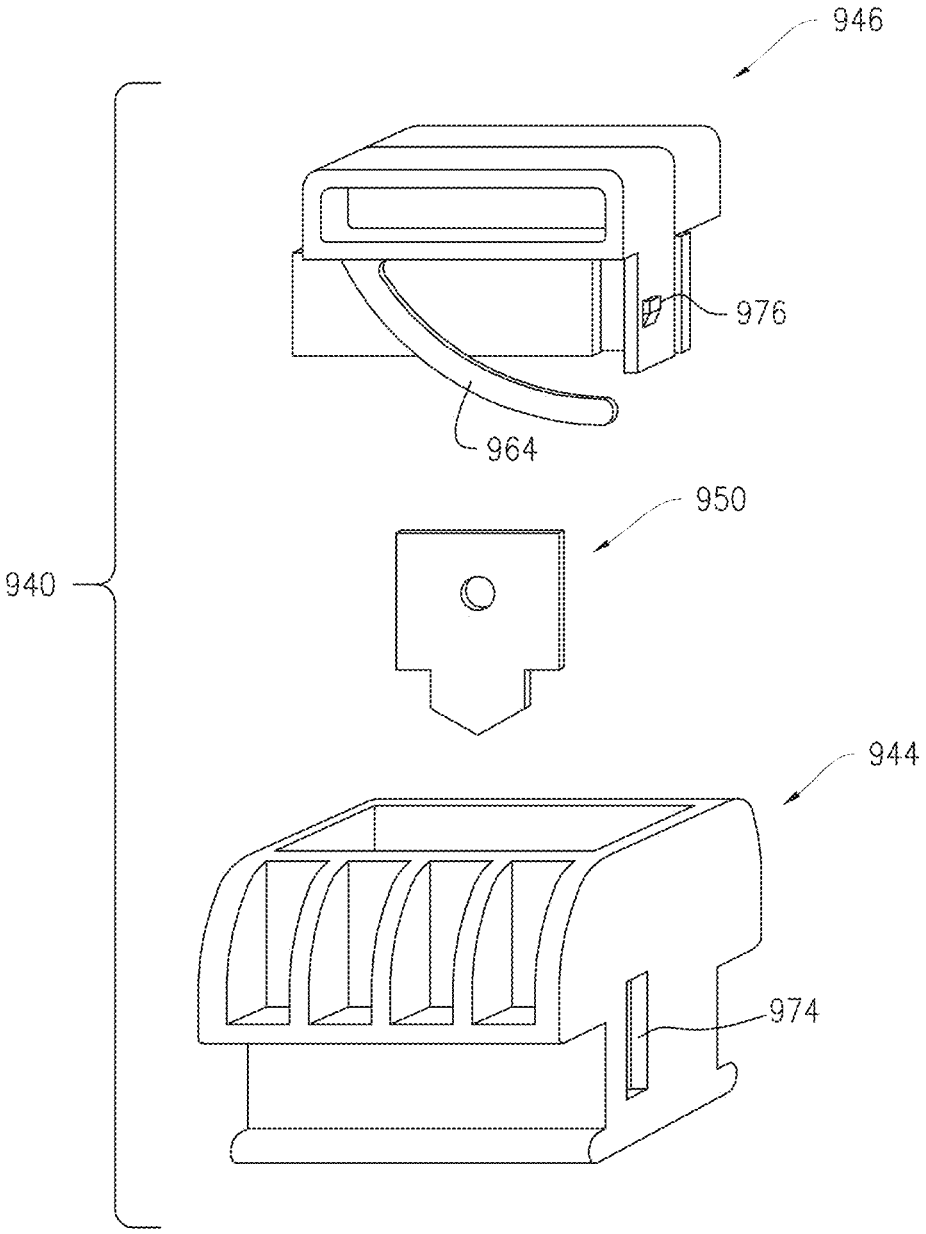
FIG. 17B is an exploded view of the cutter assembly of FIG. 17A.

FIG. 17B is an exploded view of the slidable cutter assembly 940 shown in FIG. 17A showing the base 944, a cutting blade 950 and the actuating button 946. The actuating button can be biased such as by a leaf spring 964. Stop tab 976 can be seen on the side of the button 946 which rides in slot 974 in base 944.

Figure 18:
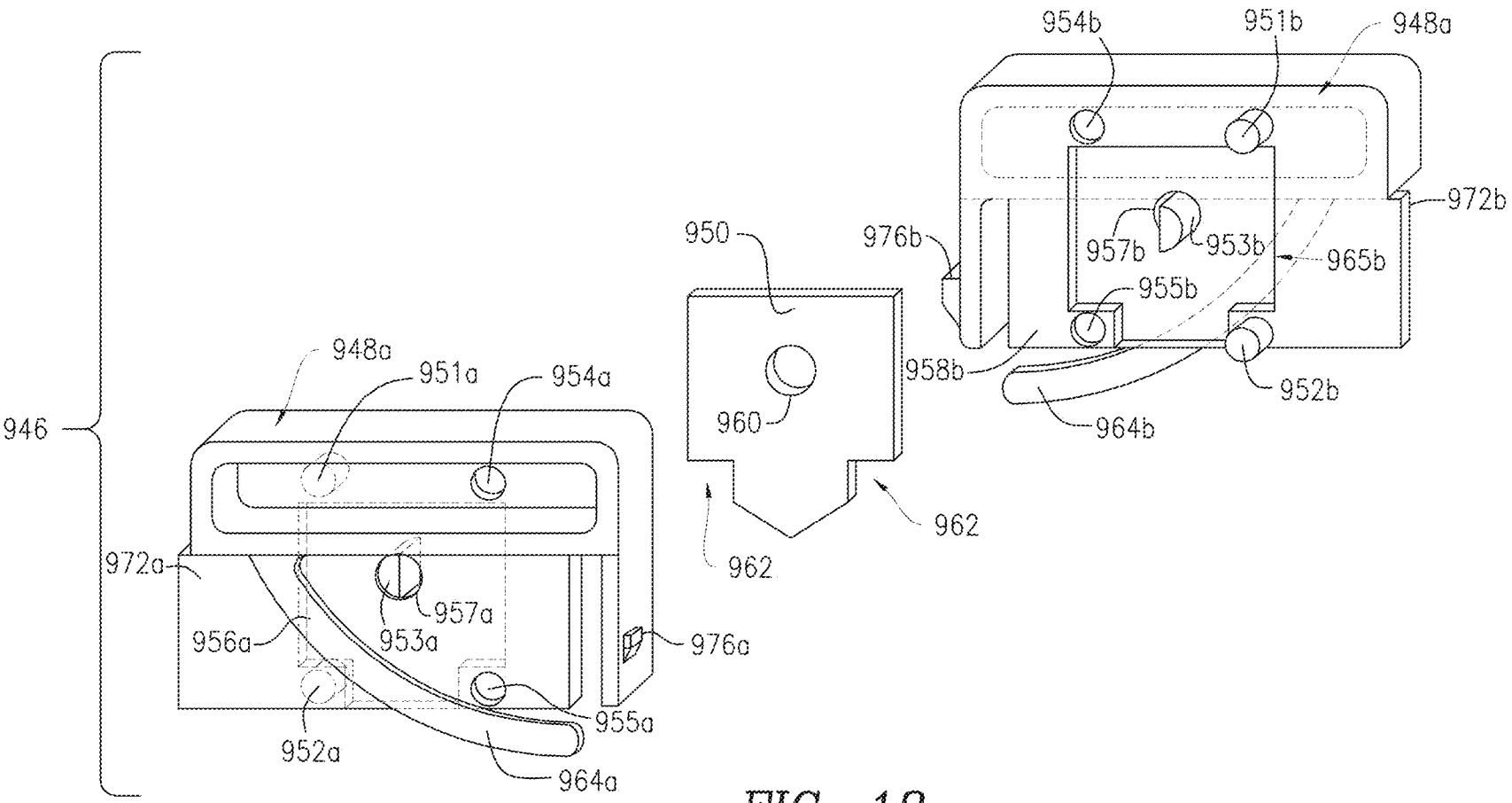
FIG. 18 is an exploded view of an actuating button of the cutter assembly of FIG. 17A.

FIG. 18 is an exploded view of the actuating button 946 of the slidable cutter assembly 940. As shown in FIG. 18, the spring button 946 can include a first button component 948*a*, a second button component 948*b*, and a blade 950. According to some aspects of the present disclosure, the first and second button components 948 can be substantially identical. For example, button component 948*a* can include one or more posts 951*a*, 952*a*, and 953*a* and receptacles 954*a*, 955*a*, and 957*a* on a rear face 958*a* thereof and button component 948*b* can include one or more posts 951*b*, 952*b*, and 953*b* and receptacles 954*b*, 955*b*, and 957*b* on a rear face 958*b* thereof. As shown in FIG. 18, posts 951*a*, 952*a*, and 953*a* on the first button component 948*a* are sized to be received by receptacles 954*b*, 955*b*, and 957*b* on the second button component 948*b* and posts 951*b*, 952*b*, and 953*b* on the second button component 948*b* are sized to be received by receptacles 954*a*, 955*a*, and 957*a* on the first button component 948*a*, thereby engaging the first button component 948*a* and the second button component 948*b* in a locking arrangement. The posts and receptacles can be provided in various configurations. For example, the posts and receptacles can have circular cross-sections (e.g., posts 951*a* and 952*a* and receptacles 954*a* and 955*a*), semi-circular cross-sections (e.g., post 953*a* and receptacle 957*a*), or a combination thereof, as shown in FIG. 18. Of course, the first and second button components 948 need not be identical. For example, according to some aspects of the present disclosure, the first button component 948*a* can be formed to only include posts, whereas the second button component 948*b* can be formed to only include receptacles, or vice versa. The button components 948 can be put together and held together by friction, adhesive, or otherwise to form the actuating button. Alternatively, the button assembly 946 could be a one-piece construction or otherwise configured. The stop tabs 976 can be formed on deformable walls 996 that can deflect when the actuating button 946 is inserted into the base 944 and return to their original position when the stop tabs 976 are seated in slots 974, thereby securing the actuating button 946 within the base 944.

Engaged with the actuating button 946 is the blade 950, which can be actuated to move with the actuating button 946 and with respect to the base of the cutter assembly. Each of the first and second button components 948 can be provided with a receiving area 956 on rear walls 958 of the button components that is sized and shaped for receiving the blade 950. The receiving area 956 could be recessed into the rear face 958, the blade could be sandwiched between the button components, or otherwise attached to the actuating button 946. Additionally, the blade 950 can include one or more apertures 960 configured to receive one or more posts to secure the blade 950 relative to the button components 948. For example, as shown in FIG. 18, the aperture 960 of the blade 950 is configured to receive one or both of the posts 953*a* and 953*b* from the first and second button components 948. The blade 950 can be further constrained within the actuating button, such as by one or more posts which can be arranged about the perimeter of the blade 950 to further secure the blade relative to the button components 948. For example, as shown in FIG. 18, posts 952*a* and 952*b* on each of the first and second button components 948 are arranged directly adjacent to recesses 962 on the body of the blade 950.

The actuating button 946 and blade 950 can be biased in a retracted position and moved to an extended position for cutting by overcoming the force of the bias. For example, the actuating button 946 can be provided with leaf springs 964 that are configured to bias the spring button 946 in a direction extending away from the base 944. The leaf springs 964 can be formed integral with, or the springs can be inserted into or otherwise attached to, each of the first and second button components 948 and positioned within the button components 948. According to other aspects of the present disclosure, the leaf springs 964 can be replaced, or supplemented, with other biasing means such as metal leaf springs, coil springs, plastic hoops, "U"-shaped springs, and the like. Of course, any biasing mechanism configured to bias the button 946 in a direction extending away from the base 944, can be used without departing from the spirit and scope of the present disclosure, including resilient material, a compressible material, or the like. According to some aspects of the present disclosure, the button 946, leaf springs 964, and sliding base 944 are all formed from plastic. The button 946, leaf springs 964, and sliding base 944 can also be formed from any other material that is suitably durable and that can provide a suitable biasing force, such as for example, metal or rubber. The blade 950 can be of any suitable shape and formed from metal or from any other material that is suitable for cutting foil, paper, plastic, or any of the various forms of roll-dispensed stock discussed herein.

Figure 19A:
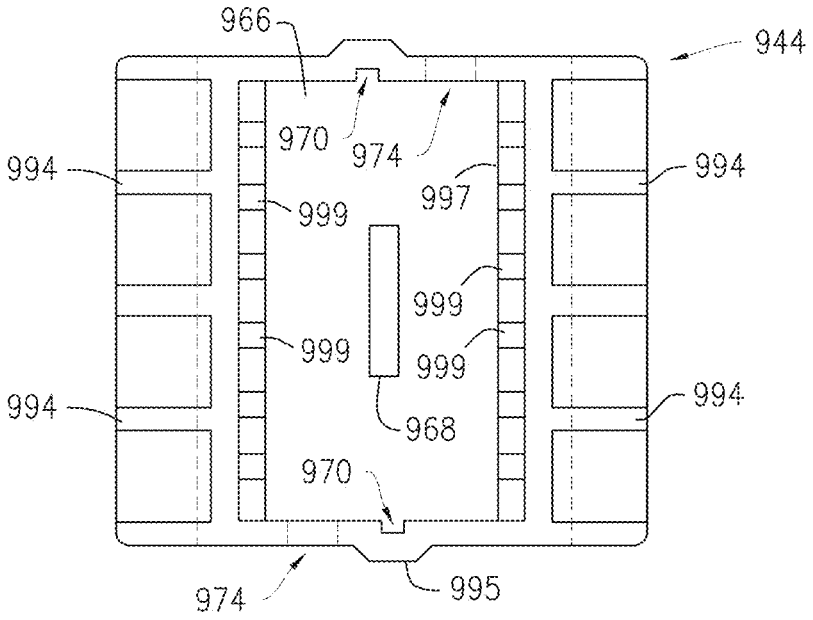
FIG. 19A is a top view of a base of the cutter assembly of FIG. 17A.
Figure 19B:
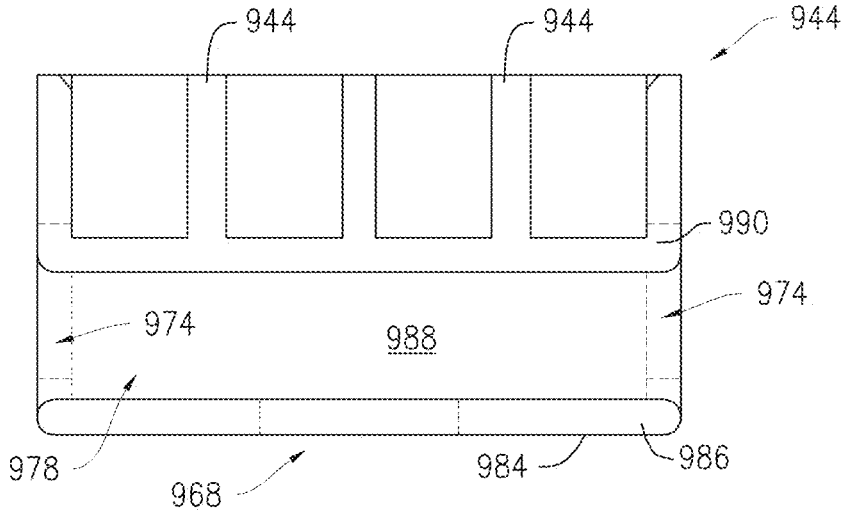
FIG. 19B is a side view of the cutter assembly of FIG. 17A.
Figure 19C:
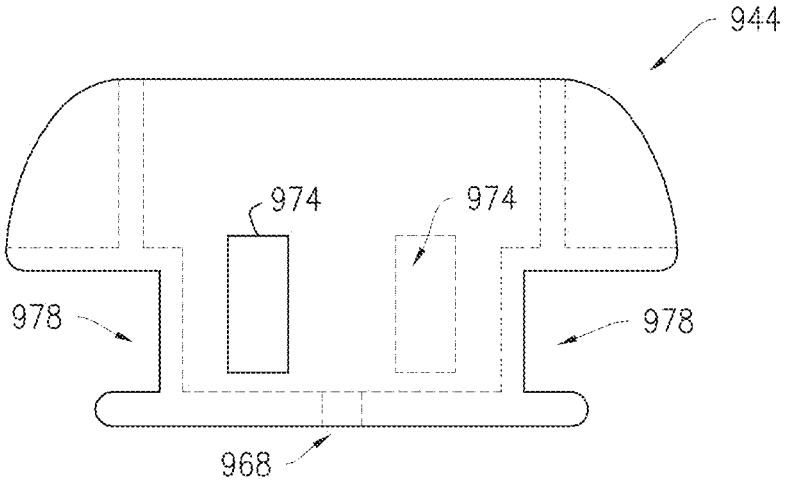
FIG. 19C is a front view of the cutter assembly of FIG. 17A.

FIGS. 19A-C show the base 944 of the of the cutter assembly 940. More specifically, FIG. 19A is a top view of the base 944, FIG. 19B is a side elevational view of the sliding base 944 and FIG. 19C is a front elevational view of the sliding base 944. As shown in FIG. 19A, the base 944 includes a central receptacle for receiving the actuating button 946. The bottom of the receptacle includes a bottom wall 966 with a slot 968 sized for receiving the blade 950 when the actuating button 946 is depressed to extend the blade 950 through the base 944. The base 944 can also include vertical channels 970 sized to slidably receive flange 972 of the actuating button 946, bumps 995 to accommodate the vertical channels 970, apertures 974 for receiving stop tabs 976 of the spring button 946, and support buttresses 994. The base 944 can also include spacers 999 on an interior wall 997 to restrain vertical movement of the actuating button 946 relative to the base 944. As shown in FIGS. 19B and 19C, the base 944 includes a bottom surface 984, having edges 986, recessed sidewalls 988, and shoulders 990 forming base channels 978. The edges 986 and shoulders 990 are positioned above and below the container lid 908 when the cutter assembly 940 is positioned in the slot 942, the recessed side walls 988 bearing against the slot edges to keep the cutter assembly 940 slidably engaged in the slot 942 and allow for travel therealong.

Figure 20A:
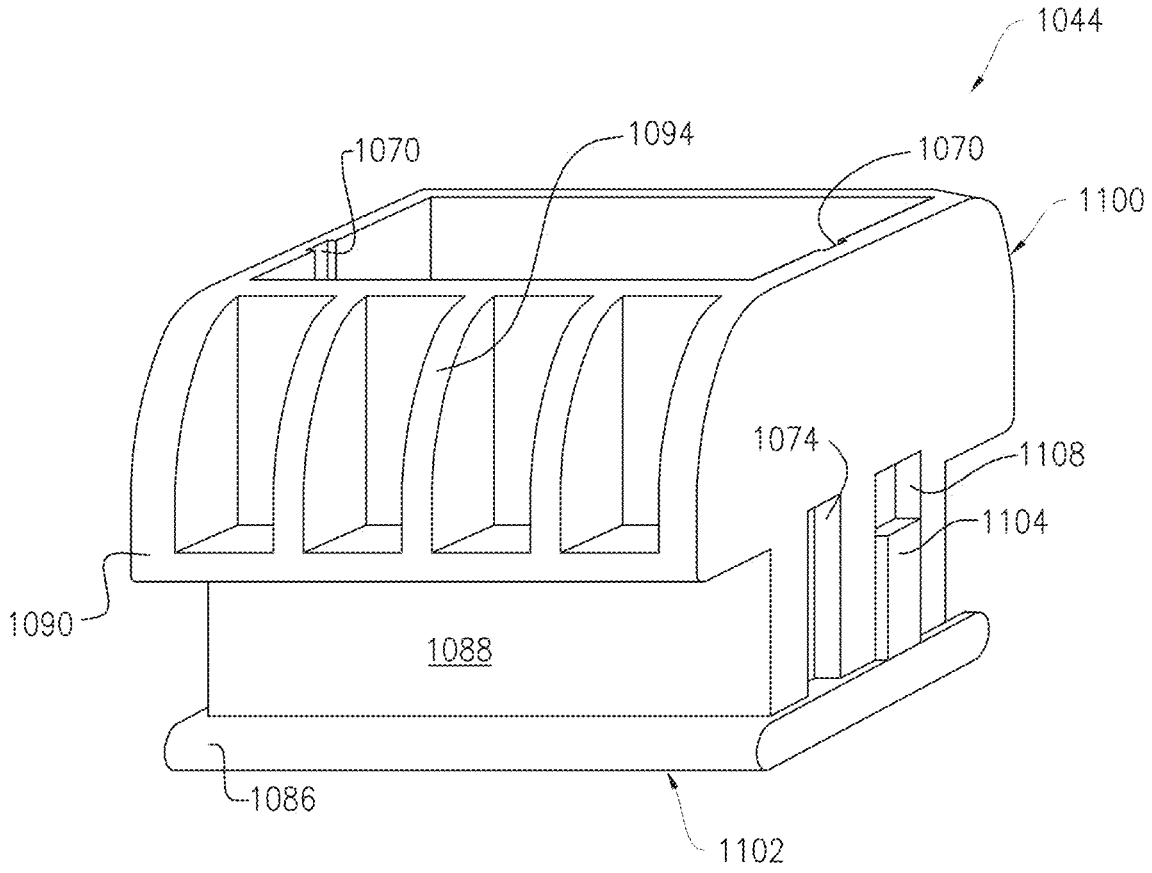
FIG. 20A is a perspective view of a base for a cutter assembly according to the present disclosure.
Figure 20B:
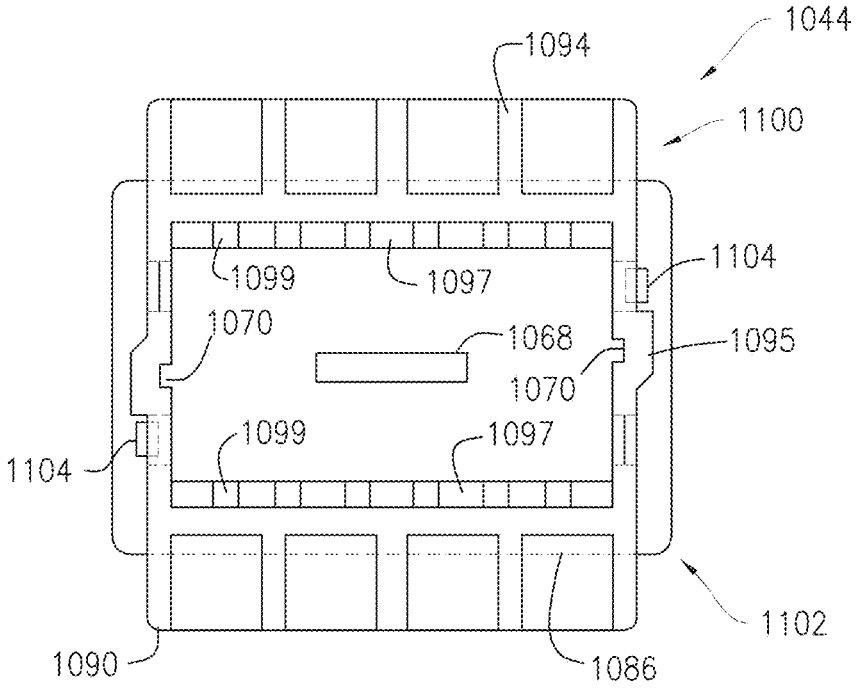
FIG. 20B is a top view of the base shown in FIG. 20A.
Figure 20C:
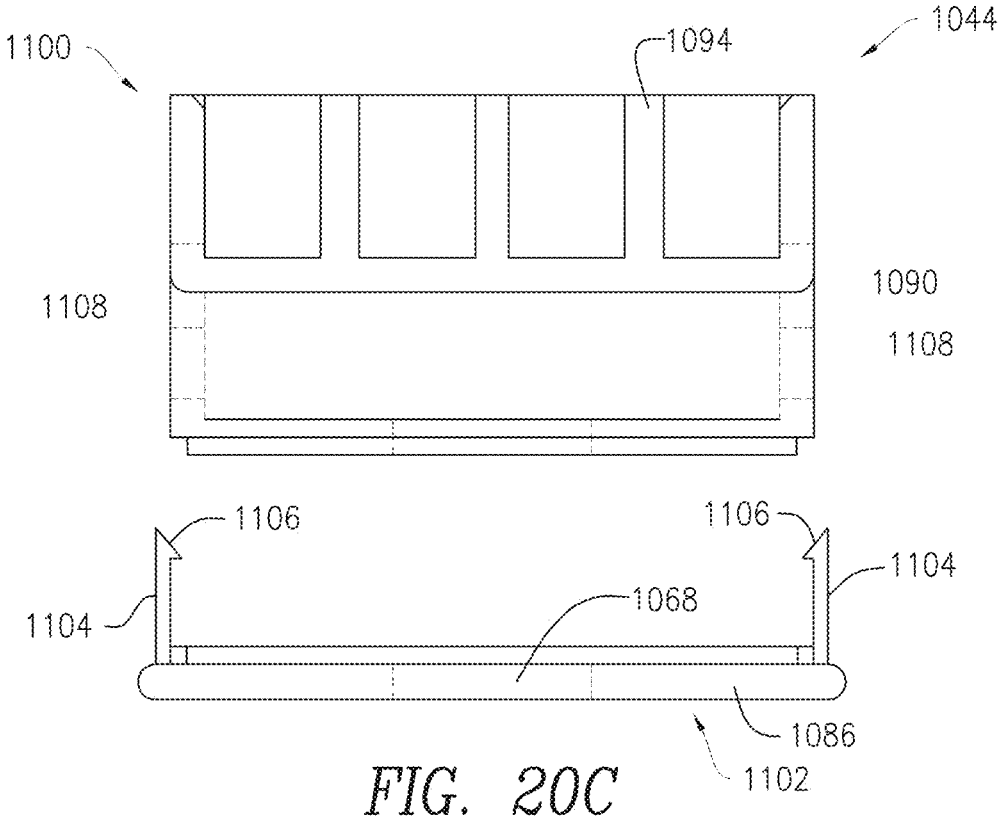
FIG. 20C is an exploded side view of the base shown in FIG. 20A.
Figure 20D:
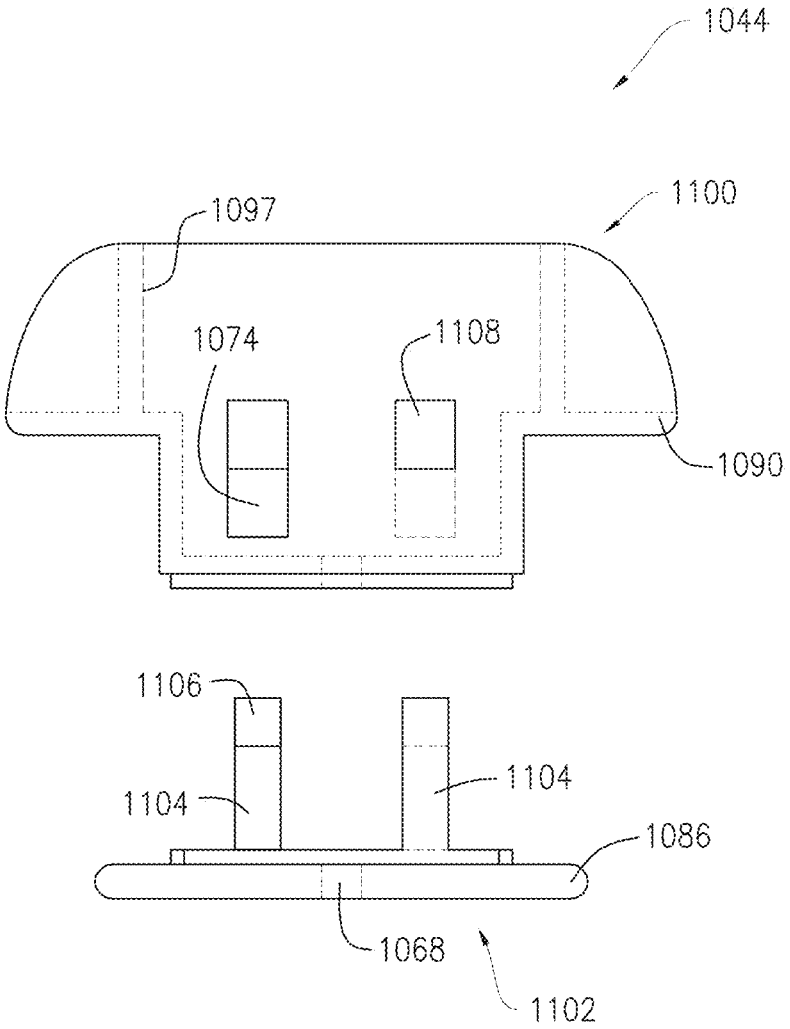
FIG. 20D is an exploded front view of the base shown in FIG. 20A.

FIGS. 20A-D show another base 1044 of a sliding cutter assembly according to some aspects of the present disclosure, including an upper body 1100 and a lower retaining plate 1102. More specifically, FIG. 20A is a perspective view of the base 1044, FIG. 20B is a top view of the base 1044, FIG. 20C is an exploded side elevational view of the base 1044, and FIG. 20D is an exploded front elevational view of the sliding base 1044. As discussed in greater detail below, base 1044 is similar to base 944 of cutter assembly 940 (see, e.g., FIGS. 17A-19C), except for the distinctions as noted herein, and as such can receive, for example, actuating button 946.

As shown in FIG. 20A-D, the base 1044 includes an upper body 1100 having central receptacle for receiving an actuating button, such as for example, actuating button 946, and a lower retaining plate 1102, for securing the base 1044 within a slot of a container, as discussed below. The upper body 1100 of the base 1044 can include vertical channels 1070 sized to slidably receive flanges 972 of the actuating button 946, bumps 1095 (see FIG. 20B) to accommodate the vertical channels 1070, apertures 1074 for receiving stop tabs 976 of the spring button 946, shoulders 1090 having support buttresses 1094, and recessed sidewalls 1088. Upper body 1100 can also include spacers 1099 on an interior wall 1097 to restrain vertical movement of the actuating button 946 relative to the base 1044.

The retaining plate 1102 includes a slot 1068 sized for receiving the blade 950 when the actuating button 946 is depressed to extend the blade 950 through the base 1044, edges 1086, and attachment means 1104 for securing the retaining plate 1102 to the base body 1100. For example, as shown, the attachment means 1104 can comprise tabs 1106 that engage apertures 1108 on the base body 1100, thereby securing the retaining plate 1102 to the base body 1100. Of course, additional means for securing the retaining plate 1102 to the base body 1100 are within the scope of the present disclosure, such as friction fittings, adhesives, welding, and the like.

When the base body 1100 and the retaining plate 1102 are assembled and attached to a container (for example, container 900 shown in FIG. 16), the shoulders 1090 of the body 1100 and the edges 1086 of the retaining plate 1102 and are positioned above and below the container lid, respectively, and the cutter assembly base body 1100 is positioned in the slot 942, with the recessed side walls 1088 bearing against the slot edges to keep the base 1044 slidably engaged in the slot 942 and allowing for travel therealong. The base 1044 with a separate body 1100 and retaining plate 1102 provides certain advantages during assembly of the container. For example, the body 1100 can be inserted through the slot in the container lid with minimal manipulation and the retaining plate 1102 can be easily attached to the body thereafter. Robotic devices or other devices can be utilized in the assembly of containers of the present disclosure.

Figure 21:
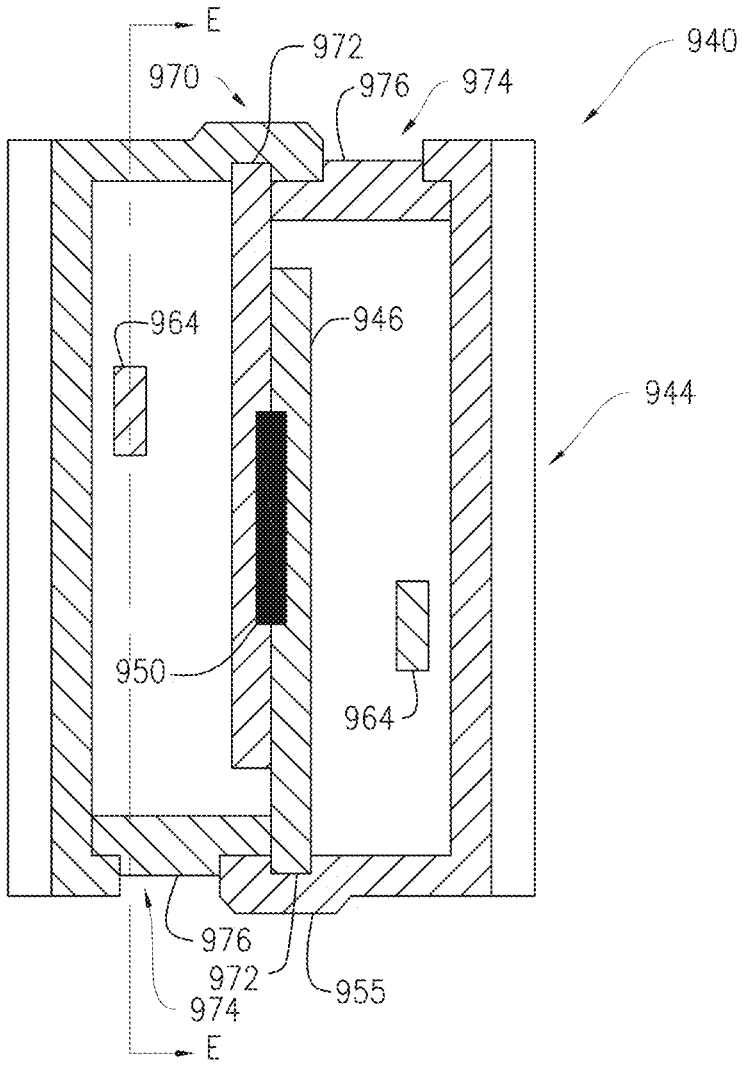
FIG. 21 is a cross-sectional view (taken along line D-D of FIG. 17A) of the cutter assembly of FIG. 17A.

FIG. 21 is a cross-sectional top view showing the actuating button 946 and blade 950 within the base 944 of the cutter assembly 940. As discussed above, the base 944 can include vertical channels 970 sized to receive the flanges 972 of the button 946. As shown in FIG. 21, the vertical channels 970 of the base 944 and flanges 972 of the button 946 assist with aligning the actuating button 946 within the base 944 during operation and provide for vertical travel as the button and blade are moved from a first retracted position (see FIG. 22A) to a second deployed position (see FIG. 22B).

Figure 22A:
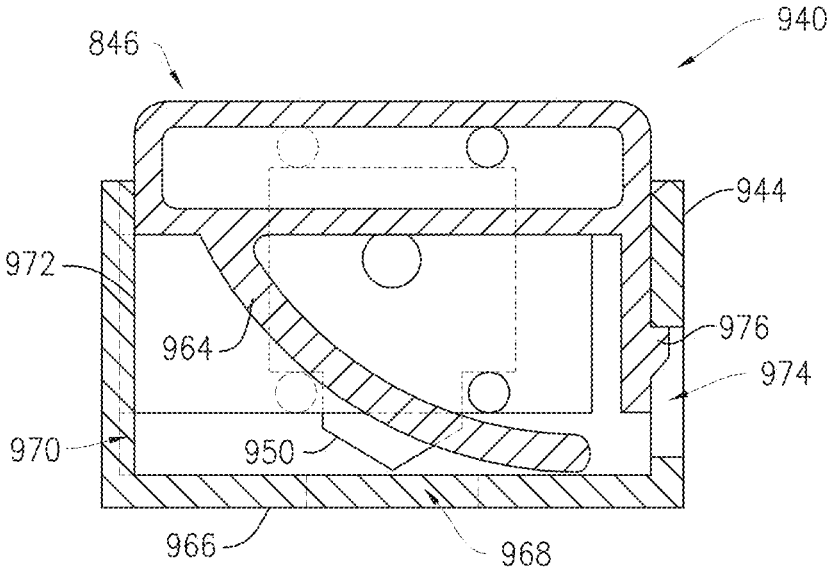
FIG. 22A is a cross-sectional view of the cutter assembly shown in FIG. 20 in a retracted position (taken along line E-E)
Figure 22B:
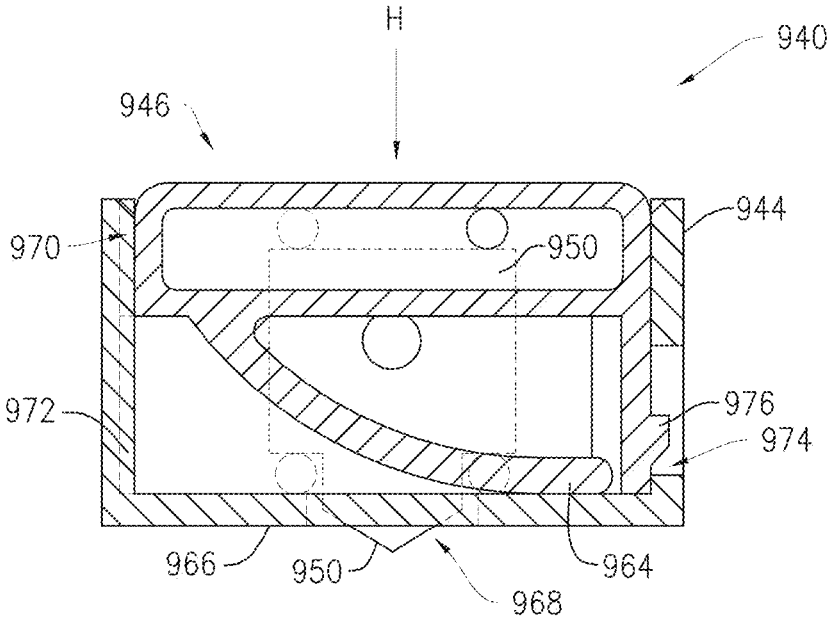
FIG. 22B is a cross-sectional view of the cutter assembly shown in FIG. 20 in a deployed position (taken along line E-E)

FIG. 22A is a cross-sectional view of the slidable cutter assembly 940 of the present disclosure with the blade 950 in a retracted position and FIG. 22B is a cross-sectional view of the slidable cutter assembly 940 of the present disclosure with the blade 950 in an extended, deployed position. As shown in FIG. 22A, the actuating button 946 can be secured within the base 944 by way of the stop tabs 976 of the button 946 being received within the slots 974 of the sliding base 944. As shown in FIG. 22B, upon application of force to button 946 in the direction of arrow H, the leaf springs 964 are elastically deformed so that the button 946 travels towards the base 944 and the blade 950 extends through aperture 968 in the bottom wall 966 of the base 944. Once force has been applied in the direction of arrow H and the blade is extended through aperture 968, the base 944 can be moved along the elongated slot 942 of container 900, thereby cutting the roll-dispensed stock to separate a portion of the stock from the roll. Upon removal of force from button 946, the button 946 and blade 950 return to the retracted position as shown in FIG. 22A. As such, the blade 950 of the cutter assembly 940 does not extend through the aperture 968 of the base 944 in normal operation (e.g., during storage or transportation). The recessed blade is a safety feature that renders the blade 950 unable to contact or cut anything, or anyone, until the container 900 is closed and the cutter assembly 940 is actuated by pressure on the button 946.

Figure 23A:
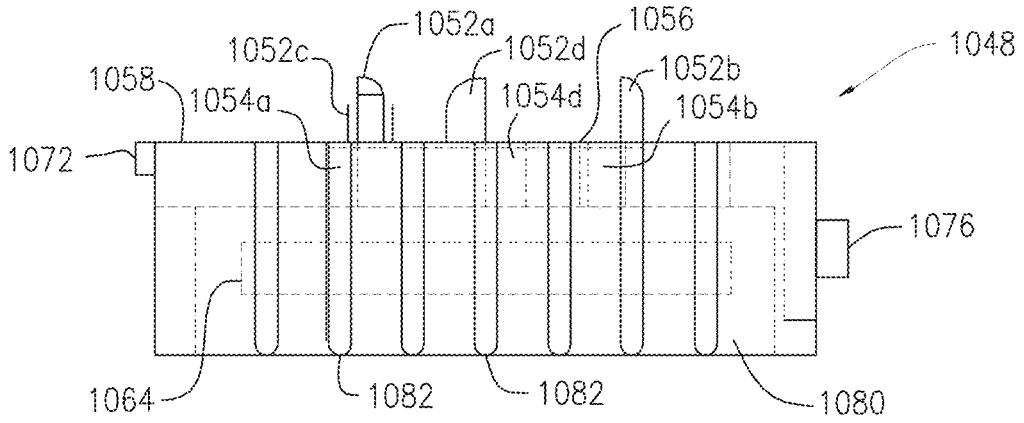
FIG. 23A is a top view of a half of an actuating button according to the present disclosure.
Figure 23B:
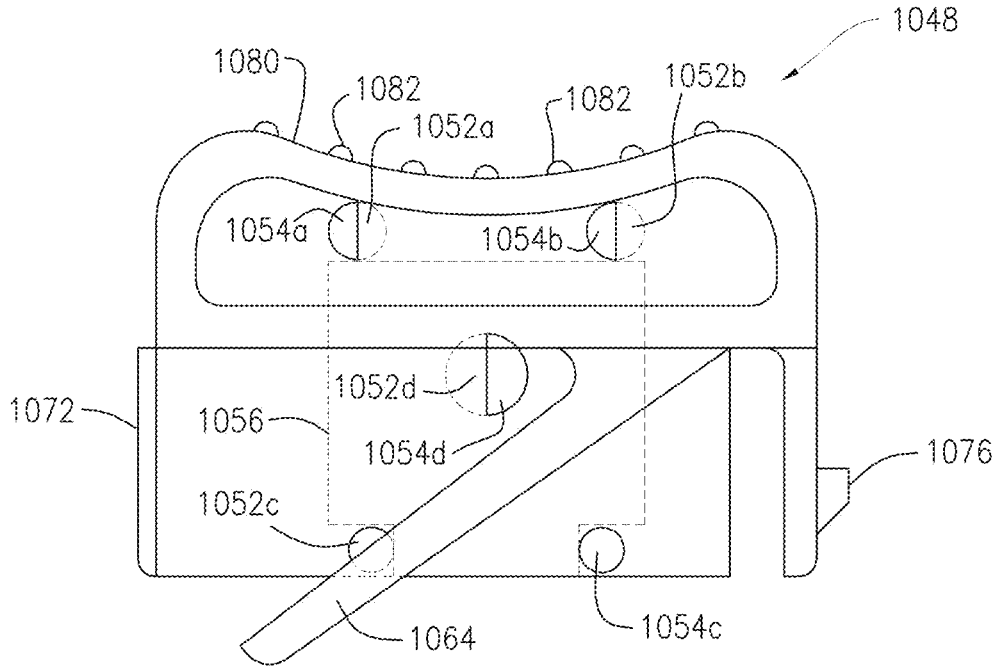
FIG. 23B is a side view of the half of the actuating button of FIG. 22A.
Figure 23C:
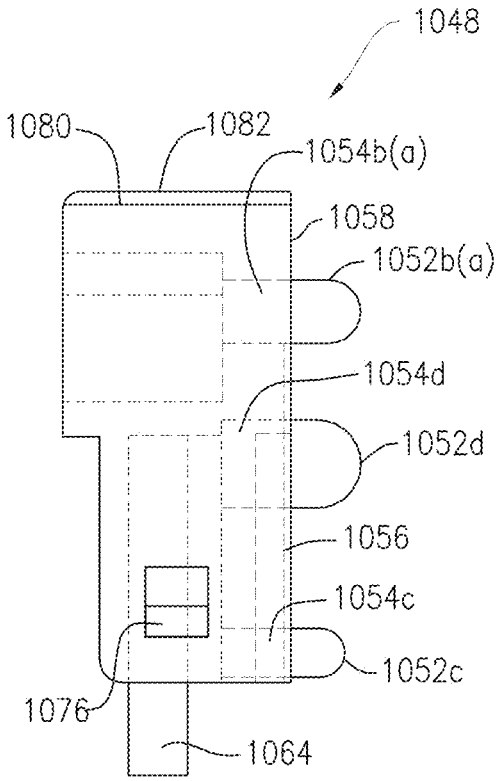
FIG. 23C is a front view of the half of the actuating button of FIG. 22A.

FIGS. 23A-C show another actuating button component 1048 according to some aspects of the present disclosure and are referred to jointly herein. Two such components 1048 can be put together to form an actuating button. More specifically, FIG. 23A is a top view of the button component 1048, FIG. 23B is a side elevational view of the button component 1048, and FIG. 23C is a front elevational view of the button component 1048. Button component 1048 can be substantially similar in structure and function to button component 848, except for the distinctions noted herein.

Button component 1048 can include one or more posts 1052*a-d* and one or more receptacles 1054*a-d*. Posts 1052*a-d* on the button component 1048 can be sized to be received by receptacles 1054*a-d* on a second button component 1048. The posts 1052 and receptacles 1054 can be provided in various configurations. For example, the posts 1052 and receptacles 1054 can have circular cross-sections (e.g., post 1052*c* and receptacle 1054*c*), semi-circular cross-sections (e.g., posts 1052*a,b,d* and receptacles 1054*a,b,d*), or a combination thereof, as shown in FIGS. 23A-C.

The button component 1048 can be provided with a receiving area 1056 on rear wall 1058 of the button component 1048 that is sized and shaped for receiving blade (not shown), thereby preventing movement of the blade relative to the button component 1048 when the button component is fully assembled. The button component 1048 can also include flange portions 1072 that are received by vertical channels in the base of the cutter assembly and stop tabs 1076 that are received by apertures in an exterior wall of the base, as discussed herein.

The button component 1048 can be provided with one or more leaf springs 1064 that are configured to bias the button in a direction away from the sliding base. According to some aspects of the present disclosure, the leaf spring 1064 is integrally formed with the button component 1048. According to other aspects of the present disclosure, the leaf spring 1064 can be replaced, or supplemented, with a traditional coil spring, or any other device configured to provide a bias, without departing from the spirit and scope of the present disclosure.

As shown in FIGS. 23A-C, the button component 1048 can also include a upper contoured surface 1080 that is ergonomically configured to assist a user positioning a finger or thumb on the button surface to apply pressure to the spring button, and for assisting with maintaining a finger or thumb on the surface of the button as the cutter moves along the slot in the container to cut the roll-dispensed stock. For example, the contoured surface 1080 can include a concave curvature to readily accept a user's finger and can further include a plurality of grip-enhancing ridges 1082, allowing the user to easily apply lateral pressure and slide the spring button (and cutter assembly) along a container to separate a portion of roll-dispensed stock.

Figure 24A:
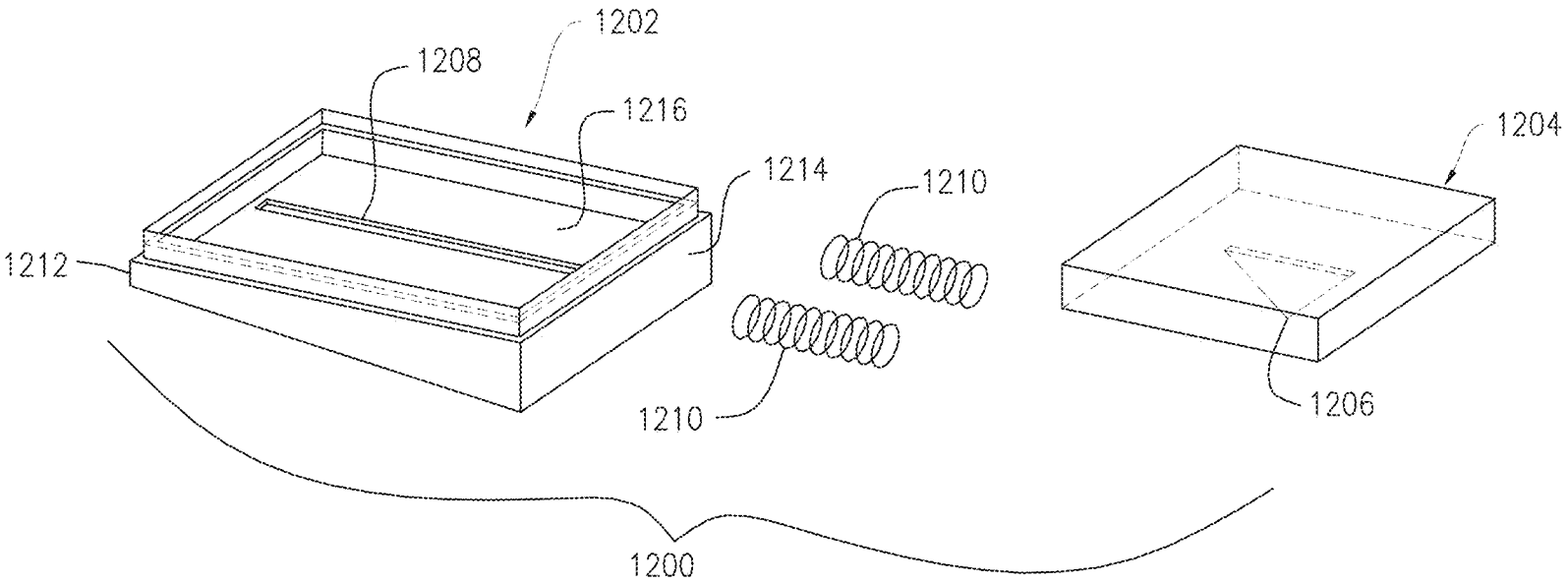
FIG. 24A is an exploded view of a cutter assembly according to the present disclosure.
Figure 24B:
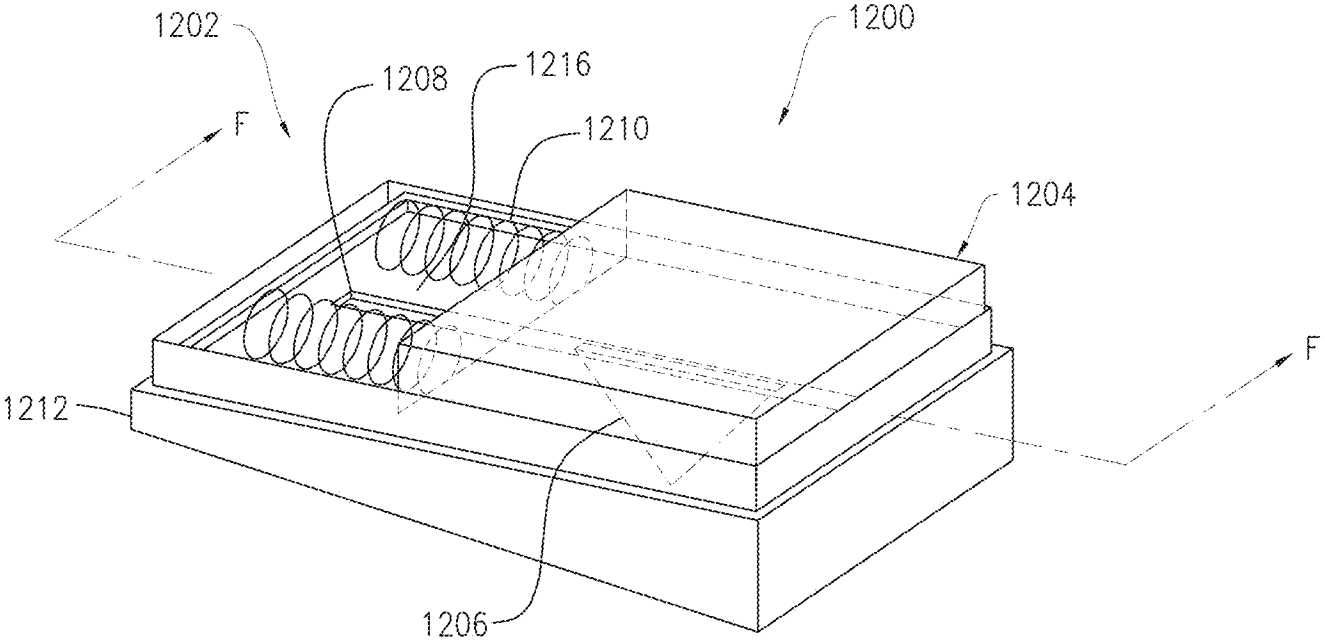
FIG. 24B is a perspective view of the cutter assembly shown in FIG. 24A.
Figure 24C:
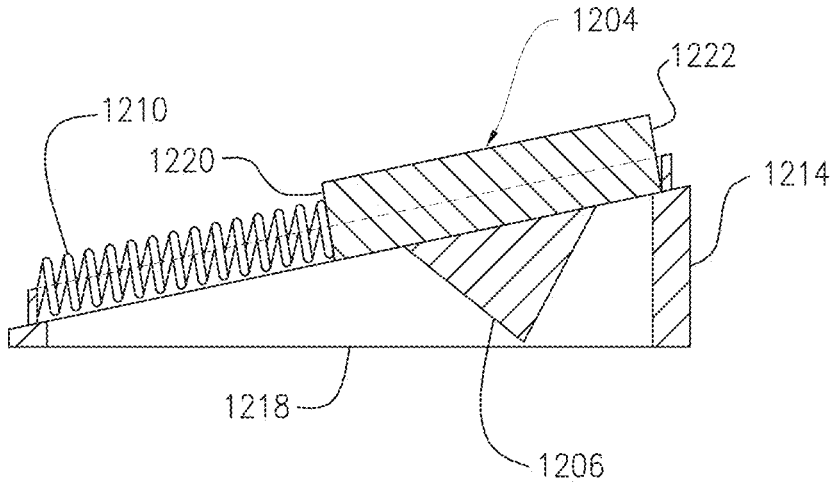
FIG. 24C is a cross-sectional view (taken along line F-F of FIG. 24B) of the cutter assembly shown in FIG. 24A in a retracted configuration.
Figure 24D:
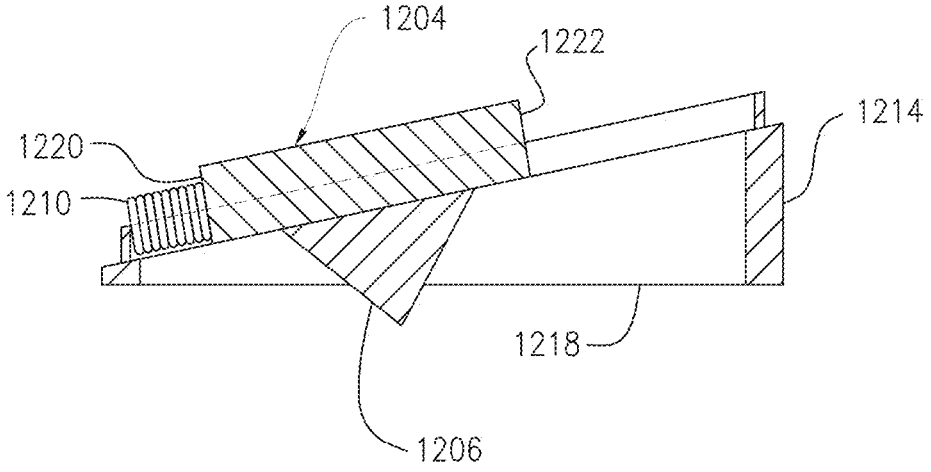
FIG. 24D is a cross-sectional view (taken along line F-F of FIG. 24B) of the cutter assembly shown in FIG. 24A in a deployed configuration.

FIGS. 24A-D show a sliding cutter assembly 1200 having a ramp configuration according to some aspects of the present disclosure. More specifically, FIG. 24A is a perspective exploded view of cutter assembly 1200, FIG. 24B is a perspective view of the cutter assembly 1200. FIG. 24C a cross-sectional view (taken along line F-F of FIG. 24B) of the cutter assembly 1200 positioned in a retracted position, and FIG. 24D is a cross-sectional view (taken along line F-F of FIG. 24B) of the cutter assembly 1200 positioned in a deployed position.

As shown in FIGS. 24A and 24B, cutter assembly 1200 includes a base 1202 and a button 1204 having a blade 1206 attached thereto. The base 1202 is configured as a ramp, having one end 1212 with a height less than the height of the other end 1214 and a bearing surface 1216, on which button 1204 slides. The base 1202 also includes a slot 1208, extending from bearing surface 1216 through a bottom surface 1218 (see FIGS. 24C and 24D), sized to accommodate and receive the blade 1206, which is attached to a bottom surface of the button 1204 and extends into slot 1208. Button 1204 is connected with the base 1202 by way of a rail, a recess, or any other means known in the art suitable to maintain a sliding engagement between button 1204 and base 1202. The cutter assembly 1200 can also include a biasing means 1210, discussed below. The cutter assembly 1200 can be affixed to a roll-dispensed stock container, as described in connection with any of the figures of the present disclosure, such as by connection to a track disposed on a container, or by being retained within a slot provided through a lid of a container. For example, the base 1204 of the cutter assembly 1200 can be provided with channels, similar to base channels 978 described in connection with FIGS. 17A-19C.

As shown in FIG. 24C, the button 1204 and blade 1206 are positionable in a retracted configuration, at the distal end 1214 of the base 1202. The blade 1206 is sized such that when positioned in the retracted configuration, the blade does not extend below the bottom surface 1218 of the base 1202. As shown in FIG. 24D, the button 1204 and blade 1206 are also positionable in a deployed configuration, at the proximal end 1212 of the base 1202. The blade 1206 is also sized such that when positioned in the deployed configuration, the blade extends below the bottom surface 1218 of the base 1202.

Cutter assembly 1200 can be provided with biasing means 1210 for maintaining the positions of the of the button 1204 and blade 1206 in the retracted configuration. For example, as shown in the figures, biasing means 1210 can include one or more (compression) coil springs positioned between the proximal end 1212 of the base 1202 and a front face 1220 of the button 1204. Alternatively, biasing means 1210 can include one or more (tension) coil springs positioned between the distal end 1214 of the base 1202 and a rear face 1222 of the button 1204. It is further contemplated by the present disclosure that any of the biasing means disclosed herein can be utilized to provide a biasing force that maintains the components of the cutter assembly 1200 in the retracted configuration. According to some aspects of the present disclosure, biasing means 1210 can include one or more levers (springs), torsion bars, or a combination thereof. Of course, those of skill in the art will appreciate that any number of mechanisms are available for providing a biasing force to maintain the button 1204 and blade 1206 in the retracted configuration, until actuated by a user, without departing from the spirit and scope of the present disclosure.

In operation, a user provides pressure to the button 1204, towards the lower end 1212 of the base 1202, thereby moving the cutter assembly 1200 from the retracted configuration to the deployed configuration shown in FIG. 24D. With the blade 1206 extended below the bottom surface 1218 of base 1202, the user can slide the cutter assembly across the roll-dispensed stock, to sever a portion of stock from the roll, such as described in connection with FIGS. 4-6. Once the roll-dispensed stock has been cut, the user releases pressure from the button 1204 and the biasing means 1210 returns the button 1204 and blade 1206 to the retracted configuration shown in FIG. 24C. The present disclosure also contemplates a method for dispensing roll-dispensed stock from a container. The method includes the steps of opening a lid to access an opening in the body of the container, drawing the roll-dispensed stock out of the body through the opening and over a surface of the container, closing the lid against the surface of the container, pressing the lid against the surface of the container to secure the roll-dispensed stock between the lid and the surface by compressing the roll-dispensed stock against one or more fixation strips, sliding the cutter along a length of the lid from a first position to a second position to cut through the roll-dispensed stock, and separating a portion of the roll-dispensed stock from the roll.

Another method for dispensing roll-dispensed stock from a container can include the steps of opening a container lid to access an opening in the body of the container, drawing the roll-dispensed stock out of the body through the opening and over a surface of the container, closing the lid against the surface of the container, pressing the lid against the surface of the container to secure the roll-dispensed stock between the lid and the surface by compressing the roll-dispensed stock, for example, against one or more fixation strips, pressing an actuating button on the cutter assembly to move a blade from a first retracted position to a second deployed position, sliding the cutter assembly along a length of the lid from a first position to a second position to cut through the roll-dispensed stock and thereby separate a portion of the roll-dispensed stock from the roll, while pressing the actuating button, and releasing pressure from the cutter assembly to automatically move the blade from the second deployed position back to the first retracted position.

Figure 25:
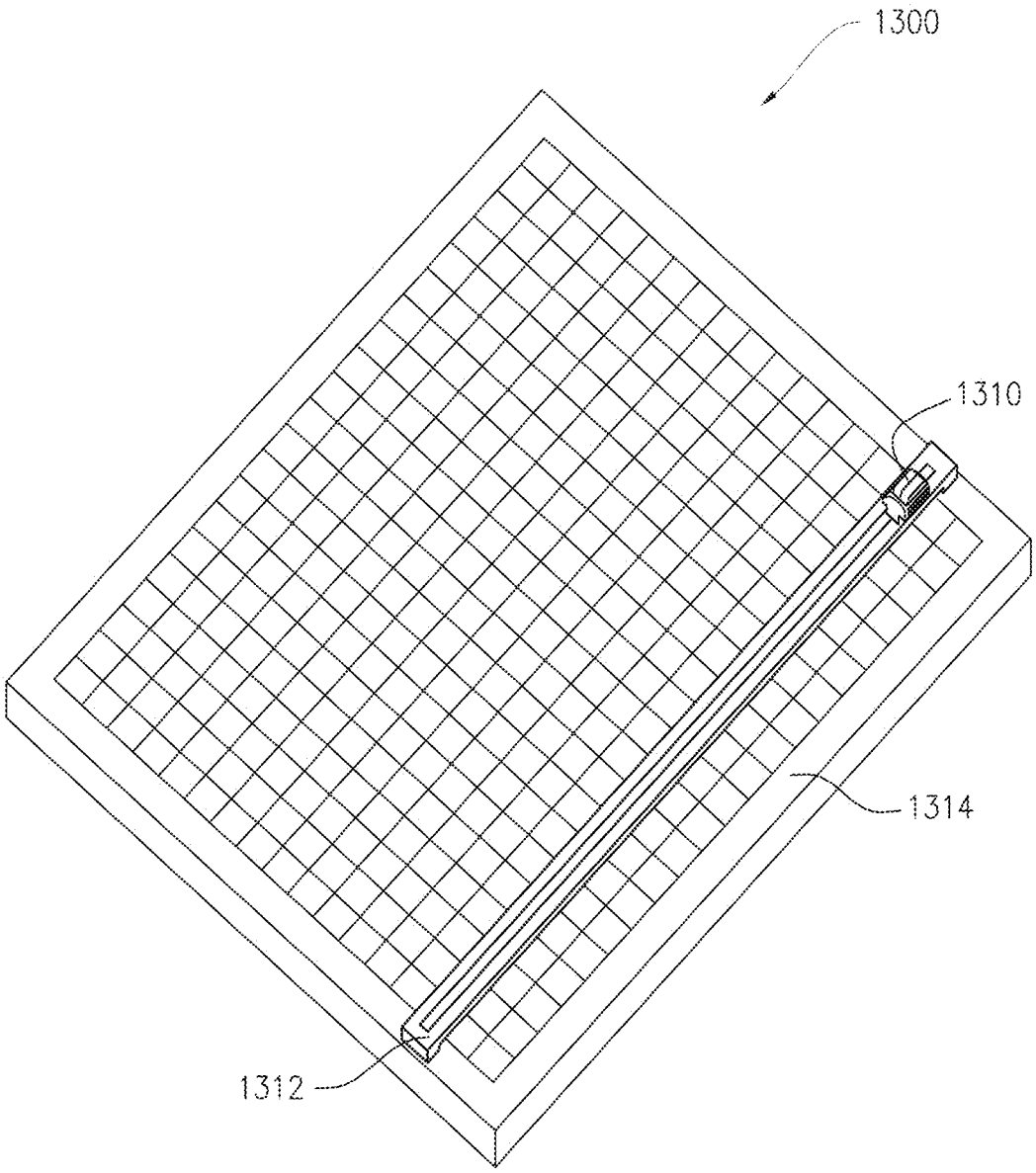
FIG. 25 is a perspective view of a paper cutting board including the slidable cutter assembly of FIG. 16.

Any of the slidable cutter designs disclosed herein can be utilized in connection with other applications which require the cutting of stock, similar to the various forms of roll-dispensed stock described herein. For example, FIG. 25 shows a paper cutting board 1300 having a sliding cutter assembly 1310 positioned on a track 1312 that is attached to a cutting surface 1314. According to some aspects of the present disclosure, cutter assembly 1310 can be substantially similar in design and operation to cutter assembly 940, described in connection with FIGS. 16-19C, or any of the slidable cutter designs disclosed herein. For example, a user can position a piece of paper between the cutting surface 1314 and the track 1312, depress a button of the cutter assembly to expose a blade thereof for cutting, slide the cutter assembly 1310 along the length of the track 1312, thereby cutting the paper, and release the button of the cutter assembly 1310 to allow the blade to return to a safe retracted position. Of course, those of ordinary skill in the art will appreciate that the slidable cutter designs of the present disclosure can be utilized in connection with various applications, in addition to those described herein, without departing from the spirit and scope of the present disclosure.

It will be noted that the cutters disclosed herein can be with or without fixation strips depending on the nature of the material to be cut.

Figure 26A:
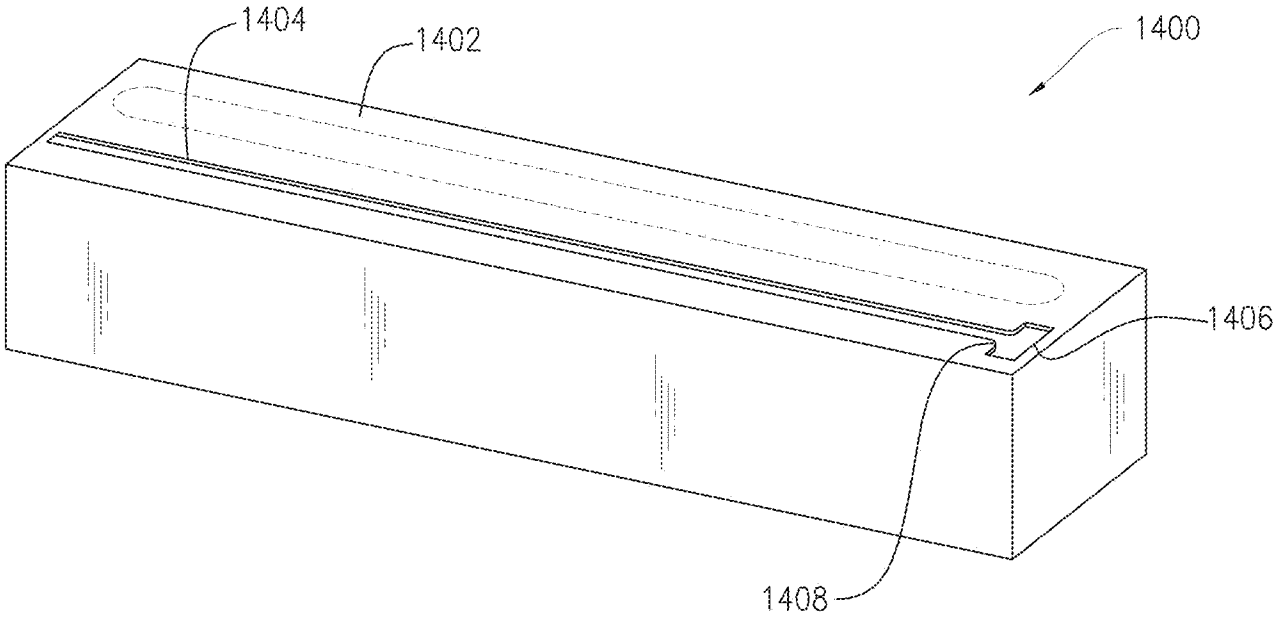
FIG. 26A is a perspective view of a roll-dispensed stock container according to the present disclosure including an elongated slot with an aperture sized to receive a cutter assembly.
Figure 26B:
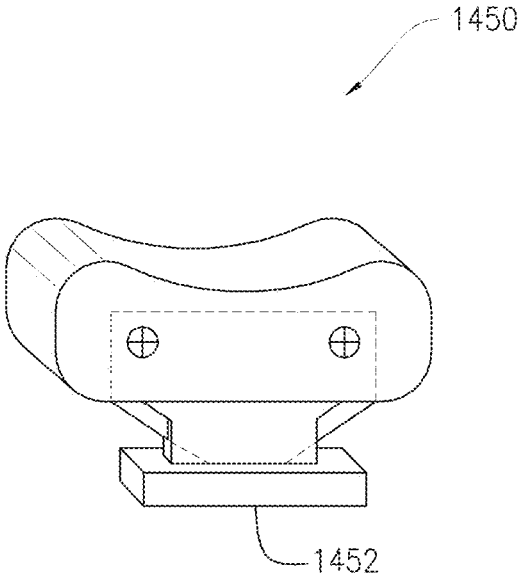
FIG. 26B is a perspective view of a cutter assembly according to the present disclosure that is received by the aperture of the roll-dispensed stock container of FIG. 26A.
Figure 27A:
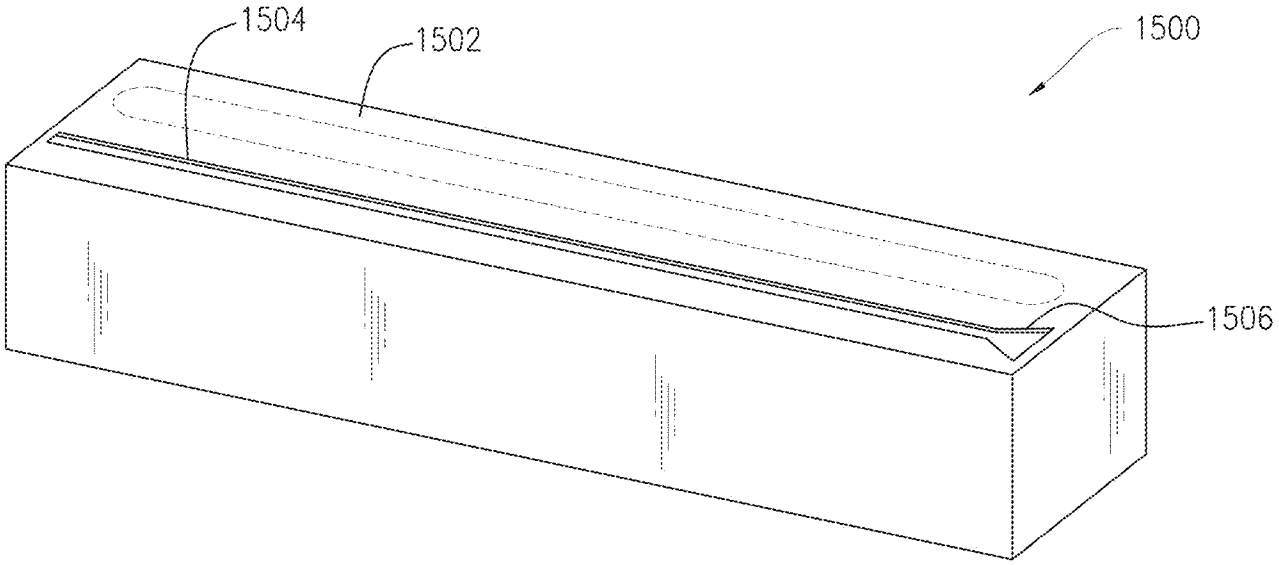
FIG. 27A is a perspective view of another roll-dispensed stock container according to the present disclosure including an elongated slot with an aperture sized to receive a cutter assembly.
Figure 27B:
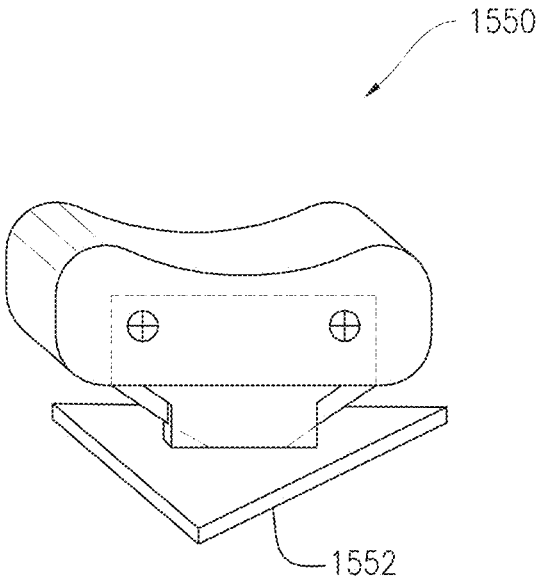
FIG. 27B is a perspective view of a another cutter assembly according to the present disclosure that is received by the aperture of the roll-dispensed stock container of FIG. 27A.

FIG. 26A is a perspective view of a roll-dispensed stock container 1400 according to the present disclosure including a top wall 1402 with an elongated slot 1404 having an aperture 1406 that is sized to receive a cutter assembly 1450, shown in FIG. 26B. The aperture 1406 can be sized to accommodate a base 1452 of the cutter assembly 1450, in an orientation other than the direction of travel during operation, to facilitate insertion of the cutter assembly into the elongated slot during assembly of the container. For example, the base 1452 cutter assembly 1450 can be inserted into the aperture 1406 and the cutter assembly 1450 can then be rotated to secure the cutter assembly 1450 within the elongated slot 1404. Aperture 1406 can have chamfered edges 1408 to facilitate the process of rotating the cutter assembly 940 from an insertion to a locked position. FIG. 27A is a perspective view of a roll-dispensed stock container 1500 including a top wall 1502, an elongated slot 1504, and an aperture 1506 that is sized to receive a triangular base 1552 of a cutter assembly 1550, aperture 1506 having a triangular configuration. It is contemplated by the present disclosure that the apertures described in connection with FIGS. 26A and 27A can be provided in any shape or configuration that allows a cutter assembly to be inserted into the aperture in a first orientation and then rotated to a second orientation, thereby securing the cutter assembly and facilitation operation.

Figure 28:
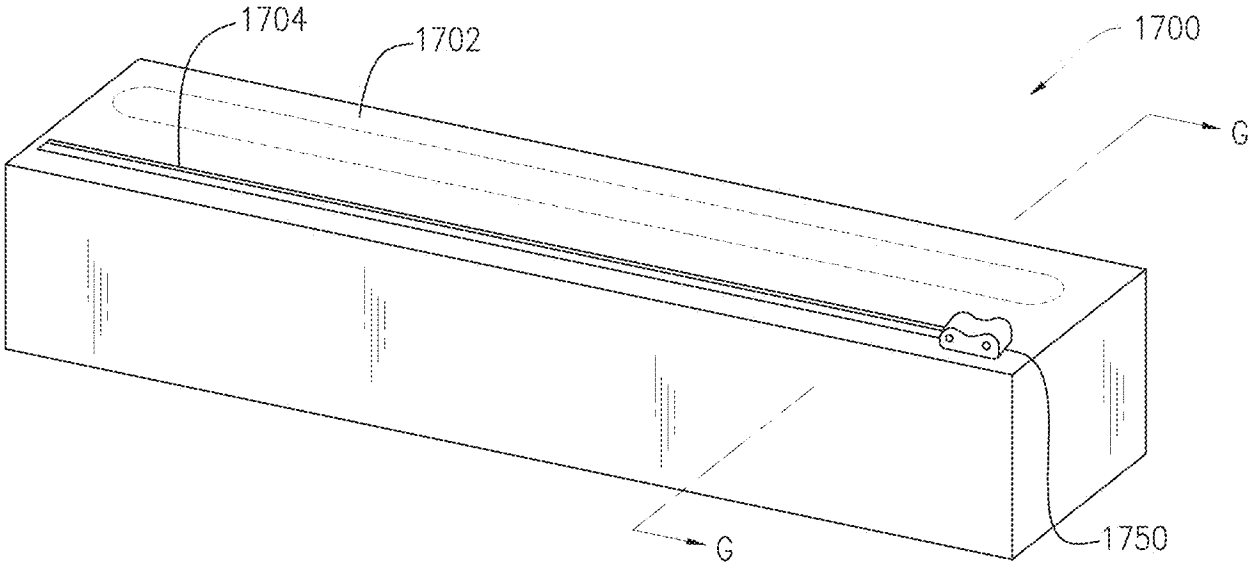
FIG. 28 is a perspective view of a roll-dispensed stock container according to the present disclosure including another slidable cutter assembly having a deformable retaining means.
Figure 29:
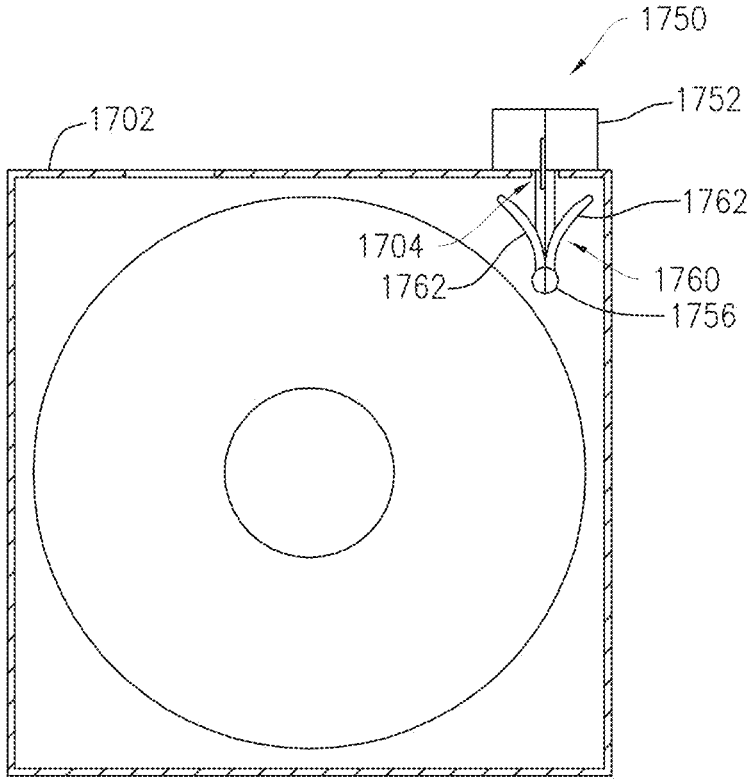
FIG. 29 is a cross-sectional view (taken along line G-G of FIG. 29) of the roll-dispensed stock container of FIG. 29.
Figure 30:
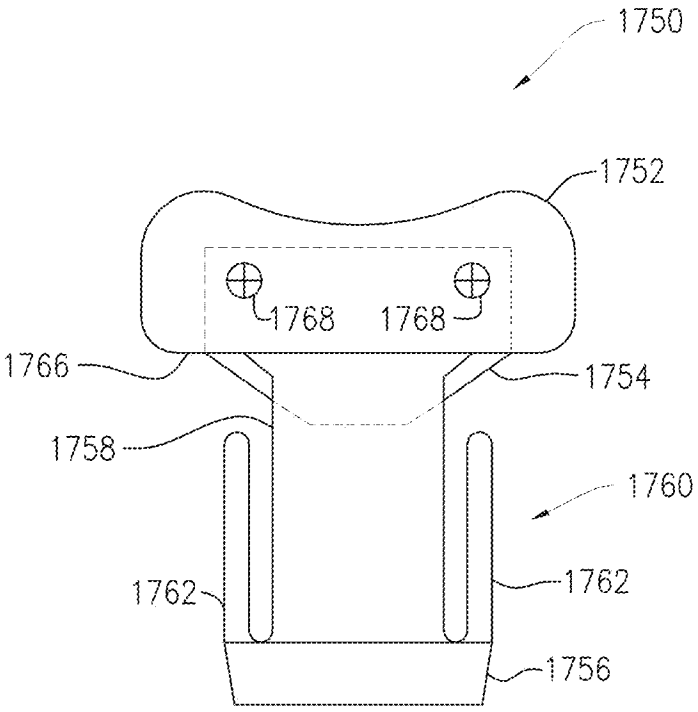
FIG. 30 is a side view of the slidable cutter assembly of FIG. 29.

FIG. 28 is a perspective view of another roll-dispensed stock container 1700 according to the present disclosure including a slidable cutter assembly 1750 having a deformable retaining means. FIG. 29 is a cross-sectional view (taken along line G-G of FIG. 29) of the roll-dispensed stock container 1700. FIG. 30 is a side view of the slidable cutter assembly 1700 and FIG. 31 is a front view of the slidable cutter assembly 1700.

As shown in FIGS. 28-31, the roll-dispensed stock container 1700 includes a top wall 1702 with an elongated slot 1704 that receives a cutter assembly 1750. The cutter assembly 1750 includes a blade housing 1752, a blade 1754, a base 1756, a stem 1758 connecting the blade housing 1752 to the base 1756, and retaining device 1760 for securing the cutter assembly 1750 within the elongated slot 1704 in the top wall 1702 of the container 1700.

Figure 31:
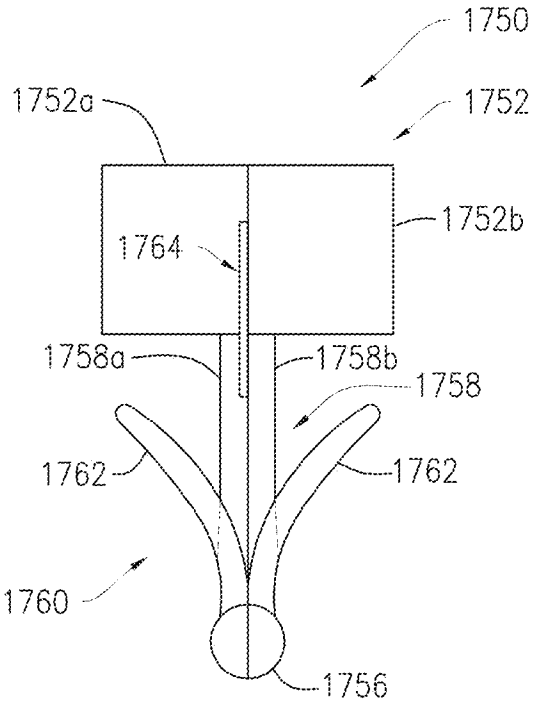
FIG. 31 is a front view of the slidable cutter assembly of FIG. 29.

As shown in FIGS. 30 and 31, the blade housing 1752 can comprise a first half 1752*a* and a second half 1752*b*, the stem 1758 can comprise first half 1758*a* and second half 1758*b*, and the blade 1754 can be disposed therebetween. According to some aspects of the present disclosure, at least one of the first half 1752*a* and the second half 1752*b* of the blade housing 1752 and the first half 1758*a* and the second half 1758*b* of the stem 1758 can include a recess 1764 sized to accept the blade 1754, as shown in FIG. 31. The blade 1754 can be sized such that a portion thereof extends below a lower face 1766 of the blade housing 1752, to cut a portion of roll-dispensed stock drawn over the elongated slot 1704 in the top wall 1702 of the container 1700.

As shown in FIG. 30, lower face 1766 of the blade housing 1752 can include a rounded profile towards front and rear sides of the blade housing 1752, allowing for the roll dispensed stock to remain flat as the cutter assembly 1750 is moved along the elongated slot 1704 of the container 1700 during the cutting process. The first half 1752*a* and the second half 1752*b* of the blade housing 1752 can be joined together with screws 1768. Alternatively, the first half 1752*a* and the second half 1752*b* of the blade housing 1752 can be joined together with an adhesive, or any other suitable means for securing the components together, such as those described above in connection with first and second halves of spring button 946 and shown in FIG. 18. According to other aspects of the present disclosure, the blade housing can also be a unitary structure.

According to some aspects of the present disclosure, the retaining device 1760 can include a plurality of fingers 1762 that depend from the base 1756, each extending in an arcuate path towards the blade housing 1752 and away from the stem 1758, as shown in FIG. 31. The fingers 1762 can be configured such that they are normally positioned as shown in FIG. 31, but when compressed towards the stem 1758, provide a spring/biasing force in the opposite direction (e.g., towards their normal position shown in FIG. 31). The fingers 1762 can be formed from any material that is resiliently deformable (e.g., thermoplastic, metal, etc.), such that the fingers 1762 can be compressed towards the stem 1758 and return to their original position.

During assembly of container 1700, the cutter assembly 1750 is inserted into the elongated slot 1704, which has a width that is roughly equal to the width of base 1756 of the cutter assembly 1750, causing the fingers 1762 of the retaining device 1760 to inwardly deform, thus reducing their width, such that that can pass through the elongated slot 1704. Once the fingers 1762 have passed through the elongated slot 1704, they return to their normal position, as shown in FIG. 29, having a width larger than the width of the elongated slot 1704. Accordingly, the cutter assembly 1750 is retained in the slot 1704 by the lower face 1766 of the blade housing 1752 (also having a width greater than the slot 1704) bearing against a top surface of top wall 1702 of the container 1700 and by upper tips of the fingers 1762 bearing against a bottom surface of the top wall 1702 of the container 1700. The retaining device 1760 can be provided in various configurations. As such, the fingers 1762 can be provided with varying geometries, material thicknesses, dimensions, and the like, suitable for a particular application. For example, the flanges can be configured to be wide enough to prevent the sliding cutter assembly 1750 from turning in the slot 1704 to reduce binding and to cut in a straight line. According to other aspects of the present disclosure, the blade 1754 and stem 1758 can have a with great enough such that the cutter assembly 1750 is prevented from turning in the slot 1704 to reduce binding and to cut in a straight line.

Figure 32:
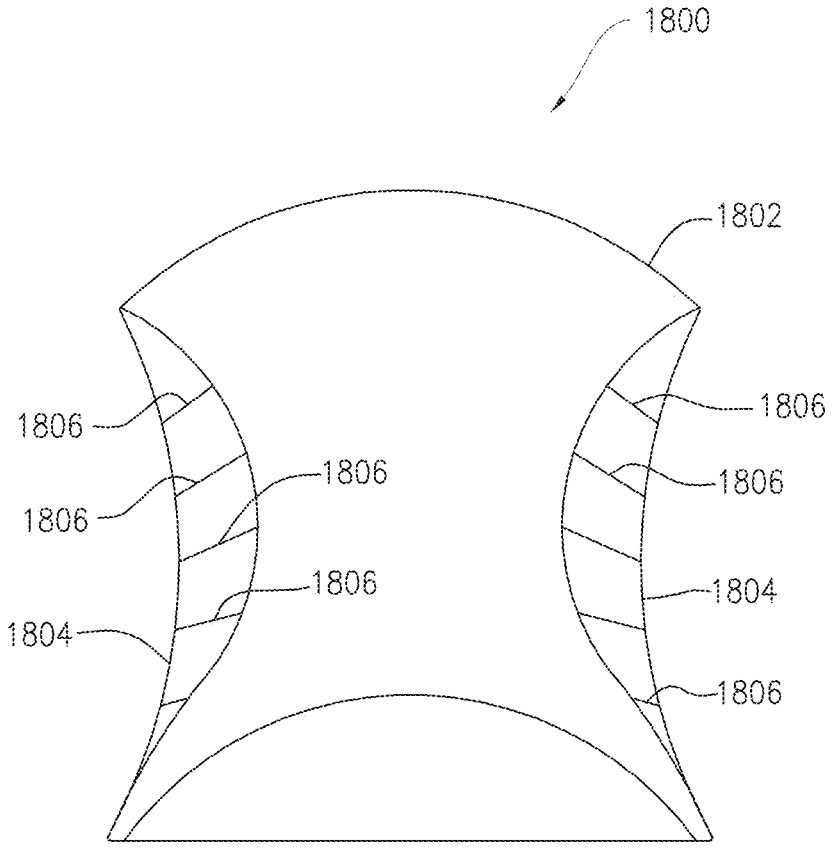
FIG. 32 is a perspective view of a cutter housing for use with a slidable cutter assembly according to the present disclosure.

FIG. 32 is a perspective view of a cutter housing, indicated generally at 1800, according to some aspects of the present disclosure. The cutter housing 1800 can be used with any sliding cutter assembly. For example, the blade housing 1752, described in connection with FIGS. 30-31, can be configured in accordance with cutter housing 1800. Of course, the geometries of cutter housing 1800 shown in FIG. 32 can be modified, without departing from the scope of the present disclosure.

As shown, the cutter housing 1800 can include a body 1802 having a semi-cylindrical shape with recessed, contoured surfaces 1804 along lateral sides thereof. The contoured surfaces 1804 can be ergonomically configured for a user's thumb and finger to grasp the cutter housing and for applying a lateral force to the cutter housing 1800, thereby moving a slidable cutter assembly along a slot in a container to cut roll-dispensed stock. The recessed, contoured surfaces 1804 can have a concave curvature to accept a user's fingers and can further include a plurality of grip-enhancing ridges 1806, allowing the user to easily apply lateral force and slide the cutter housing 1800 (and cutter assembly) along a container to separate a portion of roll-dispensed stock. In addition to providing enhanced ergonomics, the contoured surfaces 1804 also reduce manufacturing costs, by reducing the volume of the cutter housing 1800, and thus requiring less material for the cutter housing 1800.

Figure 33:
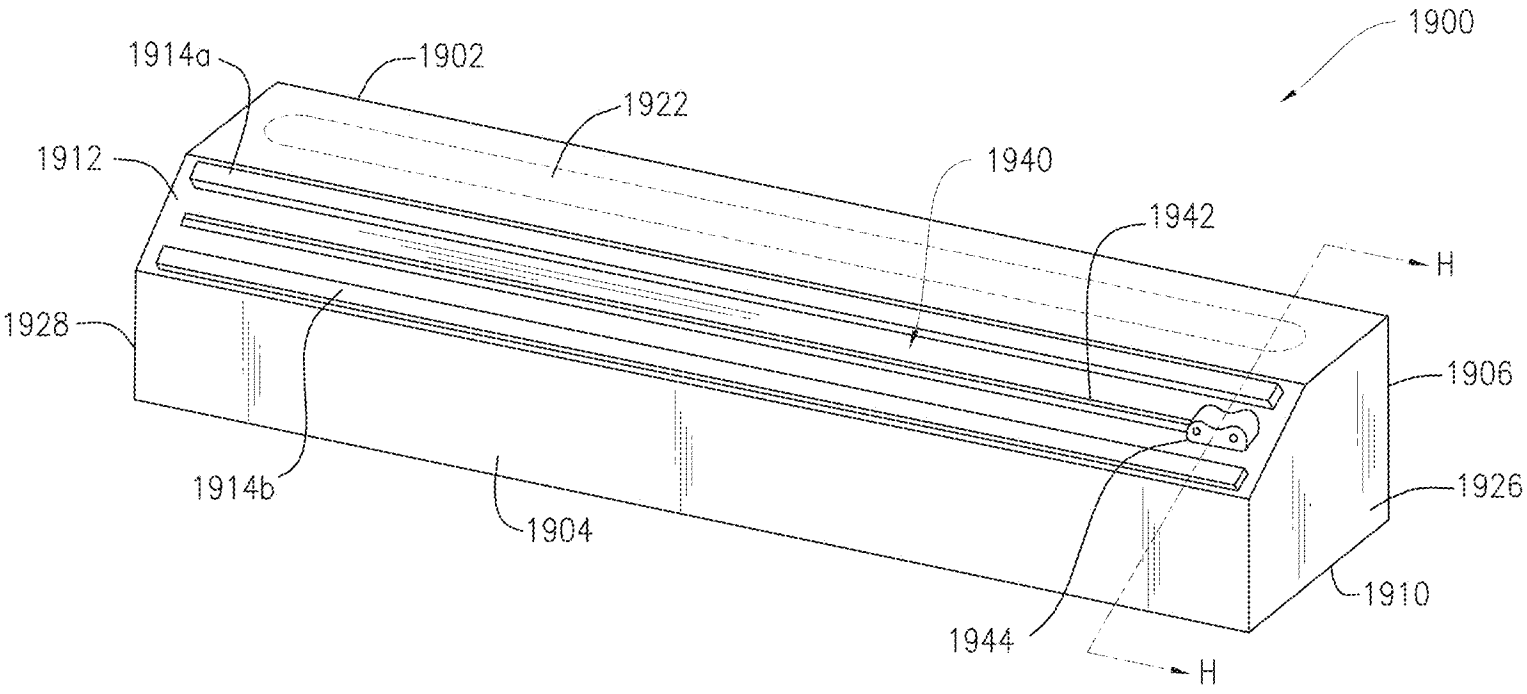
FIG. 33 is a perspective view of a roll-dispensed stock container according to the present disclosure including an elevated fixation strip on an angled support wall.
Figure 34:
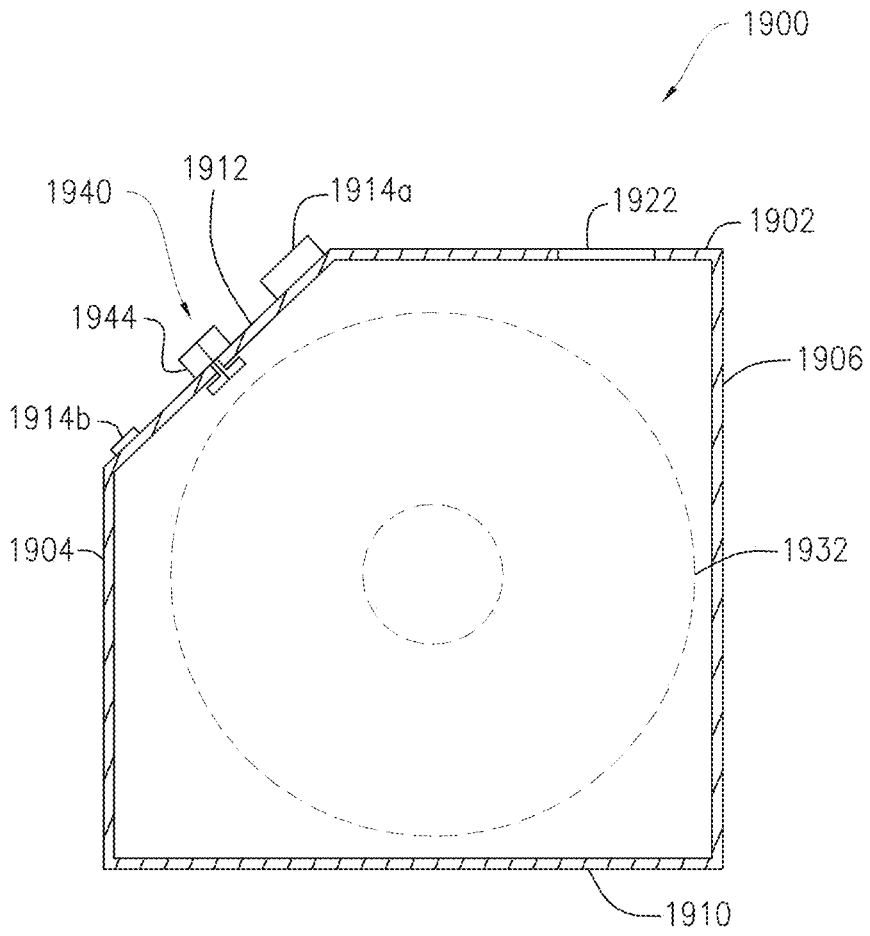
FIG. 34 is a cross-sectional view (taken along line H-H of FIG. 33) of the roll-dispensed stock container of FIG. 33.

FIG. 33 is a perspective view of a roll-dispensed stock container, indicated generally at 1900, according to the present disclosure and FIG. 34 is a cross-sectional view (taken along line H-H of FIG. 33) of the roll-dispensed stock container 1900 of FIG. 33. The container 1900 includes a top wall 1902, a front wall 1904, a rear wall 1906, a bottom wall 1910, side walls 1926 and 1928, and a support wall 1912. As shown, the height of the front wall 1904 can be less than the height of the rear wall 1906, such that the support wall 1912 is disposed at an angle relative to the top wall 1902 and the front wall 1904. The top wall 1902, front wall 1904, rear wall 1906, bottom wall 1910, support wall 1912, and side walls 1926 and 1928 form an enclosure dimensioned to receive a roll of roll-dispensed stock 1932. The container 1900 can include a perforated section 1922 in the top wall 1902, configured to be at least partially separated from the top wall 1902 to form an opening 1930 (see FIGS. 39-41) for accessing and dispensing roll-dispensed stock from the enclosure.

The container 1900 can include a cutter assembly, indicated generally at 1940. As shown in FIG. 33, the cutter assembly 1940 includes an elongated aperture 1942 disposed through the support wall 1912 and a slidable cutter 1944 with a blade or edge disposed therein. The slidable cutter 1944 travels along the aperture 1942 to cut the roll-dispensed stock 1932. The cutter assembly 140 can be provided in any desirable configuration, such as those disclosed herein, for example, cutter assembly 1750 described in connection with FIGS. 28-31. The cutter assembly 1940 can fit within a recess defined by the space under the right angle formed by the intersection of the planes extending from the top wall 1902 and the front wall 1904, and thus the cutter assembly 1940 does not extend beyond the bounds of the container 1900, so configured. The cutter assembly 1940 is thereby protected from damage during shipping or storage of the container 1900. Due to the recessed positioning of the cutter assembly 1940, multiple containers 1900 can be stacked relative to each other without imparting pressure or force on the cutter assembly 1940, thereby preventing potential damage to the cutter assembly 1940.

The support wall 1912 can be provided with fixation strips 1914*a* and 1914*b* along both sides of the aperture 1942, for maintaining the position of the roll-dispensed stock prior to cutting. As shown best in FIG. 34, fixation strip 1914*a* is located on the support wall 1912, near the top wall 1902 and has a thickness greater than fixation strip 1914*b*. Accordingly, the fixation strip 1914*a* extends a greater distance from the support wall 1912 than fixation strip 1914*b*. The fixation strips 1914*a* and 1914*b* can be made out of any material suitable for securely and removably holding the roll-dispensed stock while it is being cut. Those of ordinary skill in the art will appreciate that the material used for the fixation strips 1914*a* and 1914*b* is preferably selected based on the properties of the roll-dispensed stock material. In one example, if the roll-dispensed stock is plastic wrap, foil, wax paper, parchment paper, tape, duct tape, or wrapping paper, the fixation strips 1914*a* and 1914*b* can be made of a silicone material, flexible polymer, or another material that provides light tack or clings to the roll-dispensed stock. The fixation strips 1914*a* and 1914*b* can also be made of a low-tack adhesive (e.g., fugitive, "booger," or "credit card" glue), an ultraviolet (UV) light curing adhesive, a wax, a tacky material, or any other material suitable for securely and removably holding or gripping the roll-dispensed stock.

Figure 35:
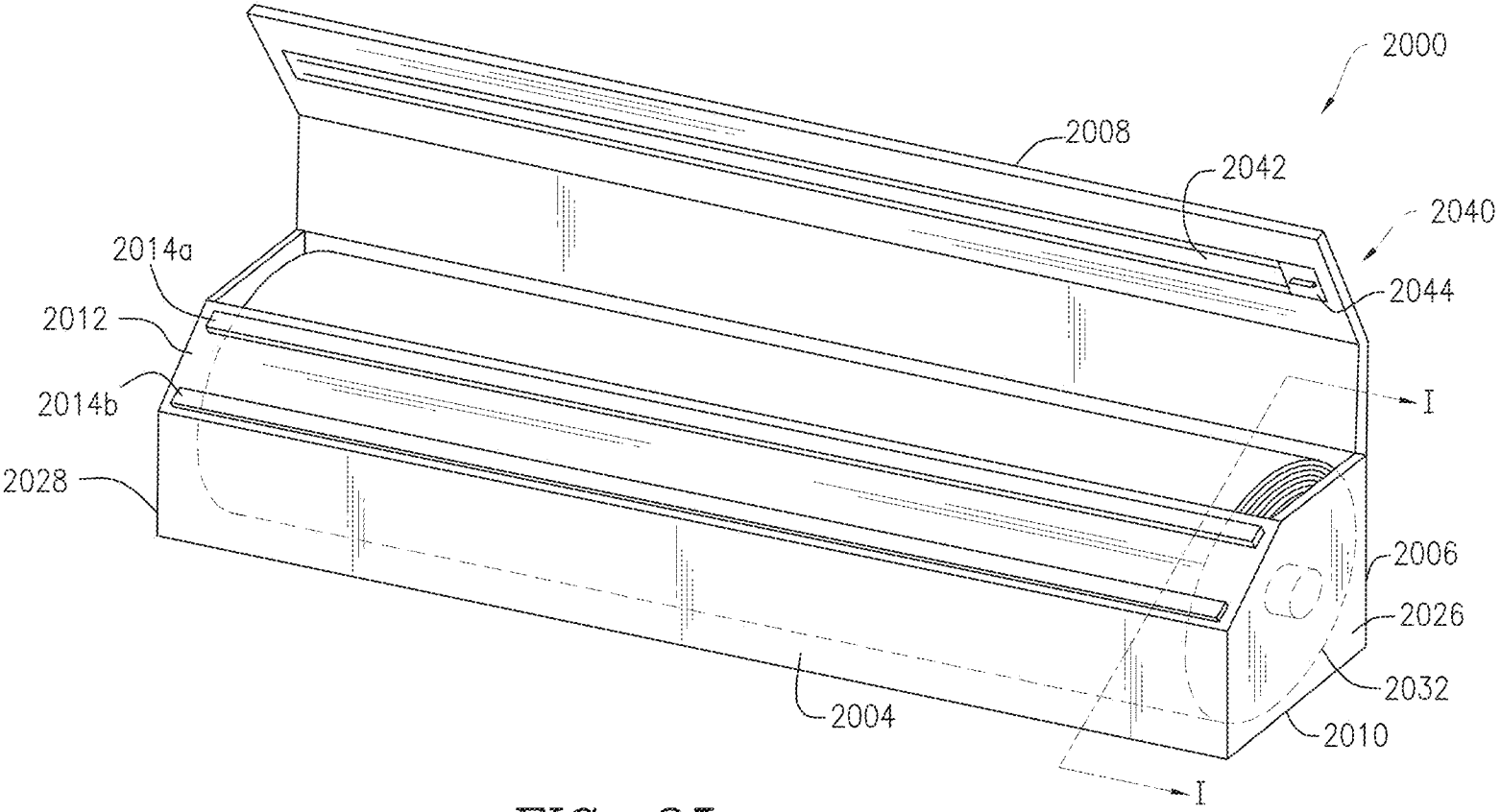
FIG. 35 is a perspective view of a roll-dispensed stock container according to the present disclosure including a lid and an elevated fixation strip on an angled support wall.
Figure 36:
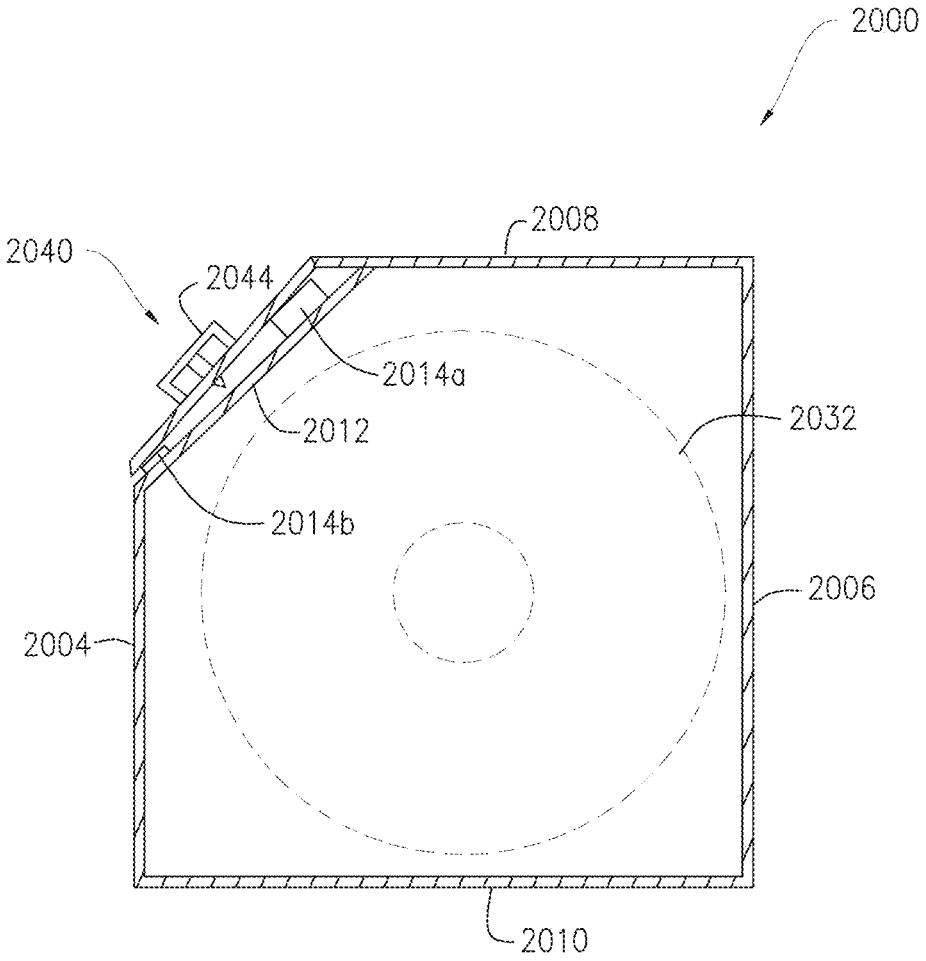
FIG. 36 is a cross-sectional view (taken along line I-I of FIG. 35) of the roll-dispensed stock container of FIG. 35.

FIG. 35 is a perspective view of another roll-dispensed stock container, indicated generally at 2000, and FIG. 36 is a cross-sectional view (taken along line I-I of FIG. 35) of the roll-dispensed stock container 2000 of FIG. 35 positioned in a closed configuration. As such, FIGS. 35 and 36 are referred to jointly herein. Container 2000 includes like structures, and is thus similar to container 100 discussed above in connection with FIGS. 1-6, except for the distinctions noted herein.

As shown, container 2000 includes a front wall 2004, a rear wall 2006, a bottom wall 2010, side walls 2026 and 2028, a support wall 2012, a lid 2008, a cutter assembly 2040 with a track 2042 and a slidable cutter 2044, and fixation strips 2014*a* and 2014*b* disposed on the support wall 2012, on both sides of the cutter assembly 2040, when the lid 2008 is in a closed configuration. Fixation strips 2014*a* and 2014*b* maintain the position of the roll-dispensed stock 2032 prior to cutting and can be made out of any material suitable for securely and removably holding the roll-dispensed stock 2032. Fixation strip 2014*a* is located near an opening 2030 for dispensing roll-dispensed stock from the container 2000 and, as shown best in FIG. 36, has a thickness greater than fixation strip 2014*b*, which is located near the intersection of the front wall 2004 and support wall 2012. Accordingly, the fixation strip 2014*a* extends a greater distance from the support wall 2012 than fixation strip 2014*b*.

Figure 37:
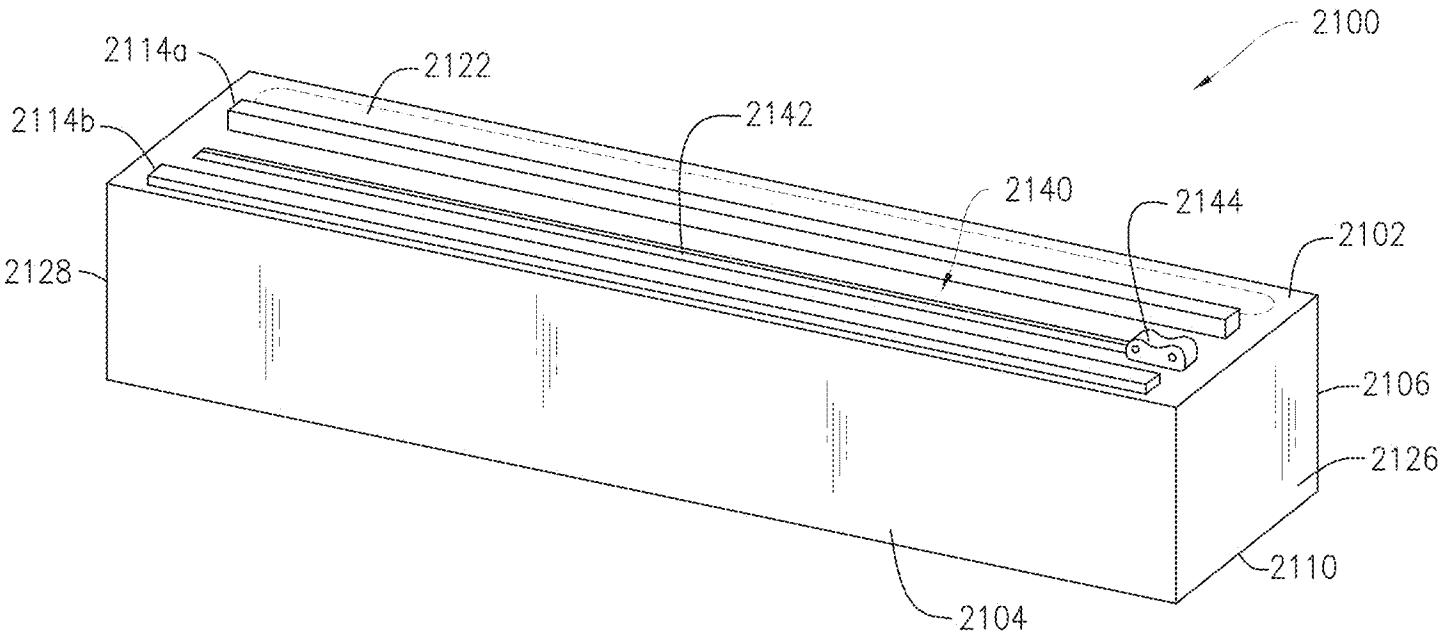
FIG. 37 is a perspective view of another roll-dispensed stock container according to the present disclosure including an elevated fixation strip.
Figure 38:
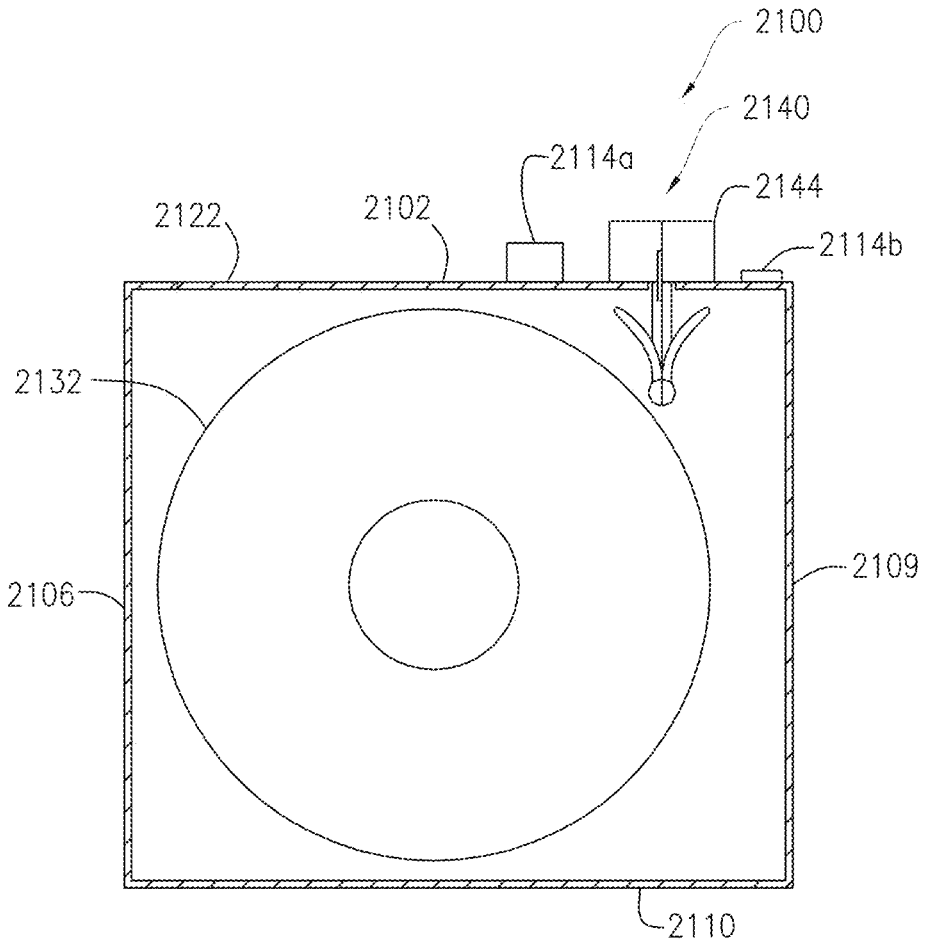
FIG. 38 is a cross-sectional view (taken along line H-H of FIG. 37) of the roll-dispensed stock container of FIG. 37.

FIG. 37 is a perspective view of another roll-dispensed stock container, indicated generally at 2100, and FIG. 38 is a cross-sectional view (taken along line J-J of FIG. 37) of the roll-dispensed stock container 2100 of FIG. 37. As such, FIGS. 37 and 38 are referred to jointly herein. The container 2100 includes a top wall 2102, a front wall 2104, a rear wall 2106, a bottom wall 2110, and side walls 2126 and 2128. The top wall 2102, front wall 2104, rear wall 2106, bottom wall 2110, and side walls 2126 and 2128 form an enclosure dimensioned to receive a roll of roll-dispensed stock 2132. The container 2100 can include a perforated section 2122 in the top wall 2102, configured to be at least partially separated from the top wall 2102 to form an opening (see, e.g., opening 1930 shown in FIGS. 39-41) for accessing and dispensing roll-dispensed stock from the enclosure.

The container 2100 can include a cutter assembly, indicated generally at 2140. As shown in FIG. 37, the cutter assembly 2140 includes an elongated aperture 2142 disposed through the top wall 2102 and a slidable cutter 2144 with a blade or serrated edge disposed therein. The slidable cutter 2144 travels along the aperture 2142 to cut the roll-dispensed stock 2132. The cutter assembly 2140 can be provided in any desirable configuration, such as those disclosed herein, for example, cutter assembly 1750 described in connection with FIGS. 28-31.

The top wall 2102 of container 2100 can be provided with fixation strips 2114*a* and 2114*b* along both sides of the aperture 2142, for maintaining the position of the roll-dispensed stock prior to cutting. As shown best in FIG. 38, fixation strip 2114*a* is located near the perforated section 2122 and has a thickness greater than fixation strip 2114*b*, which is located near the intersection of the top wall 2102 and front wall 2104. Accordingly, the fixation strip 2114*a* extends a greater distance from the top wall 2102 than fixation strip 2114*b*. The fixation strips 2114*a* and 2114*b* can be made out of any material suitable for securely and removably holding the roll-dispensed stock while it is being cut. Fixation strips 2114*a* and 2114*b* can also be applied to other containers having a generally rectangular cross-section, such as those described in U.S. patent application Ser. No. 15/399,863, the entire disclosure of which is hereby incorporated by reference. Fixation strips 2114*a* and 2114*b* are similar to fixation strips 1914*a* and 1914*b* (see FIGS. 33 and 34).

Figure 39:
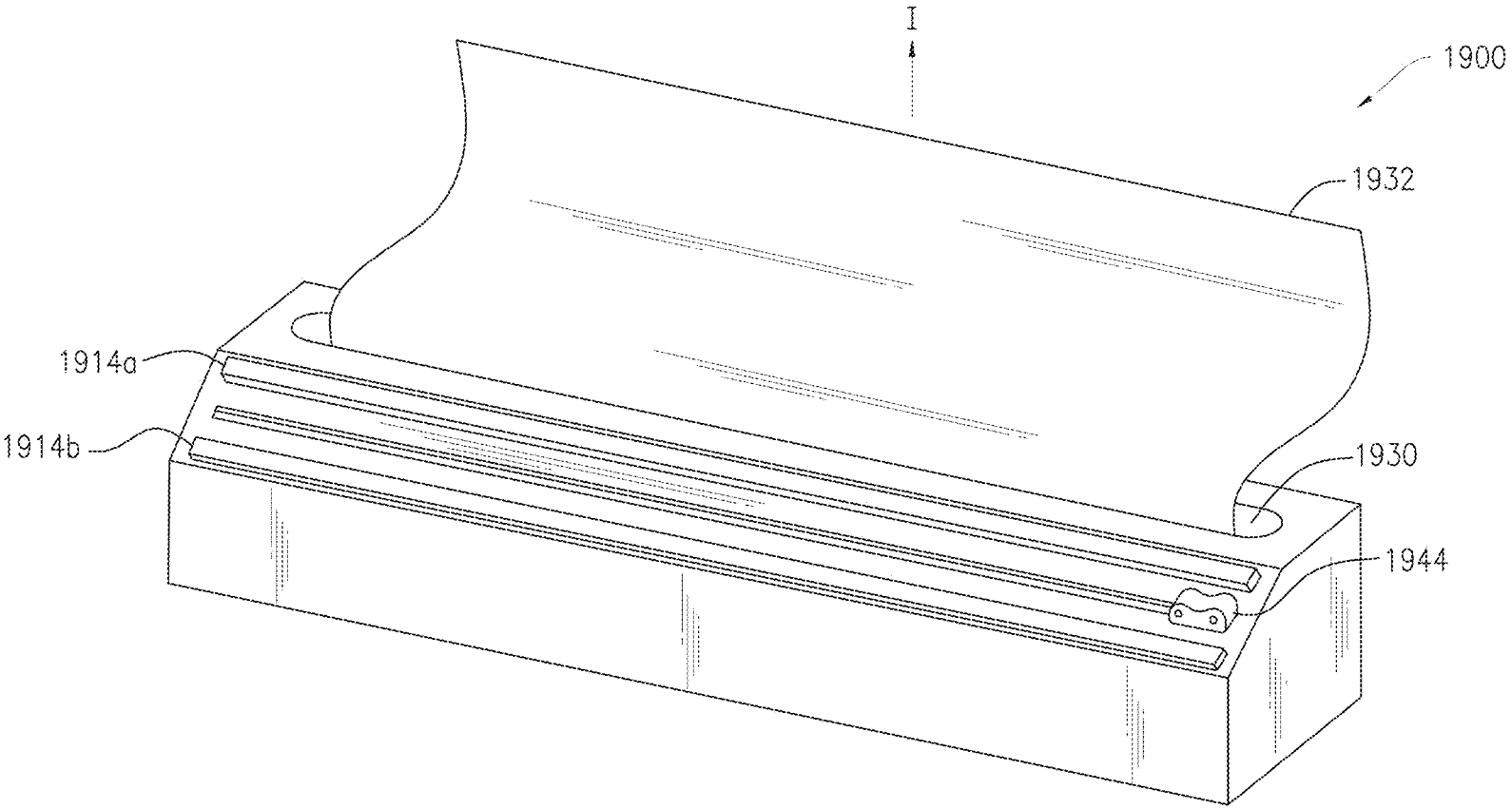
FIG. 39 is a perspective view of the roll-dispensed stock container of FIG. 33 with stock extending from the roll in a first position.
Figure 40:
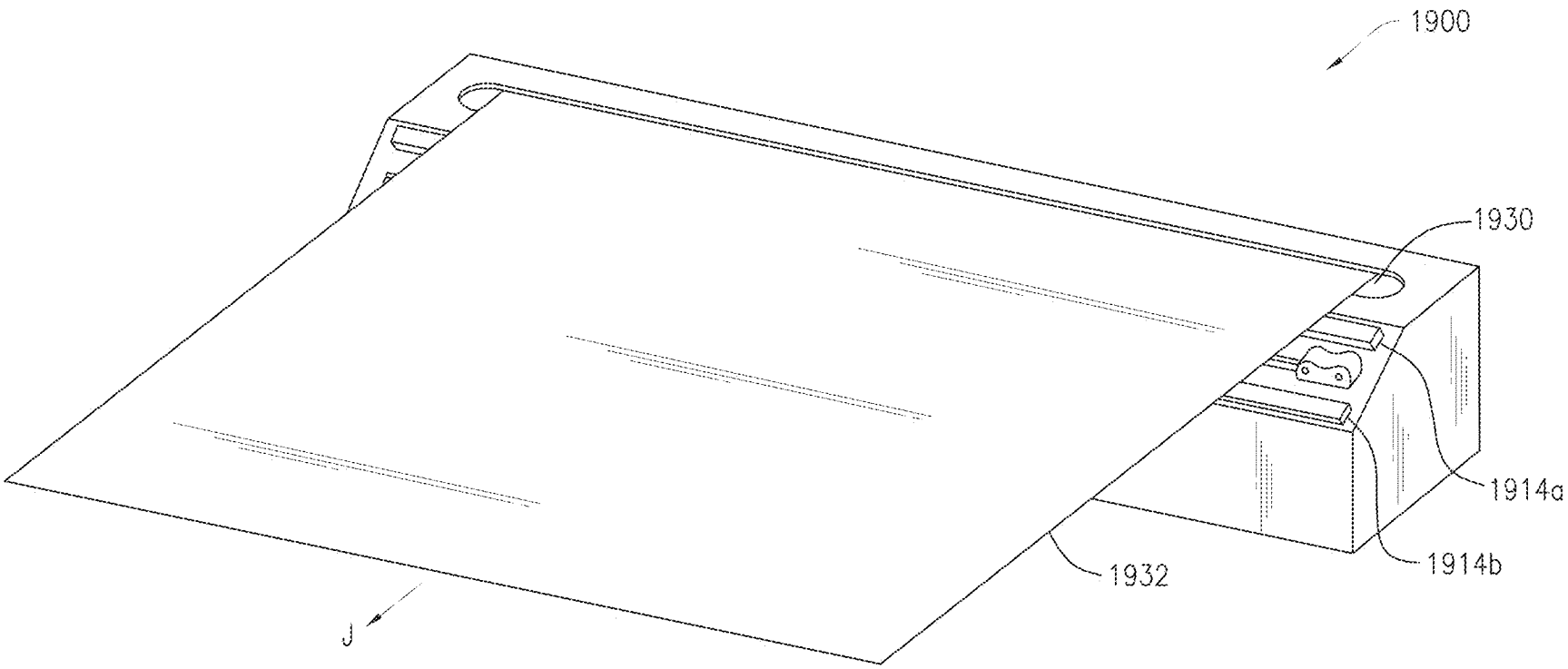
FIG. 40 is a perspective view of the roll-dispensed stock container of FIG. 33 with the stock in a second position.
Figure 41:
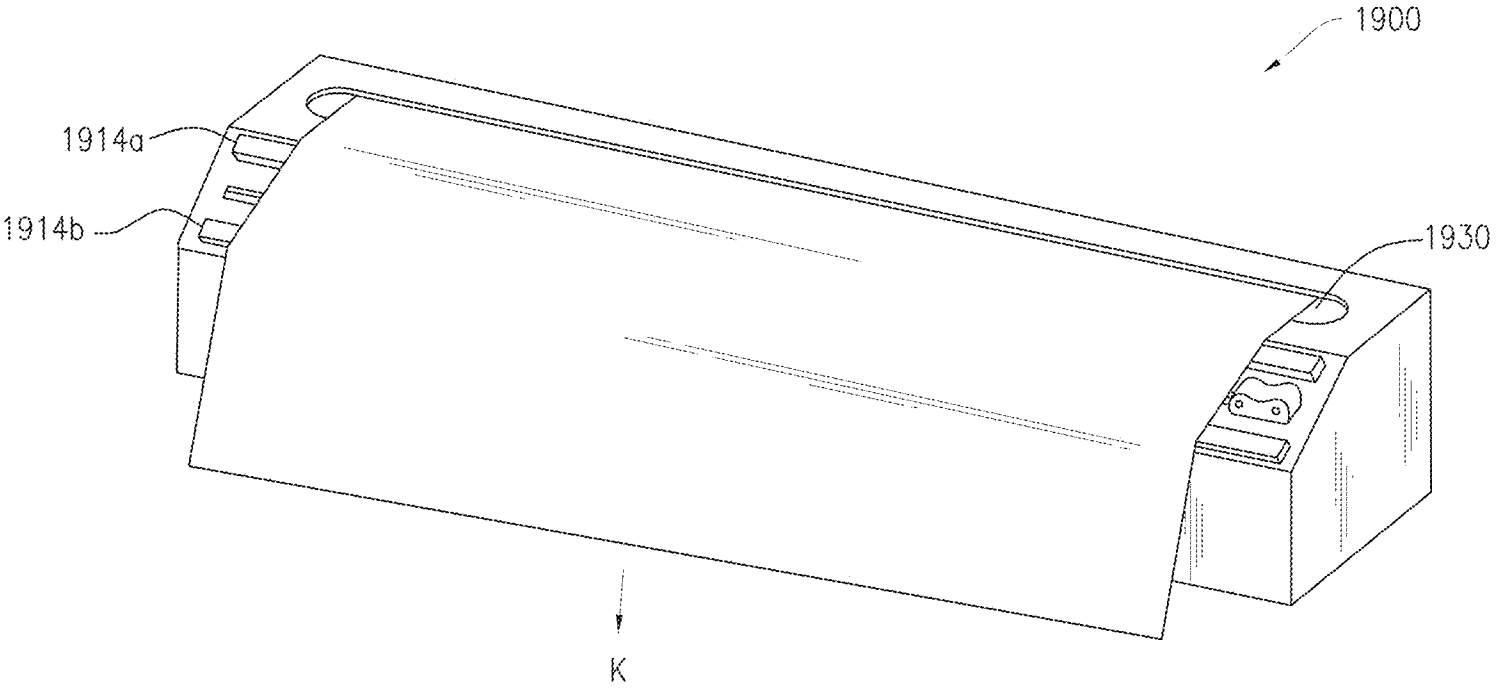
FIG. 41 is a perspective view of the roll-dispensed stock container of FIG. 33 with the stock in a third position.

FIGS. 39-41 illustrate operation of container 1900 as the roll-dispensed stock 1932 is drawn from container 1900 prior to cutting. Specifically, FIG. 39 is a perspective view of the roll-dispensed stock container 1900 with the stock 1932 extending from the container 1900 in a first position, FIG. 40 shows the stock 1932 extending from the container 1900 in a second position, and FIG. 41 shows the stock 1932 extending from the container in a third position, prior to cutting.

As shown in FIG. 39, perforated section 1922 is removed from the top wall 1902 of the container 1900, thereby forming opening 1930 and providing access to the roll-dispensed stock 1932. A portion of the roll-dispensed stock 1932 is drawn through the opening 1930, extending away from the top wall 1902 of the container 1900, in the direction of arrow I. After the portion of roll-dispensed stock 1932 is pulled from the container as show in FIG. 39, the roll-dispensed stock 1932 is pulled out as shown by arrow J in FIG. 40, and then down, such that the roll dispensed stock contacts fixation strip 1914*a*, and is then pulled down further in the direction of arrow K, as shown in FIG. 41, such that the roll dispensed stock contacts fixation strip 1914*b*. The roll-dispensed stock 1932 can then be cut by sliding the cutter 1944 along the length of the container 1900, such as, for example, as described in connection with FIGS. 4-6.

As discussed above, fixation strips 1914*a* and 1914*b* are formed from a material to which the roll-dispensed stock 1932 clings. Accordingly, when the roll dispensed stock 1932 contacts fixation strip 1914*a*, it clings thereto. Furthermore, when the roll dispensed stock 1932 is pulled in the direction of arrow J, tension is created on the roll-dispensed stock 1932, and when the roll-dispensed stock 1932 contacts fixation strip 1414*b* it clings thereto, thus maintaining the tension on the roll dispensed stock 1932 between fixation strips 1914*a* and 1914*b* prior to cutting.

Fixation strip 1914*a* is thicker and/or taller than fixation strip 1914*b*, which allows the roll-dispensed stock 1932 to contact fixation strip 1914*a*, and be put into tension, before contacting fixation strip 1914*b*, as shown in FIGS. 4 and 41. This configuration of fixation strips is also advantageous when applied to a container having a generally rectangular cross-section, such as container 2100, discussed in connection with FIGS. 37 and 38.

The present disclosure also contemplates a method for dispensing roll-dispensed stock and can include the steps of: removing a portion of roll-dispensed stock through an opening, drawing the portion of roll-dispensed stock over and contacting a first fixation strip, contacting the roll-dispensed stock with a second fixation strip thereby creating and maintaining tension on the roll-dispensed stock, and cutting the roll-dispensed stock by moving a slidable cutter along the length of the container. The foregoing steps can be applied to each of the roll-dispensed stock containers, discussed in connection with FIGS. 33-41.

Figure 42:
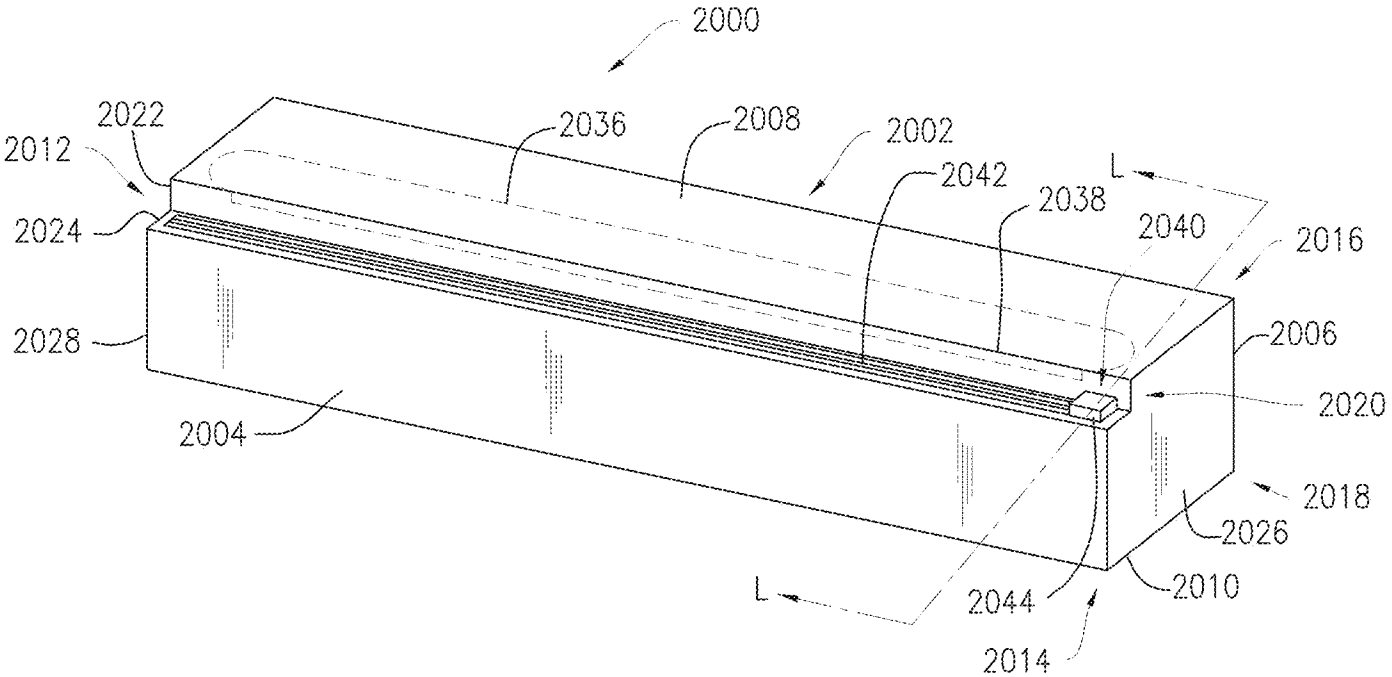
FIG. 42 is a perspective view of another roll-dispensed stock container according to the present disclosure including a recessed cutter assembly.

FIG. 42 is a perspective view of another roll-dispensed stock container 2000 according to the present disclosure including a slidable cutter assembly 2040 in a recessed area 2020. The container 2000 includes a body 2002 including a front wall 2004, a rear wall 2006, a top wall 2008 and a bottom wall 2010.

The connection between the front wall 2004 and the top wall 2008 defines a first corner 2012 of the body 2002. The connections between the front wall 2004 and the bottom wall 2010, the bottom wall 2010 and the rear wall 2006, and the rear wall 2006 and the top wall 2008 define second, third, and fourth corners 2014, 2018, and 2016 respectively. The second corner 2014, third corner 2018 and fourth corner 2016 can form substantially right angles by the connections between the respective walls.

The first corner 2012 includes a recessed area 2020 forming an inverted or inwardly directed corner. The recessed area 2020 includes a first wall or surface 2022 (e.g., a vertically oriented wall) and a second wall or surface 2024 (e.g., a horizontally oriented wall). The connection between the first surface 2022 of the recessed area 2020 and the top wall 2008 can define a substantially right angle (e.g., the first surface 2022 extends substantially parallel to the front wall 2004 and perpendicular to the top wall 2008). The connection between the second surface 2024 of the recessed area 2020 and the front wall 2004 can define a substantially right angle (e.g., the second surface 2024 extends substantially parallel to the top wall 2008 and perpendicular to the front wall 2004).

The connection between the first and second surfaces 2022, 2024 defines a substantially right angle. In some embodiments, the distance by which the first and second surfaces 2022, 2024 extend inwardly towards each other can be dimensioned equal. In some embodiments, the distance by which the first and second surfaces 2022, 2024 extend inwardly towards each other can be dimensioned differently. The recessed area 2020 defines an inverted or inwardly facing corner for protection of the cutter assembly 2040 during shipping or storage of the container 2000. In particular, the recessed area 2020 is configured such that the cutter assembly 2040 does not extend beyond planes defined by the top wall 2008 and the front wall 2004. Due to the recessed positioning of the cutter assembly 2040, multiple containers 2000 can be stacked relative to each other without imparting pressure or force on the cutter assembly 2040, thereby preventing potential damage to the cutter assembly 2040.

The body 2002 includes first and second side walls 2026, 2028 each connected to side edges of the front, rear, top and bottom walls 2004-2010 to define a plurality of lateral corners on opposing sides of the body 2002. The connection between the first and second side walls 2026, 2028 and the front, rear, top and bottom walls 2004-2010 define a substantially right angle. The front, rear, top and bottom walls 2004-2010 and the first and second side walls 2026, 2028 form an enclosure 2030 (see FIG. 43) within the body 2002 configured and dimensioned to receive a roll of roll-dispensed stock.

The container 2000 includes a perforated section 2036 (e.g., a section with a pre-perforated perimeter) formed in and extending along one or more of one of the walls of the body 2002. The perforated section 2036 can be configured to be at least partially separated from the body 2002 to form an opening for dispensing the roll-dispensed stock from the enclosure 2030.

The perforated section 2036 extends across two walls (e.g., the top wall 2008 and the first surface 2022 of the recessed area 2020). Thus, a portion of the perforated section 2036 extends across the top wall 2008, over an edge 2038 separating the top wall 2008 and the first surface 2022, and further extends on a portion of the first surface 2022. Although FIG. 42 shows the perforated section 2036 extending on or down a portion of the first surface 2022, the perforated section 2036 can extend down the first surface 2022 by any distance, including all the way to second surface 2024. When removed from the body 2002, the perforated section 2036 forms an opening extending across the top wall 2008, the edge 2038 and the first surface 2022. The opening can be sized to be as wide as the roll-dispensed stock to dispense the stock from the container 2000. According to some aspects of the present disclosure, the perforated section 2036 can be configured such that the opening extends down to a level on the vertical surface 2022 that is even with the top surface of a track 2042, described in greater detail hereinbelow. Accordingly, stock being dispensed from the opening can be extended directly over the track 2042 (e.g., parallel to the horizontal surface 2024) and perpendicular to a blade 2056 of slidable cutter 2044 (see FIG. 43), enabling the roll-dispensed stock to be laid flat over the track 2042 during the cutting process and thereby producing an even and repeatable cut, without bunching or tearing of the sock.

The container 2000 further includes a cutter assembly 2040 attached to the body 2002. As shown in FIG. 42, the cutter assembly 2040 is attached to the second surface 2024 of the recessed area 2020. The cutter assembly 2040 includes elongated track 2042 and slidable cutter 2044 with an internal blade or serrated edge. The slidable cutter 2044 travels along the track 2042 to cut roll-dispensed stock positioned over the track 2042. As described in greater detail below, the track 2042 can be fully or partially recessed into the surface 2024 of the recess 2020.

Figure 43:
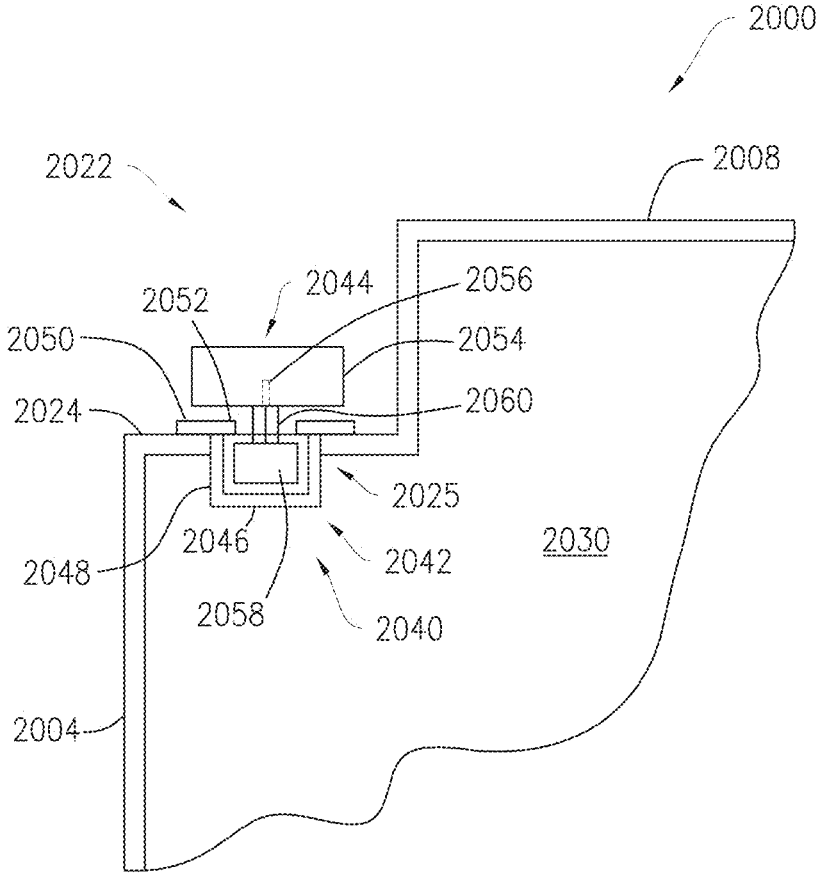
FIG. 43 is a partial cross-sectional view (taken along line L-L of FIG. 42) of the roll-dispensed stock container of FIG. 42.

FIG. 43 is a partial cross-sectional view (taken along line L-L of FIG. 42) of the roll-dispensed stock container of FIG. 42 showing the configuration of the recessed cutter assembly 2040 in greater detail. As shown in FIG. 43, the roll-dispensed stock container 2000 includes a an elongated slot 2025 in the second surface 2024 of the recessed area 2020, which receives the track 2042 of the cutter assembly 2040. The track 2042 can include a bottom wall 2046 and vertical walls 2048, forming a generally U-shaped cross-section. The track 2042 can also include exterior flanges 2050 extending away from top edges of the vertical walls 2048, which support the track 2040 within the slot 2025 by bearing on the second surface 2024 of the recess 2020, and interior flanges 2052 extending towards a center of track 2042 for retaining the slidable cutter 2044 therein. As an alternative to the interior flanges 2052, the vertical walls 2048 of the recessed track 2042 can be configured to have an inward curvature in order to retain the slidable cutter 2044 therein. The cutter assembly 2040 can be fixed within the slot 2025 by way of friction between the vertical walls 2048 and interior edges of the slot 2025, or an adhesive can be applied between the exterior flanges 2050 of the track 2042 and the second surface 2024 of the recessed area 2020. According to other aspects of the present disclosure, the track 2042 can be provided with a second set of exterior flanges (see, e.g., FIGS. 47A and 47B), positioned on the underside of the second surface 2024, sandwiching the second surface 2024 therebetween, and preventing the cutter assembly from being pulled out of the slot 2025. According to additional aspects of the present disclosure, the flanges 2050 of the track 2042 can extend within horizontal wall 2024. For example, horizontal wall 2024 can be formed from two layers, with the flanges 2050 disposed therebetween.

The cutter assembly 2044 includes a blade housing 2054, a blade 2056, a base 2058, and a stem 2060 connecting the blade housing 2054 to the base 2058. As shown in FIG. 43, the base 2058 is positioned in the track 2042 and secured therewithin by way of the interior flanges 2052. The blade 2056 is positioned within the blade housing, extends towards the base 2058, and includes exposed cutting edges along the stem 2060 for cutting roll-dispensed stock that is positioned over the track 2042. Cutter assembly 2044 can be similar to cutter assembly 1450, described in connection with FIG. 26B, as long as the base 1452 of cutter assembly 1450 is configured to be retained within track 2042.

In accordance with aspects of the present disclosure, the container 2000 can be configured to dispense, and the cutter assembly 2040 can be configured to cut, plastic wrap, foil (e.g., aluminum or tin foil), wax paper, parchment paper, tape, duct tape, wrapping paper, and other roll-dispensed stock. Further, it is contemplated that any of the embodiments of the containers of the present disclosure could be configured to dispense and cut any of the roll-dispensed stock described herein.

Figure 44A:
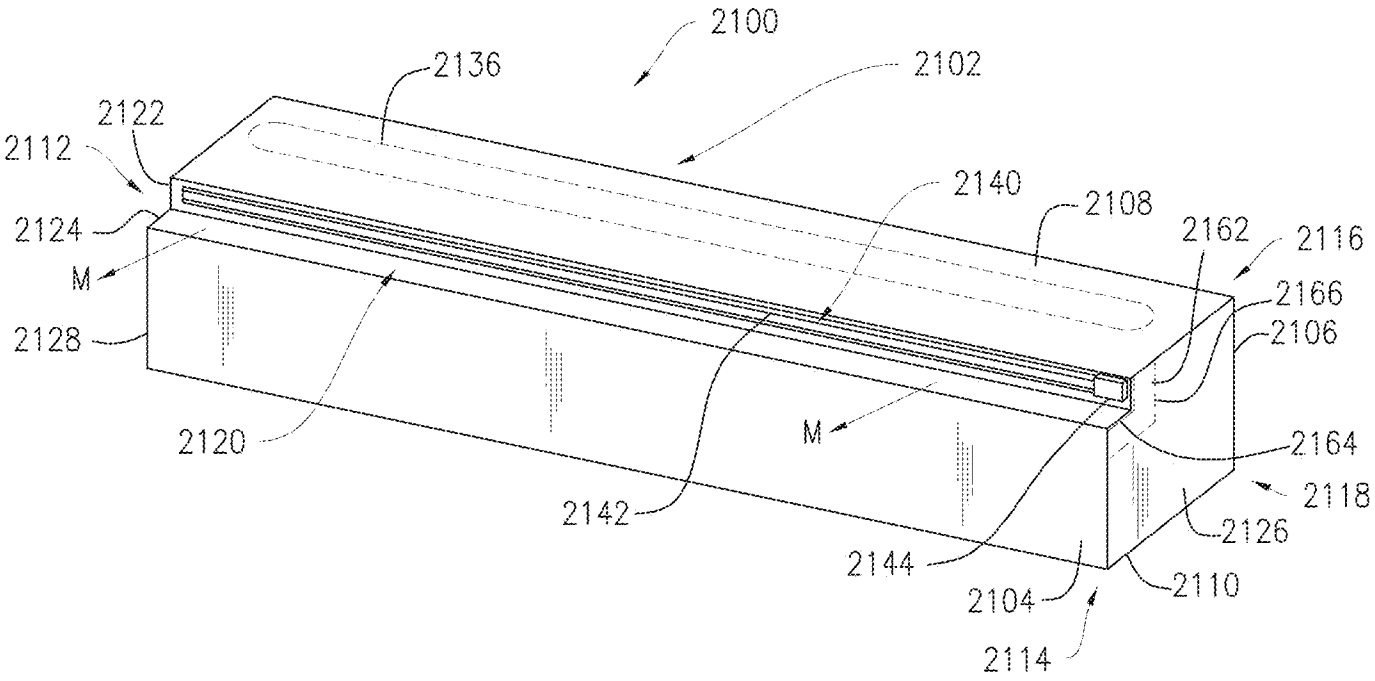
FIG. 44A is a perspective view of another roll-dispensed stock container according to the present disclosure including a recessed cutter assembly positioned in a first configuration.
Figure 44B:
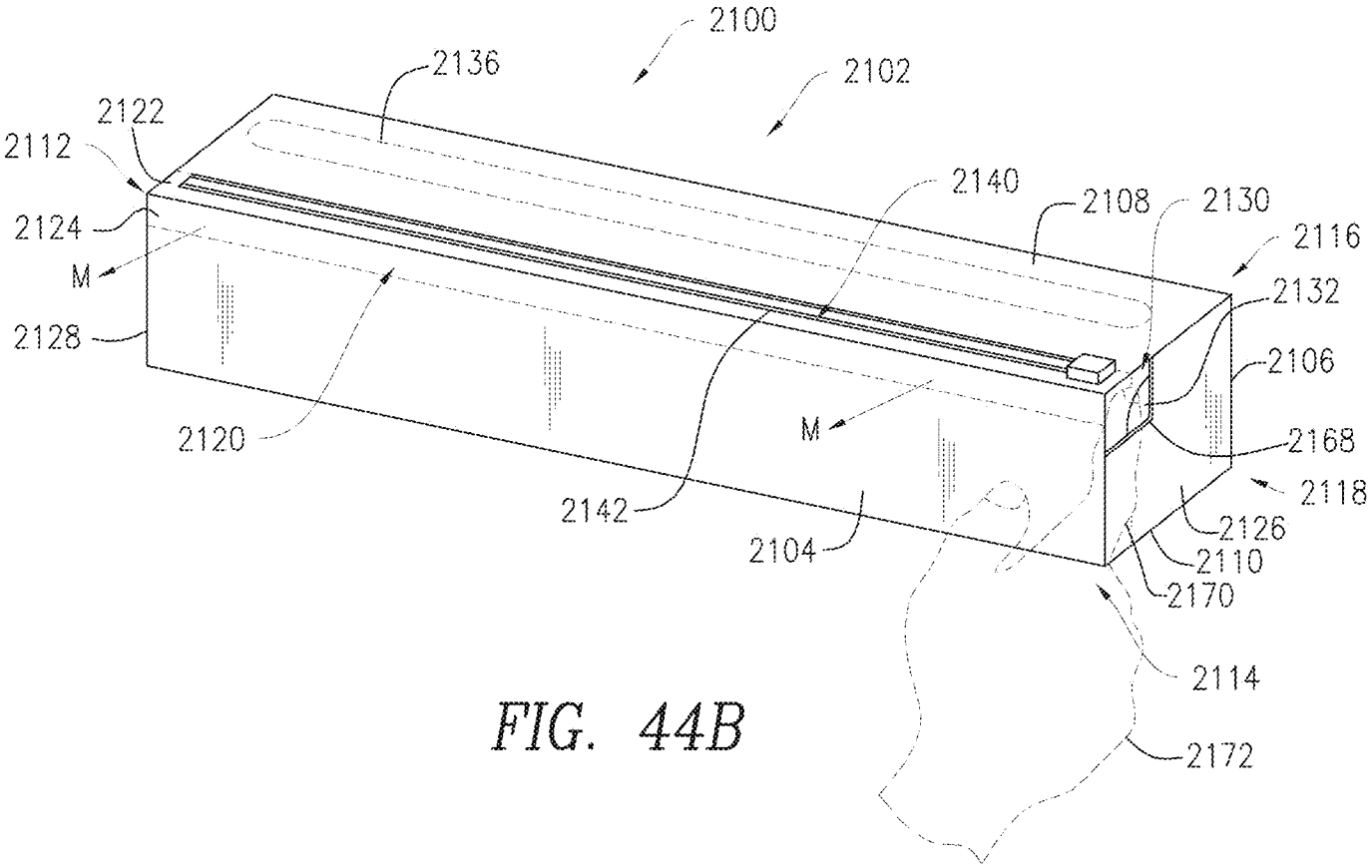
FIG. 44B is a perspective view of the roll-dispensed stock container of FIG. 44A positioned in a second configuration.
Figure 45A:
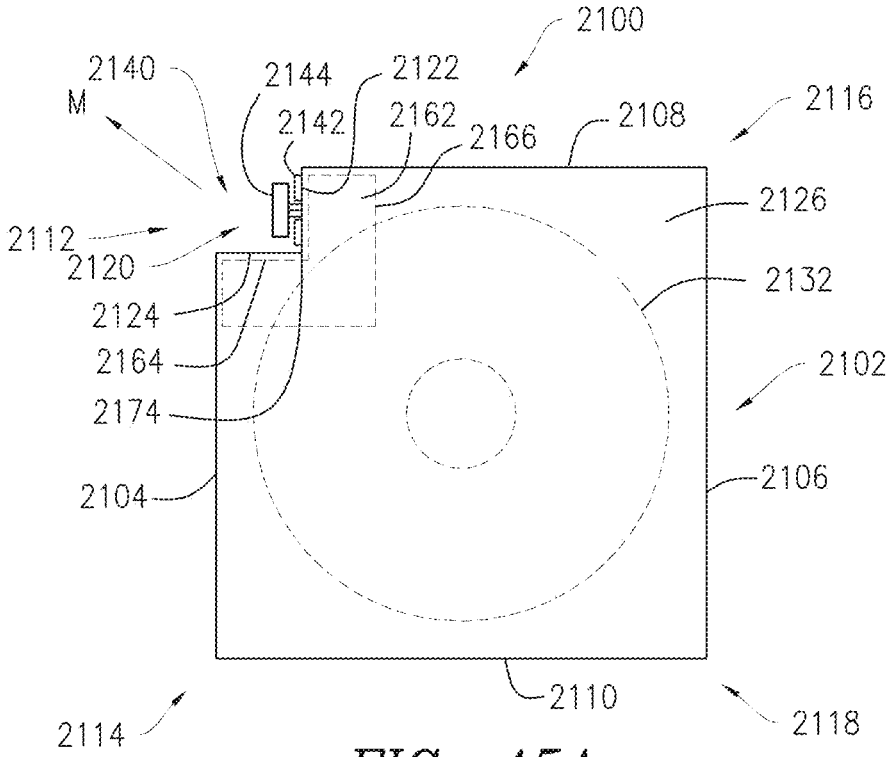
FIG. 45A is a side view of the roll-dispensed stock container of FIG. 44A positioned in the first configuration.
Figure 45B:
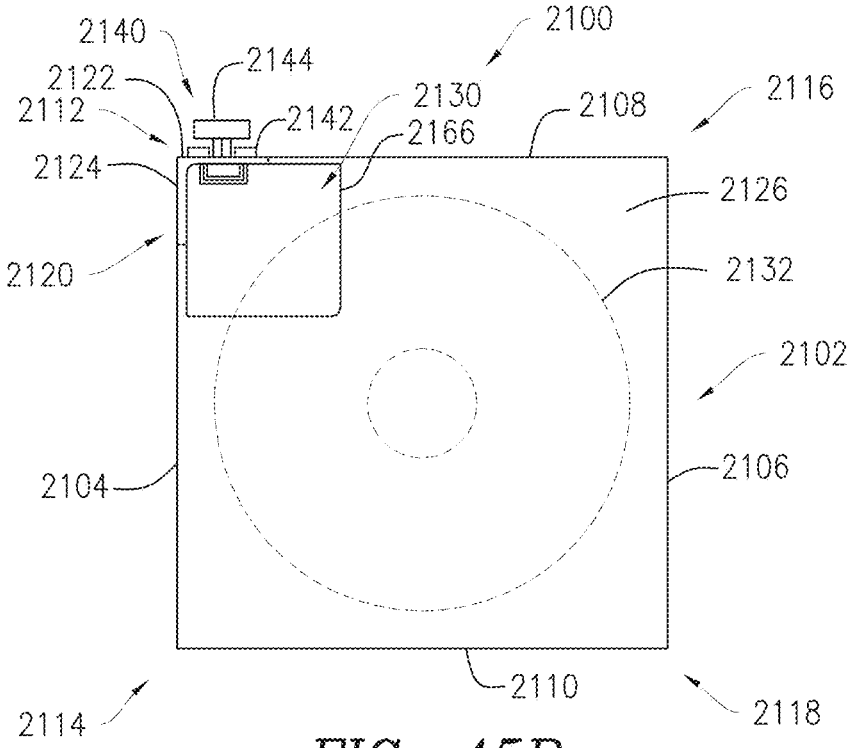
FIG. 45B is a side view of the roll-dispensed stock container of FIG. 44A positioned in the second configuration.

FIGS. 44A-45B show another roll-dispensed stock container 2100 that is positionable in recessed and extended configurations. Specifically, FIG. 44A is a perspective view of the container 2100 positioned in the recessed configuration, FIG. 44B is a perspective view of the container 2100 positioned in the extended configuration, FIG. 45A is a side view of the container 2100 positioned in the recessed configuration, and FIG. 45B is a side view of the container 2100 positioned in the extended configuration. As such, FIGS. 44A-45B are referred to jointly herein. The container 2100 can be substantially similar in structure and function to the container 2000, described in connection with FIGS. 42 and 43, except for the distinctions noted herein.

The container 2100 includes a body 2102 including a front wall 2104, a rear wall 2106, a top wall 2108 and a bottom wall 2110, forming an enclosure 2130 therein. As shown, first and second surfaces 2122, 2124 of a recessed area 2120 can be configured to be positioned in a recessed configuration (e.g., FIG. 44A) and in an extended configuration (e.g., FIG. 44B). In the recessed configuration, the recessed area 2120 defines an inverted or inwardly facing corner for protection of the cutter assembly 2140 during shipping or storage of the container 2100. The recessed slidable cutter assembly 2140 can be substantially the same as cutter assembly 2040, discussed in connection with FIG. 43. The recessed area 2120 is configured such that when the cutter assembly 2140 is attached to the first surface 2122, the cutter assembly 2140 does not extend beyond planes defined by the top wall 2108 and the front wall 2104. Similarly, the recessed area 2120 is configured such that when the cutter assembly 2140 is attached to the second surface 2124, the cutter assembly 2140 also does not extend beyond planes defined by the top wall 2108 and the front wall 2104. Due to the recessed positioning of the cutter assembly 2140, multiple containers 2100 can be stacked relative to each other without imparting pressure or force on the cutter assembly 2140, thereby preventing potential damage to the cutter assembly 2140.

In the recessed configuration, the cutter assembly 2140 is substantially perpendicular relative to the top wall 2108. As will be discussed in greater detail below, the recessed area 2120 can be flipped outwardly by a user into the extended configuration for positioning the cutter assembly 2140 in an orientation substantially parallel with the top wall 2108. In particular, in the recessed configuration, the first surface 2122 extends at an angle (e.g., a right angle) relative to the top wall 2108 and the second surface 2124 extends at an angle (e.g., a right angle) relative to the front wall 2104 to form an inwardly directed corner. In the recessed configuration, the side profile of the container 2100 defines right angles at second, third and fourth corners 2114-2118, while defining an inwardly directed first corner 2112. In the extended configuration, the first surface 2122 can extend in a substantially aligned manner relative to the top wall 2108 and the second surface can extend in a substantially aligned manner relative to the front wall 2104 to form an outwardly facing corner with a substantially right angle between the first and second surfaces 2122, 2124. In the extended configuration, the side profile of the container 2100 defines right angles at each of the first, second, third and fourth corners 2112-2118.

First and second side walls 2126, 2128 each include a perforated section 2162 (e.g., a section with a pre-perforated perimeter) disposed adjacent to the recessed area 2120. Although not visible in FIG. 44A, it should be understood that the second side wall 2128 includes a substantially similar perforated section 2162. In one embodiment, the perforated sections 2162 can define a substantially L-shaped configuration as shown in FIG. 44A. In other embodiments, the perforated sections 2162 can include an inner edge 2164 defining a substantially right angle corresponding to the shape of the recessed area 2120 and an outer edge 2166 defining a rounded or arcuate profile.

The perforated sections 2162 can be at least partially removed by the user (e.g., cut or punched out, pushed into the enclosure 2130, or the like) to form an opening 2168 in each of the first and second side walls 126, 128 (see, e.g., FIG. 44B). The openings 2168 are configured and dimensioned to partially receive one or more fingers 2170 of a user's hand 2172 such that the fingers 2170 can be used to flip, bias or push the recessed area 2120 from the recessed configuration into the extended configuration. For example, the user can urge the first and second surfaces 2122, 2124 of the recessed area 2120 outward as indicated by arrows M to convert the first and second surfaces 2122, 2124 of the recessed area 2120 into the extended configuration. In some embodiments, applying a force on the first and second surfaces 2122, 2124 in the opposite direction indicated by arrows M can urge the recessed area 2120 from the extended configuration into the recessed configuration for storage of the container 2100.

Thus, as shown in FIGS. 44A and 45A, in the recessed configuration, the cutter assembly 2140 fits within the recessed area 2120 without extending beyond the top wall 108 or the front wall 2104. As shown in FIGS. 44B and 45B, in the extended configuration, the cutter assembly 2140 is repositioned to be substantially aligned with the top wall 2108. In the recessed configuration, an inner corner 2174 (see FIG. 45A) formed by the connection of the first and second surfaces 2122, 2124 is spaced from the roll-dispensed stock 2132. In some embodiments, the side profile of the container 2100 can be rectangular and the roll-dispensed stock 2132 can be mounted within the enclosure 2130 at a position offset from a central point of the container 2100. In such embodiments, a roll of roll-dispensed stock 2132 with a bigger diameter can be disposed within the container 2100 (e.g., the sides of the roll-dispensed stock 2132 extending positioned immediately adjacent to the inner walls of the container 100) without interfering with the inner corner 2174 of the recessed area 2120.

In accordance with aspects of the present disclosure, the container 2100 can be configured to dispense, and the cutter assembly 140 can be configured to cut, plastic wrap, foil (e.g., aluminum or tin foil), wax paper, parchment paper, tape, duct tape, wrapping paper, and other roll-dispensed stock. Further, it is contemplated that any of the embodiments of the containers of the present disclosure could be configured to dispense and cut any of the roll-dispensed stock described herein.

Figure 46:
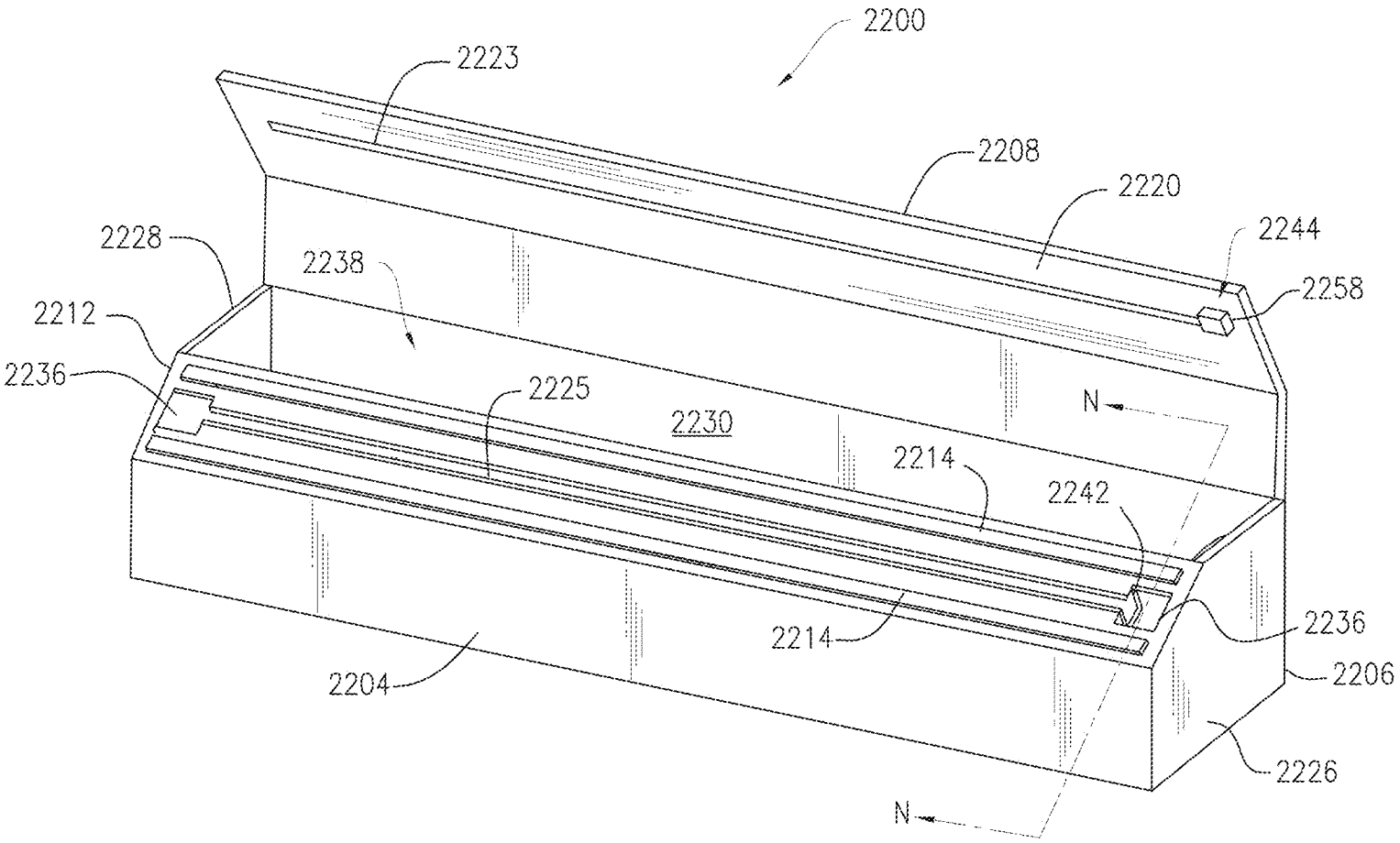
FIG. 46 is a perspective view of another roll-dispensed stock container according to the present disclosure including a recessed cutter assembly and a lid.
Figure 47A:
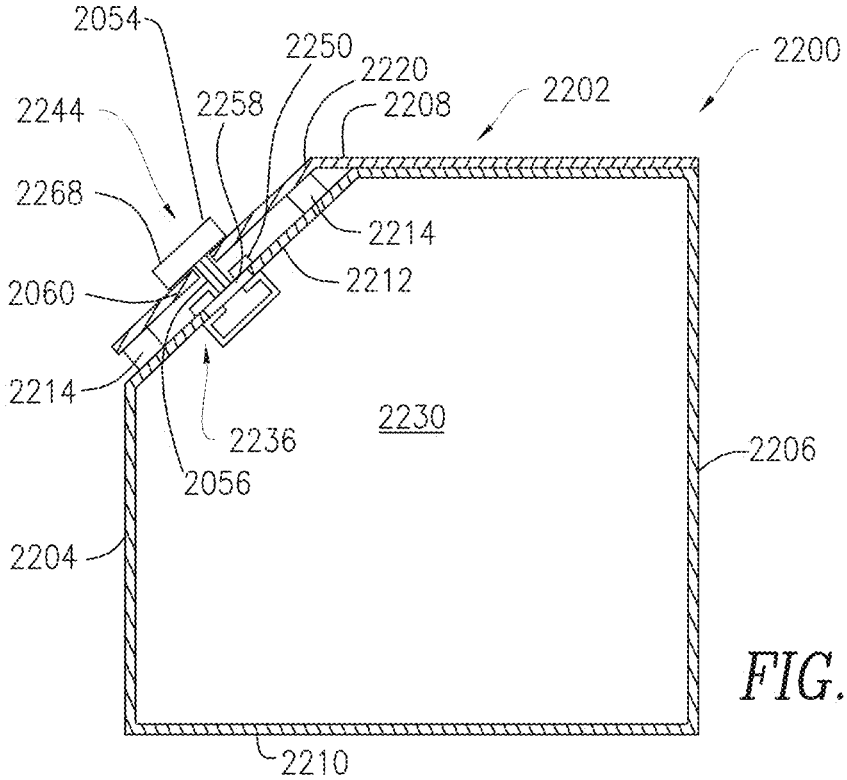
FIG. 47A is a cross-sectional view (taken along line N-N of FIG. 46) of the roll-dispensed stock container of FIG. 46 with a slidable cutter in a first position.
Figure 47B:
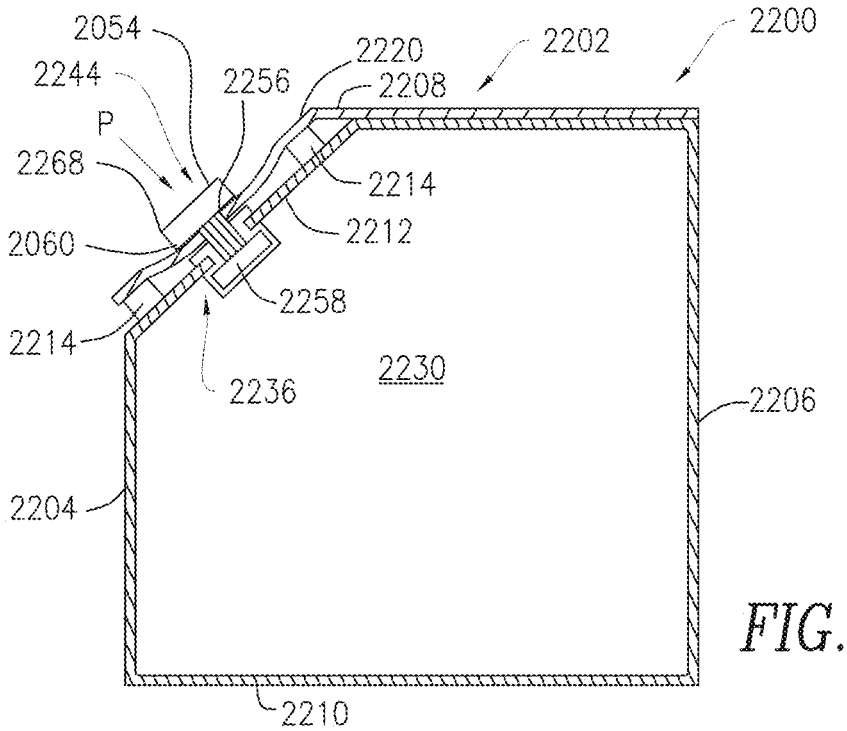
FIG. 47B is a cross-sectional view (taken along line N-N of FIG. 46) of the roll-dispensed stock container of FIG. 46 with the slidable cutter in a second position.

FIGS. 46-47B show an exemplary roll-dispensed stock container 2200 (hereinafter "container 2200") in accordance with some aspects of the present disclosure. Container 2200 can be substantially similar in structure and function to container 600, except for the distinctions noted herein. FIG. 46 is a perspective view of the container 2200 in an open configuration. As shown, container 2200 includes a body 2202 including a front wall 2204, a rear wall 2206, a bottom wall 2210, side walls 2226, 2228, a angled support wall 2212, and a lid 2208 forming an enclosure 2230 for holding roll-dispensed stock and an opening 2238 for dispensing the roll-dispensed stock. In a closed configuration, a second portion 2220 of the lid 2208 extends to cover the support wall 2212. Either or both of the support wall 2212 and the lid 2208 could have one or more fixation strips 2214, for maintaining the position of the roll-dispensed stock prior to and during the cutting process.

A slidable cutter 2244 is disposed within, and travels along, an elongated slot 2223 that extends through the second portion 2220 of the lid 2208 and along the length of the container 2200. The slidable cutter 2244 includes a blade housing 2054 on the outside of the lid 2208, a blade 2056 and stem 2060 that extend through the lid 2208, and a base 2258 on an interior side of the lid 2208. Blade housing 2054 and base 2258 of cutter 2244 are configured to have a width greater than slot 2223, thereby constraining movement of the cutter 2244 within slot 2223. Cutter 2244 can be substantially similar in structure and function to cutter 2044, described in connection with FIGS. 42 and 43, except for the distinctions noted herein. The slidable cutter 2244 could include an engagement face 2268, shaped to receive a finger of a user and pressure therefrom.

As shown in FIG. 46, container 2200 further includes recessed track 2242, which is positioned in an elongated slot 2225 that extends along the length of support wall 2212. First and second apertures 2236*a* and 2236*b* are positioned on either end the elongated slot 2225 in the support wall 2212 and are in communication with the track 2242. The first and second apertures 2236 are sized to receive the base portion 2258 of the slidable cutter 2244, allowing the base 2258 to pass through the plane of the support wall 2212. The base portion 2258 of the cutter 2244 can slide into the track 2242, and the track 2242 accepts and retains the base portion 2258 of the cutter 2244 under the support wall 2212 as it is moved along the length of the container 2200, during the cutting process. This configuration provides for the application of constant and consistent pressure during the cutting process. According to some aspects of the present disclosure, track 2242 can be substantially similar in structure and function to track 2042, described in connection with FIGS. 42 and 43. For example, track 2242 can also include exterior flanges, which support the track 2242 within the slot 2225 by bearing on the support wall 2212 and the track 2242 can be fixed within the slot 2225 by way of an adhesive applied between the exterior flanges of the track 2242 and the support wall 2212. According to other aspects of the present disclosure, the track 2242 can be provided with a second set of exterior flanges, positioned on the underside of the support wall 2212, sandwiching the support wall 2212 therebetween, and preventing the track 2242 from being pulled out of the slot 2225. According to additional aspects of the present disclosure, the flanges of the track 2242 can extend within support wall 2212. For example, support wall 2212 can be formed from two layers, with the flanges disposed therebetween.

FIGS. 47A and 47B are cross-sectional views (taken along line N-N of FIG. 46) of container 2200, positioned in a closed configuration. As shown in FIG. 47A, the base 2258 of the slidable cutter 2244 protrudes below a second portion 2220 of the lid 2208, but does not fully extend through the aperture 2236 (e.g., into enclosure 2230) in normal operation (e.g., during storage or transportation). As shown in FIG. 47B, upon application of force to blade housing 2054 in the direction of arrow P, the second portion 2220 of lid 2208 is elastically deformed so that the base 2058 of the slidable cutter 2044 fully extends through the aperture 2236. Once force has been applied to the blade housing 2054 in the direction of arrow P and the base 2258 of the slidable cutter 2244 is fully extended through the aperture 2236, the slidable cutter 2244 can be moved into track 2242 and travel within track 2242, along the length of the container 2200. Similar to track 2042 described above, track 2242 is dimensioned to accommodate a stem 2060 and blade 2256 of the slidable cutter 2244 passing therethrough, but also to retain the base 2258 of the slidable cutter 2244, thereby preventing the second portion 2220 of the lid 2208 from returning to its original position during the cutting process. Once the cutting process has been completed and the slidable cutter 2244 has traveled to the opposite end of the container (e.g., moving from aperture 2236*a* to 2236*b*, or vice versa), the base portion 2258 of the slidable cutter 2244 is freed from the track 2242 and the lid 2208 of the container 2200 can be opened.

Similar to track 2042, track 2242 can also include exterior flanges 2250, which support the track 2242 within the slot 2225 by bearing on the support wall 2212, and can be fixed within the slot 2225 by way of an adhesive applied between the exterior flanges 2250 of the track 2242 and the support wall 2212. The track 2242 can also be provided with a second set of exterior flanges, positioned on the underside of the support wall 2212, thereby preventing the track 2242 from being pulled out of the slot 2025. According to additional aspects of the present disclosure, the track 2242 and slot 2225 can be configured such that the portion of the track 2242 positioned within the enclosure 2230 is wider than the slot 2225, thereby preventing the track 2242 from being pulled out of the slot 2025 when the slidable cutter 2244 is positioned within the track 2242.

Accordingly, once force is applied in the direction on arrow P and the slidable cutter is moved along the length of container 2200 and into track 2242, pressure is maintained between the one or more fixation strips 2214 and the second portion 2220 of the lid 2208, with roll-dispensed stock disposed therebetween (not shown). As such, pressing the blade housing 2254, and thereby cutter base 2258, into the position shown in FIG. 47B maintains the pressure of the roll-dispensed stock against the fixation strips 2214, to grip the stock, as well as to tension the roll-dispensed stock. This allows the slidable cutter to easily and cleanly cut therethrough.

Figure 48:
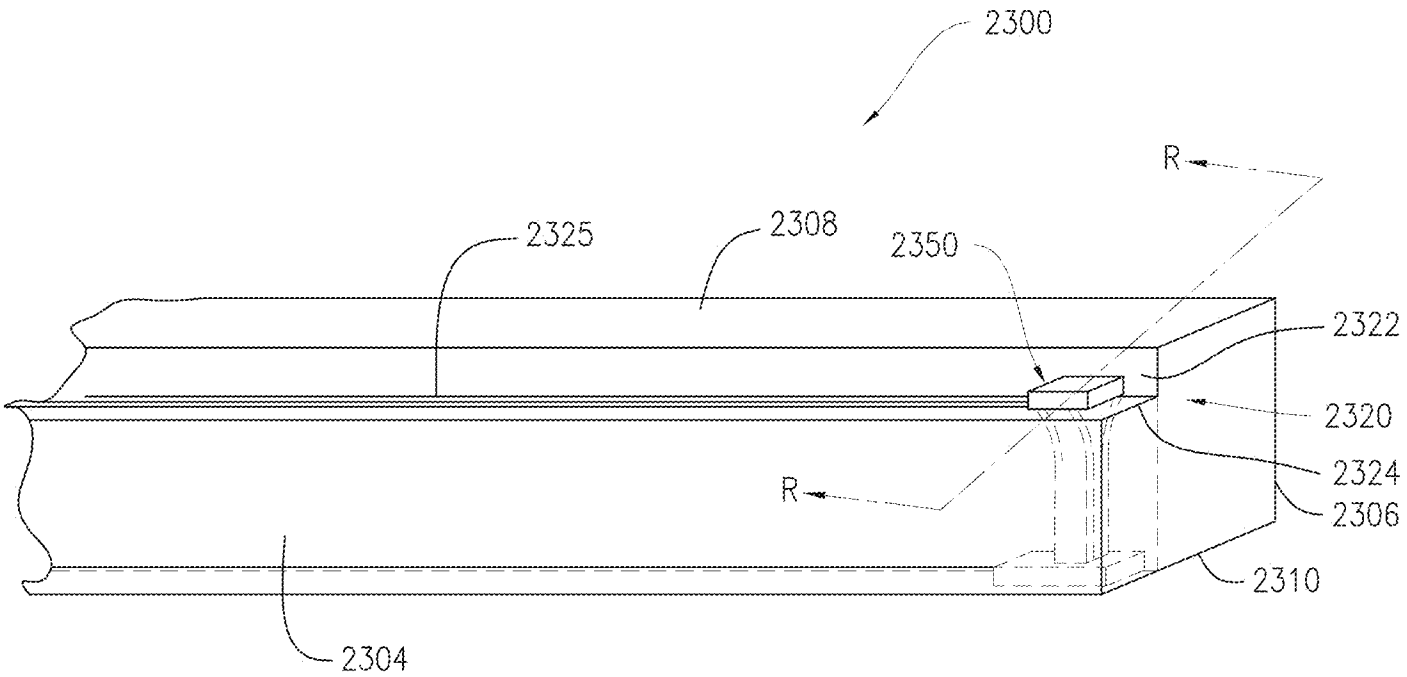
FIG. 48 is a partial perspective view of another roll-dispensed stock container according to the present disclosure including an insertable cutter.
Figure 49:
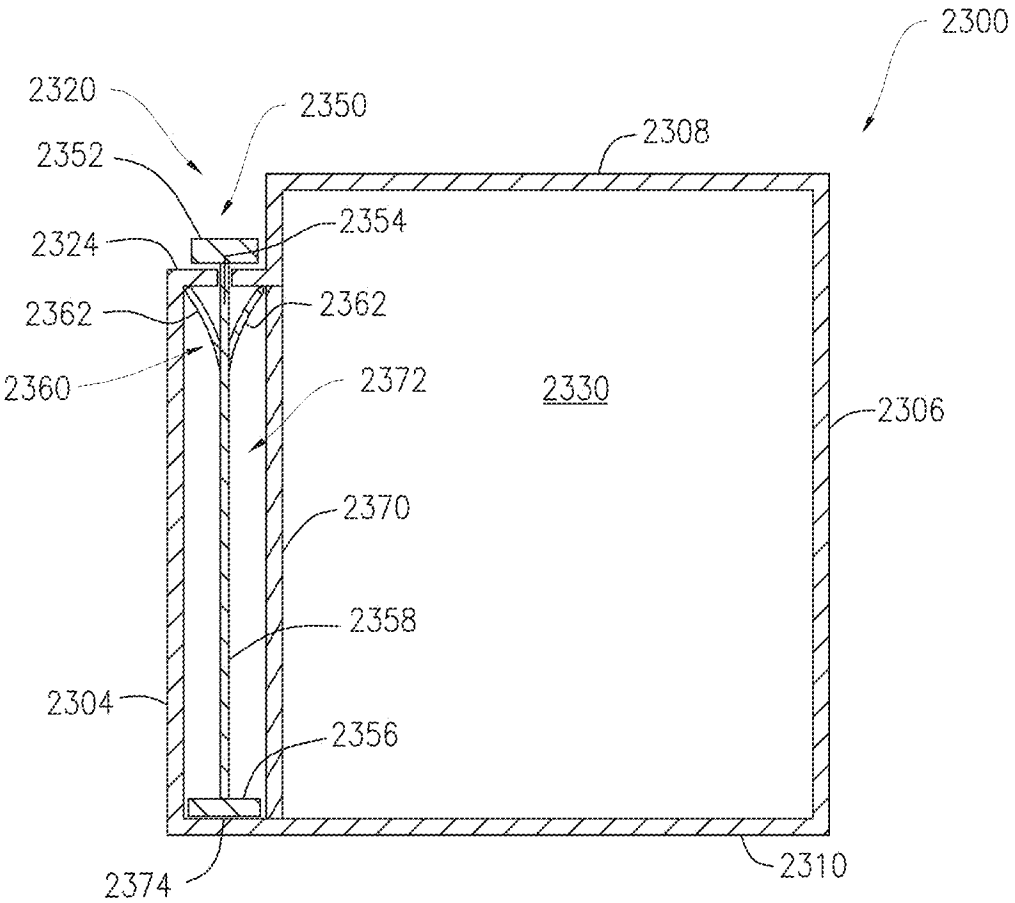
FIG. 49 is a cross-sectional view (taken along line R-R of FIG. 48) of the roll-dispensed stock container of FIG. 48.

FIG. 48 is a perspective view of a roll-dispensed stock container 2300 (hereinafter "container 2300") in accordance with some aspects of the present disclosure, including a slidable cutter assembly 2350, and FIG. 49 is a partial cross-sectional view (taken along line R-R of FIG. 48) of the roll-dispensed stock container 2300. Container 2300 includes a front wall 2304, a rear wall 2306, a top wall 2308, a bottom wall 2310, a first side wall 2326, a second side wall 2328 forming an enclosure 2330, and a recessed area 2320 having a first vertical surface 2322 and a second horizontal surface 2324. As shown best in FIG. 49, container 2300 includes a vertical internal support wall 2370 that is disposed within the enclosure 2330 and that is arranged to be generally coplanar with the vertical surface 2322 of the recess 2320. As shown, vertical support wall 2370 can bifurcate enclosure 2330, thereby defining a front chamber 2372, bounded by the front wall 2304, the bottom wall 2310, the horizontal surface 2324, and the support wall 2370. As discussed in greater detail below, the chamber 2372 can house the cutter assembly 2350.

The cutter assembly 2350 includes a blade housing 2352, a blade 2354, a base 2356, an elongated stem 2358 connecting the blade housing 2352 to the base 2356, and retaining device 2360 for securing the cutter assembly 2350 within an elongated slot 2325 in the horizontal support wall 2324 of the recess 2320. The blade 2354 can be sized such that a portion thereof extends below a lower face of the blade housing 2352, to cut a portion of roll-dispensed stock drawn over the elongated slot 2325 in the horizontal support wall 2324 of the recess 2320.

According to some aspects of the present disclosure, the blade housing 2352, the stem 1758, and the base 2356 can comprise first and second halves, and the blade 2354 can be disposed therebetween (see, e.g., FIGS. 30 and 31). According to other aspects of the present disclosure, the blade housing 2352 can also be a unitary structure. The lower face of the blade housing 2352 can include a rounded profile towards front and rear sides of the blade housing 2352, allowing for the roll dispensed stock to remain flat as the cutter assembly 2350 is moved along the elongated slot 2325 of the container 2300 during the cutting process (see, e.g., FIGS. 30 and 31).

According to some aspects of the present disclosure, the retaining device 2360 can include a plurality of fingers 2362 that depend from the stem 2358, each extending in an arcuate path towards the blade housing 2352 and away from the stem 2358. The fingers 2362 can be configured such that they are normally positioned as shown in FIGS. 48 and 49, but when compressed towards the stem 2358, provide a spring/biasing force in the opposite direction (e.g., towards their normal position. The fingers 2362 can be formed from any material that is resiliently deformable (e.g., thermoplastic, metal, etc.), such that the fingers 2362 can be compressed towards the stem 2358 and return to their original position.

During assembly of container 2300, the stem 2358 of the cutter assembly 2350 can be inserted into the elongated slot 2325, which has a width that is roughly equal to the width of the stem of the cutter assembly 2350, causing the fingers 2362 of the retaining device 2360 to inwardly deform, thus reducing their width, such that they can pass through the elongated slot 2325. Once the fingers 2362 have passed through the elongated slot 2325, they return to their normal position, as shown in FIG. 49, having a width larger than the width of the elongated slot 2325. Accordingly, the cutter assembly 2350 is prevented from being removed from the slot 2325 by upper tips of the fingers 2362 bearing against a bottom surface of the horizontal surface 2324 of the container 2300. The retaining device 2360 can be provided in various configurations. As such, the fingers 2362 can be provided with varying geometries, material thicknesses, dimensions, and the like, suitable for a particular application. According to other aspects of the present disclosure, the blade 2354, stem 2358, and base 2356 can have a length and width great enough such that the cutter assembly 2350 is prevented from turning or rocking in the slot 2325, to reduce binding and to facilitate cutting of a straight line.

As shown in FIG. 49, the elongated stem 2358 and base 2356 of the cutter assembly 2350 can also be configured to constrain movement and to provide support to the cutter assemble 2350 within the front chamber 2372 of container 2300 during the cutting process. For example, the stem 2358 can be dimensioned such that the base 2356 of the cutter assembly 2350 bears against the bottom wall 2310 of container 2300 and that the bottom surface of the blade housing 2352 is positioned above the horizontal surface 2324. This provides an advantage in that the roll-dispensed stock is not being compressed between the blade housing 2352 and the horizontal support wall 2324 during the cutting process, thereby preventing bunching and tearing of the roll-dispensed stock. Additionally, the base 2356 of the cutter assembly 2350 can be dimensioned to be substantially the same width as front chamber 2372 (e.g., the distance between front wall 2304 and support wall 2370), thereby preventing twisting of the cutter 2350 during the cutting process. The base 2356 can also be configured to have a bottom face 2374 that minimizes friction (e.g., a contoured surface, low-friction coating, or the like) between the base 2356 and the bottom wall 2310 as the cutter 2350 is moved therealong during cutting. Further still, as shown in FIG. 48, the base 2356 can be configured with length dimension that reduces the tendency of cutter assembly 2350 to rotate (e.g., base 2356 having a length dimension greater than blade housing 2352) about the base 2356 (e.g., in the plane parallel to support wall 2370) during the cutting process.

Figure 50:
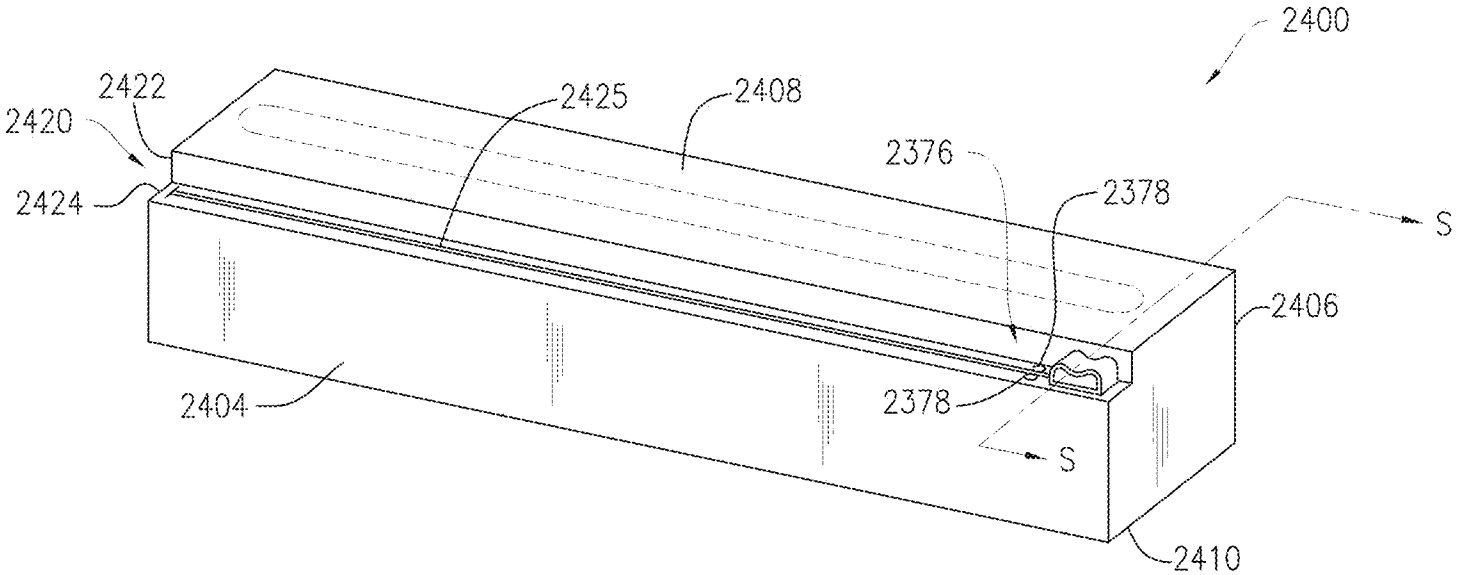
FIG. 50 is a perspective view of another roll-dispensed stock container according to the present disclosure including a retaining means for a slidable cutter.
Figure 51:
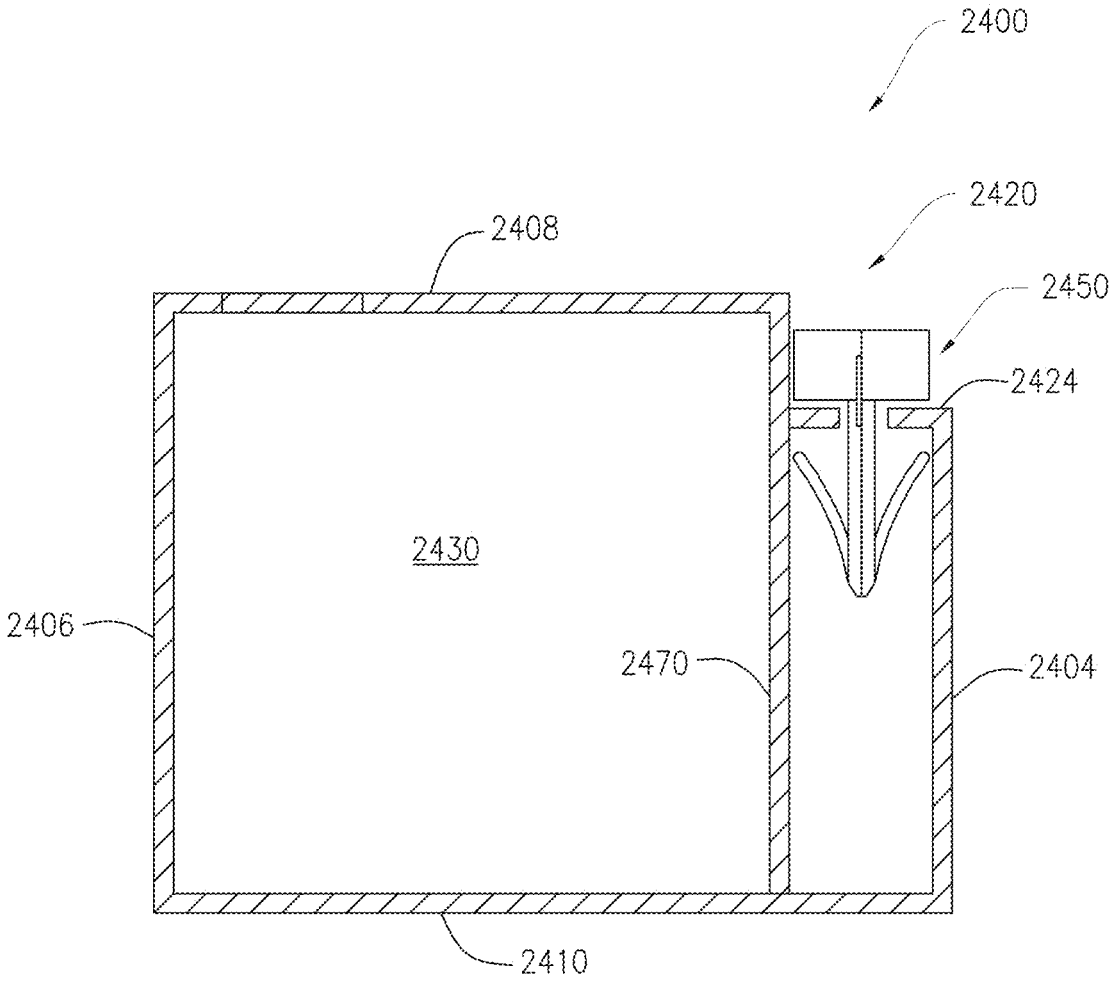
FIG. 51 is a cross-sectional view (taken along line S-S of FIG. 50) of the roll-dispensed stock container of FIG. 50.

FIG. 50 is a perspective view of a roll-dispensed stock container 2400 (hereinafter "container 2400") in accordance with some aspects of the present disclosure, including a slidable cutter assembly 2450, and FIG. 51 is a partial cross-sectional view (taken along line S-S of FIG. 50) of the roll-dispensed stock container 2400. Accordingly, FIGS. 50 and 51 are referred to jointly herein. Container 2400 can be substantially similar in structure and function to container 2300, described in connection with FIGS. 48 and 49, except for the distinctions noted herein. Container 2400 includes a front wall 2404, a rear wall 2406, a top wall 2408, a bottom wall 2410, a first side wall 2426, a second side wall 2428 forming an enclosure 2430, and a recessed area 2420 having a first vertical surface 2422 and a second horizontal surface 2424. As shown in FIG. 51, container 2400 includes a vertical internal support wall 2470 that is disposed within the enclosure 2430 and that is arranged to be generally coplanar with the vertical surface 2422 of the recess 2420. Cutter assembly 2450 can be substantially similar in structure and function to cutter assembly 1750, described in connection with FIGS. 28-31. Cutter assembly 2450 is inserted through an elongated slot 2425 in the horizontal surface 2424 and slides therealong during the cutting process. The internal support wall 2470 provides additional structural rigidity for horizontal surface 2424, which provides several benefits. For example, the additional structural rigidity of horizontal surface 2424 aides in the process of inserting the cutter assembly 2450 into the elongated slot 2425 by reducing deformation of the first vertical surface 2422 and second horizontal surface 2424 of the recessed area 2420 under pressure exerted by the cutter assembly 2450, thereby providing for an easier insertion of the cutter assembly 2450. Additionally, the additional structural rigidity of horizontal surface 2424 aides in the process of cutting roll-dispensed stock, by reducing deformation of the first vertical surface 2422 and second horizontal surface 2424 of the recessed area 2420 under pressure exerted by a user on the cutter assembly 2450, thereby providing for a more stable cutting surface.

As shown in FIG. 50, the container 2400 can also be provided with retaining means 2376 for preventing movement of the cutter assembly 2350 while not in use (e.g., during shipment, display, storage, or the like). For example, the retaining means 2376 can be one or more protrusions 2378 formed on either, or both, sides of the slot 2425 and adjacent to the cutter assembly 2450 when positioned at either end of the container 2400. The protrusions 2376 can be configured to hold (e.g., by way of friction, adhesion, or the like) the cutter assembly 2450 in place during movement of the container 2400, but can be overcome when a user desires to operate cutter assembly 2450. The protrusions 2376 can be formed from glue, silicone, rubber, or any other material suitable for non-permanent fixation of the cutter assembly 2450 to the container 2400. It is within the scope of the present disclosure that the retaining means 2376 can be used in connection with any of the containers described herein which include a slidable cutter assembly.

Figure 52:
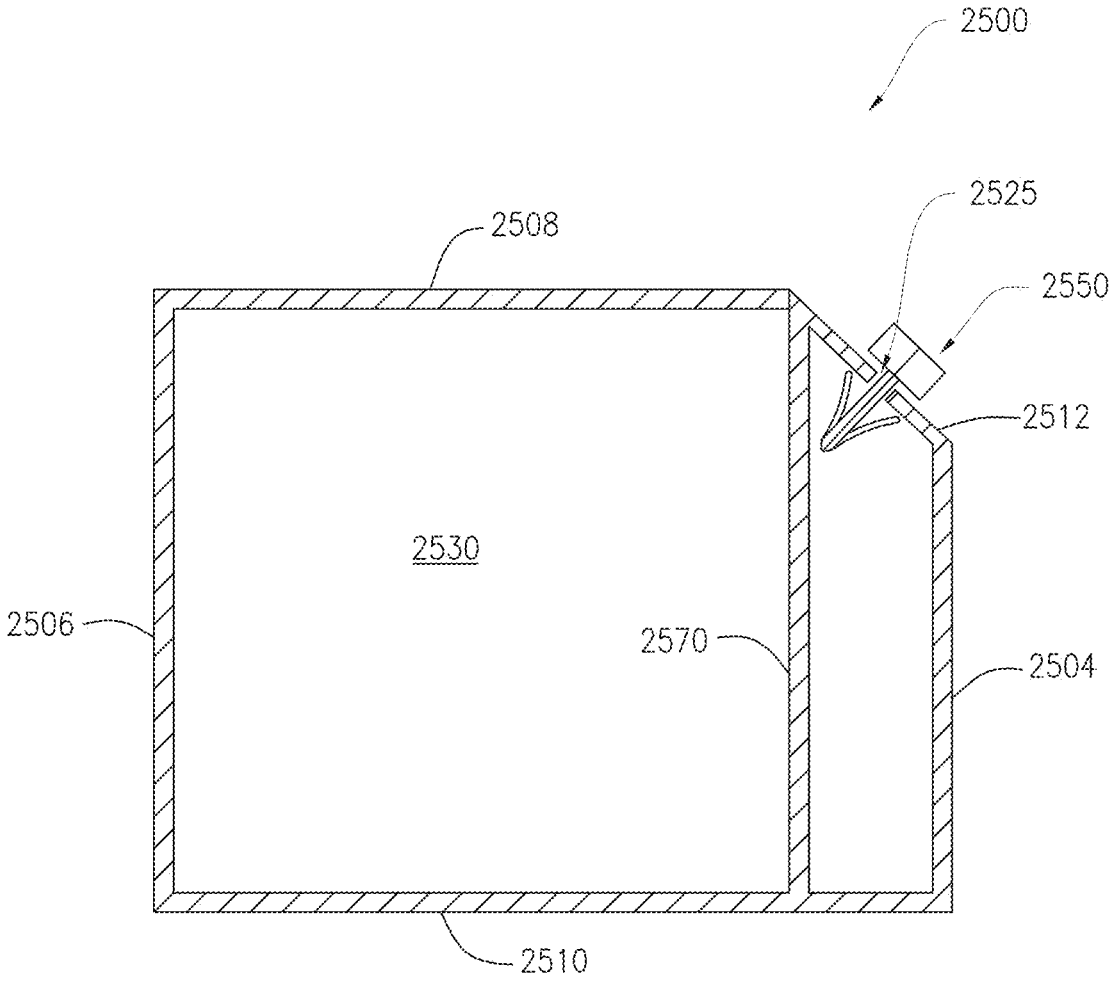
FIG. 52 is a cross-sectional view of another roll-dispensed stock container according to the present disclosure including an internal support wall.

FIG. 52 is a partial cross-sectional view of a roll-dispensed stock container 2500 (hereinafter "container 2500") in accordance with some aspects of the present disclosure, including a slidable cutter assembly 2550. Container 2500 can be substantially similar in structure and function to container 2400, described in connection with FIGS. 50 and 51, except for the distinctions noted herein. Container 2500 includes a front wall 2504, a rear wall 2506, a top wall 2508, a bottom wall 2510, first and second side walls (not shown), and an angled support wall 2512 forming an enclosure 2530. Container 2500 also includes a vertical internal support wall 2570 that is disposed within the enclosure 2530 and can extend from the intersection of the top wall 2508 and the angled support wall 2512 to the bottom wall 2510. Cutter assembly 2550 can be substantially similar in structure and function to cutter assembly 1750, described in connection with FIGS. 28-31. Cutter assembly 2550 is inserted through an elongated slot 2525 in the angled support wall 2512 and slides therealong during the cutting process. The internal support wall 2570 provides additional structural rigidity for angled support wall 2512, which provides several benefits. For example, the additional structural rigidity of angled support wall 2512 aides in the process of inserting the cutter assembly 2550 into the elongated slot 2525 by reducing deformation of the angled support wall 2512 under pressure exerted by the cutter assembly 2550, thereby providing for an easier insertion of the cutter assembly 2550. Furthermore, the additional structural rigidity of angled support wall 2512 aides in the process of cutting roll-dispensed stock, by reducing deformation of the angled support wall 2512 under pressure exerted by a user on the cutter assembly 2550, thereby providing for a more stable cutting surface.

The vertical support wall 2570 of container 2500, shown in FIG. 52, can be utilized with other containers having different configurations. For example, container 2200, described in connection with FIGS. 46-47B, or any other container described herein having a similar configuration, can be configured with a vertical support wall. Specifically, container 2200 can include an internal vertical support wall extending from a top edge of support wall 2212 and extending to the bottom wall 2210. Those of ordinary skill in the art will understand that the geometries of container 2200 can be modified in order for the enclosure 2230 accommodate a vertical support wall and a roll of roll-dispensed stock.

Figure 53B:
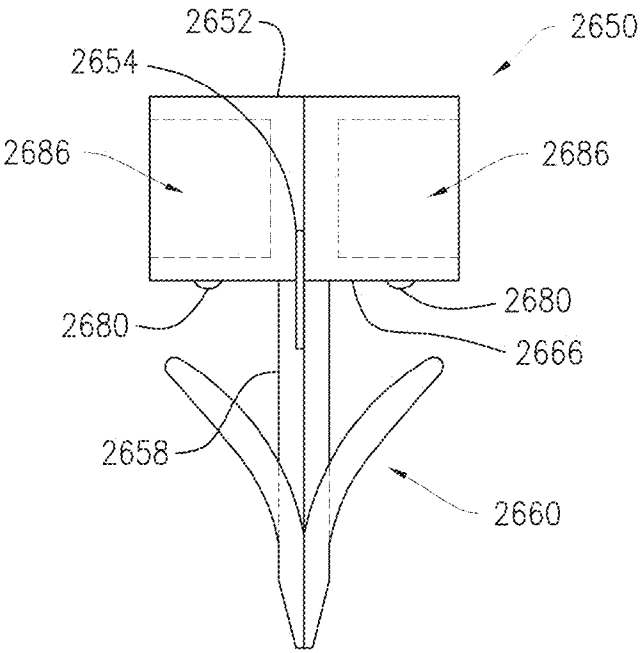
FIG. 53B is a front view of the insertable cutter of FIG. 53A.
Figure 53A:
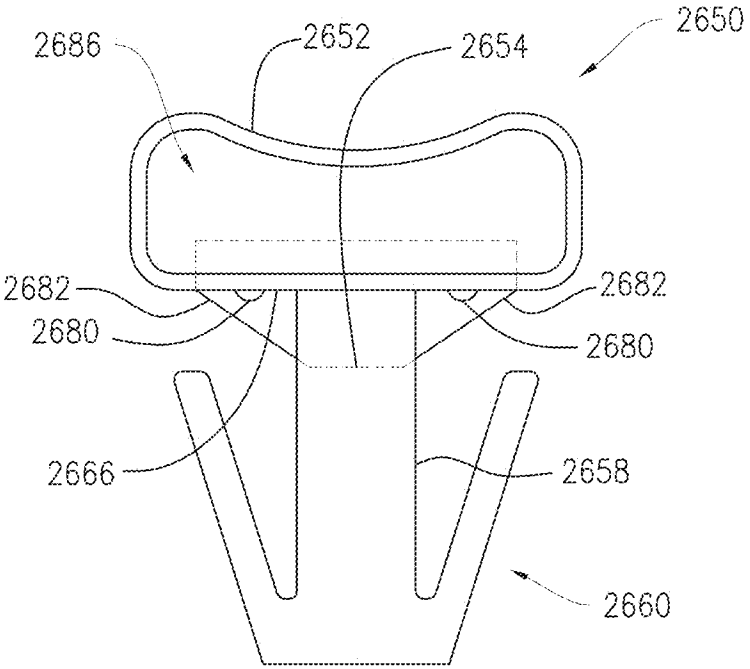
FIG. 53A is a side view of another insertable cutter according to the present disclosure including a plurality of hemispherical spacers.
Figure 53C:
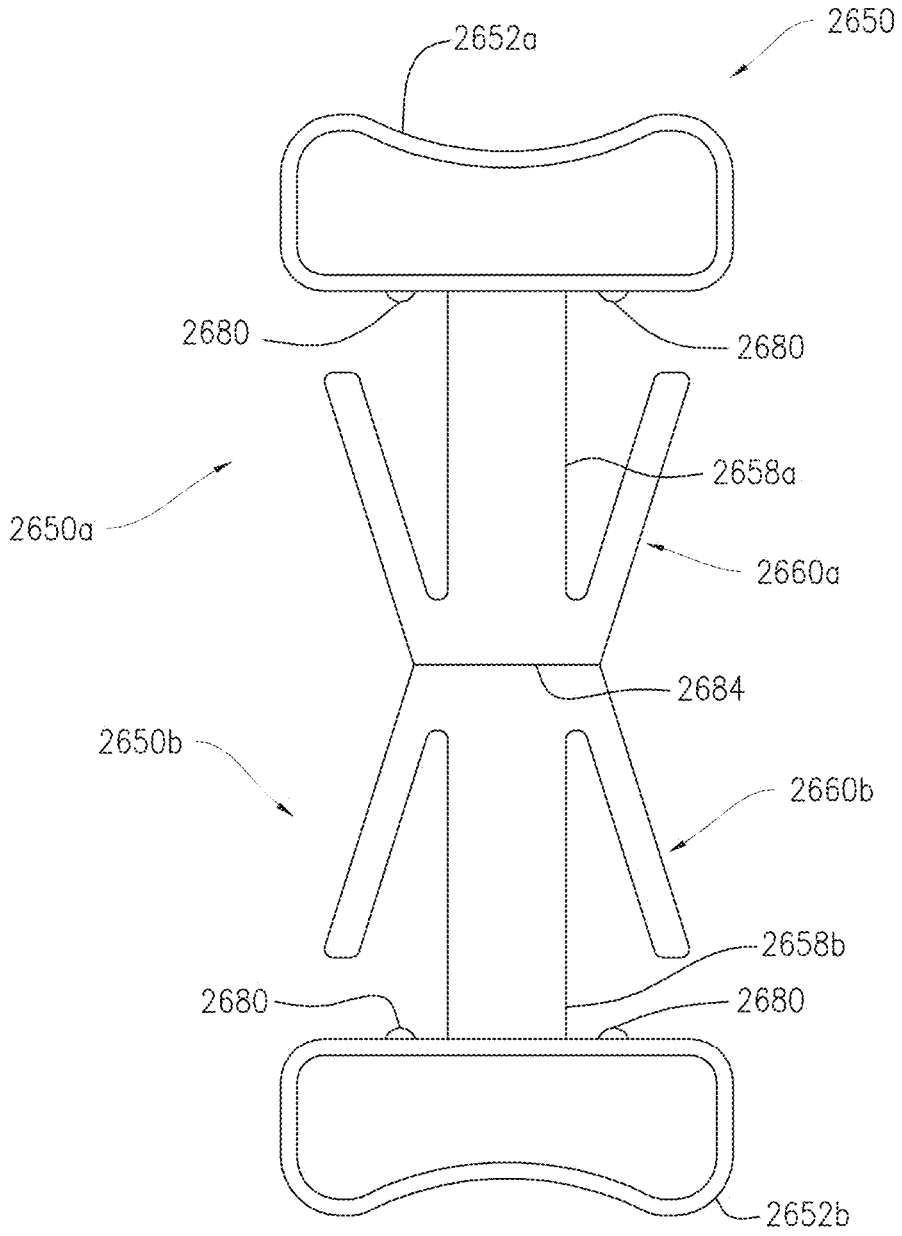
FIG. 53C is a side view of a molded insertable cutter prior to assembly according to the present disclosure.

FIGS. 53A-C show another insertable slidable cutter assembly 2650 according to the present disclosure, and are referred to jointly herein. Cutter assembly 2650 can be substantially similar in structure and function to cutter assembly 1750, described in connection with FIGS. 28-31. The cutter assembly 2650 includes a blade housing 2652, a blade 2654, a stem 2658, and a retaining device 2660 for securing the cutter assembly 2650 within an elongated slot in a wall of a container (see, e.g., elongated slot 2325 in surface 2324 of container 2300). The blade 2654 can be sized such that a portion thereof extends below a lower face 2666 of the blade housing 2652, to cut a portion of roll-dispensed stock thereunder. As shown, the blade housing can be provided with apertures extending therethrough (see FIGS. 55A and 55B) or recesses 2686 on either or both sides of blade housing 2652, which reduce the overall weight of the cutter assembly 2650 and the raw materials needed for production thereof. The lower face 2666 of the blade housing 2652 can include a rounded profile towards front and rear sides of the blade housing 2652, allowing for the roll dispensed stock to remain flat as the cutter assembly 2650 is moved thereover during the cutting process. The lower face 2666 of the blade housing 2652 can also be provided with a plurality of hemispherical protrusions 2680 adapted to reduce the surface area of the blade housing 2652 that contacts the roll-dispensed stock during the cutting process, thereby reducing friction. The protrusions also raise the lower face 2666 of the blade housing 2652 off the container 2600, making the cutter easier to move and more stable. As shown in FIG. 53A, four protrusions 2680 can be provided on the lower face 2666 of the blade housing 2652 and the protrusions 2680 can be located behind leading edges 2682 of the blade 2654, to reduce interference with the roll-dispensed stock. As such, the blade 2654 can contact the roll-dispensed stock before the protrusions 2680. A greater, or fewer, number of protrusions 2680 can be provided on the lower face 2666 of the blade housing 2652 and the protrusions 2680 can be in the form of curved rails running along the sides of the blade 2654, for example, as shown in FIGS. 54A and 54B.

The blade housing 2652 can comprise first and second halves 2652*a* and 2652*b*, the stem 2658 can comprise first and second halves 2658*a* and 2658*b*, the retaining device 2660 can comprise first and second halves 2660*a* and 2660*b*, and the blade 2654 can be disposed therebetween. According to some aspects of the present disclosure, the blade housing 2652, stem 2658, and retaining device 2660 can be formed in a single piece, e.g., molded in a unitary structure. As shown in FIG. 53C, the first half of blade housing 2652*a*, first half of stem 2658*a*, and first half of retaining device 2660*a* form a first half of cutter assembly 2650*a*, the second half of blade housing 2652*b*, second half of stem 2658*b*, and second half of retaining device 2660*b* form a second half of cutter assembly 2650*b*, and a hinge 2684, or the like, can be disposed between the first half 2650*a* and the second half 2650*b* of cutter assembly 2650. The first half 2650*a* and the second half 2650*b* of cutter assembly 2650 can be formed as a single component (e.g., via injection molding) and cutter assembly 2650 can be constructed by folding the first half 2650*a* and the second half 2650*b* about the hinge 2684, with the blade 2654 being captured therebetween. The halves can be retained together by a snap-fit connection, wherein a post on one half is inserted into a receptacle in the other half, to join the halves together, or that halves can be joined together by any other means described herein.

Figure 54B:
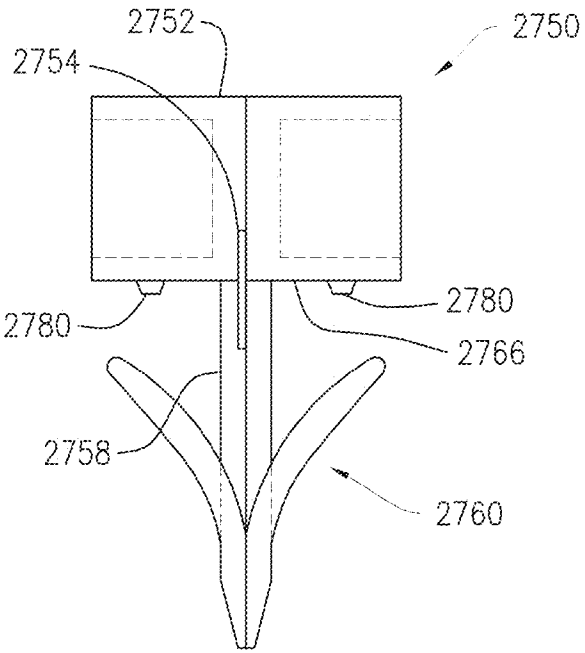
FIG. 54B is a front view of the insertable cutter of FIG. 54A.
Figure 54A:
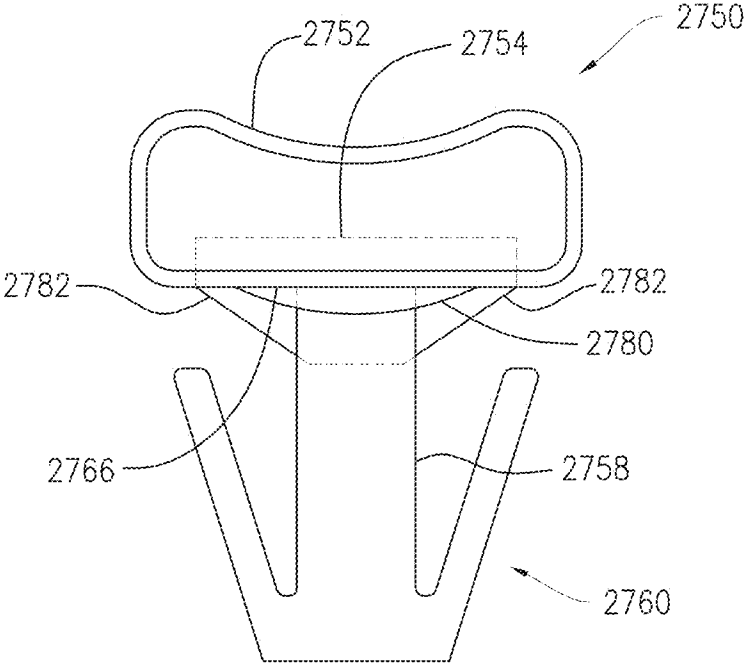
FIG. 54A is a side view of another insertable cutter according to the present disclosure including a arcuate spacers.

FIGS. 54A and 54B show another insertable slidable cutter assembly 2750 according to the present disclosure, and are referred to jointly herein. Cutter assembly 2650 can be substantially similar in structure and function to cutter assembly 2650, described in connection with FIGS. 53A-53C. The cutter assembly 2750 includes a blade housing 2752, a blade 2754, a stem 2758, and retaining device 2760. The blade 2754 can be sized such that a portion thereof extends below a lower face 2766 of the blade housing 2752, to cut a portion of roll-dispensed stock thereunder. The lower face 2766 of the blade housing 2752 can also be provided with one or more arcuate sliders 2780 adapted to reduce the surface area of the blade housing 2752 that contacts the roll-dispensed stock during the cutting process, thereby reducing friction and raising the lower face 2766 of the blade housing 2752 away from the surface of the container, to accommodate the stock for cutting and to stabilize the cutter assembly 2750. As shown in the figures, two arcuate protrusions 2780 are provided on the lower face 2766 of the blade housing 2752, on either side of the blade 2754, and the protrusions 2780 are sized to fit between leading edges 2782 of the blade 2754, allowing the blade 2754 to cut the roll-dispensed stock before the arcuate sliders 2780 come into contact therewith. While two arcuate sliders 2780 are shown in the drawings, additional arcuate sliders 2780 can be provided in the lower face 2766 of the blade housing 2752. As shown best in FIG. 54B, the arcuate sliders 2780 can be configured with any cross-sectional profile, such as trapezoidal cross-sectional profiles. However, the arcuate sliders 2780 can be configured with any cross-sectional area that reduces the surface area of the blade housing 2752 contacting the roll-dispensed stock during cutting and reduces friction.

Figure 55B:
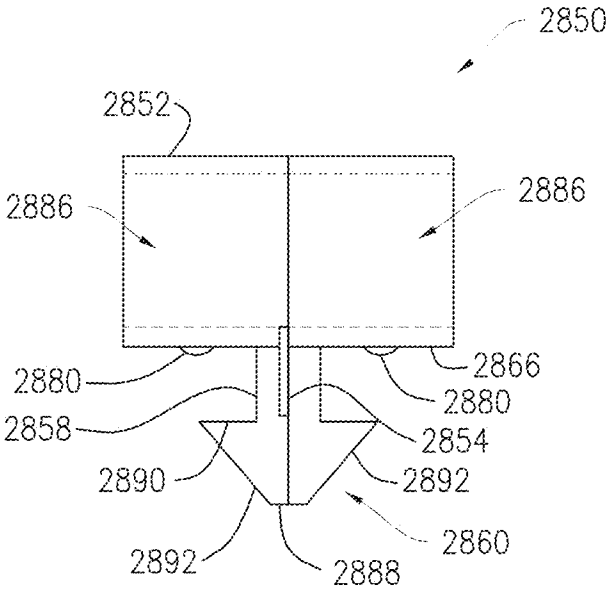
FIG. 55B is a front view of the insertable cutter of FIG. 55A.
Figure 55A:
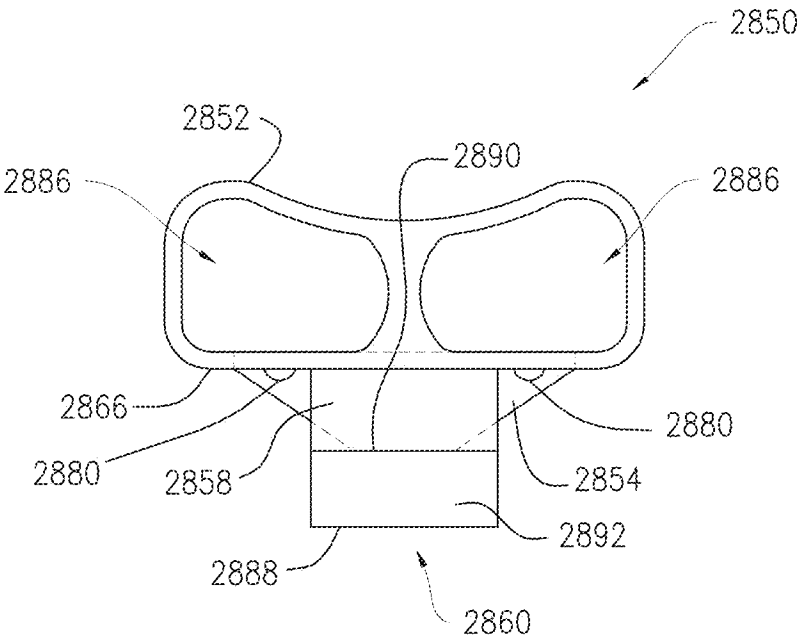
FIG. 55A is a side view of another insertable cutter according to the present disclosure including apertures for allowing airflow.

FIGS. 55A and 55B show another insertable slidable cutter assembly 2850 according to the present disclosure. The cutter assembly 2850 includes a blade housing 2852, a blade 2854, a stem 2858, and a retaining device 2860 for securing the cutter assembly 2850 within an elongated slot in a wall of a container (see, e.g., elongated slot 2325 in surface 2324 of container 2300). As shown in FIG. 55B, the retaining device 2860 can have a generally inverted triangular configuration, with a leading edge or face 2888 having a width less than the width of the elongated slot into which the cutter assembly 2850 is inserted, angles walls 2892, and a rear face 2890 having a width greater than the width of the elongated slot. As the cutter assembly 2850 is inserted through the elongated slot, the walls 2892 of the retaining device 2860 exert outward pressure on, and thereby deform, the elongated slot (e.g., where the slot is formed in a cardboard container), such that the retaining device 2860 can pass therethrough. Once the retaining device 2860 has been completely inserted into the elongated slot, the elongated slot returns to its original configuration, and the trailing face 2890 of the retaining device 2860 prevents the cutter assembly 2850 from being removed from the slot.

The blade 2854 can be sized such that a portion thereof extends below a lower face 2866 of the blade housing 2852, to cut a portion of roll-dispensed stock thereunder. The blade housing can be provided with one or more apertures 2886 extending through the blade housing 2852. The apertures 2886 can be sized and configured to allow the passage of air, if the cutter assembly 2850 is inadvertently swallowed by a child, thereby reducing or eliminating the risk of choking. Additionally, the apertures 2886 reduce the overall weight of the cutter assembly 2850 and the materials needed for production thereof.

The lower face 2866 of the blade housing 2852 can include a rounded profile towards front and rear sides of the blade housing 2852, and the lower face 2866 of the blade housing 2852 can also be provided with a plurality of hemispherical protrusions 2880 adapted to reduce the surface area of the blade housing 2852 that contacts the roll-dispensed stock during the cutting process, thereby reducing friction. As shown, four protrusions 2880 are provided on the lower face 2866 of the blade housing 2852 and the protrusions 2880 are located behind leading edges 2882 of the blade 2854, allowing the blade 2854 to cut the roll-dispensed stock before the protrusions 2880 come into contact therewith. Of course, a arcuate rail or rocker, as described in connection with FIGS. 54A and 54B, can be used in place of the protrusions 2880.

Figure 56B:
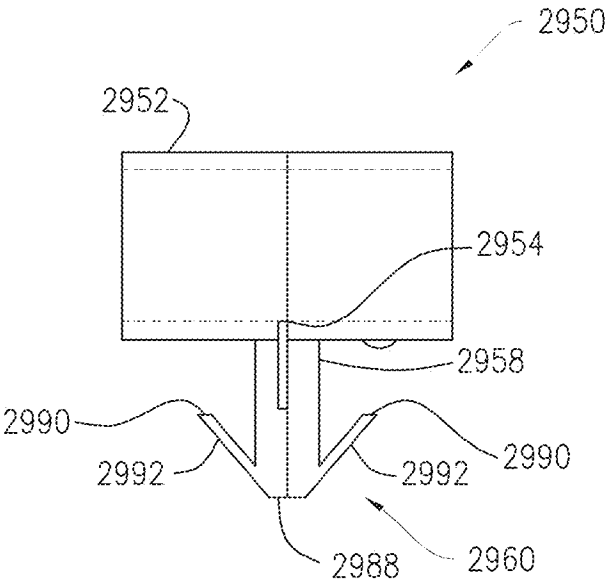
FIG. 56B is a front view of the insertable cutter of FIG. 56A.
Figure 56A:
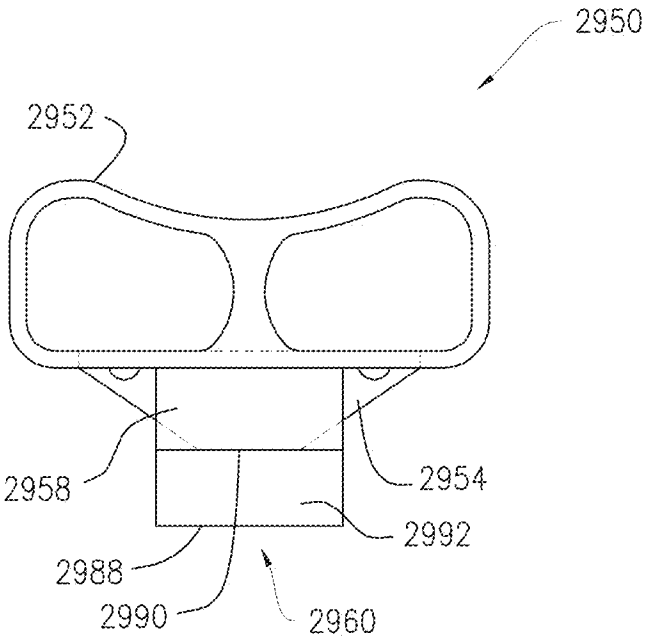
FIG. 56A is a side view of another insertable cutter according to the present disclosure including apertures for allowing airflow.

FIGS. 56A and 56B show another insertable slidable cutter assembly 2950 according to the present disclosure, and are referred to jointly herein. Cutter assembly 2950 can be substantially similar in structure and function to cutter assembly 2850, described in connection with FIGS. 55A and 55B. The cutter assembly 2950 includes a blade housing 2952, a blade 2954, a stem 2958, and a retaining device 2960 for securing the cutter assembly 2950 within an elongated slot in a wall of a container (see, e.g., elongated slot 2325 in surface 2324 of container 2300). As shown in FIG. 56B, the retaining device 2960 can include a leading edge or face 2988 having a width less than the width of the elongated slot into which the cutter assembly 2950 is inserted and resiliently deformable flanges 2992 that extend at an angle from the leading face 2988, such that the distance between top edges 2990 of the flanges 2992 is greater than the width of the elongated slot. As the cutter assembly 2950 is inserted into the elongated slot, the flanges 2992 of the retaining device 2960 are compressed by exterior edges of the elongated slot, such that the flanges 2992 of the retaining device 2960 can pass therethrough. Once the retaining device 2960 has been completely inserted through the elongated slot, the flanges 2992 return to their original configuration (as shown in FIG. 56B), and the top edges 2990 of the flanges 2992 prevent the cutter assembly 2950 from being removed from the slot. Cutter assembly 2950 can also include protrusions or arcuate rails, as described herein, to space the cutter housing 2952 from the container.

Figure 57:
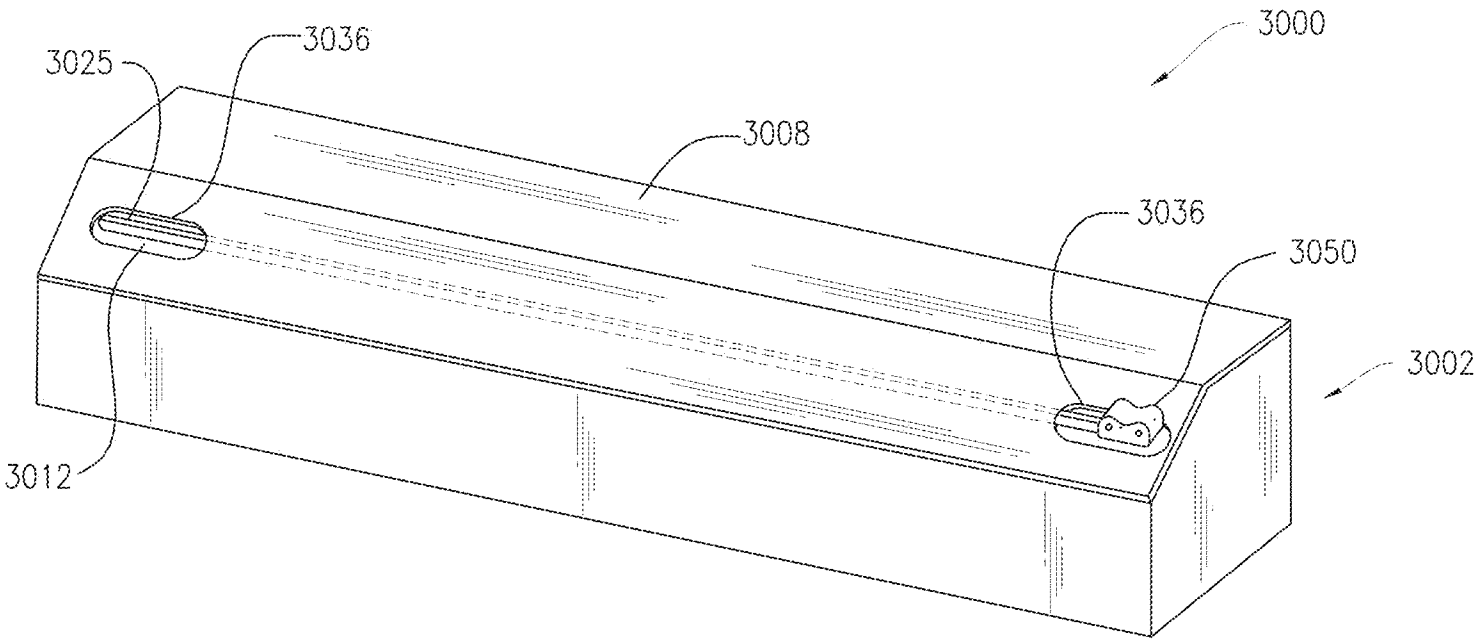
FIG. 57 is a perspective view of another roll-dispensed stock container according to the present disclosure including a lid with apertures for retaining a slidable cutter.

FIG. 57 is a perspective view of a container 3000 including a body 3002 having an angled support wall 3012 with an elongated slot 3025, a slidable cutter assembly 3050 disposed within the elongated slot 3025, and a lid 3008 disposed over the angled support wall 3012 having one or more apertures 3036 at opposite ends thereof, sized to accept the slidable cutter assembly 3050. When the container 3000 is positioned with the lid 3008 in a closed configuration (as shown in FIG. 57), the apertures 3036 in the lid 3008 prevent the cutter assembly 3050 from freely moving along the length of the elongated slot 3025. Conversely, when the container 300 is positioned with the lid 3008 in an open configuration, the cutter assembly is not constrained by the apertures 3036 in the lid 3008 and is able to freely move along the length of the slot 3025. The apertures 3036 also show a purchaser the cutter configuration prior to use or sale.

Figure 58:
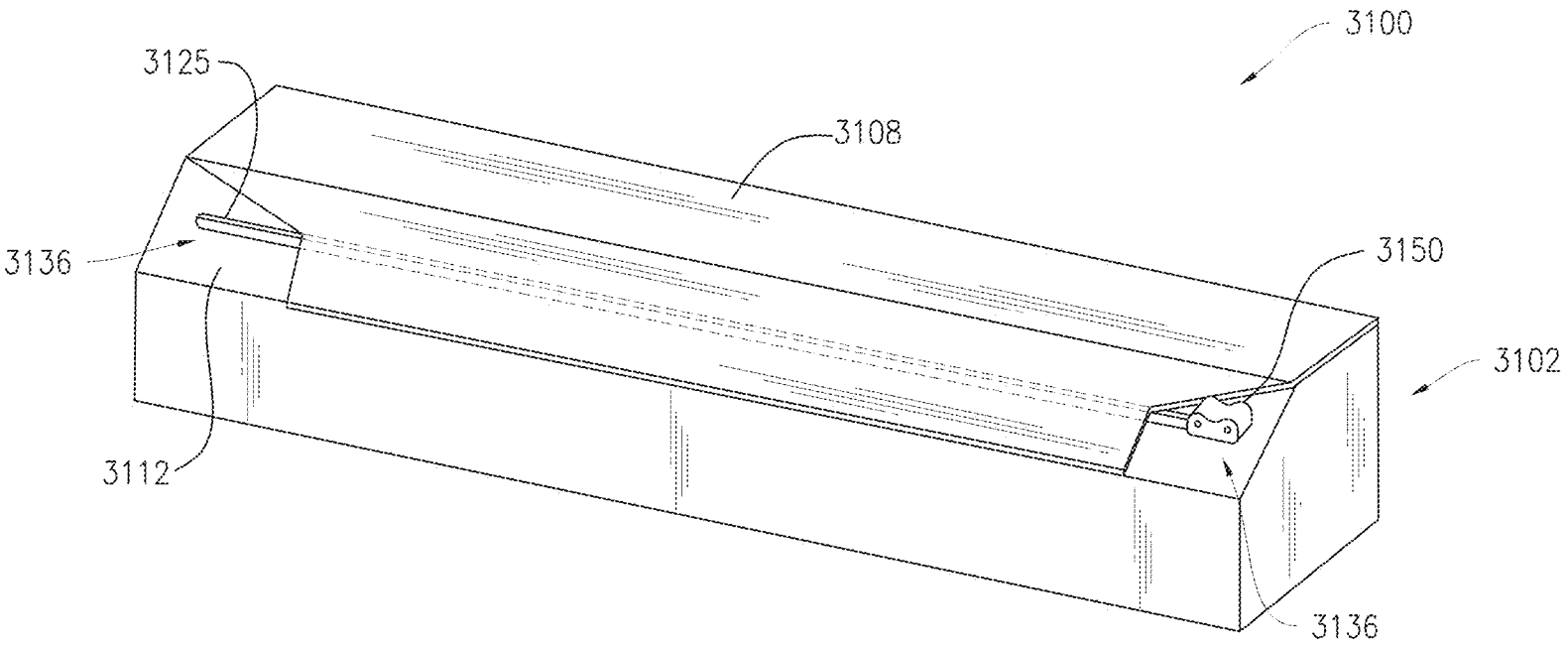
FIG. 58 is a perspective view of another roll-dispensed stock container according to the present disclosure including a lid with areas of reduced width for retaining a slidable cutter.

FIG. 58 is a perspective view of a container 3100 according to some aspects of the present disclosure, including a body 3102 having an angled support wall 3112 with an elongated slot 3125, a slidable cutter assembly 3150 disposed within the elongated slot 3125, and a lid 3108 disposed over the angled support wall 3102. The lid 3108 is configured with cutouts 3136 at opposite ends thereof, sized to accommodate the slidable cutter assembly 3150, when the cutter assembly 3150 is positioned at outermost ends of the container 3100. When the container 3100 is positioned with the lid 3108 in a closed configuration (as shown in FIG. 58), the cutouts 3136 in the lid 3108 prevent the cutter assembly 3150 from freely moving along the length of the elongated slot 3125. Conversely, when the container 3100 is positioned with the lid 3108 in an open configuration, the cutter assembly 3150 is not constrained by the edges of the lid 3108 and is able to freely move along the length of the slot 3125. The cutouts 3136 also show a purchaser the cutter configuration prior to use or sale.

Figure 59:
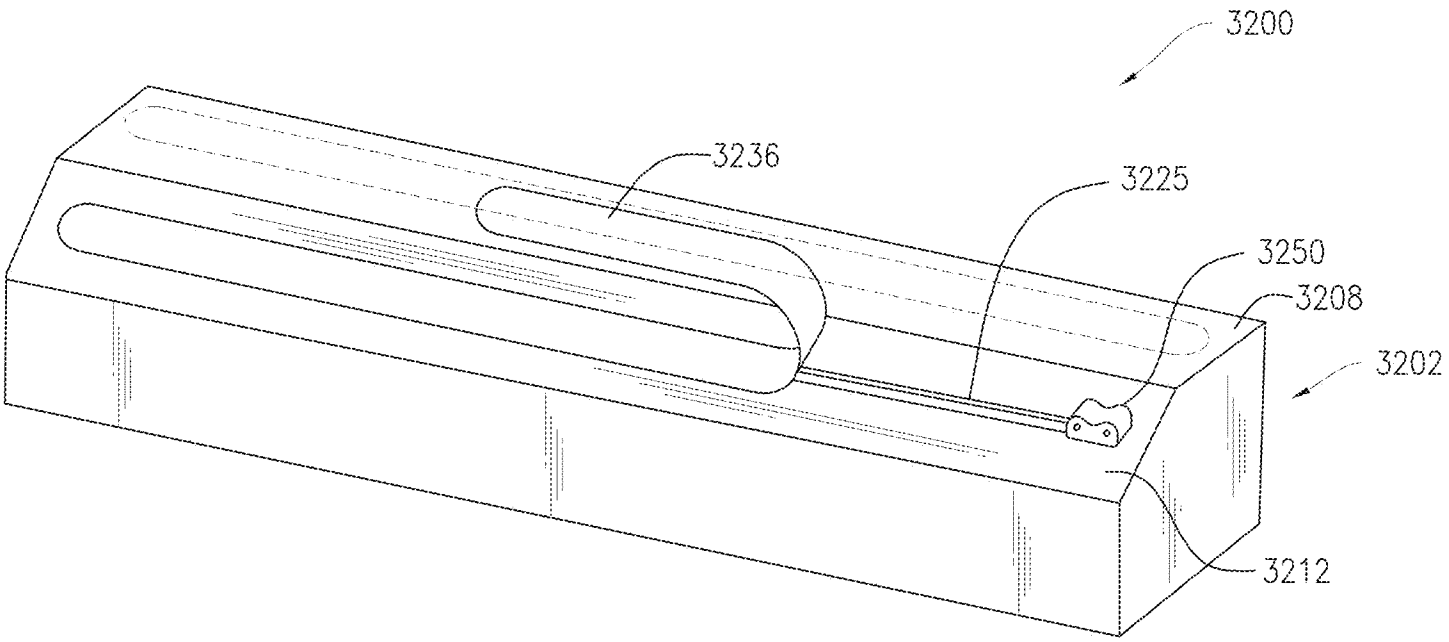
FIG. 59 is a perspective view of another roll-dispensed stock container according to the present disclosure including a strip of material for retaining a slidable cutter.

FIG. 59 is a perspective view of a container 3200 according to some aspects of the present disclosure, including a body 3202 having an angled support wall 3212 with an elongated slot 3225 therein, a slidable cutter assembly 3250 disposed within the elongated slot 3225, and an elongated strip of material 3236 positioned on the angled support wall 3212 and over at least a portion of the elongated slot 3225, preventing movement of the cutter assembly 3250 therealong. The material 3236 can be adhered to the support wall 3212 using any adhesive. The adhesive is be adapted to allow the material 3236 to be removed. However, the adhesive can also be adapted such that the material 3236 can be replaced. As shown in FIG. 59, the material 3236 can be selectively positionable over the elongated slot 3225, in order to prevent movement of the cutter assembly 3250 therein. When the material 3236 is removed, the slidable cutter assembly 3250 is able to freely move along the length of the slot 3225.

Figure 60:
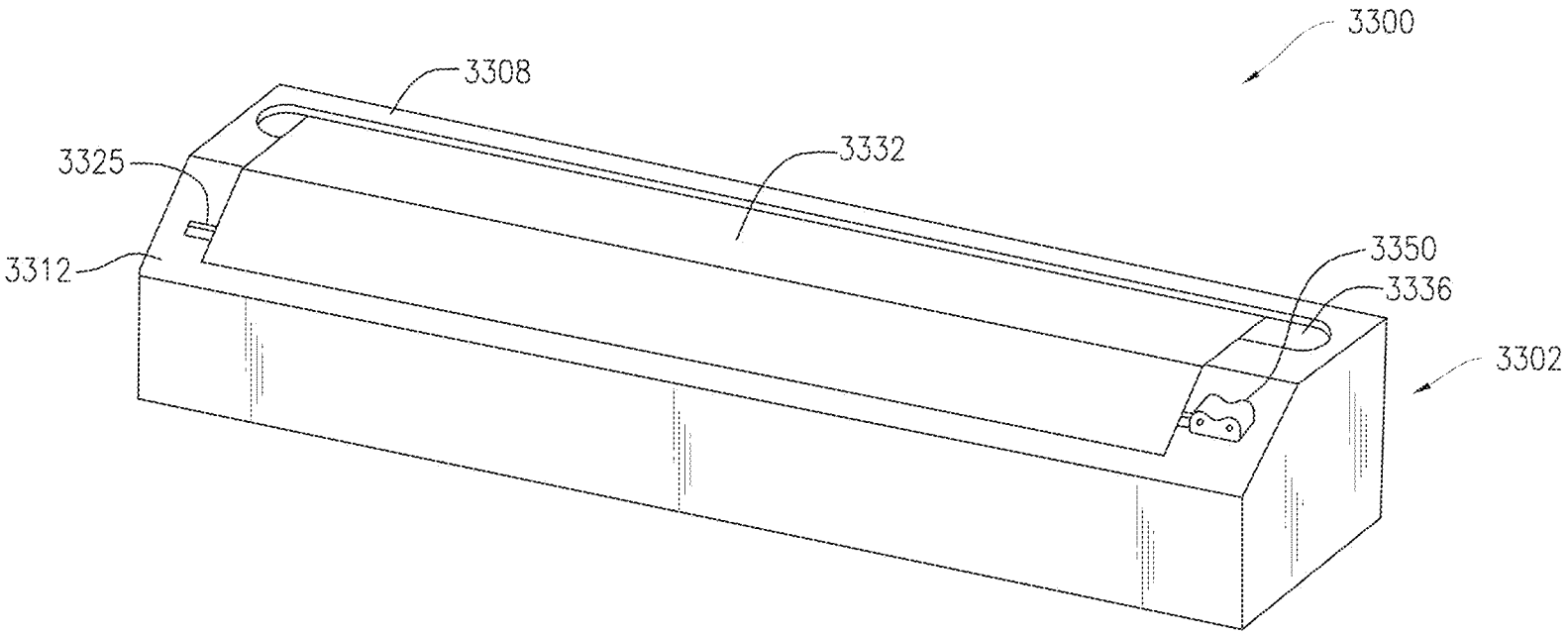
FIG. 60 is a perspective view of another roll-dispensed stock container according to the present disclosure including roll-dispensed stock positioned to retain a slidable cutter.

FIG. 60 is a perspective view of a container 3300 according to some aspects of the present disclosure, including a body 3302 having a top wall 3308 with an aperture 3336 therein for dispensing roll-dispensed stock 3332, an angled support wall 3312 with an elongated slot 3325 therein, and a slidable cutter assembly 3350 disposed within the elongated slot 3125. As shown, the stock 3332 extends from within the body 3302 and is adhered to the support wall 3313, covering at least a portion of the elongated slot 3325 and preventing movement of the cutter assembly 3350 therealong. The roll-dispensed stock 3332 can be adhered to the support wall 3312 using adhesives applied to one or both of the support wall 3312 and a leading edge roll-dispensed stock 3332, or by adhesives applied to the support wall 3312 and adapted to allow the roll-dispensed stock 3332 to be removed and later replaced. When a user desires to cut a segment of the roll-dispensed stock 3332, the user can simply slide the cutter assembly 3350 across the stock 3332, thereby separating the stock 3332 from the support wall 3312.

Figure 61:
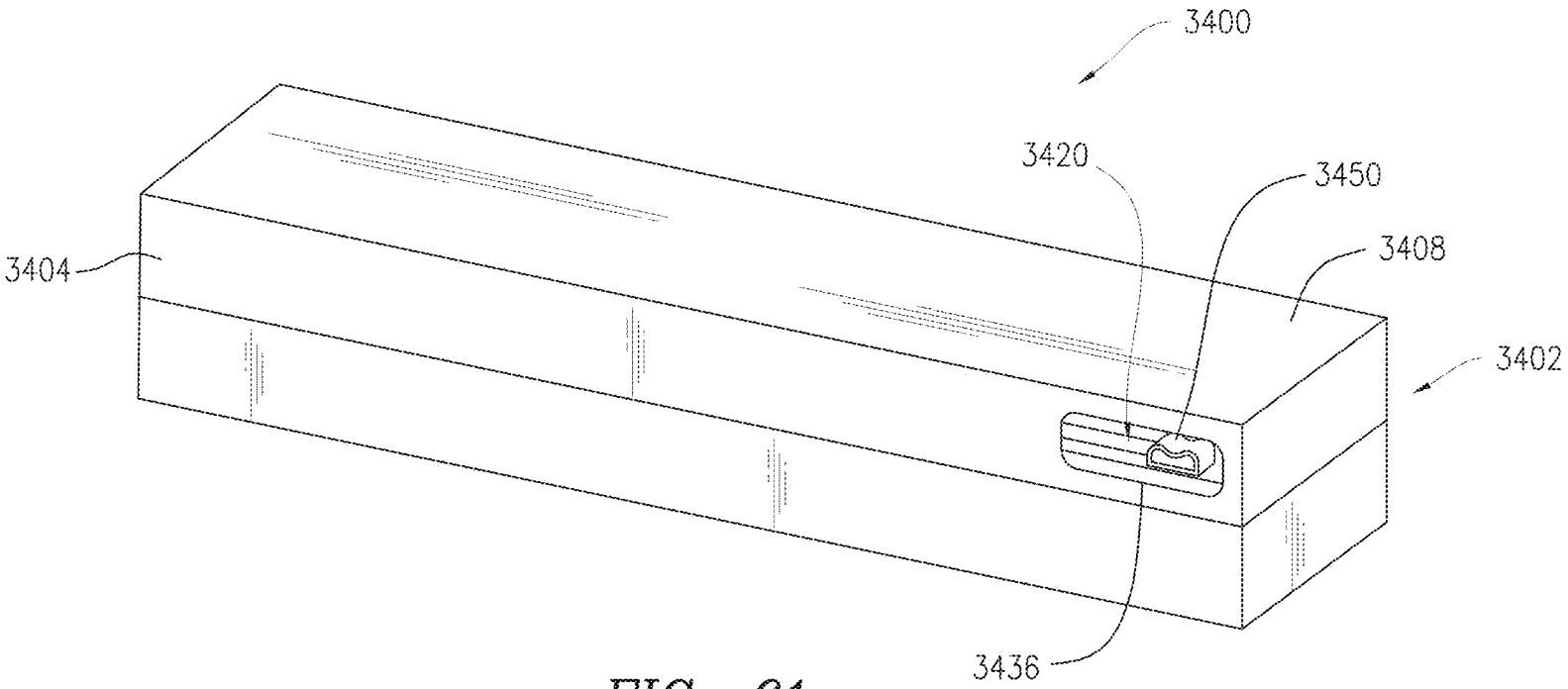
FIG. 61 is a perspective view of another roll-dispensed stock container according to the present disclosure including a lid with a window for viewing a slidable cutter assembly.
Figure 62A:
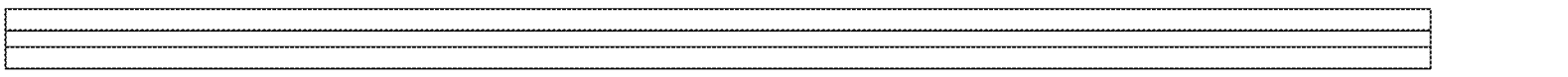
FIG. 62A is a top view of a track for a slidable cutter according to the present disclosure including flanges.
Figure 62B:
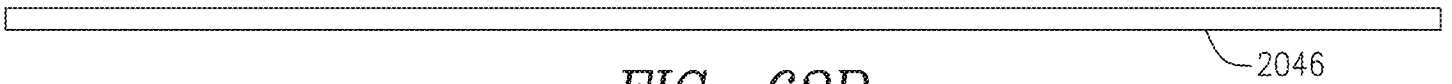
FIG. 62B is a side view of the track of FIG. 62A.
Figure 62D:
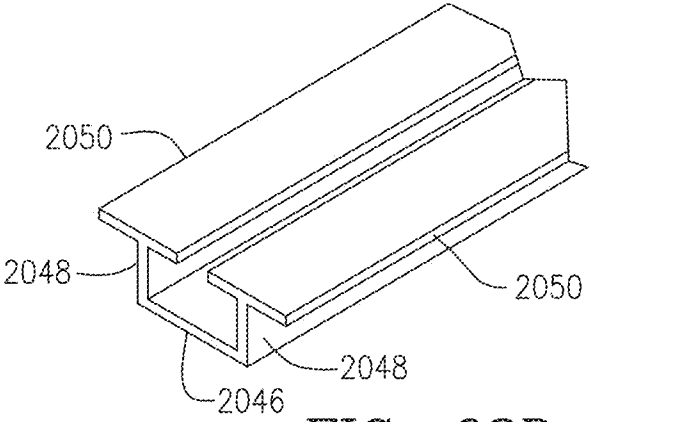
FIG. 62D is a partial perspective view of the track of FIG. 62A.
Figure 62C:
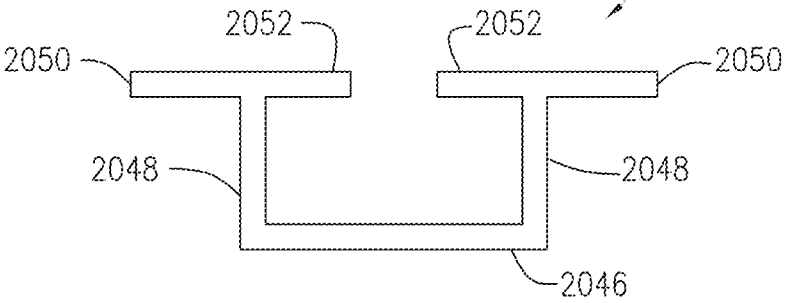
FIG. 62C is a front view of the track of FIG. 62A.

FIG. 61 is a perspective view of a container 3400 according to some aspects of the present disclosure. Container can be similar in structure and function to container 2000, described in connection with FIGS. 42-43. As shown in FIG. 61, container 3400 includes a body 3402 having an recessed area 3420, a slidable cutter assembly 3450 disposed within the recessed area 3420, and a lid 3408 disposed over the body 3402, including the recessed area 3402. The lid 3108 is configured with one or more apertures 3436 in a front wall 3404 of the lid 3108, along the recessed area 3420, such that one can observe the position and configuration of the recessed area 3420 and cutter assembly 3450 without opening the lid 3408, thereby making container 3400 particularly suited for display and/or marketing purposes.

FIGS. 62A-62D show additional detail of the track 2042, described in connection with FIGS. 42 and 43. More specifically, FIGS. 62A-D are top, front, side, and partial perspective views of the track 2042, respectively. As shown, track 2042 can include a bottom wall 2046 and vertical walls 2048, forming a generally U-shaped cross-section. The track 2042 can also include exterior flanges 2050 extending away from top edges of the vertical walls 2048, which support the track 2042 within slot 2025, as described in connection with FIG. 43, for example, and interior flanges 2052 extending towards a center of track 2042 for retaining the slidable cutter 2044 therein. The track 2042 can be extruded from a single material. According to other aspects of the present disclosure, the track 2042 can be formed from a first material and a second layer of material can be provided (e.g., through coextrusion) on an upper surface of the track 2042 (not shown) for providing enhanced adhesive properties.

Figure 63A:
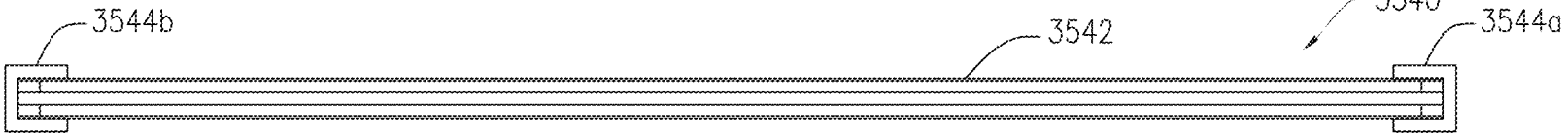
FIG. 63A is a top view of another track for a slidable cutter according to the present disclosure including end caps.
Figure 63C:
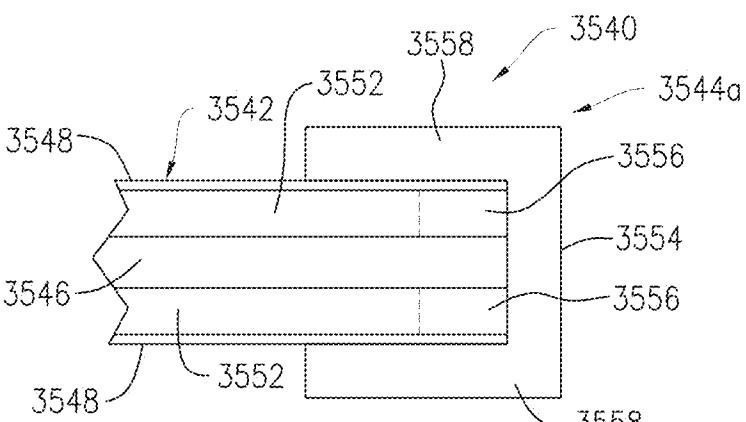
FIG. 63C is a top view of the track of FIG. 63A.
Figure 63D:
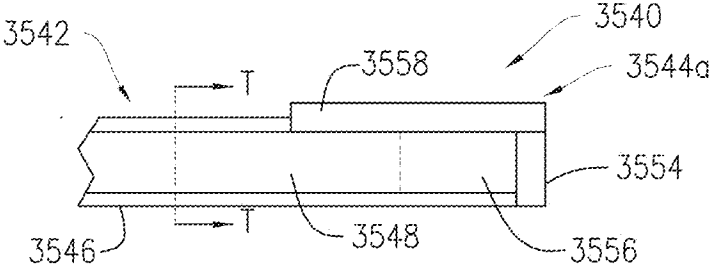
FIG. 63D is a side view of the track of FIG. 63A.
Figure 63B:
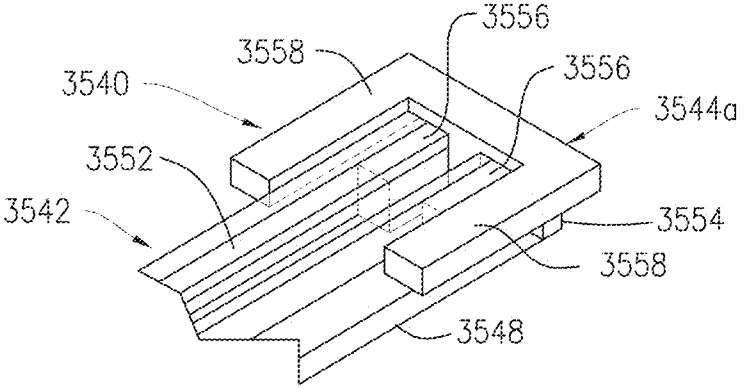
FIG. 63B is a partial perspective view of the track of FIG. 63A.
Figure 63E:
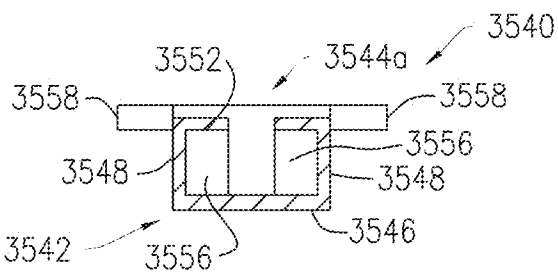
FIG. 63E is a cross-sectional view (taken along line T-T of FIG. 63D) of the track of FIG. 63A.

FIGS. 63A-E show another rail assembly 3540, according to some aspects the present disclosure. More specifically, FIG. 63A is a top view of the rail assembly 3540, FIG. 63B is a partial perspective view of a first end of the rail assembly 3540, FIG. 63C is an enlarged top view of the first end of the rail assembly 3540, FIG. 63D is an enlarged front view of the first end of the rail assembly 3540, and FIG. 63E is a cross-sectional view (taken along line T-T of FIG. 63D) of the rail assembly 3540.

As shown, the rail assembly 3540 includes a rail 3542, a first end cap 3544*a*, and a second end cap 3544*b*. Rail 3542 can include a bottom wall 3546 and vertical walls 3548, forming a generally U-shaped cross-section (see FIG. 63E). The rail 3542 can also include interior flanges 3552 extending from the top edges of vertical walls 3548 and towards a center of track 3542, for retaining a slidable cutter (e.g., slidable cutter 2044, described in connection with FIGS. 42 and 43) therein. Similar to the track 2042, described above, the rail 3542 can be extruded from a single material, or a second layer of material can be provided (e.g., through coextrusion) on an upper surface of the rail 3542 (not shown) for providing enhanced adhesive properties.

Each end cap 3544*a* and 3544*b* includes a rear wall 3554, with one or more cap blocks 3556 extending therefrom, in a direction that is substantially perpendicular to the rear wall 3544, and along track 3542, at the bottom wall 3546. The one or more cap blocks 3556 are configured to be received and retained within the track 3542. Additionally, each end cap 3544 include cap flanges 3558 that extend from the rear wall 3554, in a direction that is substantially perpendicular thereto, along track 3542 at upper edges of vertical walls 3548, and parallel to inner flanges 3552 of the track 3542. The cap flanges 3558 and rear wall 3554 extend along three sides of the track 3542, forming a generally U-shaped end, from a top-down view (see, e.g., FIG. 63C). An additional flange (not shown) can extend from the rear wall 3554 of the end cap 3544, in a similar fashion to cap flanges 3558, such that flanges are provided along three sides of the track 3542 at each end thereof.

The end caps 3544*a* and 3544*b* and cap flanges 3558 support the rail assembly 3540, recessed into an elongated slot of container, as described in connection with of one or more of the containers of the present disclosure. For example, rail assembly 3540 can function similar to track 2042, described in connection with FIGS. 42, 43, and FIGS. 62A-D. Additionally, the cap blocks 3556 of end caps 3544*a* and 3544*b* act as stops, preventing a slidable cutter (e.g., slidable cutter 2044) from contacting, and potentially damaging, outermost edges of an elongated slot that are adjacent to the ends of the track 3542.

The container of the present disclosure can be manufactured by producing a container blank, having an elongated slot, folding the blank to form a container body, and inserting the slidable cutter assembly into the elongated slot.

The container blank can be formed from a cardboard material in a substantially planar configuration prior to folding. The blank can be cut or stamped from a sheet of cardboard, or other material, and can include front wall, rear wall, top wall, bottom wall panels, and any other walls or surfaces described herein. Perforated or fold lines can be formed for separating the respective wall panels. The elongated slot can be formed (e.g., in a wall panel corresponding to a support wall or horizontal wall of a vertical recess, as described above) by cutting or stamping at the same time as the blank is cut or stamped from the sheet. An adhesive, or other means for securing the panels to one another, can be applied to adjoining wall panels before or after the blank is formed, or when partially folded, to maintain the blank in the folded configuration. The steps of producing the container blank and folding the blank to form a container body can be accomplished by various automated, and/or robotic, manufacturing processes known to the art.

The track (e.g., track 2042 or rail 3542) can be made of plastic, as described above, and can formed by extrusion, injection molding, or other commonly known plastic component production methods. The rails can be formed with or without flanges. Similarly, the end caps 3544 can be formed by injection molding, or other production methods. As discussed above, the slidable cutter (e.g., slidable cutter 2044) can also be formed by injection molding, or other production methods. The rails and cutter can be assembled after they are formed. The end caps (in the case of rail assembly 3540) can be attached to the rail and retained by an interference fit or an adhesive. The friction or interference fit can be between the end blocks and the interior surfaces of the rail.

The assembled slidable cutter assembly can be picked up manually, or robotically, and inserted into the elongated slot and secured by an adhesive applied to undersides of the flanges, the exterior surface of the container surrounding the elongated slot, or both. Insertion of the cutter assembly in the elongated slot includes positioning the assembly proximate to the slot, moving the assembly to match the orientation of the slot, moving the assembly into the slot to contact the flanges against the edges of the slot, and allowing the adhesive, if any, to retain the assembly on the container. The foregoing steps for inserting the slidable cutter into the elongated slot can be accomplished with robotic assembly means and computer vision systems. The slidable cutter assembly has uniform and uninterrupted vertical walls and is sized to fit into the elongated slot and has a width less than or equal to the width of elongated slot to facilitate insertion of the assembly into the slot. The flanges overhang the rail and extend beyond the vertical walls of the rail. Accordingly, the body of the container can be completely formed before the slidable cutter assembly is inserted, and the body of the container does not need to be manipulated when the slidable cutter assembly is finally inserted, all of which simplify the manufacturing and assembly of the container and reduce production costs.

Figure 64:
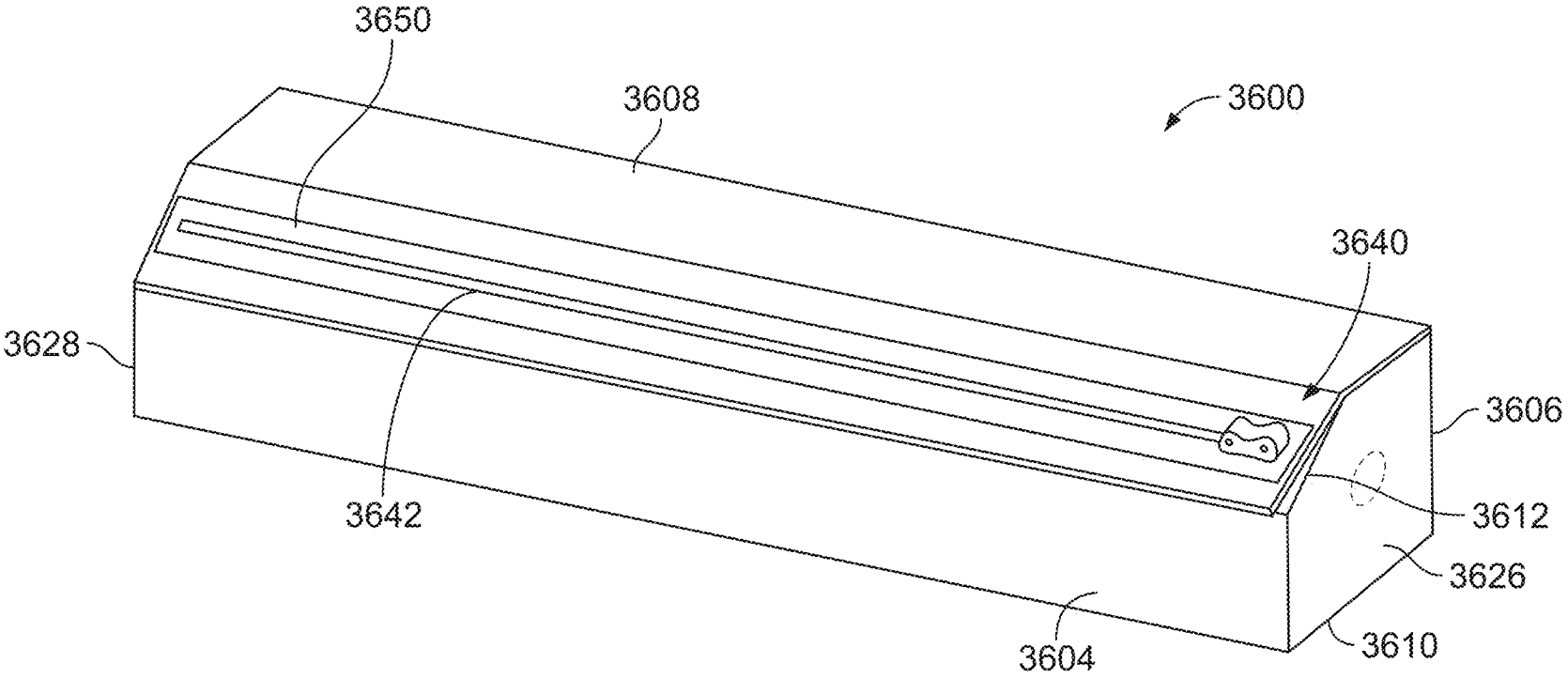
FIG. 64 is a perspective view of a roll-dispensed stock container of the present disclosure having a coating provided thereon.
Figure 65:
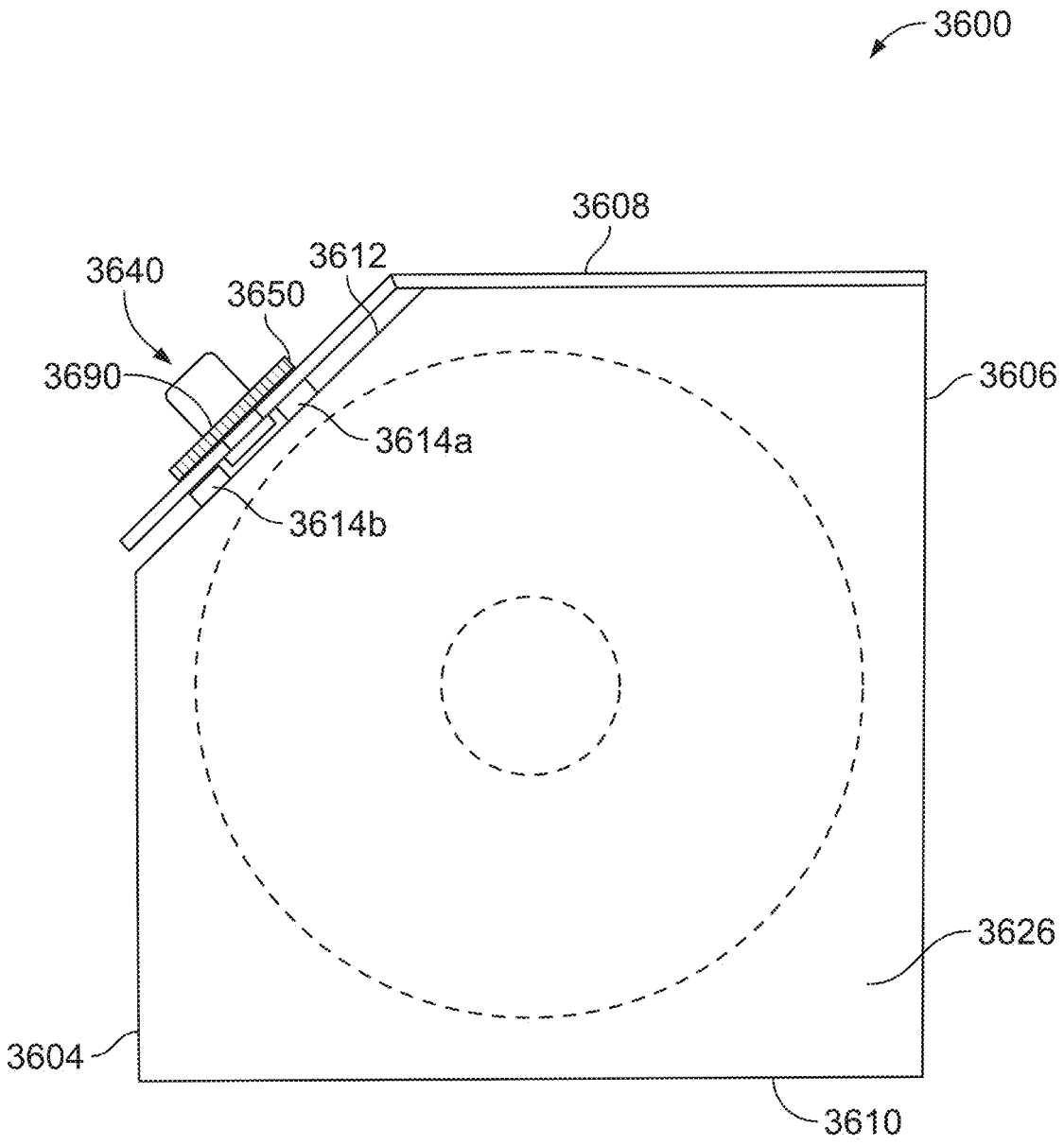
FIG. 65 is a side elevational view of the roll-dispensed stock container of FIG. 64.

FIGS. 64 and 65 show another roll-dispensed stock container 3600 according to some embodiments the present disclosure, having a coating 3650 disposed on one or more surfaces thereof. More specifically, FIG. 64 is a perspective view of the roll-dispensed stock container 3600 positioned in a closed configuration and FIG. 65 is a side elevational view of the roll-dispensed stock container 3600 of FIG. 64.

As shown in FIG. 64, container 3600 includes a front wall 3604, a rear wall 3606, a bottom wall 3610, side walls 3626 and 3628, a support wall 3612, a lid 3608 with an elongated slot 3642 therein, a slidable cutter 3640 disposed within and movable along the slot 3642, and fixation strips 3614*a* and 3614*b* disposed on the support wall 3612. The container 3600 can be any container disclosed herein or otherwise known or developed. The slidable cutter 3640 can be any slidable cutter disclosed herein, or other cutter known or developed, for use in connection with container 3600.

The coating 3650 can be a film, laminate, or other layer of material and can be provided on one or more surfaces of the container 3600 to reduce surface friction, increase rigidity, disperse forces associated with a cutter, and/or otherwise enhance characteristics of the container 3600. For example, the coating 3650 can be a material having a low coefficient of friction, such as low-density polyethylene (LDPE), polytetrafluoroethylene (PTFE), polyimide, polyetheretherketone (PEEK), polyphenylensulfide (PPS), nylon, acetal, polyester, or other materials known to those of ordinary skill in the art having low-friction characteristics. The coating 3650 can also be formed from a thermoplastic elastomer such as that sold by Monsanto Company under the trademark Santoprene. Furthermore, the coating 3650 can be provided as a sheet of material, applied in a liquid or gaseous form, or otherwise bonded to the one or more surfaces of the container 3600. The coating 3650 can also be formed from a transparent or translucent material such that underlying graphics or other indicia provided on the surfaces of the container 3600 can be viewed therethrough.

According to some embodiments of the present disclosure, the coating 3650 can be configured to reduce friction between the slidable cutter 3640 and the lid 3608, thereby preventing the slidable cutter 3640 from binding and/or sticking to the lid 3608 as the slidable cutter 3640 is moved along the slot 3642 to cut the roll-dispensed stock. For example, as shown best in FIG. 65, the coating 3650 can be disposed on a top surface of the lid 3608, about the slot 3642. As discussed herein, pressure is applied to the slidable cutter 3640 during cutting of the roll-dispensed stock, which presses shoulders 3690 of the cutter 3640 against the coating 3650 on the lid 3608. Accordingly, the coating forms a low-friction interface (e.g., barrier) between the shoulders 3690 of cutter 3640 and the lid 3608, thereby allowing the slidable cutter 3640 to freely move along the slot 3642 without binding to the top surface of the lid 3608. As referred to herein, a material having a low-coefficient of friction, or a low-friction material is any material or structure having a coefficient of friction that is less than the material of the container 3600, or that reduces sliding friction between the slidable cutter 3640 and the container 3600 as the slidable cutter 3640 is moved along the slot 3642.

As described above, the coating 3650 can increase, or supplement, the rigidity of the container 3600. The coating 3650 could be formed from one or more of the materials that is sufficiently thick or rigid to add rigidity to the container 3600. For example, the coating 3650 shown in FIG. 65 can have a thickness sufficient to increase the rigidity of the lid 3608 of the container 3600. According to other embodiments of the present disclosure, the coating 3650 can be formed from one or more layers of material, having one or more characteristics. For example, the coating 3650 could include a first layer of material selected to increase the rigidity of the container and a second layer of material selected to reduce friction between the slidable cutter 3640 and the lid 3608 of the container 3600.

As shown in FIGS. 64 and 65, the coating 3650 can be provided along the cutting path of the cutter and be sufficiently wide to accommodate the cutter such that the cutter rides on the coating 3650 without contacting the surface of the container therebelow. However, it should be understood that the coating could extend along an entire surface or wall (see, e.g., FIG. 66), or on multiple walls or the entire container 3600 (see, e.g., FIG. 67). Each of the walls of the container 3600 can be provided with a coating selected and configured to increase the rigidity thereof, while only the lid 3608 is provided with a low-friction coating. It should be also be understood that the coatings 3650 disclosed herein can be applied not only to container 3600, but to any of the roll-dispensed stock containers described herein, or otherwise known or developed.

Figure 66:
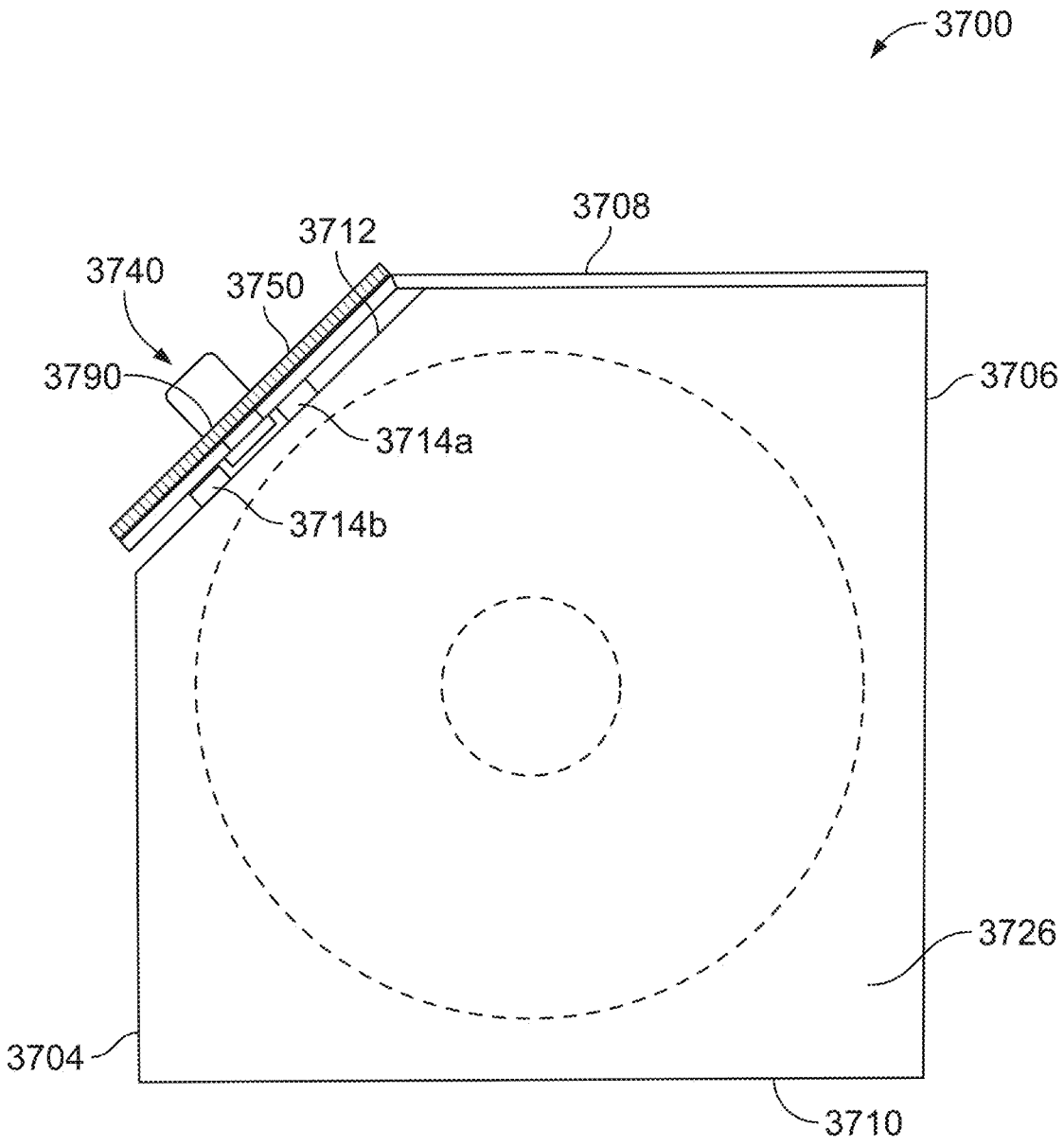
FIG. 66 is a side elevational view of another roll-dispensed stock container of the present disclosure having a coating provided thereon.

FIG. 66 is a side elevational view of another roll-dispensed stock container 3700 according to some embodiments the present disclosure, having a coating 3750 disposed on over the lid of the container. Container 3700 includes a front wall 3704, a rear wall 3706, a bottom wall 3710, a first side wall 3726 and a second side wall (not shown), a support wall 3712, a lid 3708 with an elongated slot therein (not shown), a slidable cutter 3740 disposed within and movable along the slot, fixation strips 3714*a* and 3714*b* disposed on the support wall 3712, and a coating 3750 disposed on a top surface of the 3708. The coating 3750 can be formed form similar materials and function similar to coating 3650, discussed in connection with FIGS. 64 and 65, but extends along an entire surface of the lid 3708. Similarly, the coating 3750 could extend on more than one wall of the container 3700 (see, e.g., FIG. 67) and more than one coating can be provided on the container 3700.

Figure 67:
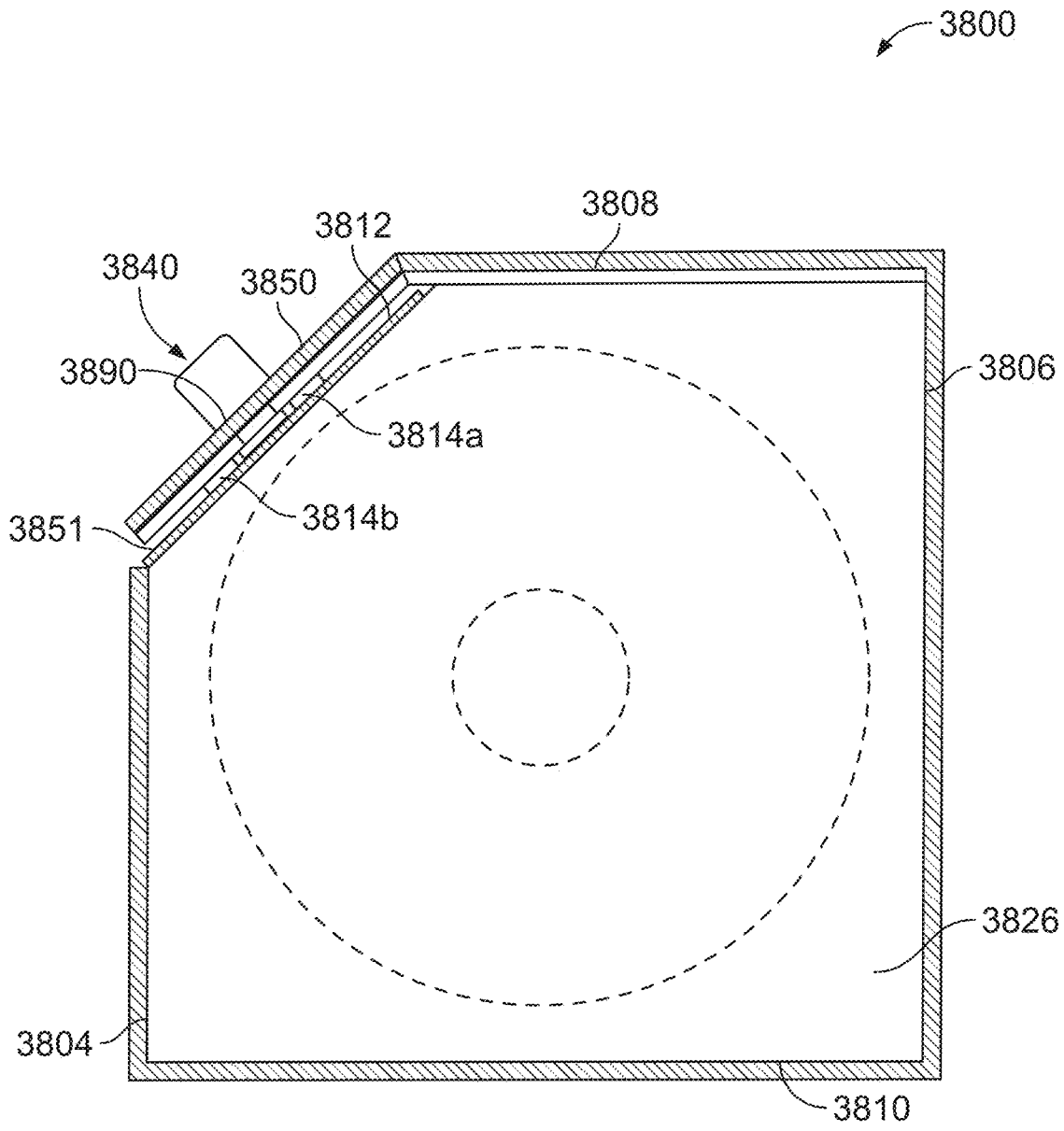
FIG. 67 is a side elevational view of another roll-dispensed stock container of the present disclosure having a coating provided thereon.

FIG. 67 is a side elevational view of another roll-dispensed stock container 3800 according to some embodiments the present disclosure, having a coating 3850 disposed over the entire container 3800. Container 3800 includes a front wall 3804, a rear wall 3806, a bottom wall 3810, a first side wall 3826 and a second side wall (not shown), a support wall 3812, a lid 3808 with an elongated slot therein (not shown), a slidable cutter 3840 disposed within and movable along the slot, fixation strips 3814*a* and 3814*b* disposed on the support wall 3812, and the coating 3850 is disposed over the entire exterior surface of the container 3800. According to some embodiments of the present disclosure, the container 3800 is also provided with a coating 3851 on the support wall 3812. The coating 3850, and the coating 3851, can be formed form similar materials and function similar to coating 3650, discussed above in connection with FIGS. 64 and 65.

Figure 68A:
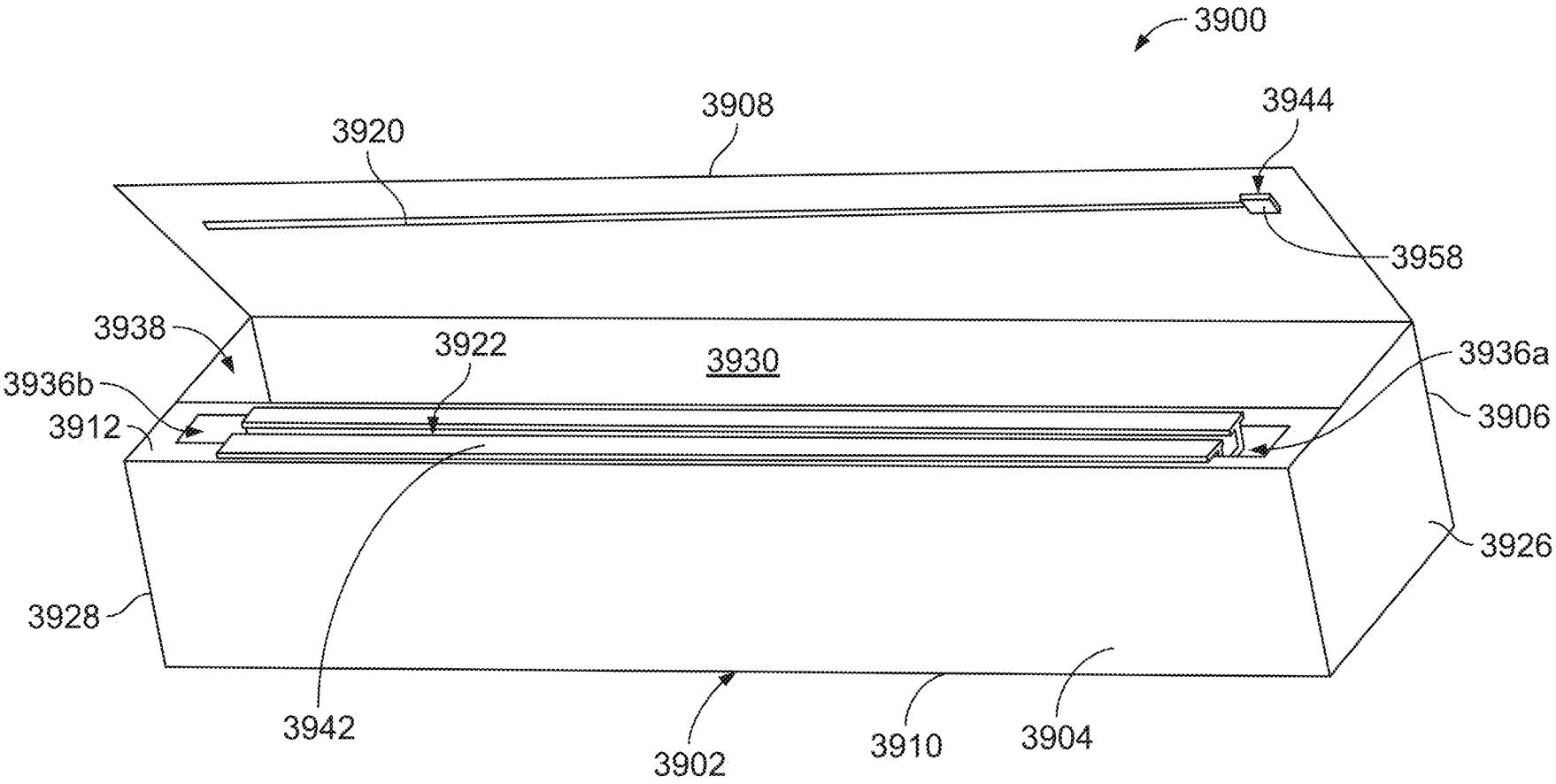
FIG. 68A is a perspective view of another roll-dispensed stock container according to the present disclosure, positioned in an open configuration, including a recessed track on a support wall that is engaged by a slidable cutter on a lid.
Figure 68B:
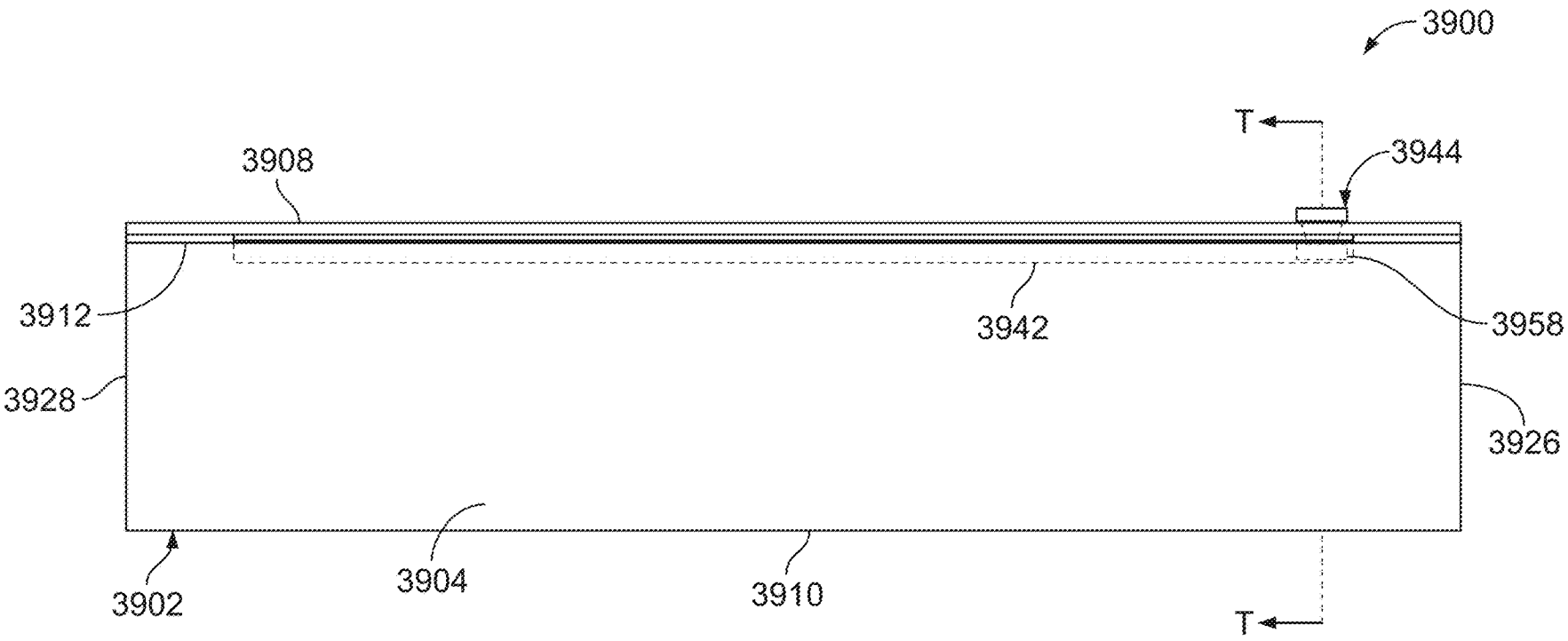
FIG. 68B is a front elevational view of the roll-dispensed stock container of FIG. 68A, positioned in a closed configuration.
Figure 69:
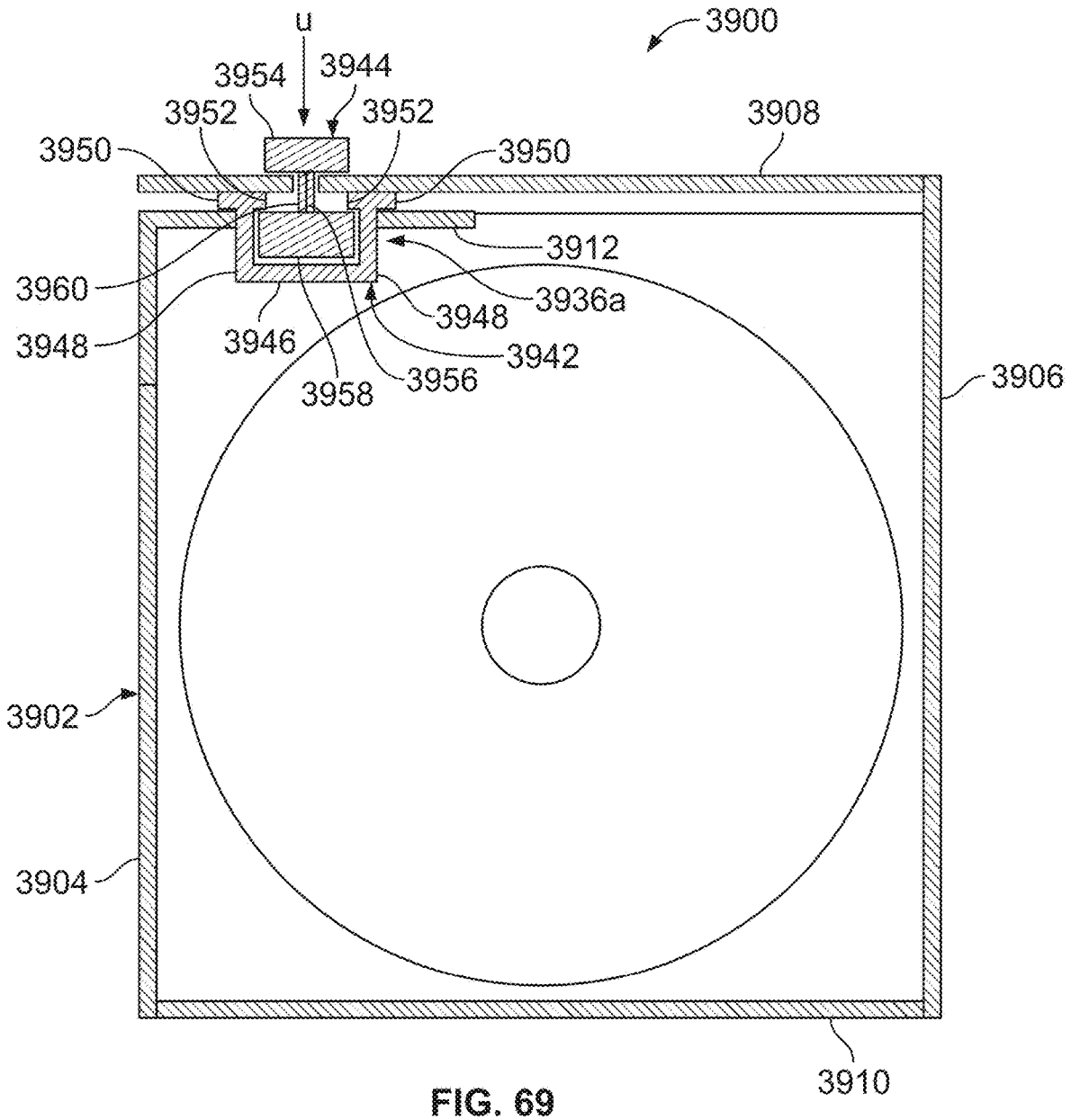
FIG. 69 is a partial cross-sectional view (taken along line T-T of FIG. 68B) of the roll-dispensed stock container of FIGS. 68A and 68B.

FIGS. 68A, 68B, and 69 show another roll-dispensed stock container 3900 according to the present disclosure, having a support wall 3912 with a recessed track 3942 for accepting a slidable cutter 3944. More specifically, FIG. 68A is a perspective view of the roll-dispensed stock container 3900 positioned in an open configuration, FIG. 68B is a front view of the roll-dispensed stock container 3900 positioned in a closed configuration with the slidable cutter 3944 engaged with the track 3942, and FIG. 69 is a side cross-sectional view (taken along line T-T of FIG. 68B) of the roll-dispensed stock container 3900. As shown, container 3900 includes a body 3902 including a front wall 3904, a rear wall 3906, a bottom wall 3910, side walls 3926, 3928, a support wall 3912, and a lid 3908 forming an enclosure 3930 for holding roll-dispensed stock, and an opening 3938 for dispensing the roll-dispensed stock from the enclosure 3930. In a closed configuration (see FIGS. 68B and 69), the lid 3908 covers the opening 3938 and extends over the support wall 3912 and the track 3942.

As shown in FIG. 69, a slidable cutter, indicated generally at 3944, is disposed within, and travels along, an elongated slot 3920 that extends through the lid 3908 and along the length of the container 3900. The slidable cutter 3944 includes a blade housing 3954 on the outside of the lid 3908, a blade 3956, a stem 3960 and a cutter base 3958. The blade 3956 extends through the lid 3908, and the cutter base 3958 is positioned on an interior side of the lid 3908. The blade housing 3954 and the base 3958 of the cutter 3944 are configured to have a width greater than the slot 3920, thereby constraining the cutter 3944 within slot 3920.

The container 3900 further includes a recessed track 3942, which is positioned in an elongated slot 3922 that extends along the length of support wall 3912. First and second apertures 3936*a*, 3936*b* are positioned on either end the elongated slot 3922 in the support wall 3912 and are also in communication with the track 3942. The first and second apertures 3936*a*, 3936*b* are sized to receive the cutter base portion 3958 of the slidable cutter 3944, allowing the cutter base 3958 to pass through the plane of the support wall 3912 and into the interior of the body 3902. As described herein, the cutter base portion 3958 can slide into the track 3942, and the track 3942 accepts and retains the cutter base portion 3958 as the cutter 3944 is moved along the length of the container 3900, urging the lid 3908 toward the support wall 3912 and/or track 3942 during the cutting process. This locking configuration provides for the application of constant and consistent pressure to the roll dispensed stock, between the underside of the lid 3908 and the track 3942, during the cutting process.

The track 3942 includes a bottom wall 3946 and vertical walls 3948, forming a generally U-shaped channel, exterior flanges 3950, and interior flanges 3952. The interior flanges 3952 retain the cutter base 3958 of the cutter 3944 within the track 3942 during the cutting process. The exterior flanges 3950, support the track 3942 within the slot 3922, by bearing on the support wall 3912. The track 3942 can be fixed within the slot 3922 by way of an adhesive applied between the exterior flanges 3950 of the track 3942 and the support wall 3912. According to some embodiments of the present disclosure, the track 3942 can also be provided with a second set of exterior flanges (not shown), positioned on the underside of the support wall 3912, sandwiching the support wall 3912 therebetween, and preventing the track 3942 from being removed from the slot 3922. According to other embodiments of the present disclosure, the flanges 3950 of the track 3942 can extend within the support wall 3912. For example, according to embodiments where the track 3942 extends within the support wall 3912, the support wall 3912 can be formed from two or more layers, with the flanges 3950 extending therebetween.

As shown in FIG. 69, the cutter base 3958 of the slidable cutter 3944 protrudes below a bottom surface of the lid 3908 and extends into the aperture 3936*a* (e.g., into enclosure 3930) in normal operation when the container 3900 is positioned in the closed position (e.g., during storage or transportation, or during a cutting operation). Upon an application of force to the blade housing 4054 in the direction of arrow U, the blade housing 3954 is pressed against the exterior side of the lid 3908, the interior side of the lid 3908 is pressed against the exterior flanges 3950 of the track 3942, and the base 3958 of the cutter 3944 is positioned such that the cutter base 3958 can be received within the track 3942. A portion of the lid 3908 can be compressed against the track 3942 or elastically deformed by the application of force to the blade housing 3954, so that the cutter base 3958 of the slidable cutter 3944 fully extends through the aperture 3936 and the slidable cutter 3944 can be moved into track 3942 and travel within track 3942 along the length of the container 3900. The internal flanges 3952 of the track 3942 secure the cutter base 3958 within the track 3942, so the lid 3908 is secured against the track 3942 during the cutting process. This configuration provides for the application of constant and consistent pressure to the roll-dispensed stock captured between the lid 3908 and the track 3942, thereby gripping and tensioning the roll-dispensed stock during the cutting process, and allowing the slidable cutter 3944 to easily and cleanly cut therethrough.

Importantly, it should be understood that during the cutting process, the blade housing 3954 is positioned on a top exterior surface of the lid 3908, the cutter base 3958 is positioned below the flanges 3952 of the track 3942 (e.g., below the support wall 3912 and within the container 3900, and the blade 3956 extends therebetween, securing the lid 3908 of the container 3900 in a closed position throughout the cutting process. Once the cutting process has been completed (e.g., by moving the slidable cutter across 3944 the length of the track 3942), the lid 3908 of the container 3900 can be released and opened by moving the base 3958 of the slidable cutter to one of the apertures 3936*a* and 3936*b*. For example, after the slidable cutter 3944 has traveled from one end of the container 3900 to an opposite end of the container 3900 (e.g., moving from aperture 3936*a* to 3936*b*, or vice versa), the cutter base 3958 of the slidable cutter 3944 can be freed from the track 3942 by positioning the base of the cutter within the aperture 3936*a* or 3936*b* at the opposite end of the container and the lid 3908 of the container 3900 can be opened.

It should also be understood that some embodiments of the present disclosure include only one of the apertures 3936*a* and 3936*b*. According to such embodiments, once the cutting process has been completed (e.g., by moving the slidable cutter across 3944 the length of the track 3942), the slidable cutter 3944 must be returned to its original position before the lid 3908 of the container 3900 can be released and opened. For example, after the slidable cutter 3944 has traveled from one end of the container 3900 (e.g., from an initial starting position at aperture 3936*a* or 3936*b*) to an opposite end of the container 3900, the slidable cutter 3944 must be returned to its original starting position (e.g., aperture 3936*a* or 3936*b*) before the cutter base 3958 can be freed from the track 3942 by positioning the base 3944 of the cutter within the aperture 3936*a* or 3936*b*. Conversely, the lid 3908 of the container 3900 can be secured in the closed position (e.g., for storage or transportation) by leaving, or positioning, the base 3944 of the slidable cutter 3944 within the track 3942.

Figure 70:
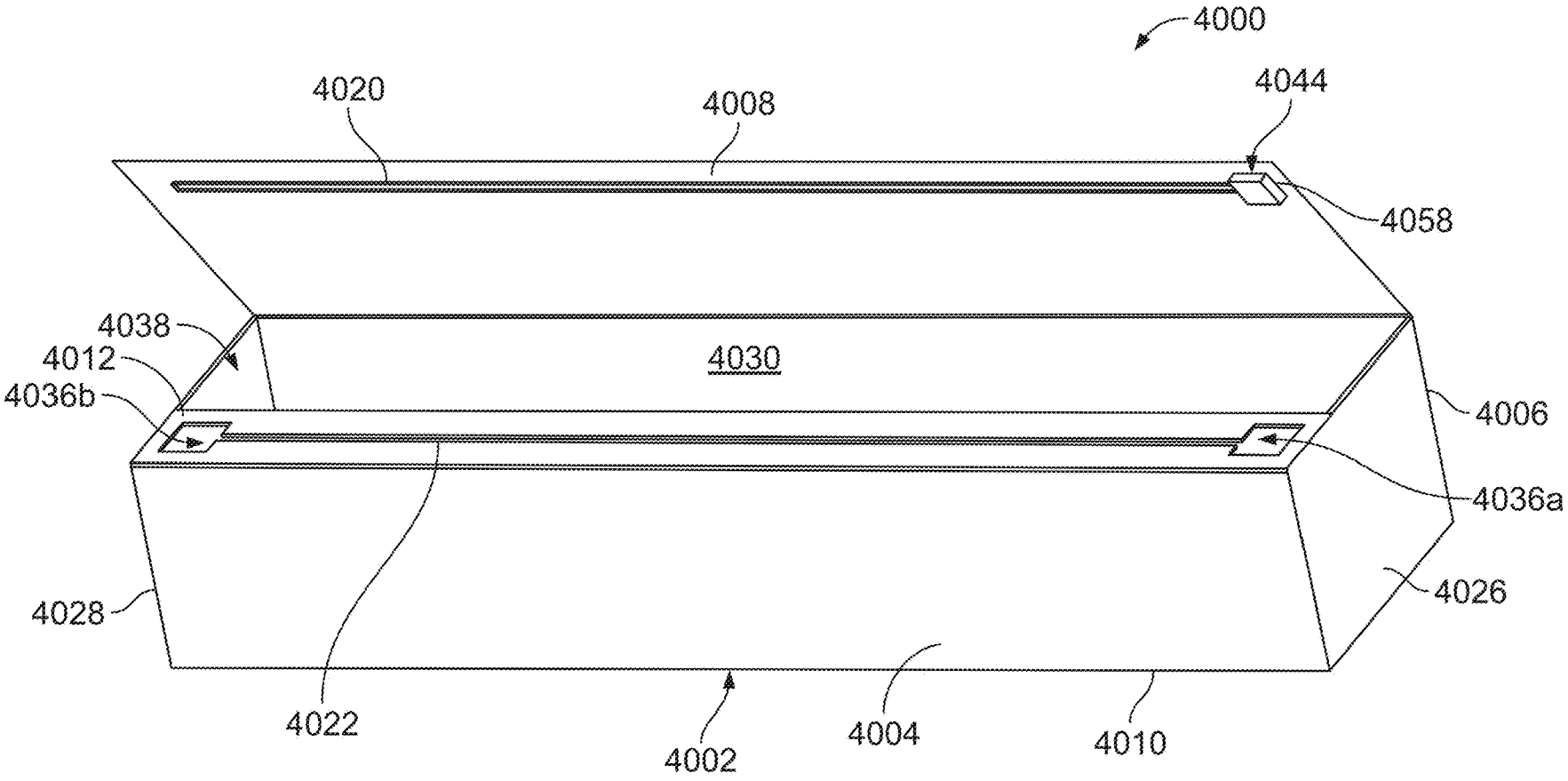
FIG. 70 is a perspective view of another roll-dispensed stock container according to the present disclosure, including a slidable cutter on a lid that engages a support wall.

FIG. 70 is a perspective view of another roll-dispensed stock container 4000 according to the present disclosure, positioned in an open configuration. Container 4000 includes a body 4002 including a front wall 4004, a rear wall 4006, a bottom wall 4010, side walls 4026, 4028, a support wall 4012, and a lid 4008 forming an enclosure 4030 for holding roll-dispensed stock, and an opening 4038 for dispensing the roll-dispensed stock from the enclosure 4030. In a closed configuration (see, e.g., container 3900 discussed in connection with FIG. 69), the lid 4008 covers the opening 4038 and extends over the support wall 4012. A slidable cutter 4044 is disposed within, and travels along, an elongated slot 4020 that extends through the lid 4008 and along the length of the container 4000.

The container 4000 further includes an elongated slot 4022 that extends along the length of the support wall 4012. First and second apertures 4036*a*, 4036*b* are positioned on either end the elongated slot 4022. The first and second apertures 4036*a*, 4036*b* are sized to receive a base portion 4058 of the slidable cutter 4044, allowing the base 4058 to pass through the plane of the support wall 4012 and into the interior of the body 4002.

The elongated slot 4022 is sized to accept a blade and a stem (see, e.g., blade 3956 and stem 3960 shown in FIG. 69) of the cutter 4044, allowing travel therein, and to retain the base portion 4058 of the cutter 4044 under the support wall 4012 as the cutter 4044 it is moved along the length of the container 4000, urging the lid 4008 toward the support wall 4012 during the cutting process. This configuration provides for the application of constant and consistent pressure to the roll dispensed stock, between the lid 4008 and the support wall 4012, during the cutting process.

Similar to operation of the container 3900, the base 4058 of the slidable cutter 4044 protrudes below a bottom surface of the lid 4008 and extends into the aperture 4036*a* (e.g., into enclosure 4030) when the container 4000 is positioned in the closed position (e.g., during storage or transportation). During the cutting process, the base 4058 of the cutter 4044 is moved from one of the apertures 4036*a*, 4036*b* to a position under the support wall 4012 as the cutter 4044 is moved along the length of the container 4000, retaining the base 4058 of the cutter 4044 under the support wall and pressing the interior side of the lid 4008 against the support wall 4012, and securing the roll-dispensed stock therebetween. This configuration provides for the application of constant and consistent pressure to the roll-dispensed stock captured between the lid 4008 and the support wall 4012, thereby gripping and tensioning the roll-dispensed stock during the cutting process, and allowing the slidable cutter 4044 to easily and cleanly cut therethrough.

Importantly, it should be understood that during the cutting process, the blade housing 4054 is positioned on a top exterior surface of the lid 4008, the cutter base 4058 is positioned below the support wall 4012 and within the container 4000, and the blade 4056 extends therebetween, securing the lid 4008 of the container 4000 in a closed position throughout the cutting process. Once the cutting process has been completed (e.g., by moving the slidable cutter 4044 across the length of the elongated slot 4022), the lid 4008 of the container 4000 can be released and opened by moving the base 4058 of the slidable cutter to one of the apertures 4036*a* and 4036*b* at either end of the elongated slot 4022. For example, after the slidable cutter 4044 has traveled from one end of the container 4000 to an opposite end of the container 4000 (e.g., moving from aperture 4036*a* to 4036*b*, or vice versa), the cutter base 4058 of the slidable cutter 4044 can be freed from the support wall 4012/elongated slot 4022 by positioning the base 4058 of the cutter within the aperture 4036*a* or 4036*b* at the opposite end of the container 4000 and the lid 4008 of the container 4000 can then be opened.

It should also be understood that some embodiments of the present disclosure include only one of the apertures 4036*a* and 4036*b*. According to such embodiments, once the cutting process has been completed (e.g., by moving the slidable cutter 4044 across the length of the elongated slot 4022), the slidable cutter 4044 must be returned to its original position before the lid 4008 of the container 4000 can be released and opened. For example, after the slidable cutter 4044 has traveled from one end of the container 4000 (e.g., from an initial starting position at aperture 4036*a* or 4036*b*) to an opposite end of the container 4000, the slidable cutter 4044 must be returned to its original starting position (e.g., aperture 4036*a* or 4036*b*) before the cutter base 4058 can be freed from the elongated slot 4022/support wall 4012 by positioning the base 4044 of the cutter 4044 within the starting aperture 4036*a* or 4036*b*. Conversely, the lid 4008 of the container 4000 can be secured in the closed position (e.g., for storage or transportation) by leaving, or positioning, the slidable cutter 4044 along the elongated slot 4022.

Figure 71:
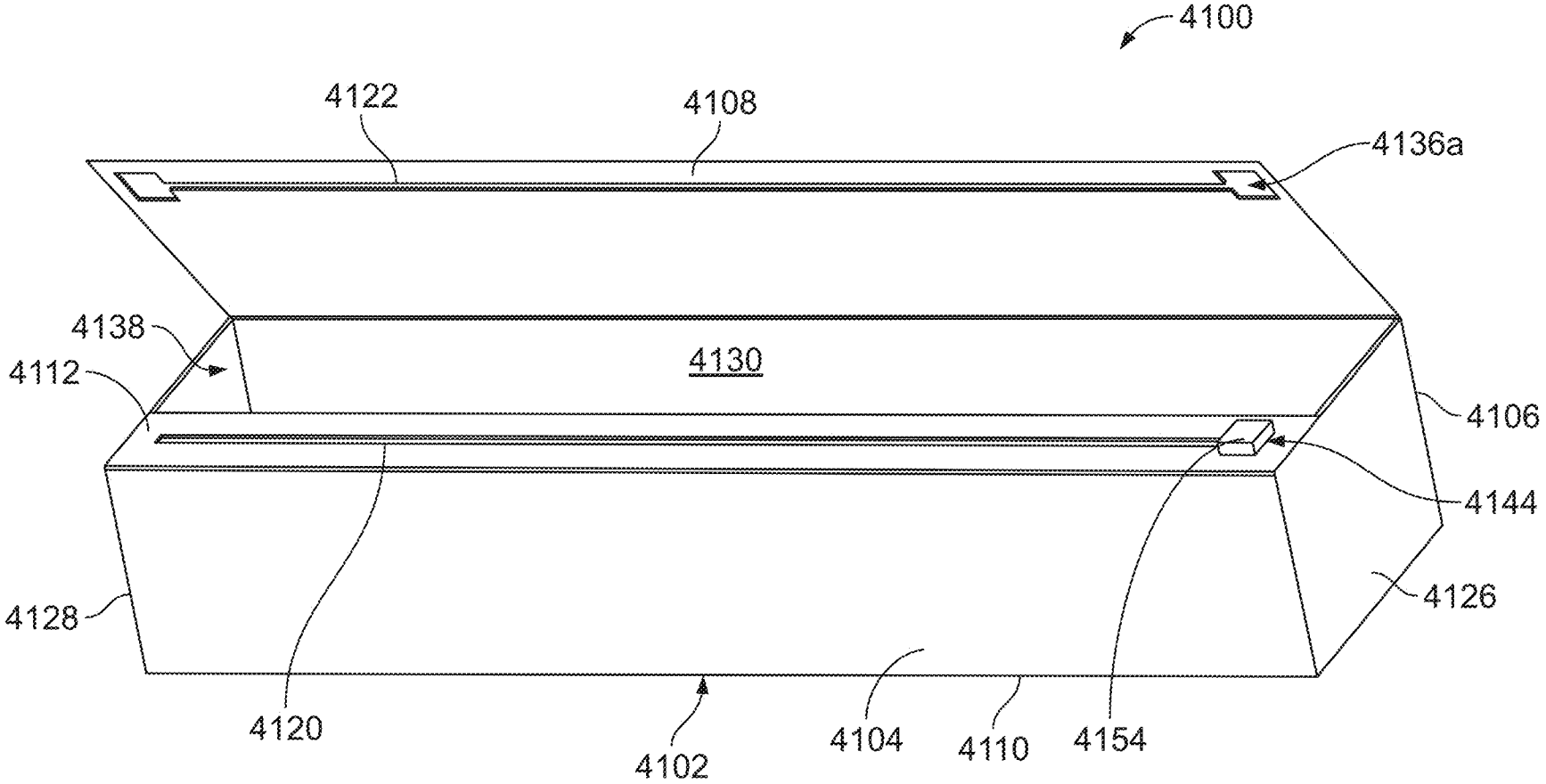
FIG. 71 is a perspective view of another roll-dispensed stock container according to the present disclosure, including a slidable cutter on a support wall that engages a lid.

FIG. 71 is a perspective view of another roll-dispensed stock container 4100 according to the present disclosure, positioned in an open configuration. Container 4100 includes a body 4102 including a front wall 4104, a rear wall 4106, a bottom wall 4110, side walls 4126, 4128, a support wall 4112, and a lid 4108 forming an enclosure 4130 for holding roll-dispensed stock, and an opening 4138 for dispensing the roll-dispensed stock from the enclosure 4130. In a closed configuration (see, e.g., container 3900 discussed in connection with FIG. 69), the lid 4108 covers the opening 4138 and extends over the support wall 4112. A slidable cutter 4144 is disposed within, and travels along, an elongated slot 4120 that extends through the support wall 4112 and along the length of the container 4100.

The container 4100 further includes an elongated slot 4122 that extends along the length of the lid 4108. First and second apertures 4136*a*, 4136*b* are positioned on either end the elongated slot 4122. The first and second apertures 4136*a*, 4136*b* are sized to receive the blade housing 4154 of the slidable cutter 4144, allowing the blade housing 4154 to pass through the lid 4108 when the container 4100 is positioned in the closed position (e.g., during storage, transportation, or during a cutting operation).

The elongated slot 4122 is sized to accept a blade and a stem (see, e.g., blade 3956 and stem 3960 shown in FIG. 69) of the cutter 4144, allowing the cutter 2144 to travel therein, as the cutter 4144 is moved along the length of the container 4100 during the cutting process. The elongated slot 4122 is also sized such that the lid 4108 is engaged by the blade housing 4154 of the cutter 4144, and held in a closed position, during the cutting process. This configuration provides for the application of constant and consistent pressure to the roll dispensed stock, between the lid 4108 and the support wall 4112, during the cutting process.

As the cutter 4144 is moved along the length of the container 4100 during the cutting process, the blade housing 4154 of the cutter 4144 is moved from its position within one of the apertures 4136*a*, 4136*b*, through the elongate slot 4022, and over the lid 4108. This engages the blade housing 4154 with a top surface of the lid 4108, compressing a bottom side of the lid 4108 against the support wall 4112, and securing the roll-dispensed stock therebetween. This configuration provides for the application of constant and consistent pressure to the roll-dispensed stock captured between the lid 4108 and the support wall 4112, thereby gripping and tensioning the roll-dispensed stock during the cutting process, and allowing the slidable cutter 4144 to easily and cleanly cut therethrough.

Importantly, it should be understood that during the cutting process, the blade housing 4154 is positioned on a top exterior surface of the lid 4108, the cutter base 4158 is positioned below the support wall 4112 and within the container 4100, and the blade 4156 extends therebetween, securing the lid 4108 of the container 4100 in a closed position throughout the cutting process. Once the cutting process has been completed (e.g., by moving the slidable cutter 4144 across the length of the elongated slot 4122), the lid 4108 of the container 4100 can be released and opened by moving the blade housing 4154 of the slidable cutter 4144 to one of the apertures 4136*a* and 4136*b* at either end of the elongated slot 4122. For example, after the slidable cutter 4144 has traveled from one end of the container 4100 to an opposite end of the container 4100 (e.g., moving from aperture 4136*a* to 4136*b*, or vice versa), the blade housing 4154 of the slidable cutter 4144 can be freed from the lid 4108/elongated slot 4122 by positioning the blade housing 4154 of the cutter 4144 within the aperture 4136*a* or 4136*b* at the opposite end of the container 4100 and the lid 4108 of the container 4100 can then be opened.

It should also be understood that some embodiments of the present disclosure include only one of the apertures 4136*a* and 4136*b*. According to such embodiments, once the cutting process has been completed (e.g., by moving the slidable cutter 4144 across the length of the elongated slot 4122), the slidable cutter 4144 must be returned to its original position before the lid 4108 of the container 4100 can be released and opened. For example, after the slidable cutter 4144 has traveled from one end of the container 4100 (e.g., from an initial starting position at aperture 4136*a* or 4136*b*) to an opposite end of the container 4100, the slidable cutter 4144 must be returned to its original starting position (e.g., aperture 4136*a* or 4136*b*) before the blade housing 4154 can be freed from the elongated slot 4122/lid 4108 by positioning the blade housing 4154 of the cutter 4144 within the starting aperture 4136*a* or 4136*b*. Conversely, the lid 4108 of the container 4100 can be secured in the closed position (e.g., for storage or transportation) by leaving, or positioning, the slidable cutter 4144 along the elongated slot 4122.

Figure 72:
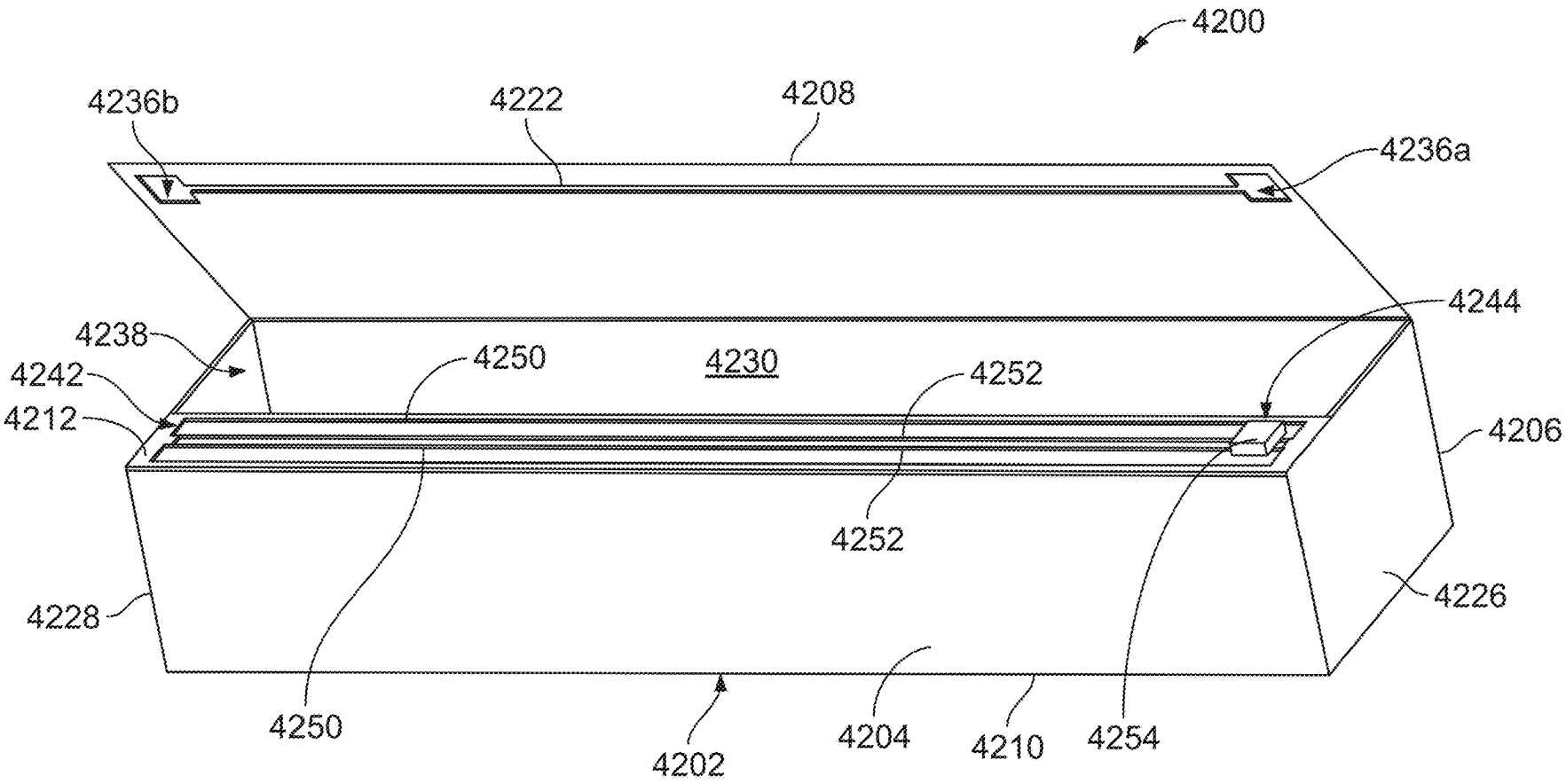
FIG. 72 is a perspective view of another roll-dispensed stock container according to the present disclosure, including a recessed track with a slidable cutter on a support wall that engages a lid.

FIG. 72 is a perspective view of another roll-dispensed stock container 4200 according to the present disclosure, positioned in an open configuration. Container 4200 includes a body 4202 including a front wall 4204, a rear wall 4206, a bottom wall 4210, side walls 4226, 4228, a support wall 4212, and a lid 4208 forming an enclosure 4230 for holding roll-dispensed stock, and an opening 4238 for dispensing the roll-dispensed stock from the enclosure 4230. In a closed configuration, the lid 4208 covers the opening 4238 and extends over the support wall 4212.

The recessed rail 4242 is positioned within an elongated slot, which extends through the support wall 4212 and along the length of the container 4200, and a slidable cutter 4244 is disposed within, and travels along, the recessed rail 4242. A base of the cutter 4244 is positioned within a U-shaped channel formed by bottom and vertical walls of the track 4242 and is retained therein by interior flanges 4252. Accordingly, the base of the cutter 4244 is recessed below the support wall 4212 and a blade housing 4254 is positioned above the support wall 4212. The track 4242 can also include exterior flanges 4250, which support the track 4242 on the support wall 4212 and serve to recess the track 4242 within the elongated slot of the support wall 4212 by bearing thereagainst. The track 4242 can be fixed within the slot of the support wall 4212 by way of an adhesive applied between the exterior flanges 4250 of the track 4242 and the support wall 4212. According to other embodiments, the track 4242 can be provided with a second set of exterior flanges and/or the flanges of the track 4242 can extend within the support wall 4212, as described, for example, in connection with FIGS. 68 and 69.

The container 4200 further includes an elongated slot 4222 that extends along the length of the lid 4208. First and second apertures 4236*a*, 4236*b* are positioned on either end the elongated slot 4222. The first and second apertures 4236*a*, 4236*b* are sized to receive the blade housing 4254 of the slidable cutter 4244, allowing the blade housing 4254 to pass through the lid 4208 when the container 4200 is positioned in the closed position (e.g., during storage, transportation, or during a cutting operation). The elongated slot 4222 is sized to accept a blade and a stem (see, e.g., blade 3956 and stem 3960 shown in FIG. 69) of the cutter 4244, allowing the cutter 2144 to travel therein, as the cutter 4244 is moved along the length of the container 4200 during the cutting process. The elongated slot 4222 is also sized such that the lid 4208 is engaged by the blade housing 4254 of the cutter 4244, and held in a closed position, during the cutting process. This configuration provides for the application of constant and consistent pressure to the roll dispensed stock, compressed between the lid 4208 and the flanges (e.g., inner flanges 4252 and outer flanges 4250) the track 4242, during the cutting process.

As the cutter 4244 is moved along the length of the container 4200 during the cutting process, the blade housing 4254 of the cutter 4244 is moved from its position within one of the apertures 4236*a*, 4236*b*, through the elongated slot 4222, and over the lid 4208. This engages the blade housing 4254 with a top surface of the lid 4208, compressing a bottom side of the lid 4208 against the flanges (e.g., inner flanges 4252 and outer flanges 4250) the track 4242, and securing the roll-dispensed stock therebetween. This configuration allows the container 4200 to grip and tension the roll-dispensed stock between the lid 4208 and the flanges (e.g., inner flanges 4252 and outer flanges 4250) of the track 4242 during the cutting process, and allows the slidable cutter 4244 to easily and cleanly cut therethrough.

Importantly, it should be understood that during the cutting process, the blade housing 4254 is positioned on a top exterior surface of the lid 4208, the cutter base 4258 is positioned below the support wall 4212 and within the container 4200, and the blade 4256 extends therebetween, securing the lid 4208 of the container 4200 in a closed position throughout the cutting process. Once the cutting process has been completed (e.g., by moving the slidable cutter 4244 across the length of the elongated slot 4222), the lid 4208 of the container 4200 can be released and opened by moving the blade housing 4254 of the slidable cutter 4244 to one of the apertures 4236*a* and 4236*b* at either end of the elongated slot 4222. For example, after the slidable cutter 4244 has traveled from one end of the container 4200 to an opposite end of the container 4200 (e.g., moving from aperture 4236*a* to 4236*b*, or vice versa), the blade housing 4254 of the slidable cutter 4244 can be freed from the lid 4208/elongated slot 4222 by positioning the blade housing 4254 of the cutter 4244 within the aperture 4236*a* or 4236*b* at the opposite end of the container 4200 and the lid 4208 of the container 4200 can then be opened.

It should also be understood that some embodiments of the present disclosure include only one of the apertures 4236*a* and 4236*b*. According to such embodiments, once the cutting process has been completed (e.g., by moving the slidable cutter 4244 across the length of the elongated slot 4222), the slidable cutter 4244 must be returned to its original position before the lid 4208 of the container 4200 can be released and opened. For example, after the slidable cutter 4244 has traveled from one end of the container 4200 (e.g., from an initial starting position at aperture 4236*a* or 4236*b*) to an opposite end of the container 4200, the slidable cutter 4244 must be returned to its original starting position (e.g., aperture 4236*a* or 4236*b*) before the blade housing 4254 can be freed from the elongated slot 4222/lid 4208 by positioning the blade housing 4254 of the cutter 4244 within the starting aperture 4236*a* or 4236*b*. Conversely, the lid 4208 of the container 4200 can be secured in the closed position (e.g., for storage or transportation) by leaving, or positioning, the slidable cutter 4244 along the elongated slot 4222.

Figure 73:
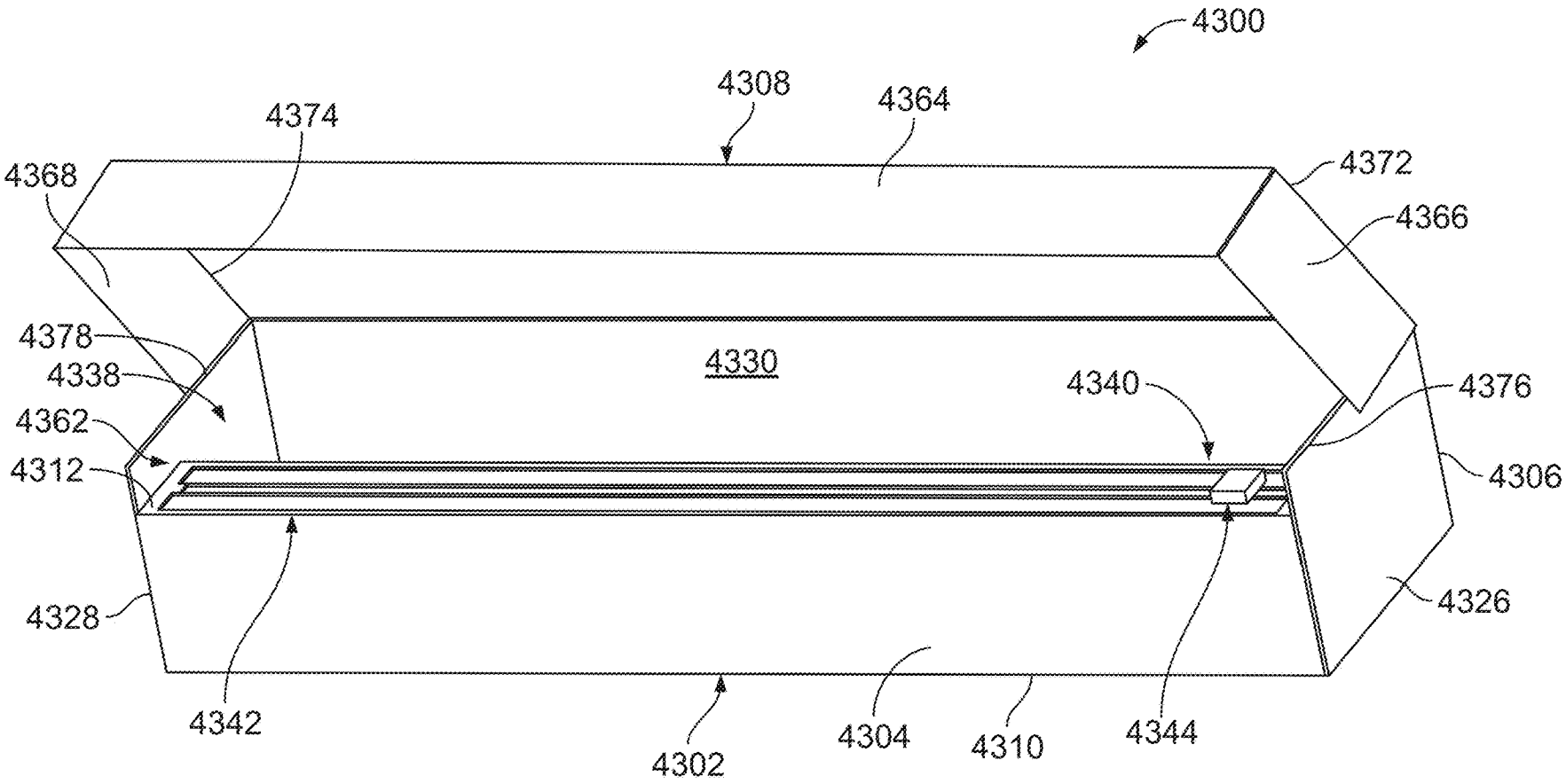
FIG. 73 is a perspective view of another roll-dispensed stock container according to the present disclosure, including a track and slidable cutter positioned in a recess of the container.

FIG. 73 is a perspective view of another roll-dispensed stock container 4300 according to the present disclosure, positioned in an open configuration and including a cutter assembly 4340 positioned in a recessed area 4362. Container 4300 includes a body 4302 including a front wall 4304, a rear wall 4306, a bottom wall 4310, side walls 4326, 4328, a support wall 4312, and a lid 4308 having a front flap 4364 and side flaps 4366, 4368, forming an enclosure 4330 for holding roll-dispensed stock, and an opening 4338 for dispensing the roll-dispensed stock from the enclosure 4330. The cutter assembly 4340 includes a recessed track 4342 and a slidable cutter 4344 and is positioned on the support wall 4312 and within the recessed area 4362.

The support wall 4312 is positioned below top edges 4376, 4378 of the side walls 4326, 4328 and is generally parallel with the bottom wall 4310 of the container, but could be provided at other angles relative thereto. As shown, the recessed area 4362 is defined by the space between one or more of the support wall 4312, the side walls 4326, 4328, and the lid 4308 (e.g., when positioned in a closed configuration) and protects the cutter assembly 4340 during shipping or storage of the container 4300. In particular, the recessed area 4362 is configured such that the cutter assembly 4340 does not extend beyond planes defined by the top edges 4376, 4378 of the side walls 4326, 4328, the lid 4308 (e.g., when positioned in the closed configuration), and/or the front wall 4304. Due to the recessed positioning of the cutter assembly 4340, multiple containers 4300 can be stacked relative to each other without imparting pressure or force on the cutter assembly 4340, thereby preventing potential damage to the cutter assembly 4340.

According to embodiments of the present disclosure, the support wall 4312 can extend generally perpendicular to the front wall and can be positioned at a height such that stock being dispensed from the opening 4330 can be extended directly over the track 4342 (e.g., generally parallel to the support wall and/or a surface on which the container 4300 is placed) and generally perpendicular to a blade (see, e.g., blade 3956 of cutter 3944) of the slidable cutter 4344, enabling the roll-dispensed stock to be laid flat over the track 4342 during the cutting process and thereby producing an even and repeatable cut, without bunching or tearing of the roll-dispensed sock.

In the closed configuration (see, e.g., container 3900 discussed in connection with FIG. 69), the lid 4308 covers the opening 4338, the recessed area 4362, and the support wall 4312. Specifically, the front flap 4364 of the lid 4308 extends from a front edge 4370 of the lid 4308 and over the front wall 4304 of the container 4300 to prevent debris from entering the container through the recessed area and the side flaps 4366, 4368 extend from lateral edges 4372, 4374 of the lid 4308 and over the side walls 4326, 4328 of the container 4300 to provide structural rigidity to the front flap 4364 and to allow the lid 4308 to rest on upper edges 4376, 4378 of the respective side walls 4326, 4328, thereby preventing contact with the cutter assembly 4340 in the closed configuration.

The recessed rail 4342 is positioned within an elongated slot (see, e.g., slot 2025 shown in FIG. 43), which extends through the support wall 4312 and along the length of the container 4300, and the slidable cutter 4344 is disposed within, and travels along, the recessed rail 4342. The recessed rail 4342 and slidable cutter 4344 can be functionally and structurally similar to the recessed rail 2042 and slidable cutter 2044, respectively, described in connection with FIGS. 42 and 43. A base (see, e.g., base 2058 of cutter 2044) of the cutter 4344 is positioned within a U-shaped channel formed by bottom and vertical walls (see, e.g., bottom wall 2046 and vertical walls 2048 of track 2042) of the track 4342 and is retained therein by interior flanges 4352. Accordingly, at least a portion of the cutter assembly 4340 is recessed below the support wall 4312 (e.g., within enclosure 4330). The track 4342 can also include exterior flanges 4350, which support the track 4342 on the support wall 4312 and serve to recess the track 4342 within the elongated slot of the support wall 4312 by bearing thereagainst. The track 4342 can be fixed within the slot of the support wall 4312 by way of an adhesive applied between the exterior flanges 4350 of the track 4342 and the support wall 4312. According to other embodiments, the track 4342 can be provided with a second set of exterior flanges and/or the flanges of the track 4342 can extend within the support wall 4312, as described in connection with FIGS. 68A, 68B, and 69. As such, the track 4342 can be fully or partially recessed below the support wall 4312 and the recessed area 4362. It should be noted that other cutters, tracks, or cutter assemblies of the present disclosure, or otherwise known or developed, could be provided on the support wall 4312. For example, in some embodiments, the support wall 4312 does not include an elongated slot. According to such embodiments, a cutter assembly, including a track and a cutter slidable therealong, could be affixed to top surface of the support wall 4312 (e.g., via an adhesive or the like).

Figure 74:
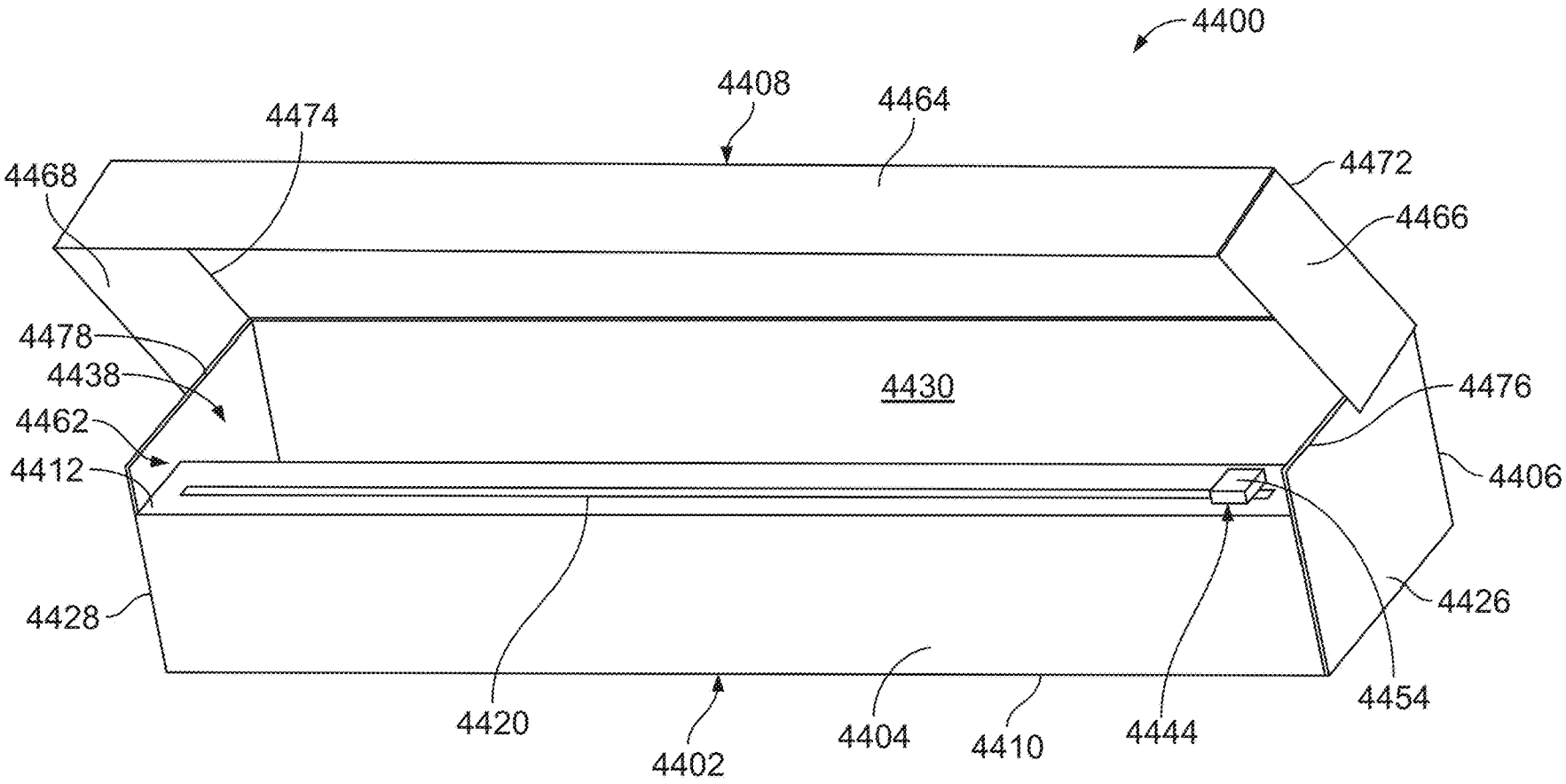
FIG. 74 is a perspective view of another roll-dispensed stock container according to the present disclosure, including a slidable cutter positioned in a recess of the container.

FIG. 74 is a perspective view of another roll-dispensed stock container 4400 according to the present disclosure, positioned in an open configuration and including a slidable cutter 4444 positioned in a recessed area 4462. Container 4400 can include like structures and function similar to container 4300, discussed in connection with FIG. 73, other containers discussed herein, or otherwise known or developed. Container 4400 differs from container 4300 in that container 4400 does not include a track (e.g., recessed track 4342), allowing for a more streamlined manufacturing and assembly process.

Container 4400 includes a body 4402 including a front wall 4404, a rear wall 4406, a bottom wall 4410, side walls 4426, 4428, a support wall 4412, and a lid 4408 having a front flap 4464 and side flaps 4466, 4468, forming an enclosure 4430 for holding roll-dispensed stock, and an opening 4438 for dispensing the roll-dispensed stock from the enclosure 4430. The slidable cutter 4444 is disposed within, and travels along, an elongated slot 4420 that extends through the support wall 4412 and along the length of the container 4400. The slidable cutter 4444 is retained within the elongated slot 4420 by a base (see, e.g., base 4058 of cutter 4044) positioned on an interior side of the support wall 4412 (e.g., within enclosure 4430) and a blade housing 4454 positioned on a top side of the support wall 4412.

The support wall 4412 is positioned below top edges 4476, 4478 of the side walls 4426, 4428 and is generally parallel with the bottom wall 4410 of the container, but could be provided at other angles relative thereto. As shown, the recessed area 4462 is defined by the space between one or more of the support wall 4412, the side walls 4426, 4428, and the lid 4408 (e.g., when positioned in a closed configuration) and protects the slidable cutter 4444 during shipping or storage of the container 4400. In particular, the recessed area 4462 is configured such that the slidable cutter 4444 does not extend beyond planes defined by the top edges 4476, 4478 of the side walls 4426, 4428, the lid 4408 (e.g., when positioned in the closed configuration), and/or the front wall 4404. Due to the recessed positioning of the slidable cutter 4444, multiple containers 4400 can be stacked relative to each other without imparting pressure or force on the slidable cutter 4444, thereby preventing potential damage to the slidable cutter 4444.

According to embodiments of the present disclosure, the support wall 4412 can extend generally perpendicular to the front wall and can be positioned at a height such that stock being dispensed from the opening 4430 can be extended directly over (e.g., generally parallel to the support wall 4412 and/or a surface on which the container 4400 is placed) the support wall 4412 and generally perpendicular to a blade (see, e.g., blade 3956 of cutter 3944) of the slidable cutter 4444, enabling the roll-dispensed stock to be laid flat over the support wall 4412 during the cutting process and thereby producing an even and repeatable cut, without bunching or tearing of the roll-dispensed sock.

In the closed configuration (see, e.g., container 3900 discussed in connection with FIG. 69), the lid 4408 covers the opening 4438, the recessed area 4462, and the support wall 4412. Specifically, the front flap 4464 of the lid 4408 extends from a front edge 4470 of the lid 4408 and over the front wall 4404 of the container 4400 to prevent debris from entering the container through the recessed area and the side flaps 4466, 4468 extend from lateral edges 4472, 4474 of the lid 4408 and over the side walls 4426, 4428 of the container 4400 to provide structural rigidity to the front flap 4464 and to allow the lid 4408 to rest on upper edges 4476, 4478 of the respective side walls 4426, 4428, thereby preventing contact with the cutter assembly 4440 in the closed configuration.

In accordance with embodiments of the present disclosure, containers 3900, 4000, 4100, 4200, 4300, and 4400 can be configured to dispense, and slidable cutters 3944, 4044, 4144, 4144, 4344, and 4444 can be configured to cut, plastic wrap, foil (e.g., aluminum or tin foil), wax paper, parchment paper, tape, duct tape, wrapping paper, non-woven fabric and other roll-dispensed stock. Further, it is contemplated that any of the embodiments of the containers of the present disclosure could be configured to dispense and cut any of the roll-dispensed stock described herein.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

What is claimed is:

1. A roll-dispensed stock container, comprising:

a body including a front wall, a rear wall, a bottom wall, and first and second side walls forming an enclosure to receive a roll of roll-dispensed stock;

a support wall extending from a front edge attached to the front wall to a rear edge spaced away from the rear wall to form an opening between the support wall and the rear wall for dispensing the roll-dispensed stock from the enclosure, the support wall having a first slot extending therein for receiving a slideable cutter therein;

a lid movably joined to a top edge of the rear wall having a second slot, the lid extending over the support wall and covering the opening;

the slidable cutter movable along the first and second slots in the support wall and the lid and having a top portion, a base portion, and a blade portion disposed therebetween, the top portion of the slidable cutter positioned above the lid, the base portion positioned below the support wall, and the blade portion extending through the first and second slots, such that the lid is positioned against the support wall and the roll-dispensed stock is positioned therebetween during cutting.

2. The roll-dispensed stock container of claim 1, wherein the rear wall has a greater height than the front wall and the rear edge of the support wall is at the same height as the rear wall.

3. The roll-dispensed stock container of claim 1, wherein the opening is positioned between the top edge of the rear wall and the support wall.

4. The roll-dispensed stock container of claim 1, comprising first and second fixation strips on the support wall, the first and second fixation strips positioned along the first slot.

5. The roll-dispensed stock container of claim 4, wherein the lid is pressed against the first and second fixation strips to deform the first and second fixation strips and tension and secure the roll dispensed stock between the strips, where the top portion of the slidable cutter is positioned above the lid, the base portion is retained below the support wall, and the blade portion extends through the first and second slots.

6. The roll-dispensed stock container of claim 5, further comprising a bend in the lid defining a first portion extending over the support wall and a second portion extending over the opening, wherein when the top portion of the slidable cutter is positioned above the first portion of the lid, the base portion is retained below the support wall, and the blade portion extends through the first and second slots.

7. The roll-dispensed stock container of claim 1 wherein the support wall is movable from a first position to a second re-fill position.

8. The roll-dispensed stock container of claim 1 wherein the slidable cutter fits within an area defined by the space under a right angle formed by the intersection of planes extending from the front wall and the top portion of the lid when the lid is in a closed position.

* * * * *